US010392090B2

(12) United States Patent
Langenfeld et al.

(10) Patent No.: US 10,392,090 B2
(45) **Date of Patent: *Aug. 27, 2019**

(54) SWIMMING PROPULSION DEVICE

(71) Applicant: DEKA Products Limited Partnership, Manchester, NH (US)

(72) Inventors: Christopher C. Langenfeld, Nashua, NH (US); Christopher M. Werner, San Jose, CA (US); Ryan K. LaRocque, Manchester, NH (US); Thomas S. Schnellinger, North Andover, NH (US); Stanley B. Smith, III, Raymond, NH (US)

(73) Assignee: DEKA Products Limited Partnership, Manchester, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/837,201

(22) Filed: Dec. 11, 2017

(65) Prior Publication Data

US 2018/0105248 A1 Apr. 19, 2018

Related U.S. Application Data

(63) Continuation of application No. 15/149,730, filed on May 9, 2016, now Pat. No. 9,840,315, which is a continuation of application No. 14/246,360, filed on Apr. 7, 2014, now Pat. No. 9,334,033, which is a continuation of application No. 13/073,343, filed on Mar. 28, 2011, now Pat. No. 8,690,617, which is a continuation-in-part of application No. 12/186,719, filed on Aug. 6, 2008, now Pat. No. 7,988,508.

(Continued)

(51) Int. Cl.

| | |
|---|---|
| ***B63H 16/08*** | (2006.01) |
| ***A63B 35/00*** | (2006.01) |
| ***B63B 1/30*** | (2006.01) |
| ***B63H 1/36*** | (2006.01) |
| ***B63B 1/24*** | (2006.01) |
| ***B63B 1/26*** | (2006.01) |

(52) U.S. Cl.

CPC ..... *B63H 16/08* (2013.01); *A63B 35/00* (2013.01); *B63B 1/248* (2013.01); *B63B 1/26* (2013.01); *B63B 1/30* (2013.01); *B63H 1/36* (2013.01)

(58) Field of Classification Search

CPC ..... B63H 16/08; B63H 1/36; A63B 35/00; B63B 1/30

USPC ..... 440/21; 441/60

See application file for complete search history.

(56) References Cited

U.S. PATENT DOCUMENTS 3,122,759 A * 3/1964 Gongwer ..... A63B 35/00 441/60

3,204,699 A * 9/1965 Gongwer ..... A63B 35/00 441/60

(Continued)

*Primary Examiner* — Lars A Olson

(74) *Attorney, Agent, or Firm* — Michelle Saquet Temple

(57) ABSTRACT

A swimming propulsion device. The swimming propulsion device includes a fuselage at least one propulsor pivotally connected to the fuselage, and in some embodiments, at least one stabilizer affixed to the fuselage. The device also includes a swimmer connection mechanism removably attached to the fuselage by a locking mechanism whereby the swimmer connection mechanism connects a swimmer to the device, and a control mechanism installed within the propulsor. A method for efficient swimming is also disclosed.

20 Claims, 153 Drawing Sheets

Related U.S. Application Data

(60) Provisional application No. 61/349,384, filed on May 28, 2010, provisional application No. 60/963,587, filed on Aug. 6, 2007.

(56) References Cited

U.S. PATENT DOCUMENTS

| | | | | |
|---|---|---|---|---|
| 3,802,008 | A * | 4/1974 | Gongwer | A63B 35/00 441/60 |
| 7,988,508 | B2 * | 8/2011 | Langenfeld | A63B 35/00 440/21 |
| 8,690,617 | B2 * | 4/2014 | Langenfeld | A63B 35/00 440/21 |
| 9,334,033 | B2 * | 5/2016 | Langenfeld | A63B 35/00 |
| 9,840,315 | B2 * | 12/2017 | Langenfeld | A63B 35/00 |

* cited by examiner

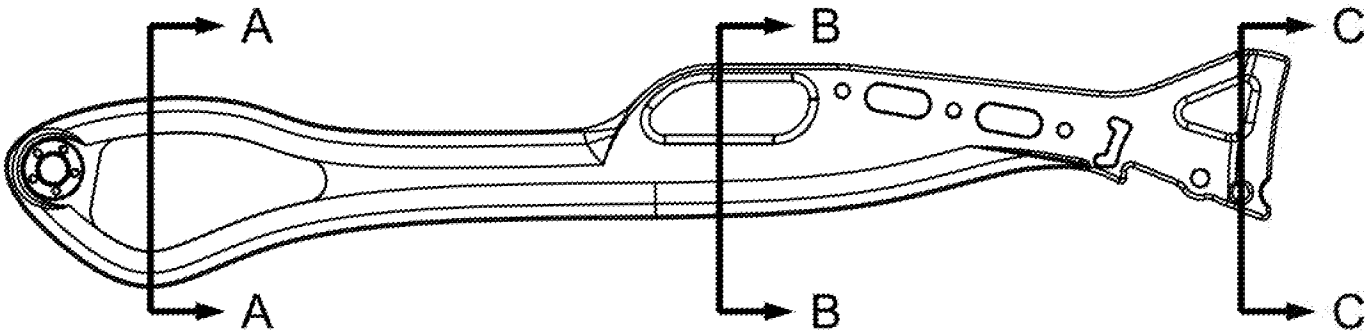
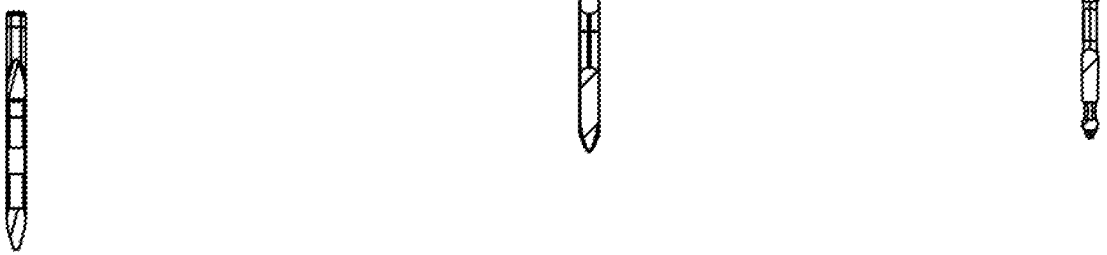
FIG. 21C
FIG. 21D
FIG. 21E

SWIMMING PROPULSION DEVICE

CROSS REFERENCE TO RELATED APPLICATIONS

This application is a Continuation Application of U.S. patent application Ser. No. 15/149,730, filed May 9, 2016 and entitled Swimming Propulsion Device, now U.S. Pat. No. 9,840,315, issued Dec. 12, 2017, which is a Continuation Application of U.S. patent application Ser. No. 14/246,360, filed Apr. 7, 2014 and entitled Swimming Propulsion Device, now U.S. Pat. No. 9,334,033, issued May 10, 2016, which is a Continuation Application of U.S. patent application Ser. No. 13/073,343, filed Mar. 28, 2011 and entitled Swimming Propulsion Device, now U.S. Pat. No. 8,690,617, issued Apr. 8, 2014, which claims the benefit of U.S. Provisional Application No. 61/349,384 filed May 28, 2010 and entitled Swimming Propulsion Device, all of which are hereby incorporated herein by reference in their entireties.

U.S. patent application Ser. No. 13/073,343 is also a Continuation-In-Part Application of U.S. patent application Ser. No. 12/186,719, filed Aug. 6, 2008 and entitled Swimming Propulsion Device, which is now U.S. Pat. No. 7,988,508, issued Aug. 2, 2011, which claims the benefit of U.S. Provisional Application No. 60/963,587, filed Aug. 6, 2007 and entitled Swimming Propulsion Device, both of which are hereby incorporated herein by reference in their entireties.

STATEMENT OF GOVERNMENT INTEREST

This invention was made with Government support under Contract Number W911NF-09-C-0031 awarded by the U.S. Army RDECOM ACQ CTR. The Government has certain rights in the invention.

TECHNICAL FIELD

The present invention relates to a swimming device and more particularly, to a swimming propulsion device.

BACKGROUND INFORMATION

Swimming propulsion devices have a long history and have included swimming fins, hand fins, and personal water propellers. These devices had been designed to enhance the speed, efficiency and mobility of bodily moment during surface and underwater swimming.

The typical approach to designing swimming fins and hand fins has been to enlarge the effective area of a swimmer's hands or feet. Although swimming fins and hand fins may have increased a swimmer's propulsion through the water, because the fins are worn on each hand or each foot minimizes the fins' effectiveness. For the same amount of energy expended without the fins, swimmer's increased their propulsion minimally.

One improved swimming fin has been a monofin, where the swimmer wears one fin that fits over both his feet. However, there is some instability in the swimmer's swimming form when using monofins, which results in limited propulsion. As the swimmer uses the monofin, the swimmer's legs do not maintain a stable non-flailing motion that helps in propelling through water.

Accordingly, there is a need for a more effective swimming propulsion device that includes amongst other characteristics, more comfort, easier wearability, and provides greater stability and efficiency for the swimmer.

SUMMARY

In accordance with one aspect of the present invention, a swimming propulsion device is disclosed. The swimming propulsion device includes a fuselage having a forward section and an aft section, at least one propulsor pivotally connected to the forward section of the fuselage, at least one stabilizer affixed to the aft section of the fuselage, a swimmer connection mechanism removably attached to the fuselage by a locking mechanism whereby the swimmer connection mechanism connects a swimmer to the device, and a control mechanism attached to the fuselage and the propulsor.

Some embodiments of this aspect of the present invention may include one or more of the following: wherein the locking mechanism further includes a first member and a second member, wherein the first member and second member removably mate by a ball and pin mechanism; wherein the swimmer connection mechanism further includes a first member, a second member, and a fastening mechanism including a buckle and strap, wherein the first member and second member are attached to one another by the latching mechanism and wherein the first member and second member are ergonomic to a swimmer's bottom leg; wherein the swimmer connection mechanism further includes wherein the first member and the second member include a hard layer and a foam layer; wherein, in the swimmer connection mechanism, the second member further includes a cleat for attachment to a locking mechanism member; wherein the fuselage further includes a wedge shaped forward section and a front edge, a top edge and bottom edge wherein the front edge, the top edge, and the bottom edge are tapered and wherein the forward section is positioned on a lower plane than the aft section; wherein the fuselage further including a first fuselage member and a second fuselage member wherein each of said fuselage member connected to a propulsor member; wherein the fuselage further includes a forward member and an aft member, wherein the forward member and aft member are slidably connected whereby the fuselage is adjustable in length; wherein each propulsor includes a first propulsor member and a second propulsor member, wherein the first propulsor wing member is releasably and foldably attached to the second propulsor member whereby the first propulsor wing members folds back when released from the second propulsor member; wherein the second propulsor member is attached to the fuselage; wherein the swimmer connection mechanism further comprising at least one housing for receiving a swimmer's feet; and/or wherein the device further including a fin attachment mechanism.

In accordance with one aspect of the present invention, a swimming propulsion device is disclosed. The swimming propulsion device includes a fuselage having a forward section and an aft section, at least one propulsor pivotally connected to the forward section of the fuselage, a swimmer connection mechanism removably attached to the fuselage by a locking mechanism whereby the swimmer connection mechanism connects a swimmer to the device, the swimmer connection mechanism further including a first member, a second member, and a fastening mechanism including a buckle and strap, wherein the first member and second member are attached to one another by the latching mechanism and wherein the first member and second member are ergonomic to a swimmer's bottom leg.

Some embodiments of this aspect of the present invention may include one or more of the following: at least one stabilizer affixed to the aft section of the fuselage; a control mechanism attached to the fuselage and the propulsor; a fin attachment mechanism; and/or wherein the second member further including a cleat for attachment to a locking mechanism member.

In accordance with one aspect of the present invention, a method for efficient swimming disclosed. The method includes attaching at least one cuff to the bottom part of a swimmer's leg, adjusting the at least one cuff using a buckle and strap mechanism, and attaching the at least one cuff to a swimming propulsion device.

In accordance with one aspect of the present invention, a swimming propulsion device is disclosed. The swimming propulsion device includes a fuselage having a forward section and an aft section, at least one propulsor pivotably connected to the forward section of the fuselage, at least one stabilizer pivotably connected to the aft section of the fuselage, a swimmer connection mechanism removably attached to the fuselage by a locking mechanism whereby the swimmer connection mechanism connects a swimmer to the device, and a control mechanism installed within the propulsor and attached to the fuselage.

Some embodiments of this aspect of the present invention may include one or more of the following: wherein the locking mechanism further includes a first member and a second member, wherein the first member and second member removably mate by a ball and latching mechanism; wherein the swimmer connection mechanism further includes a first member, a second member, and a fastening mechanism including a buckle and strap, wherein the first member and second member are attached to one another by the fastening mechanism and wherein the first member and second member are ergonomic to a swimmer's bottom leg; wherein the swimmer connection mechanism further includes wherein the first member and the second member include a hard layer and a foam layer; wherein, in the swimmer connection mechanism, the second member further includes a cleat for attachment to a locking mechanism member; wherein the fuselage further includes a rounded arrow shape and may be smooth and also narrow as the sides meet; wherein each propulsor includes a first propulsor member and a second propulsor member, wherein the first propulsor wing member is pivotably and foldably attached to the second propulsor member whereby the first propulsor wing members folds back when released from the second propulsor member; and wherein the second propulsor member is attached to the fuselage.

In accordance with one aspect of the present invention, a swimming propulsion device is disclosed. The device includes a fuselage having a forward section and an aft section, at least one propulsor pivotally connected to the forward section of the fuselage, at least one stabilizer affixed to the aft section of the fuselage, a swimmer connection mechanism removably attached to the fuselage by a locking mechanism whereby the swimmer connection mechanism connects a swimmer to the device, and a control mechanism attached to the fuselage and the propulsor. The at least one propulsor including at least two portions connected one to another at a propulsor connection point adjacent to the fuselage and wherein the two portions of the at least one propulsor fold towards one another about the connection point and at least one stabilizer including two portions connected one to another at a stabilizer connection point adjacent to the fuselage and wherein the two portions of the at least one stabilizer fold towards one another about the stabilizer connection point.

Some embodiments of this aspect of the present invention may include one or more of the following: wherein the locking mechanism further includes a first member and a second member, wherein the first member and second member removably mate by a ball and pin mechanism; wherein the swimmer connection mechanism further includes a first member, a second member, and a fastening mechanism including a buckle and strap, wherein the first member and second member are attached to one another by the latching mechanism and wherein the first member and second member are ergonomic to a swimmer's bottom leg; wherein the swimmer connection mechanism further includes wherein the first member and the second member include a hard layer and a foam layer; wherein, in the swimmer connection mechanism, the second member further includes a cleat for attachment to a locking mechanism member; wherein the fuselage further includes a wedge shaped forward section and a front edge, a top edge and bottom edge wherein the front edge, the top edge, and the bottom edge are tapered and wherein the forward section is positioned on a lower plane than the aft section; wherein the fuselage further including a first fuselage member and a second fuselage member wherein each of said fuselage member connected to a propulsor member; wherein the fuselage further includes a forward member and an aft member, wherein the forward member and aft member are slidably connected whereby the fuselage is adjustable in length; wherein each propulsor includes a first propulsor member and a second propulsor member, wherein the first propulsor wing member is releasably and foldably attached to the second propulsor member whereby the first propulsor wing members folds back when released from the second propulsor member; wherein the second propulsor member is attached to the fuselage; wherein the swimmer connection mechanism further comprising at least one housing for receiving a swimmer's feet; and/or wherein the device further including a fin attachment mechanism.

In accordance with one aspect of the present invention, a swimming propulsion device is disclosed. The swimming propulsion device includes a fuselage having a forward section and an aft section, at least one propulsor pivotally connected to the forward section of the fuselage, a swimmer connection mechanism removably attached to the fuselage by a locking mechanism whereby the swimmer connection mechanism connects a swimmer to the device, the swimmer connection mechanism further including a first member, a second member, and a fastening mechanism including a buckle and strap, wherein the first member and second member are attached to one another by the latching mechanism and wherein the first member and second member are ergonomic to a swimmer's bottom leg and wherein the at least one propulsor comprising at least two portions connected one to another at a connection point adjacent to the fuselage and wherein the two portions of the at least one propulsor fold towards one another about the connection point.

In accordance with one aspect of the present invention, a swimming propulsion device is disclosed. The swimming propulsion device includes a fuselage having a forward section and an aft section, at least one propulsor pivotably connected to the forward section of the fuselage, a swimmer connection mechanism removably attached to the fuselage by a locking mechanism whereby the swimmer connection mechanism connects a swimmer to the device, the swimmer connection mechanism further including a first member, a second member, and a fastening mechanism including a buckle and strap, wherein the first member and second member are attached to one another by the latching mechanism and wherein the first member and second member are ergonomic to a swimmer's bottom leg.

Some embodiments of this aspect of the present invention may include one or more of the following: at least one stabilizer affixed to the aft section of the fuselage; a control mechanism installed within the propulsor and attached to the fuselage; and/or wherein the second member further including a cleat for attachment to a locking mechanism member.

Some embodiments of this aspect of the present invention may include a control mechanism wherein the control mechanism comprising a torsion bar having a distal end and a proximal end; a torsion bar anchor fixed to the proximal end of the torsion bar; and an internal structure within the propulsor member containing the distal end of the torsion bar. The internal structure allows for rotation of the distal end of the torsion bar and the torsion bar anchor fixes the proximal end of the torsion bar in place.

In accordance with one aspect of the present invention, a method for efficient swimming disclosed. The method includes unfolding a propulsor, unfolding a stabilizer, attaching at least one cuff to the bottom part of a swimmer's leg, adjusting the at least one cuff using a buckle and strap mechanism, and removably attaching the at least one cuff to a swimming propulsion device by an attachment mechanism.

These aspects of the invention are not meant to be exclusive and other features, aspects, and advantages of the present invention will be readily apparent to those of ordinary skill in the art when read in conjunction with the appended claims and accompanying drawings.

BRIEF DESCRIPTION OF THE DRAWINGS

These and other features and advantages of the present invention will be better understood by reading the following detailed description, taken together with the drawings wherein:

FIG. 21C is a side view of is a cross section of the forward section of an embodiment of the fuselage;

FIG. 21D is a cross section of the handle section of an embodiment of the fuselage;

FIG. 21E is a cross section of the aft section of an embodiment of the fuselage;

FIG. 22F is an enlarged detailed view of the exploded view of an embodiment of the entire control mechanism;

FIG. 23 is a top perspective view of an embodiment of a disengaged mounting bracket;

FIG. 23A is a top perspective view of an embodiment of an engaged mounting bracket;

FIG. 23B is a top view of an embodiment of the mounting bracket while the mounting bracket is unlocked and the cross section of the mounting bracket;

FIG. 23C is a top view of an embodiment of the mounting bracket while the mounting bracket is locked and the cross section of the mounting bracket;

FIG. 23D is an exploded view of an embodiment of the mounting bracket assembly including the cuff attachment;

FIG. 23E is an exploded view of an embodiment of the mounting bracket assembly;

FIG. 23F is a front perspective view of an embodiment of a pair of cuffs with straps;

FIG. 23G is a front perspective view of an embodiment of a pair of cuffs;

FIG. 23H is a bottom view of an embodiment of the cuffs having straps;

FIG. 23I is a bottom view of an embodiment of the cuffs;

FIG. 23J is a top view of a pair of an embodiment of cuffs having straps;

Figure 23:
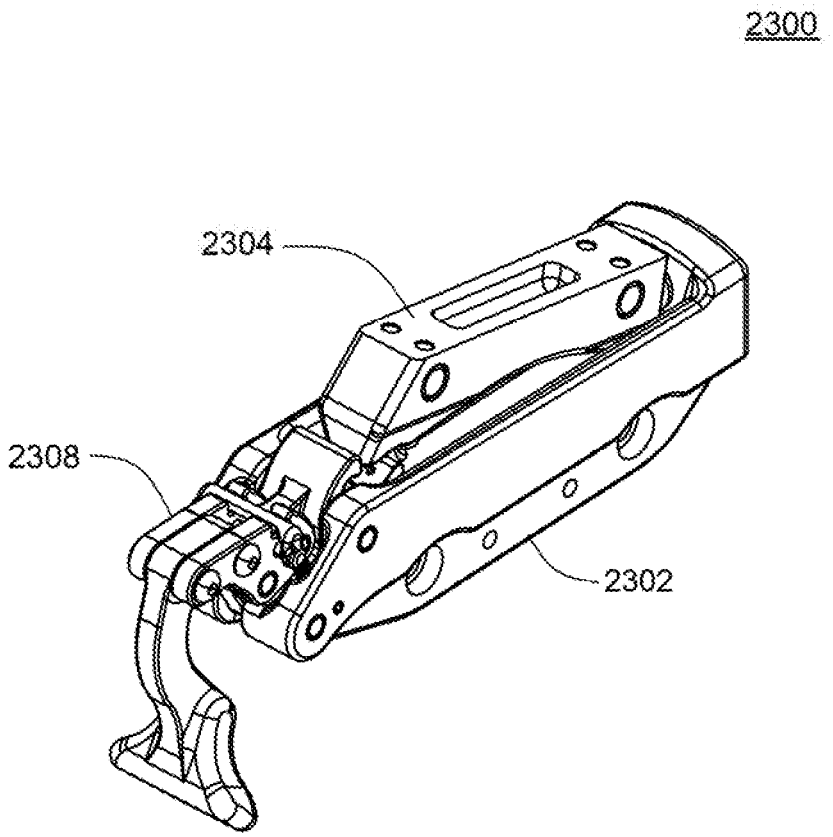
Figure 23A:
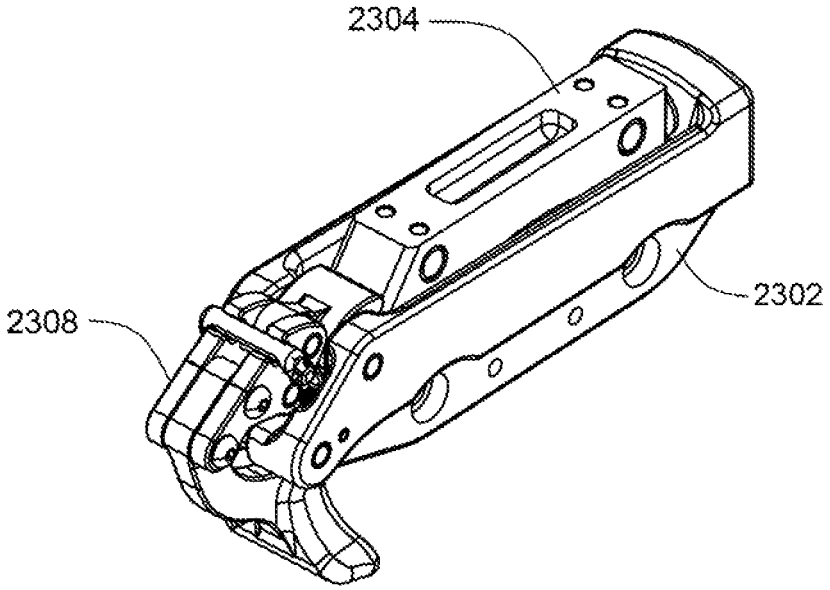
Figure 23B:
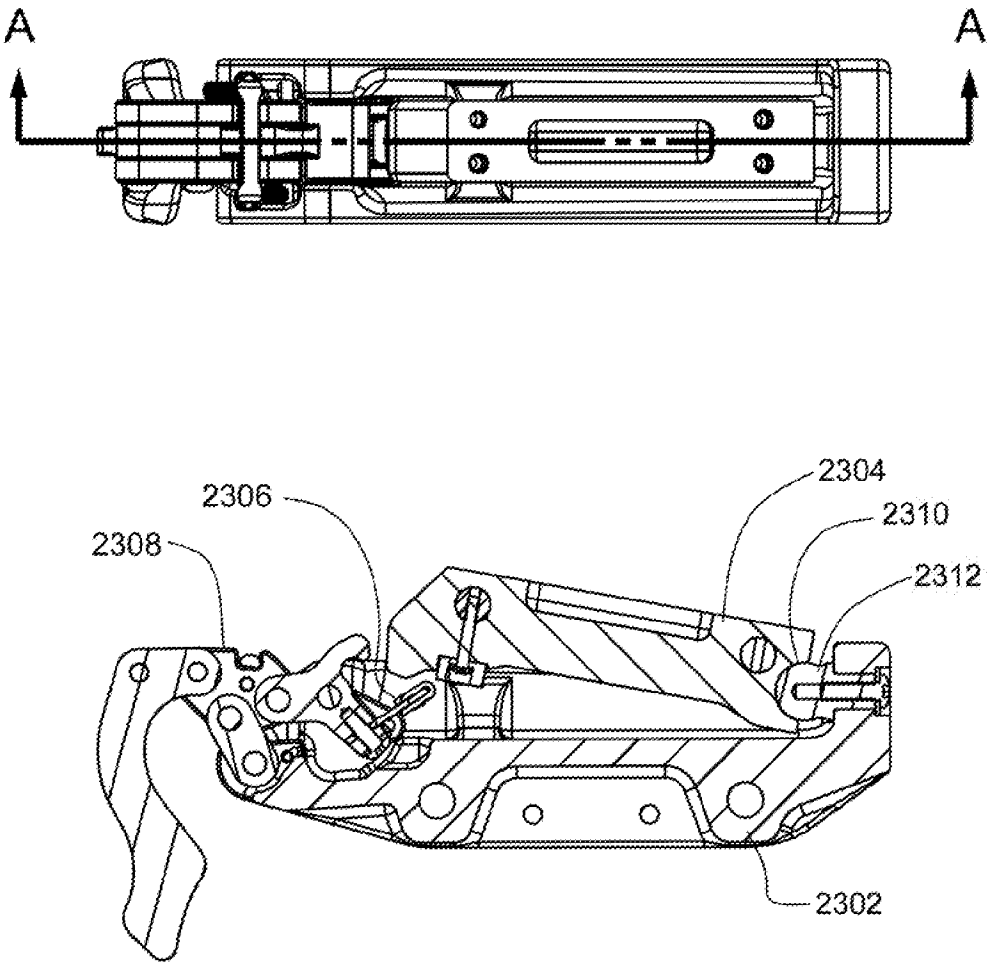
Figure 23C:
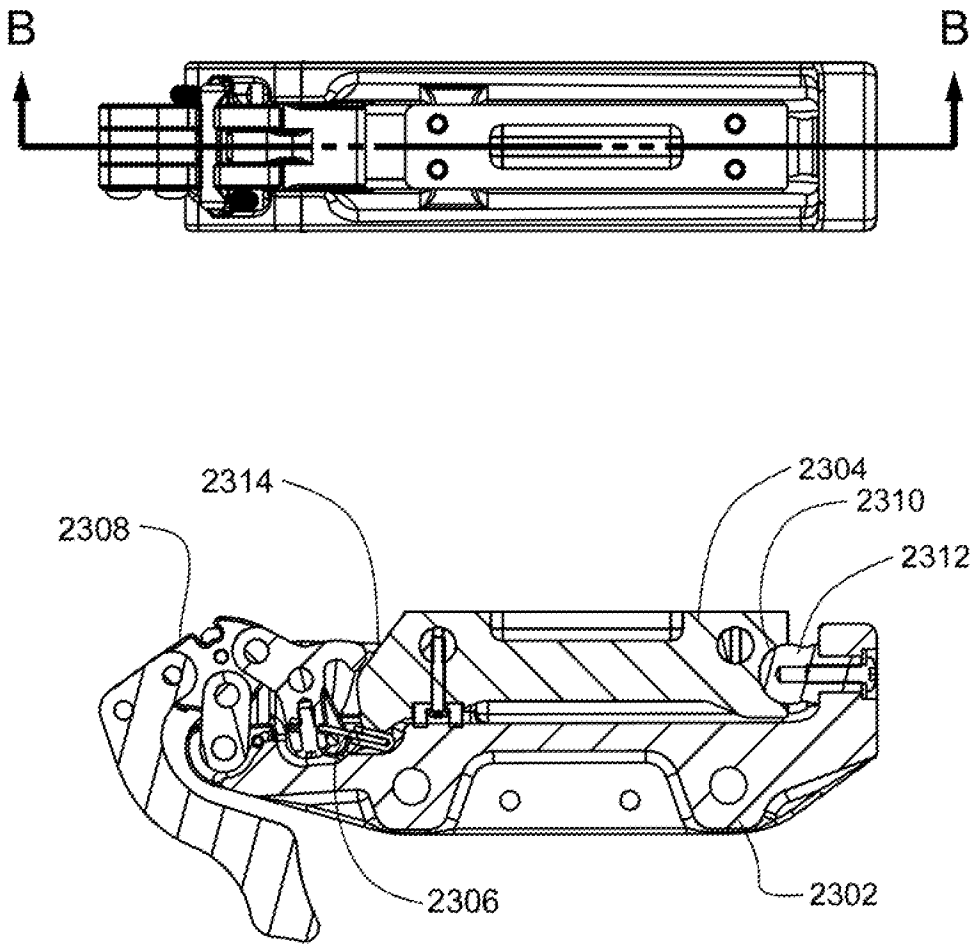
Figure 23D:
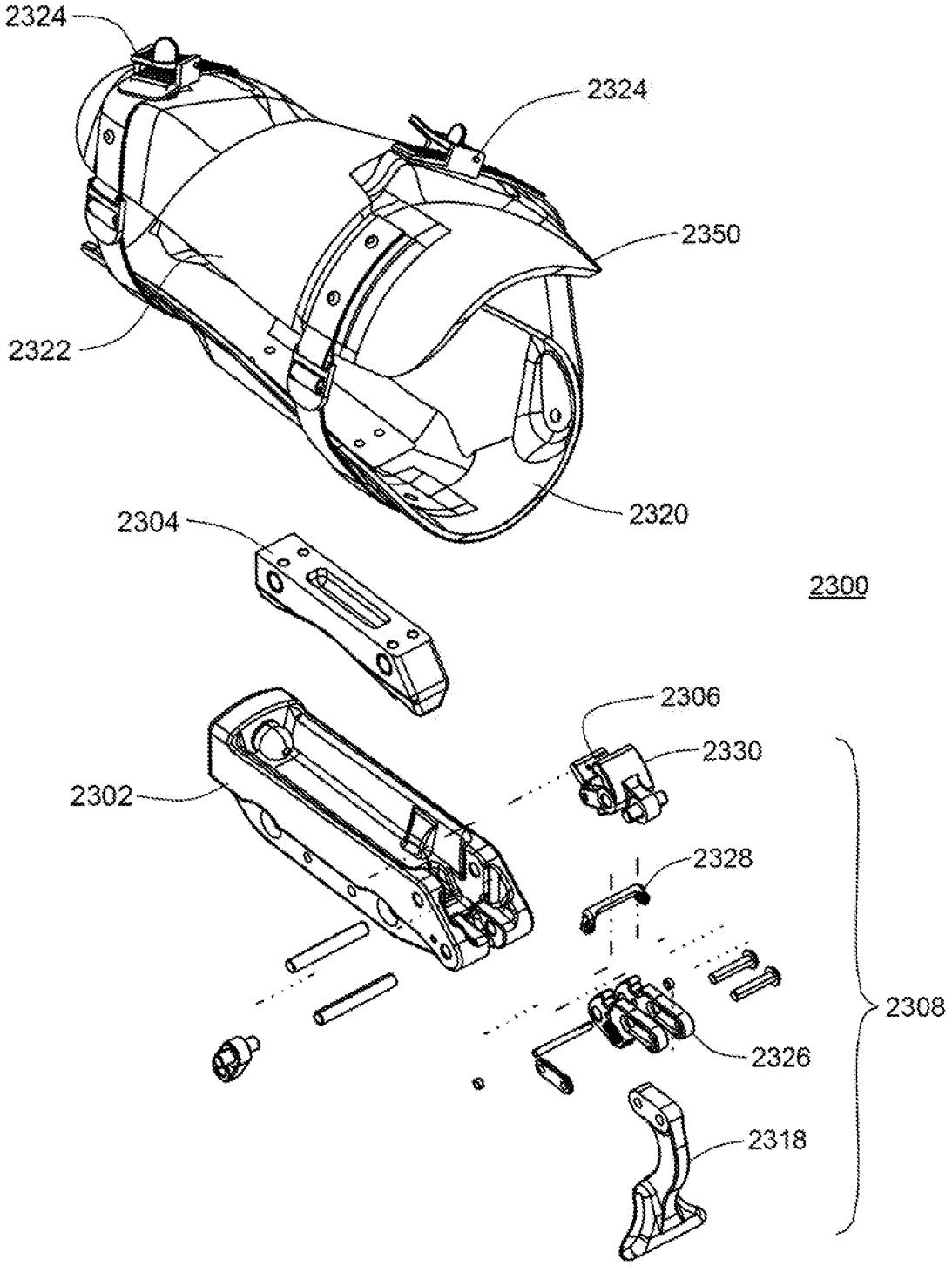
Figure 23E:
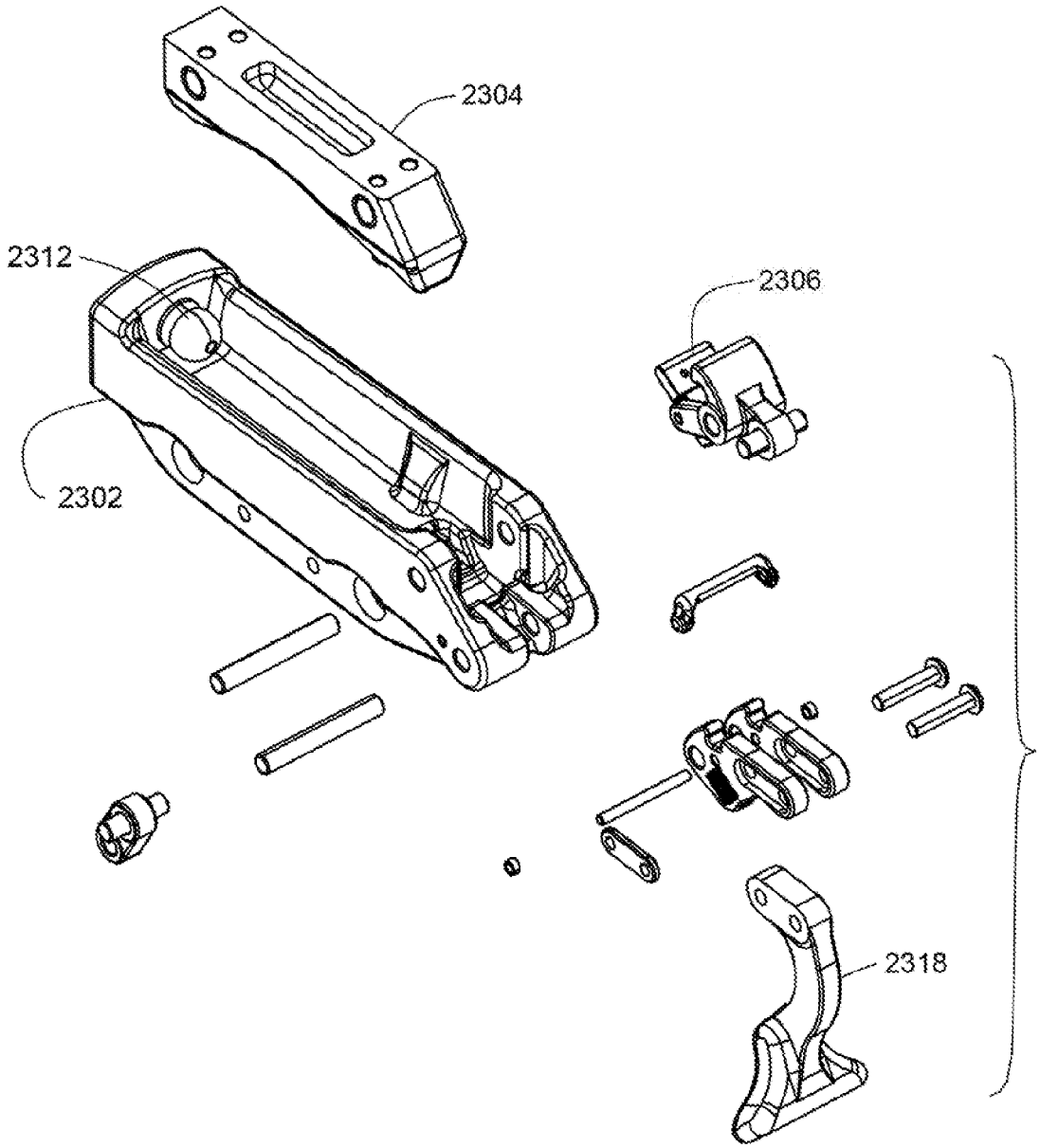
Figure 23F:
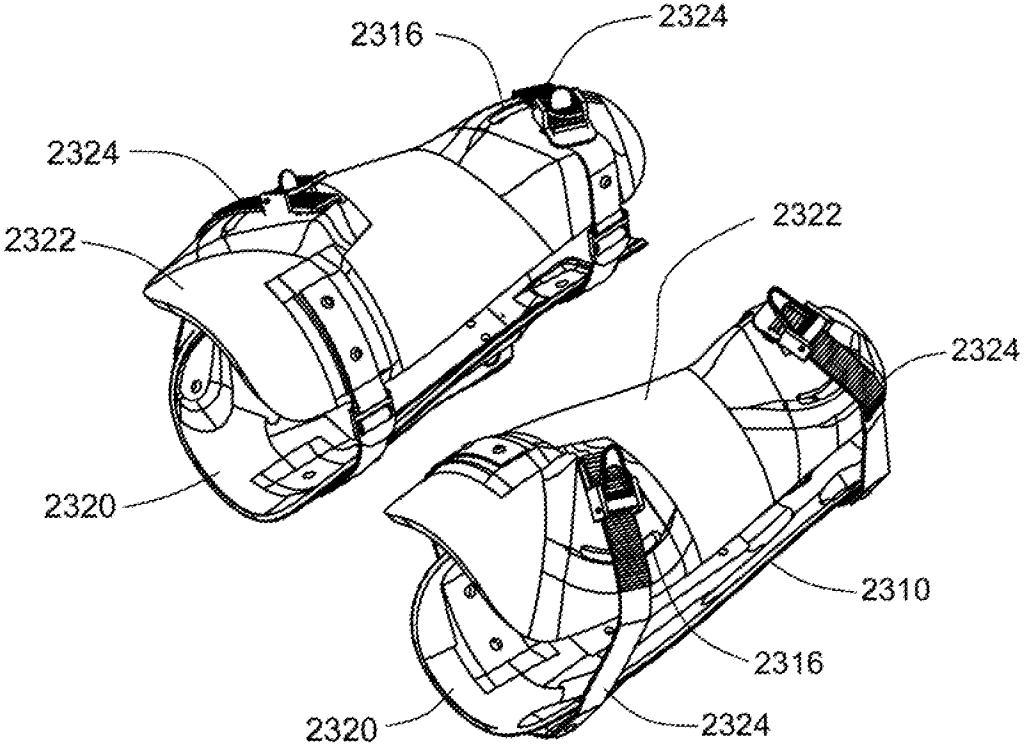
Figure 23G:
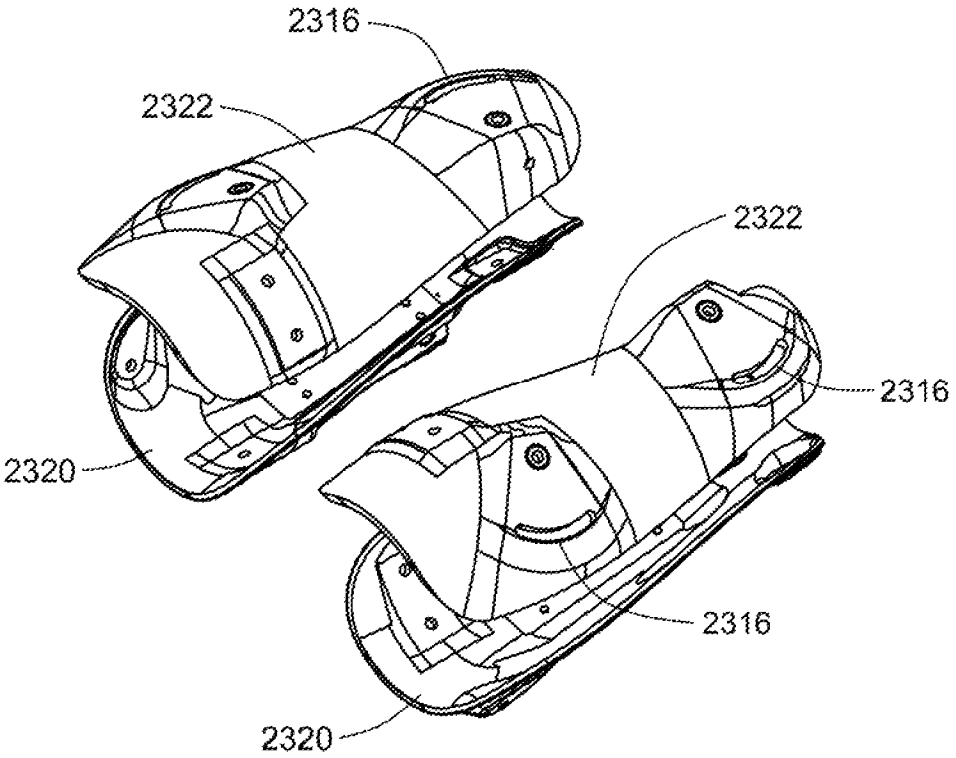
Figure 23H:
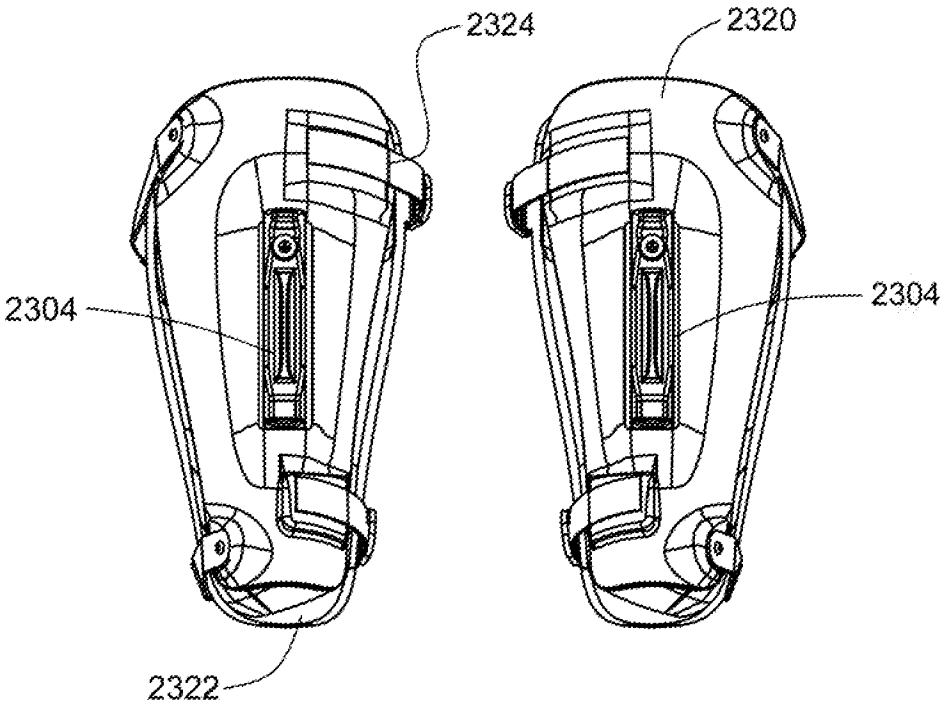
Figure 23I:
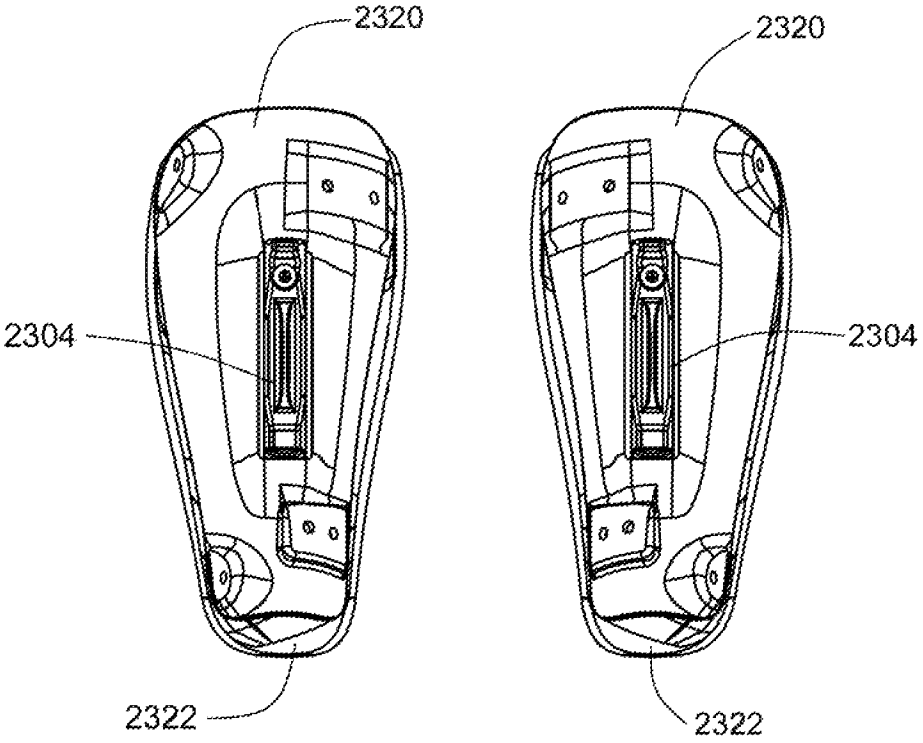
Figure 23J:
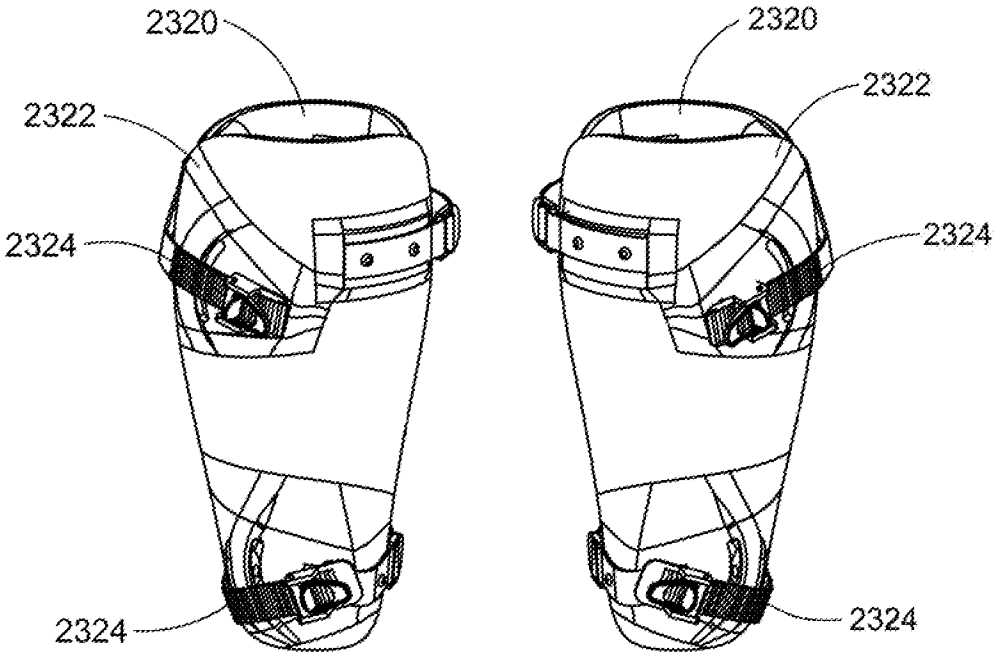
Figure 23K:
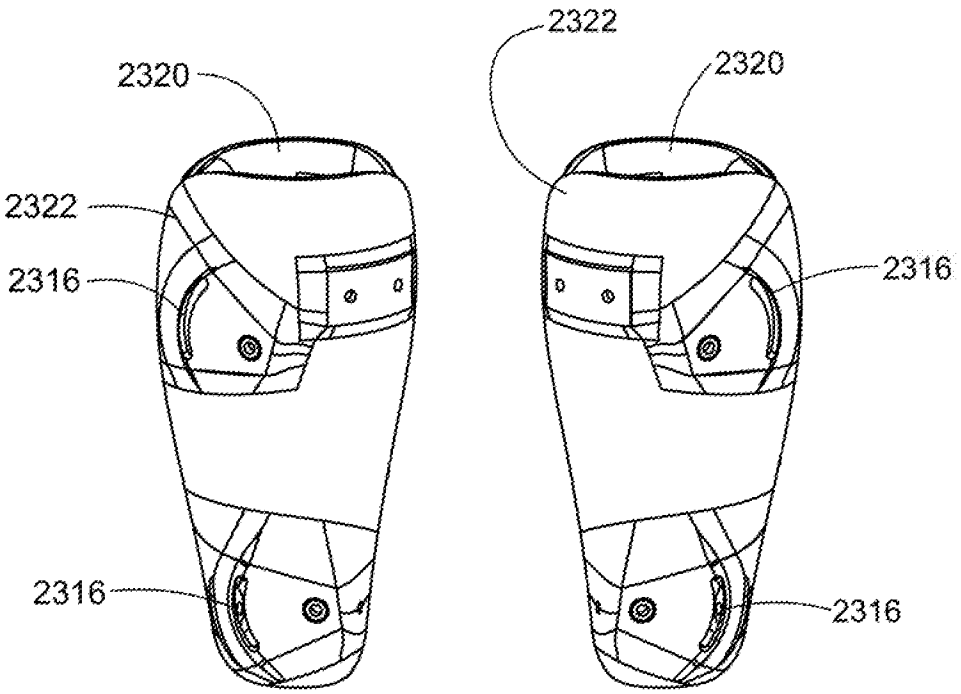
Figure 24:
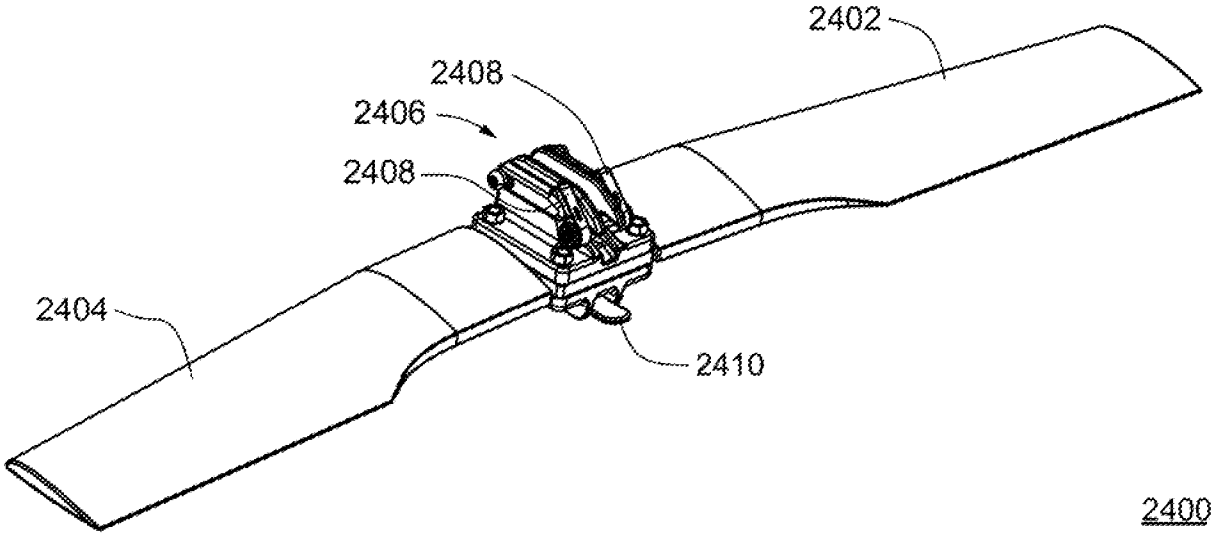
Figure 24A:
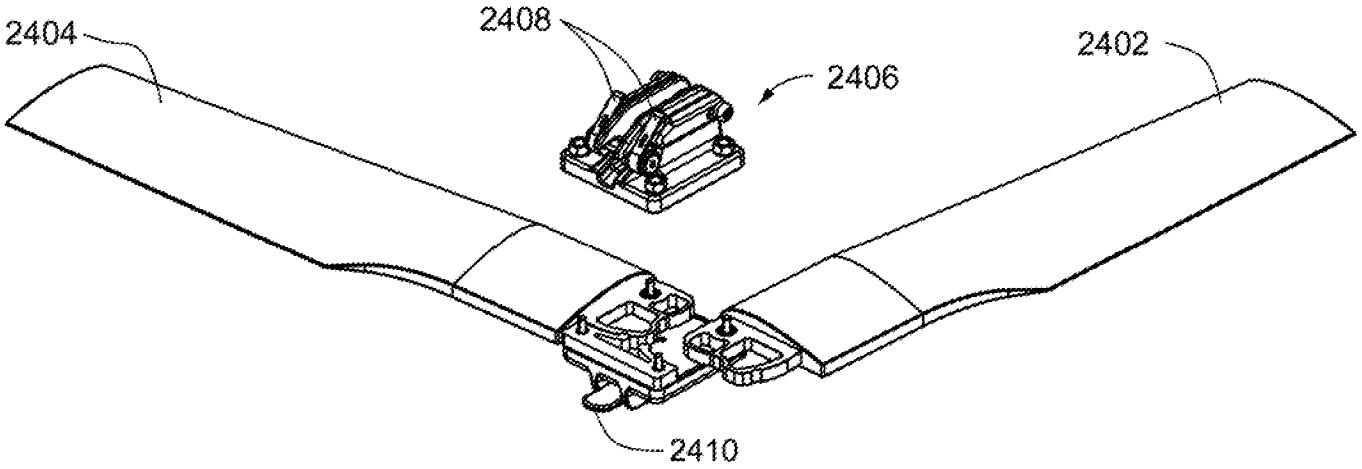
Figure 24B:
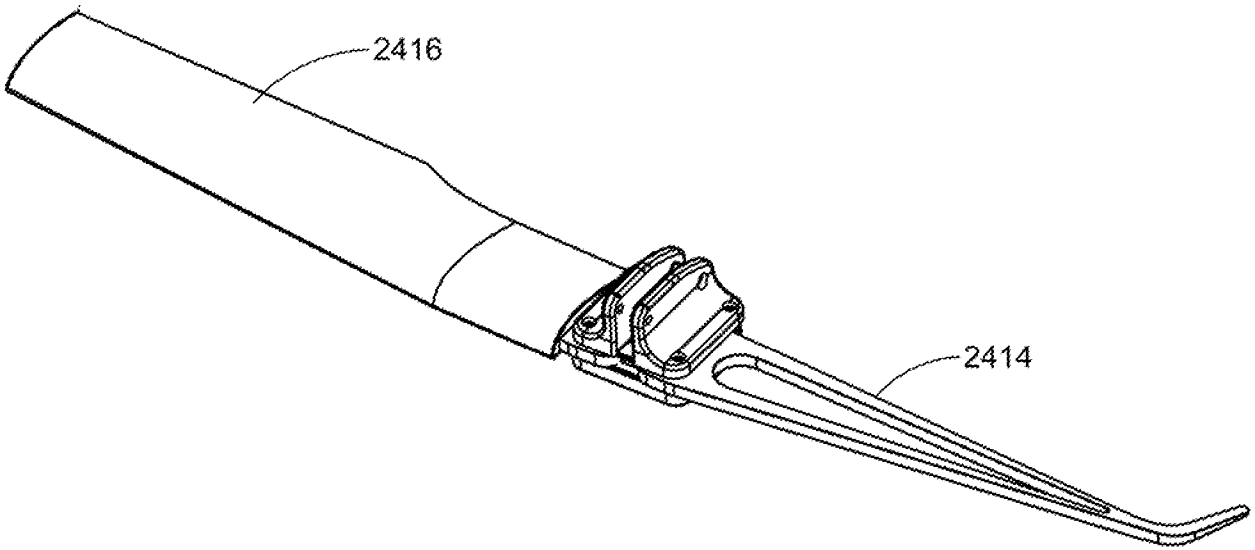
Figure 24C:
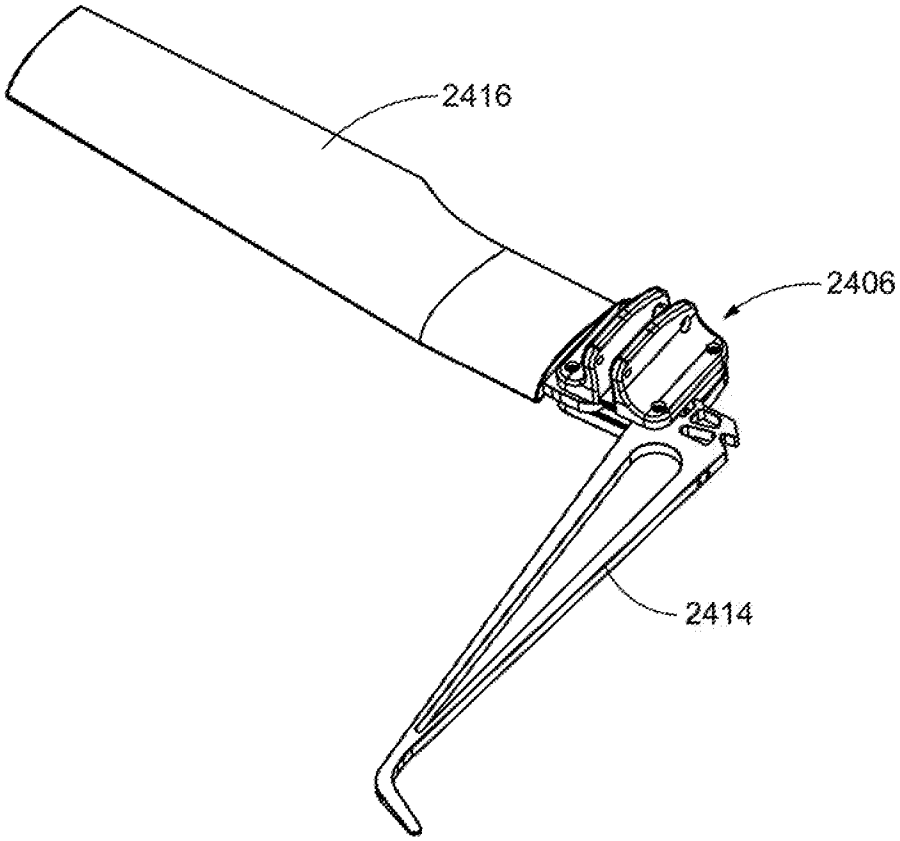
Figure 24D:
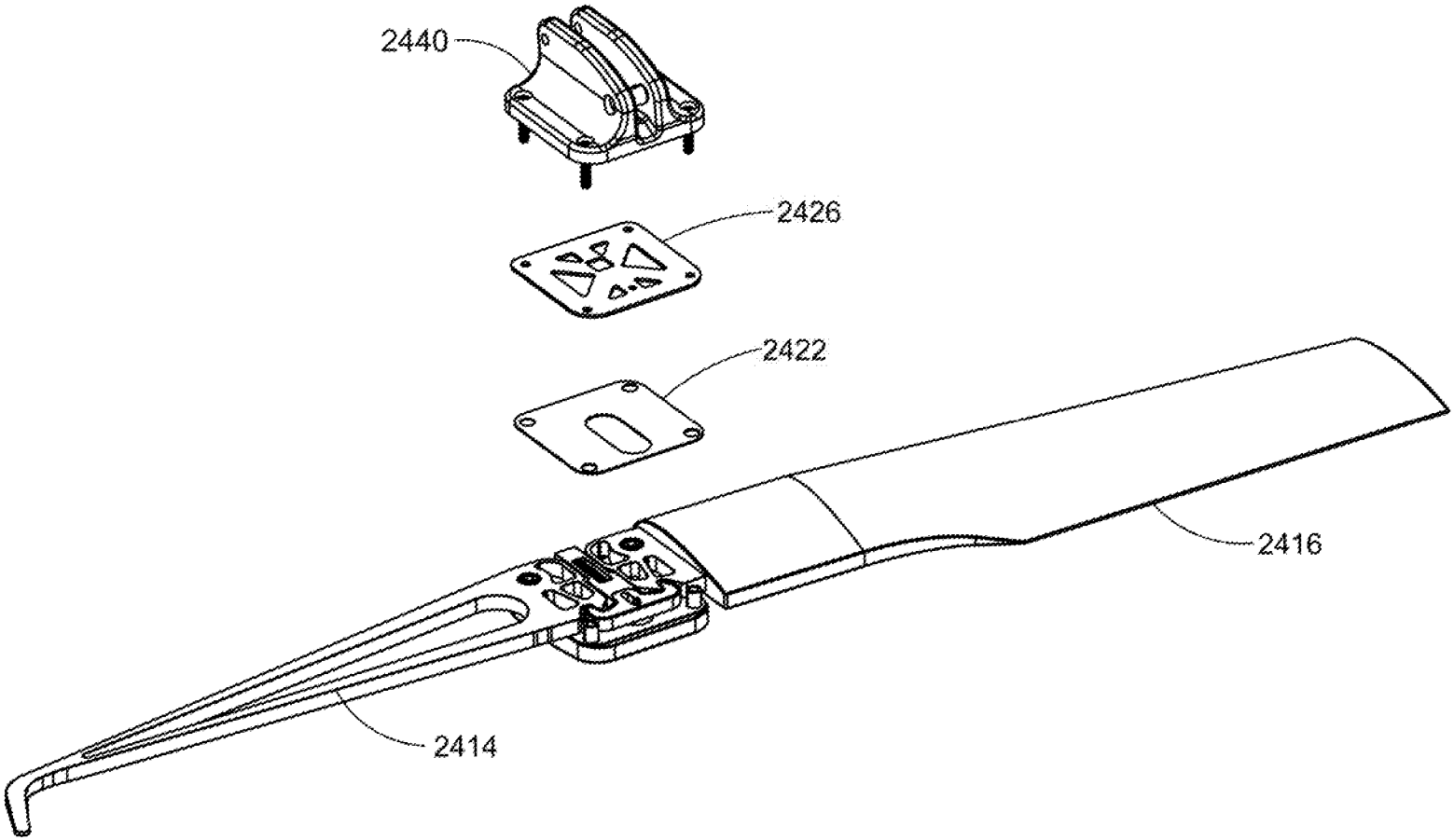
Figure 24E:
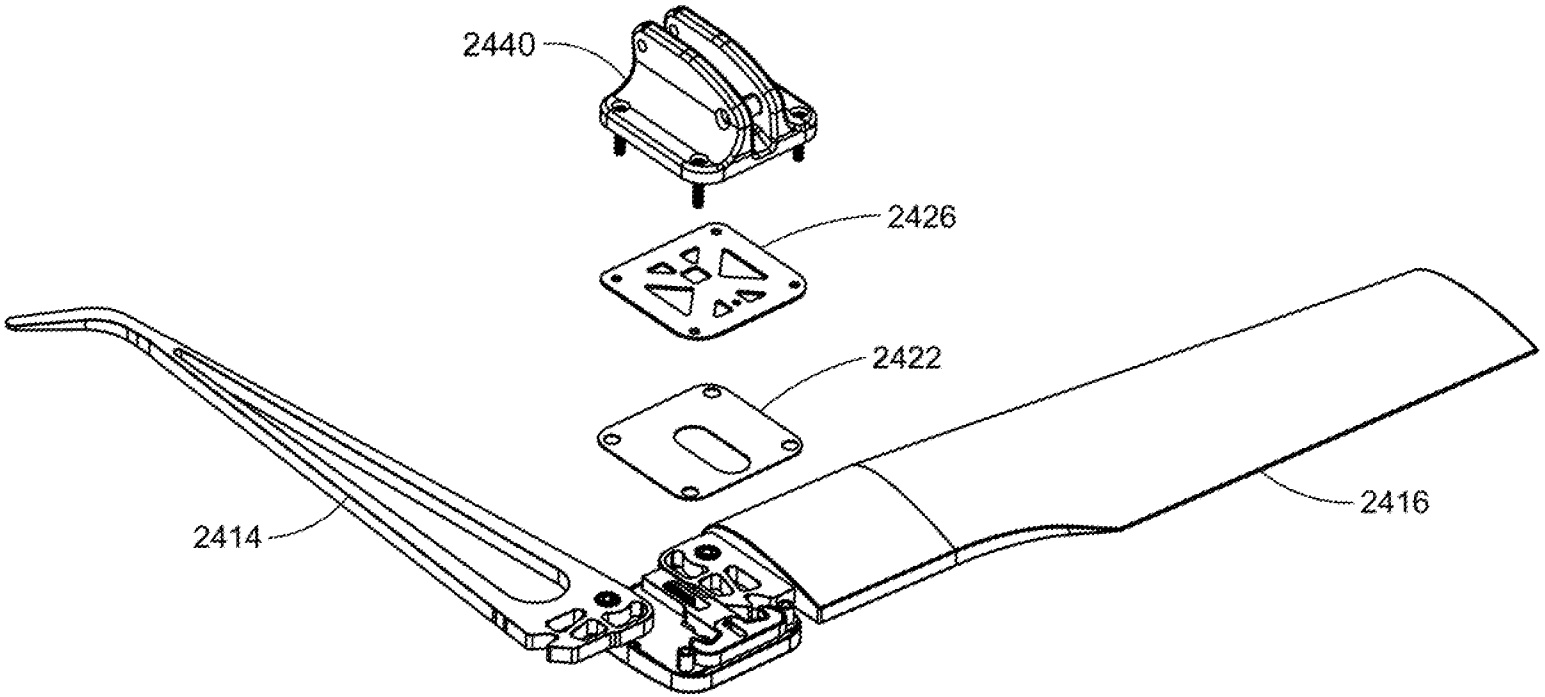
Figure 24G:
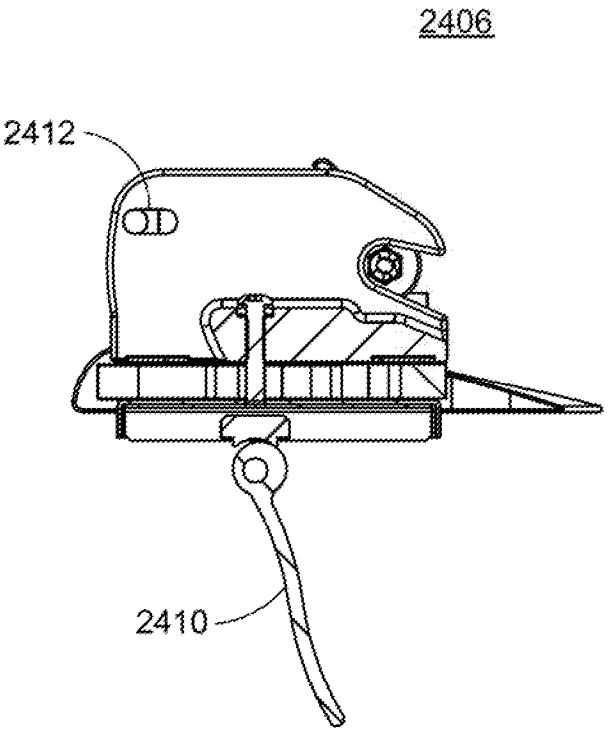
Figure 24F:
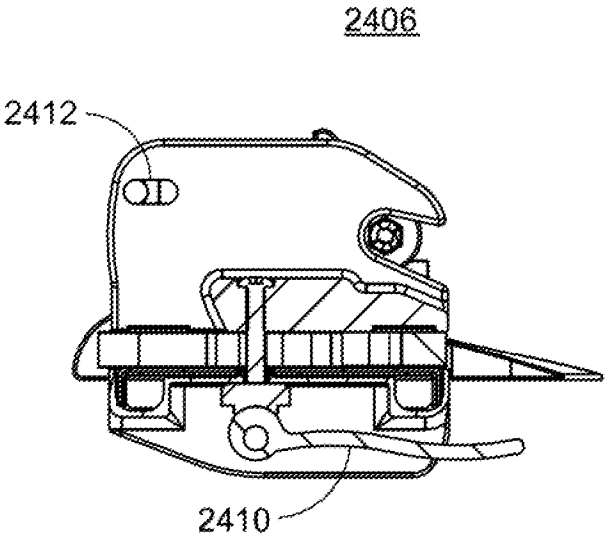
Figure 24H:
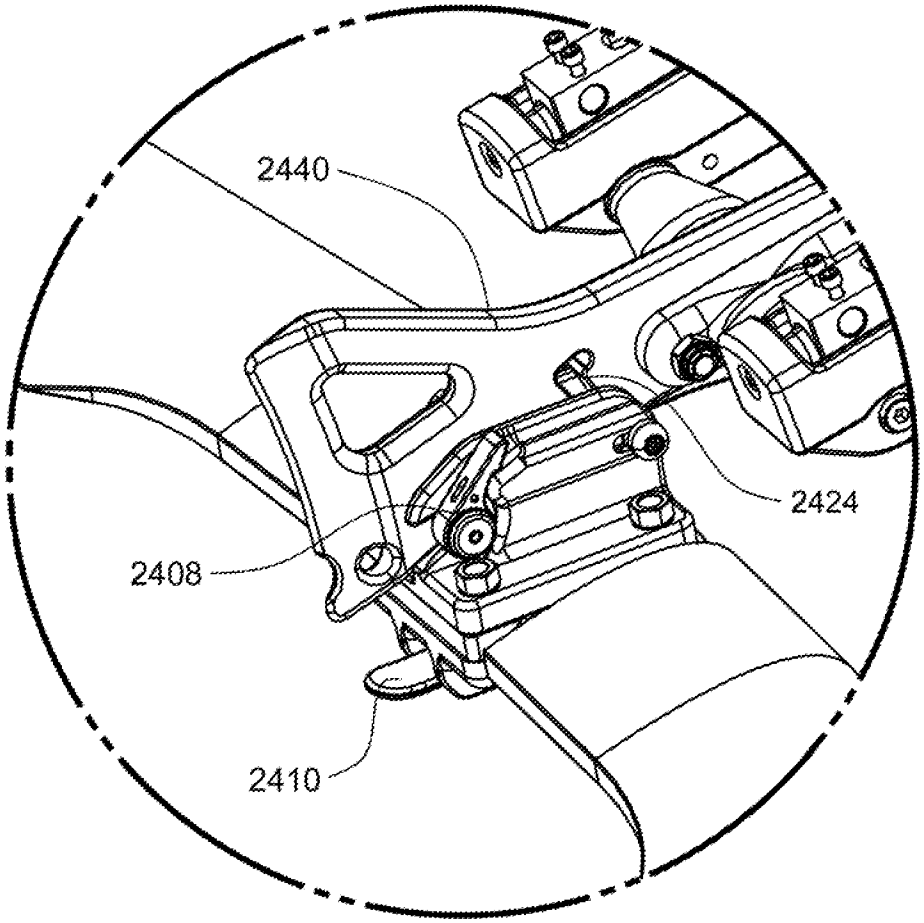
Figure 24I:
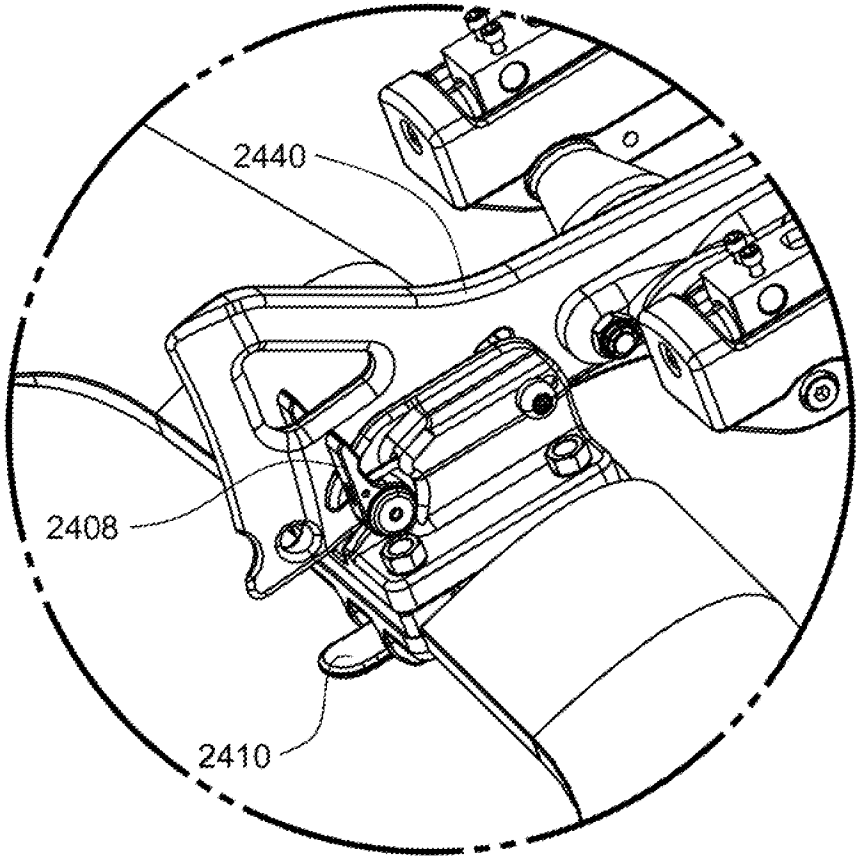
Figure 24J:
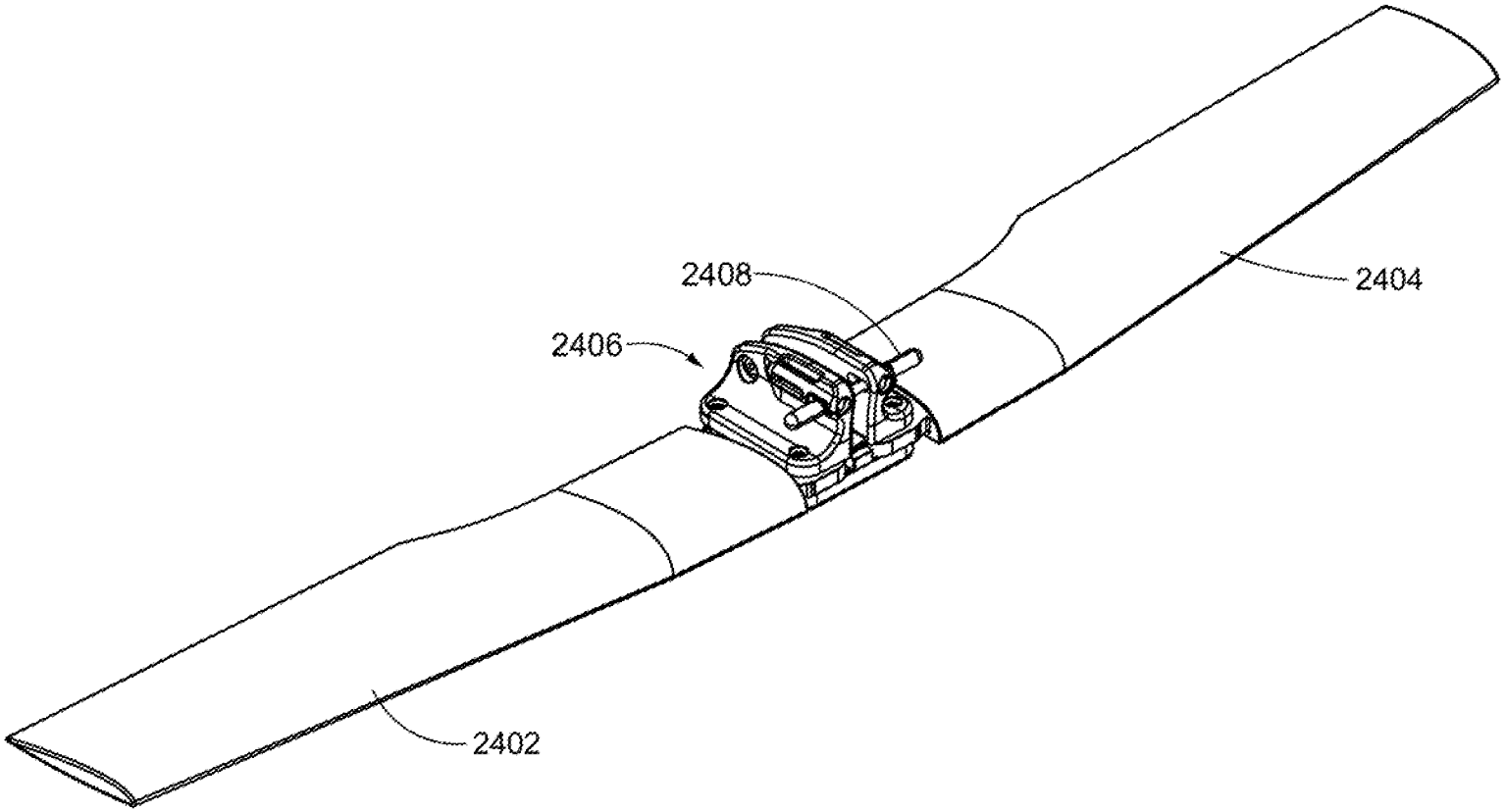
Figure 24K:
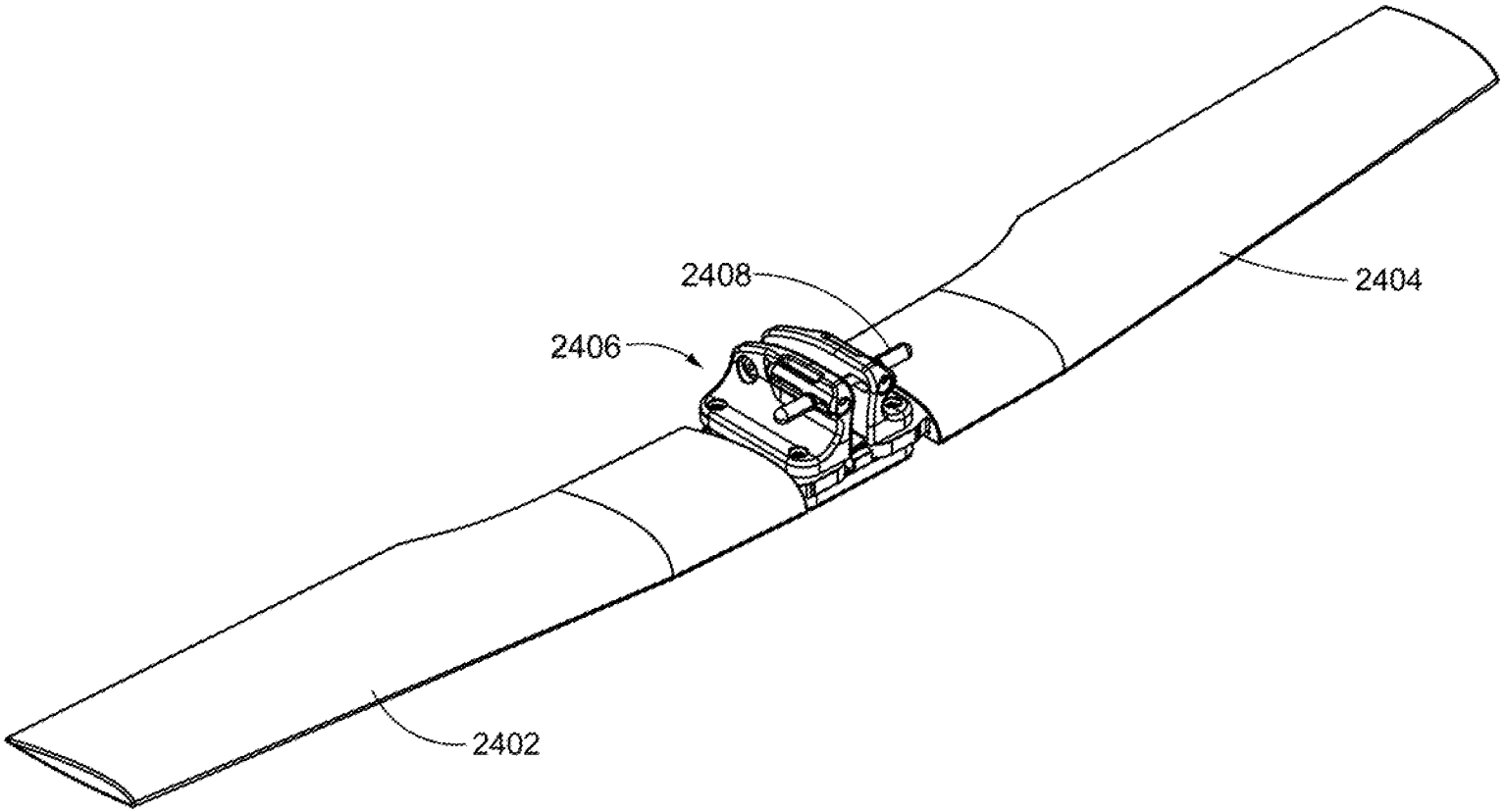
Figure 24L:
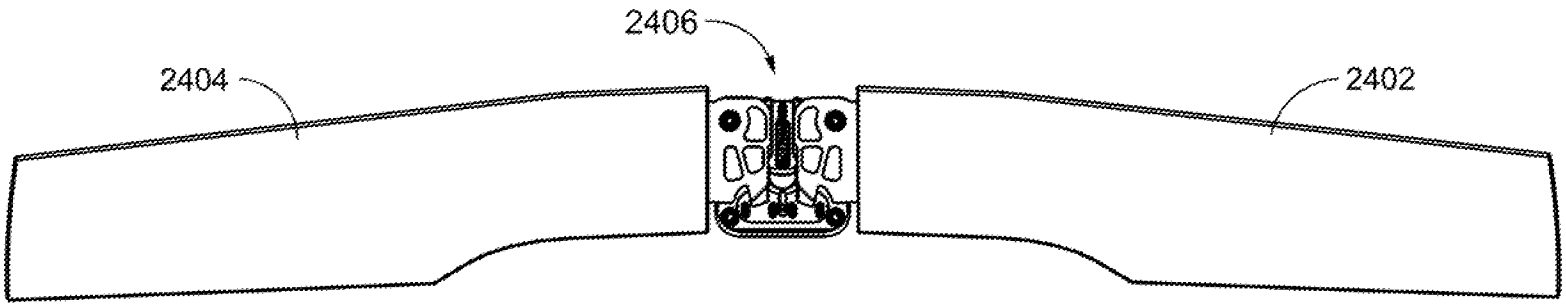
Figure 24M:
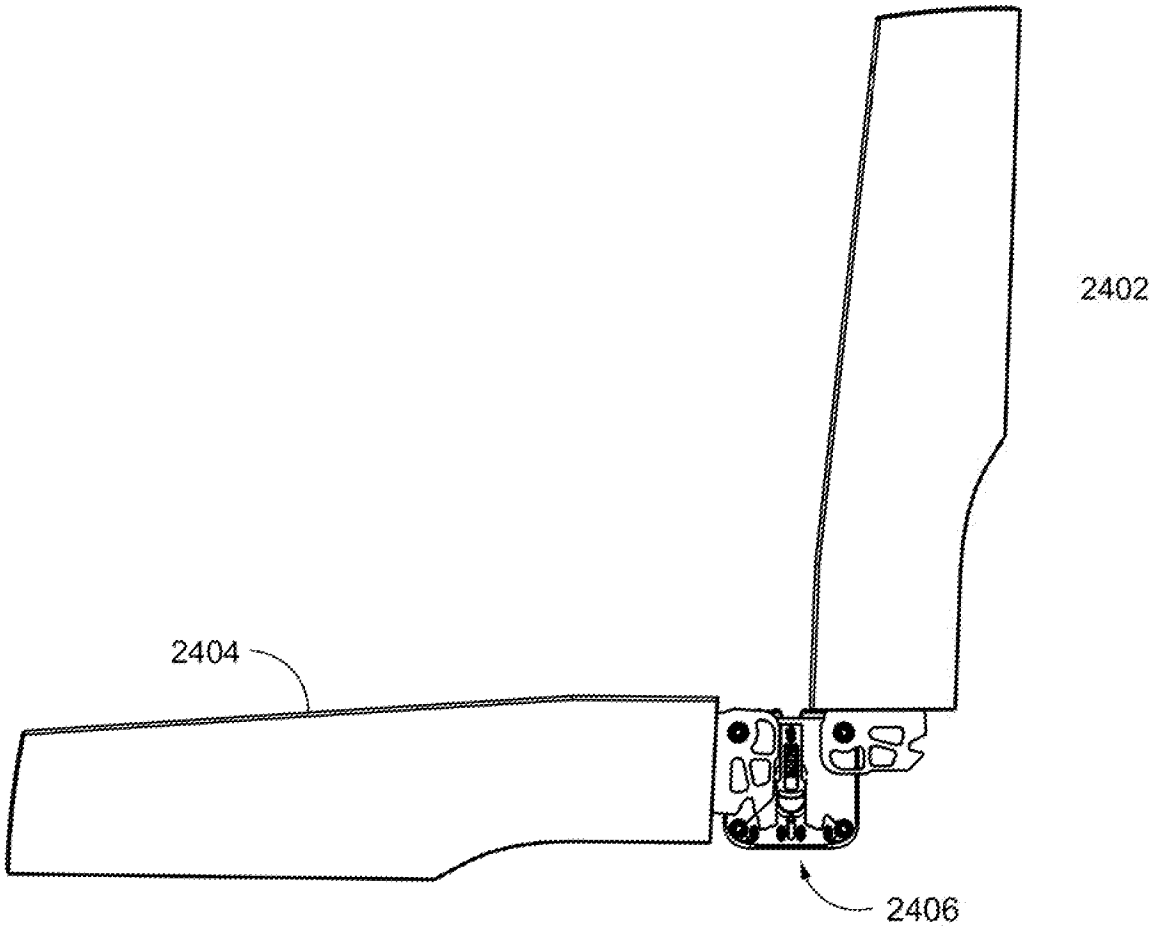
Figure 24N:
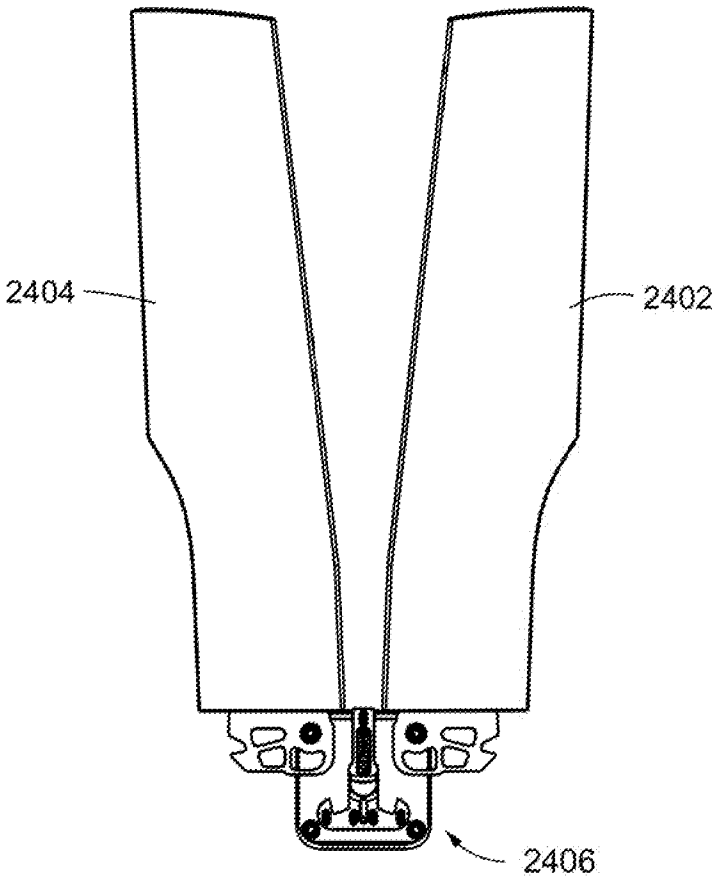
Figure 24O:
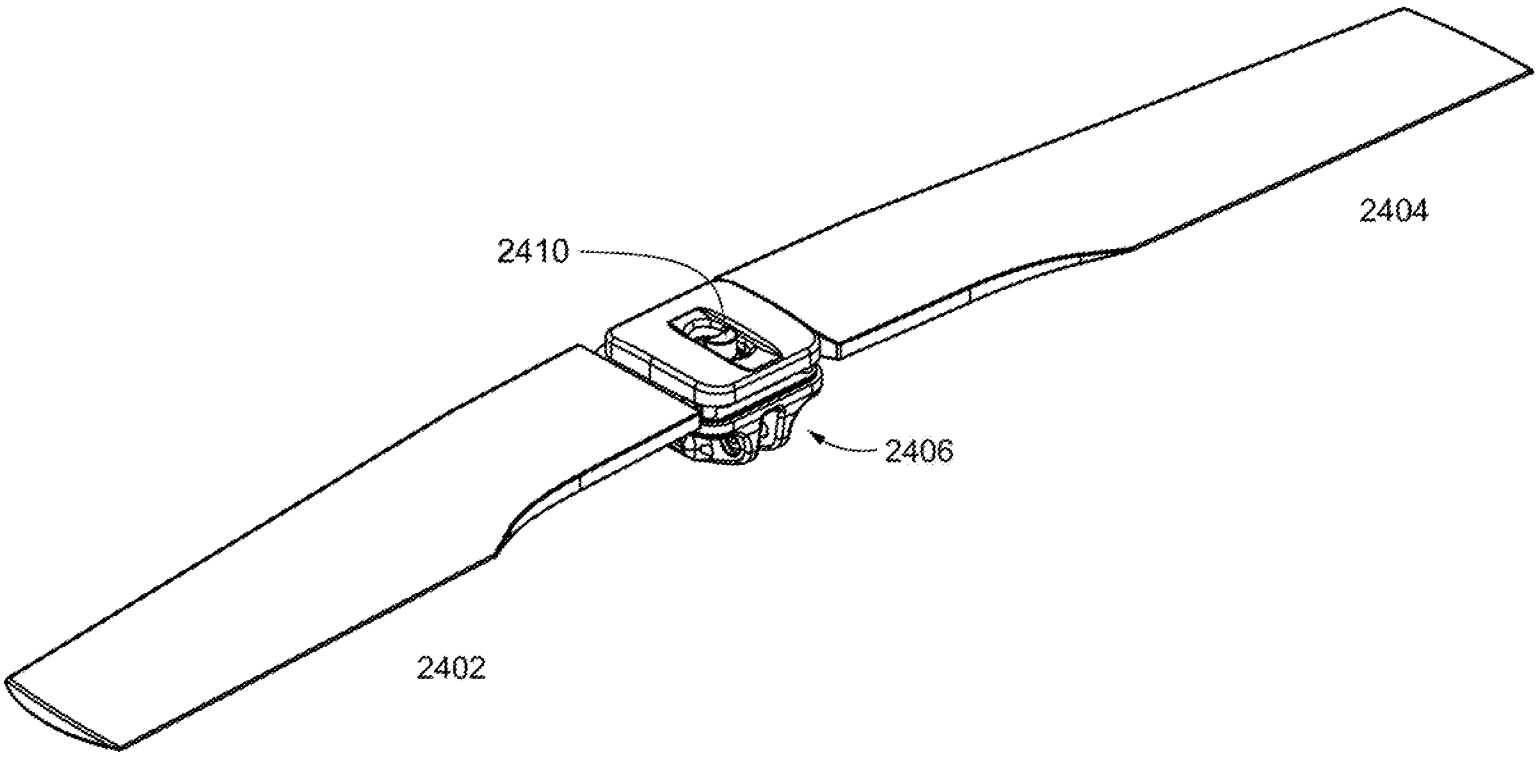
Figure 24P:
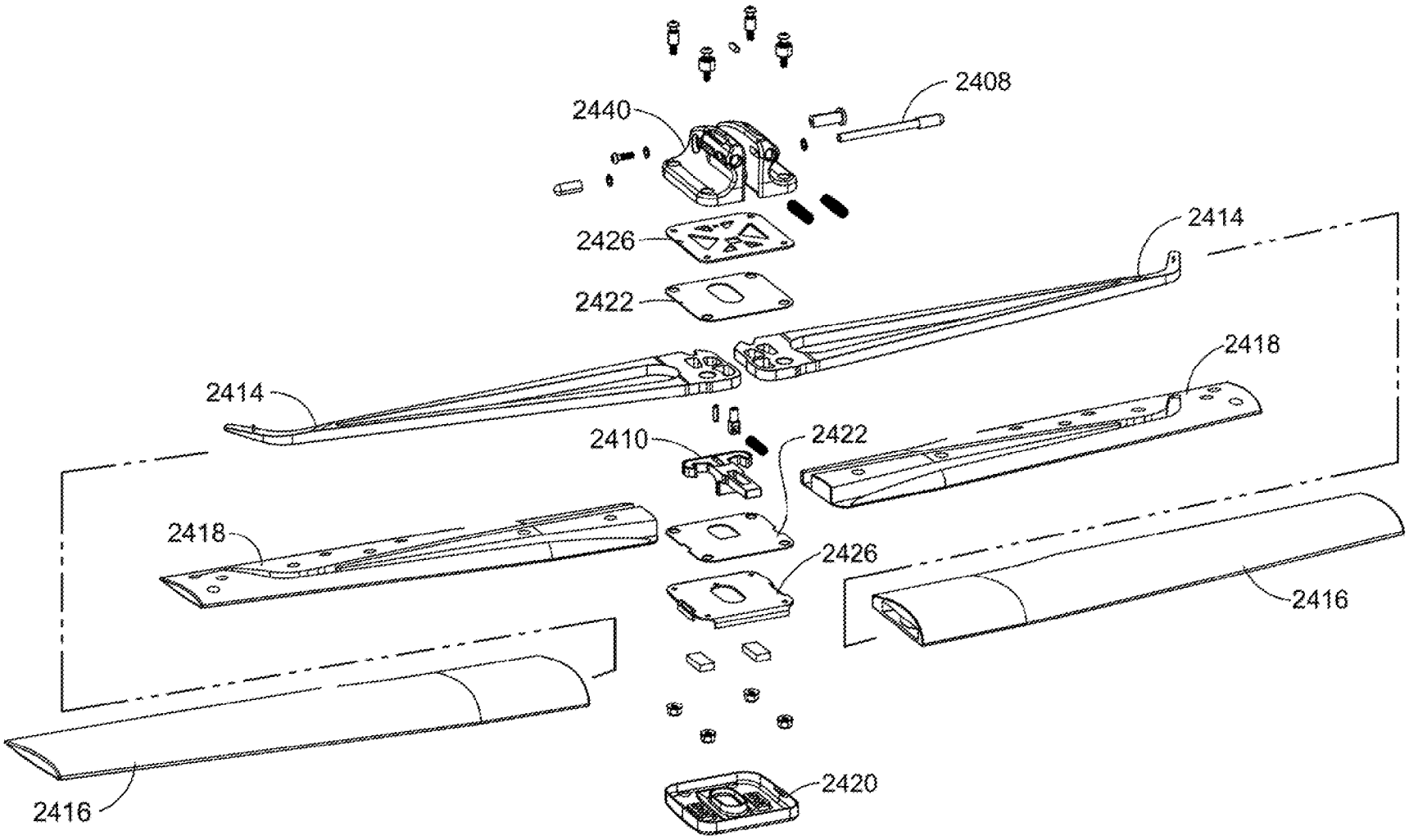
Figure 24Q:
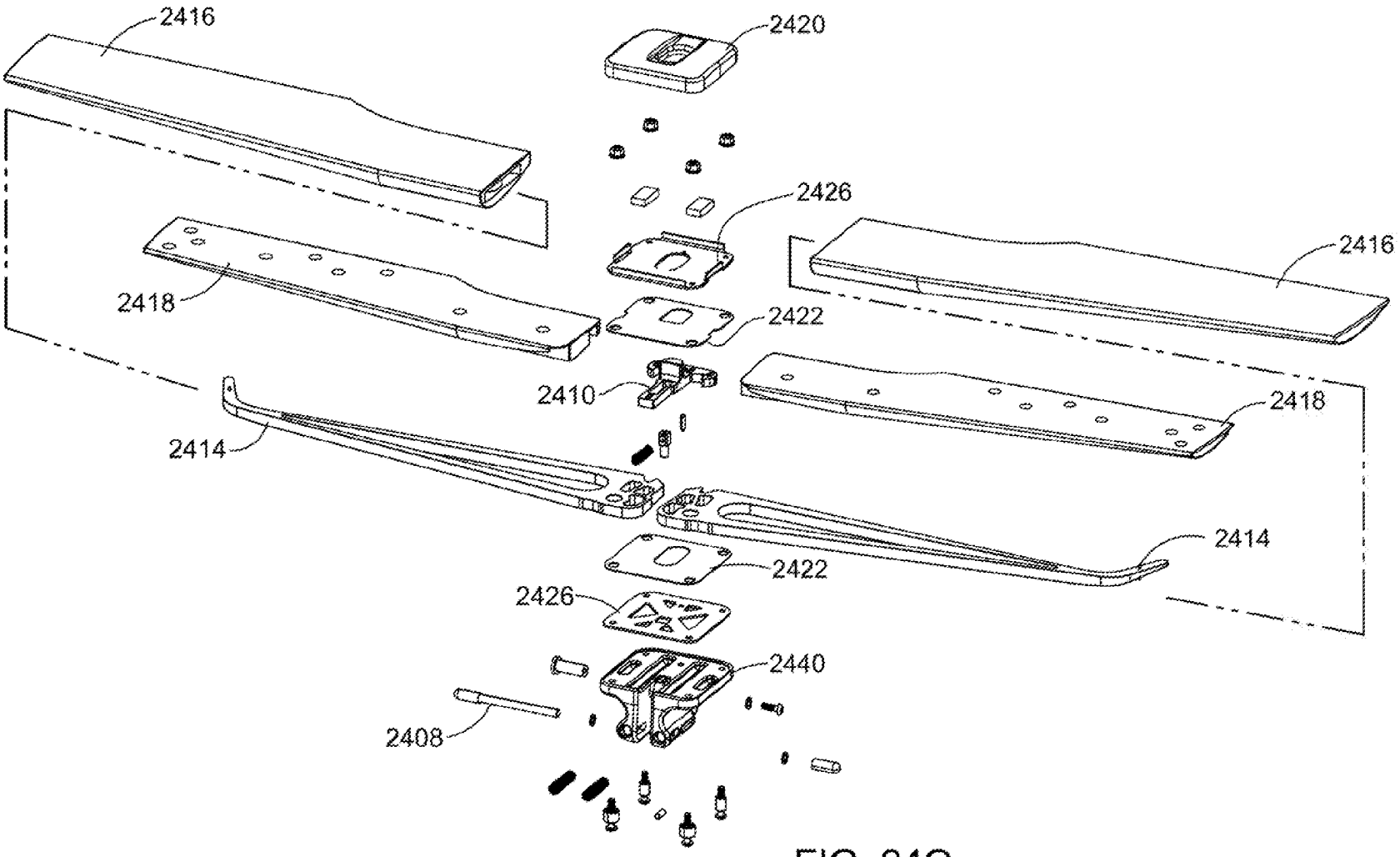
Figure 24R:
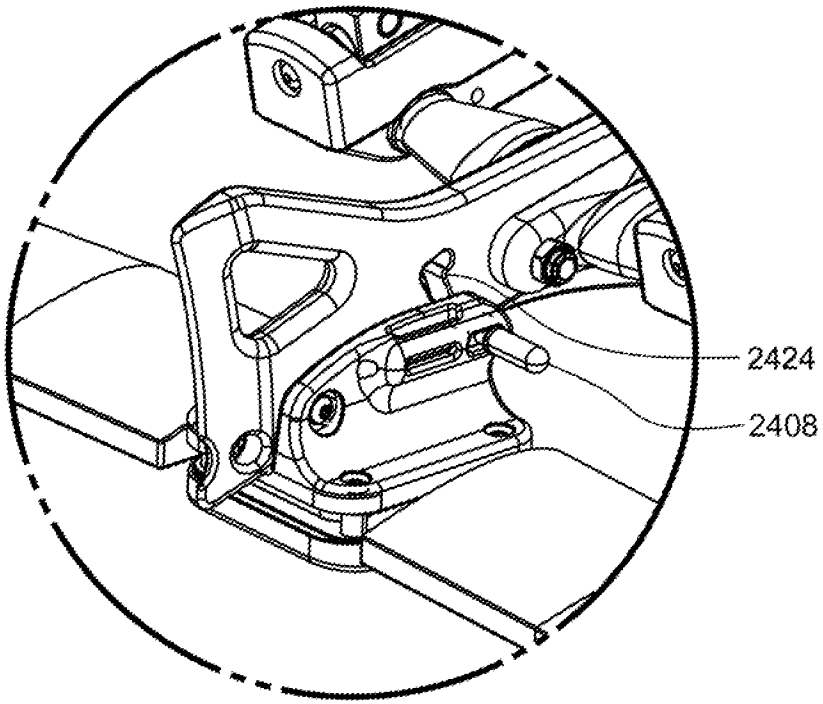
Figure 24S:
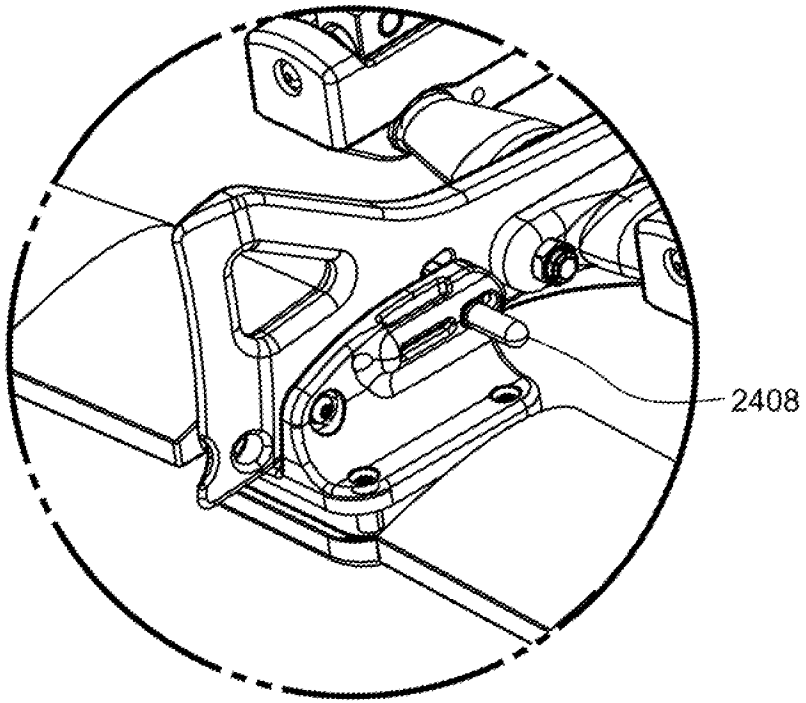
Figure 24U:
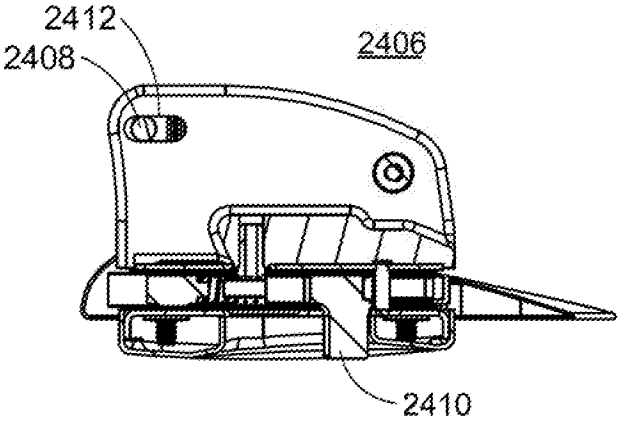
Figure 24T:
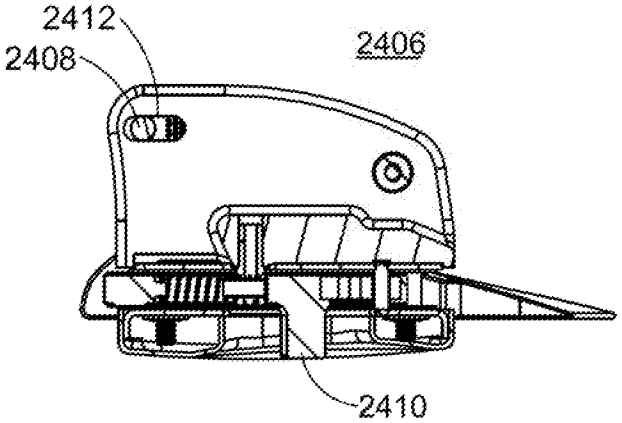
Figure 24V:
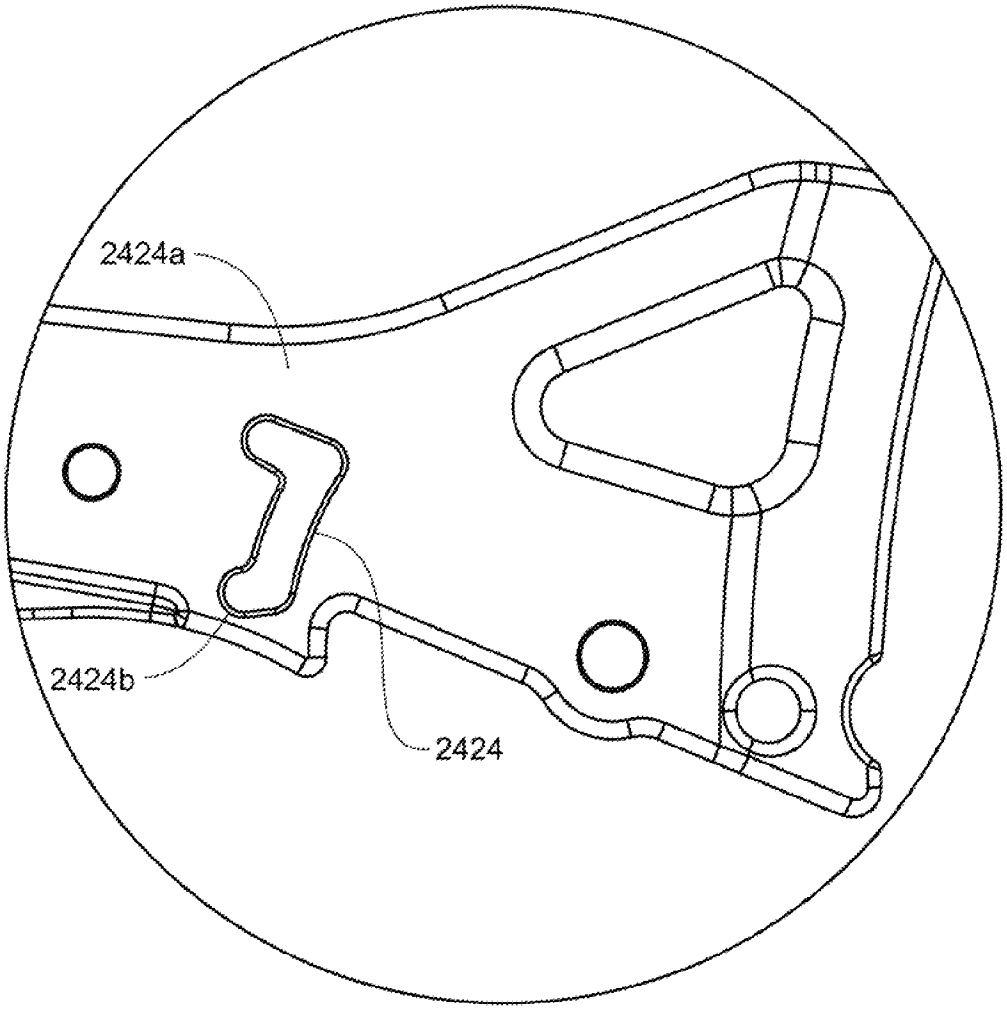
Figure 24W:
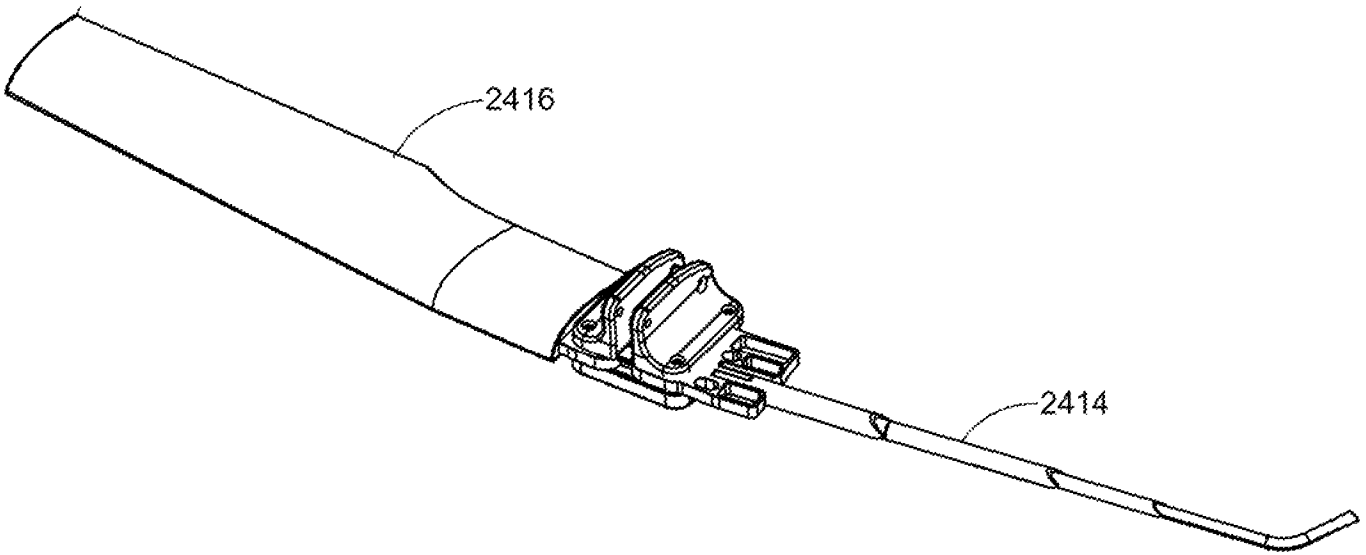
Figure 25:
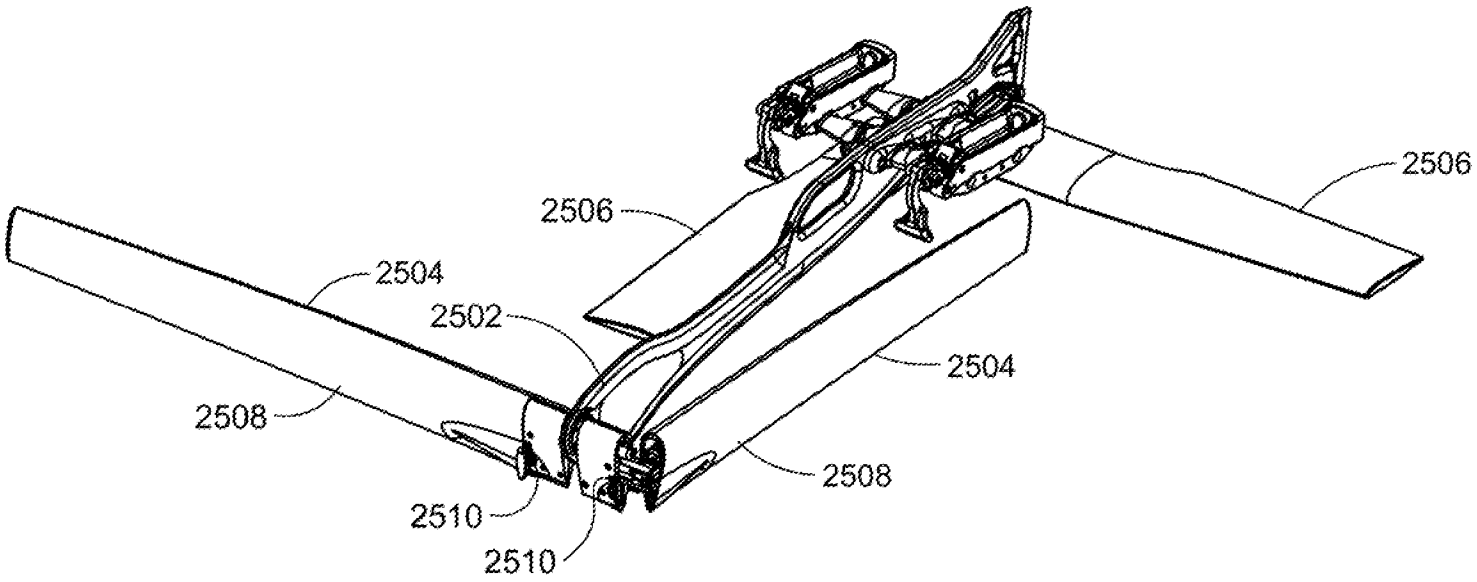
Figure 25A:
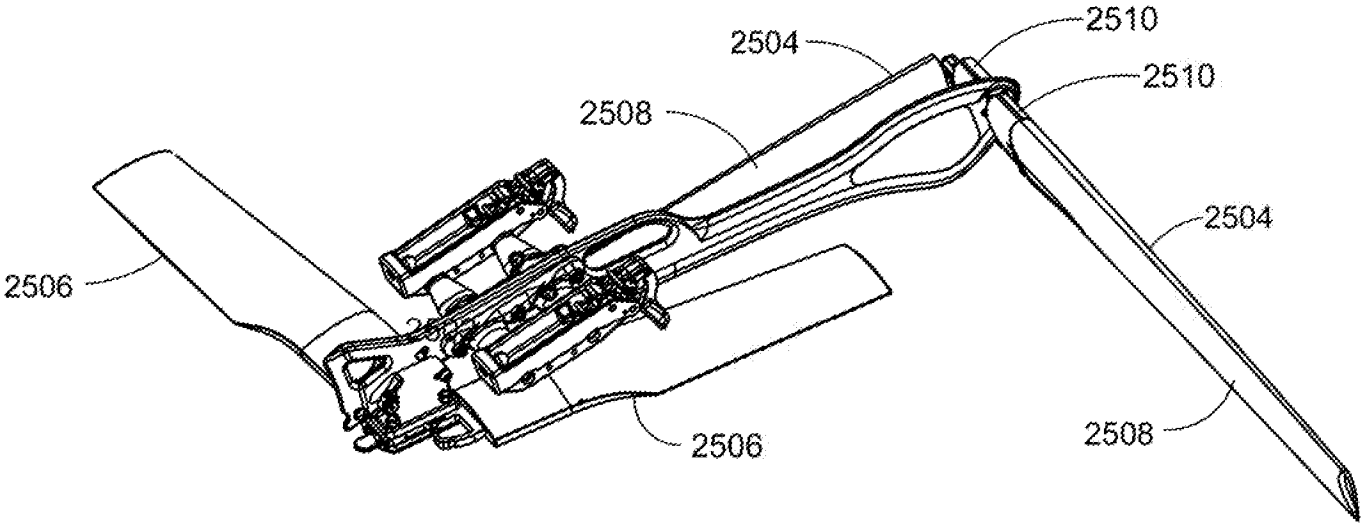
Figure 25B:
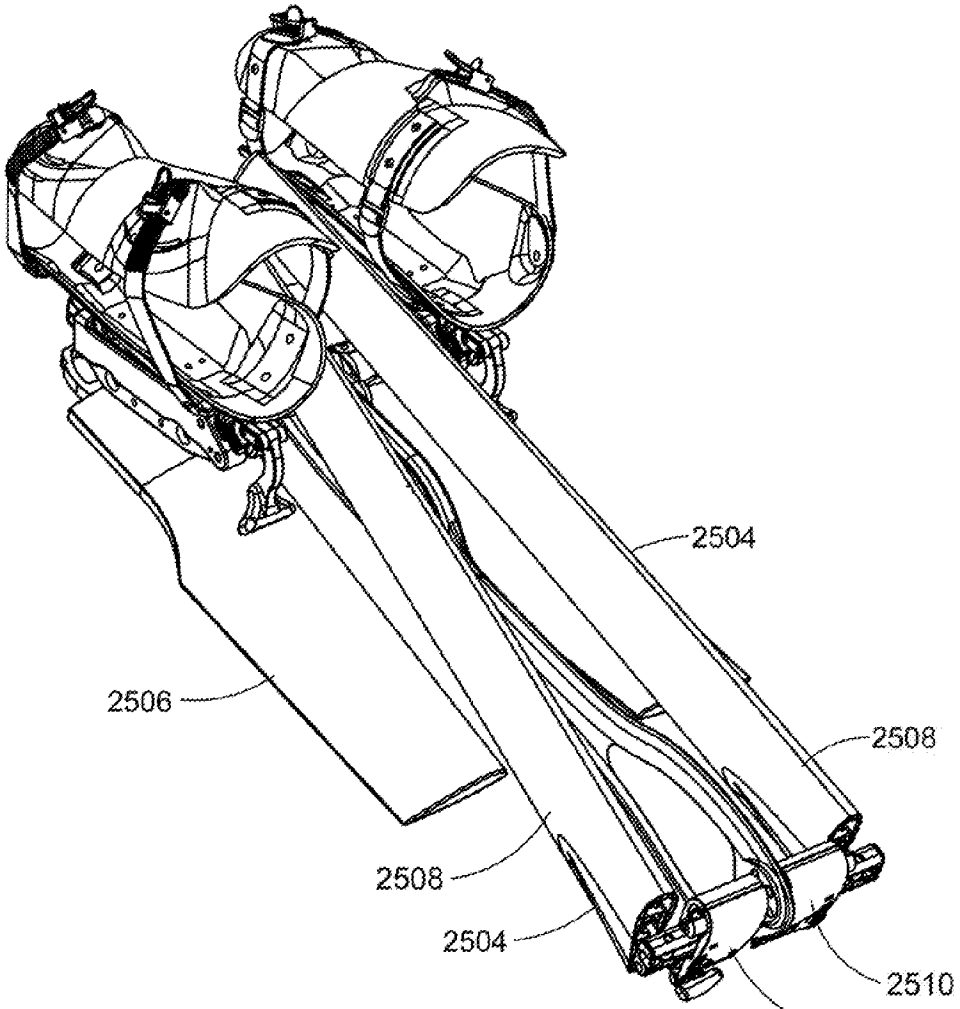
Figure 25C:
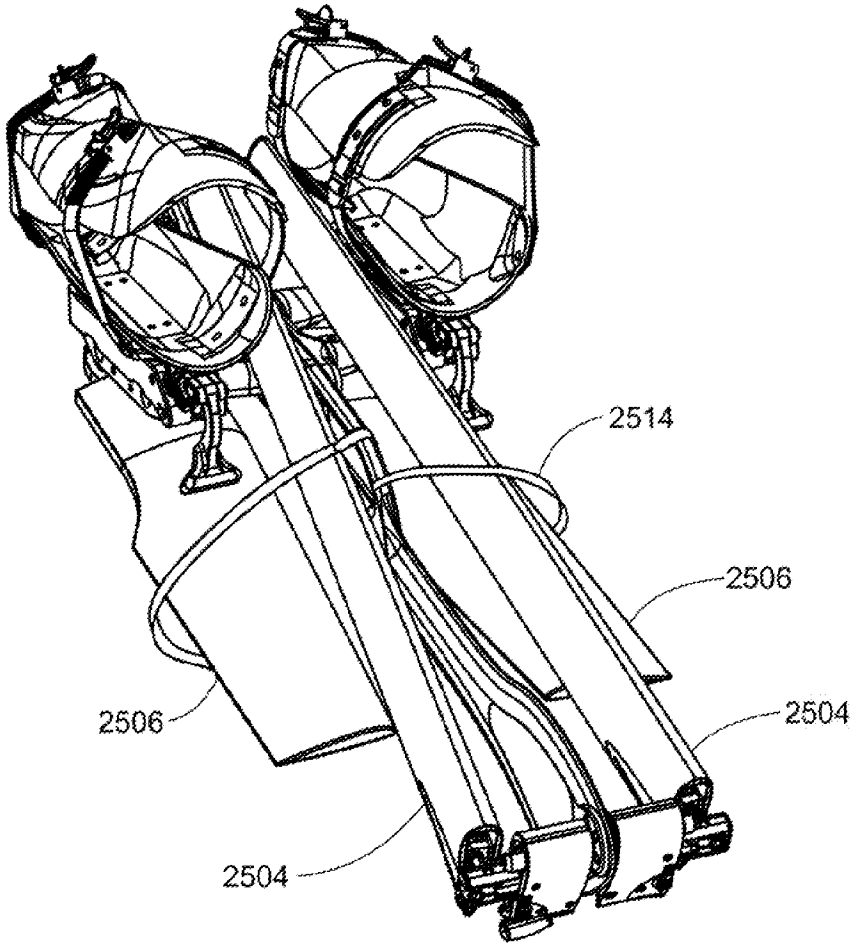
Figure 25D:
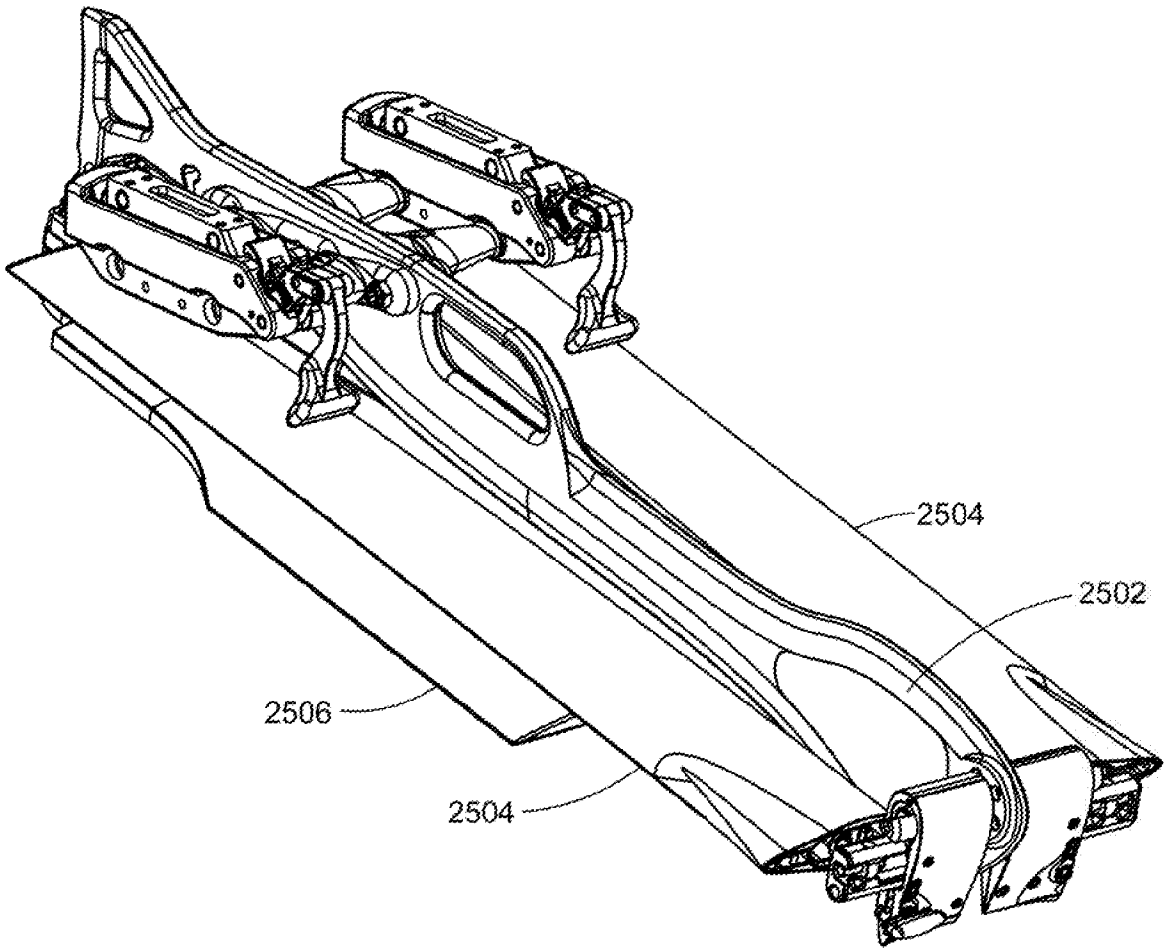

FIG. 23K is a top view of an embodiment of a pair of cuffs;

FIG. 24 is a perspective view of an embodiment of the stabilizer;

FIG. 24A is a partial exploded view of an embodiment of the stabilizer having a stabilizer member in the collapsed position;

FIG. 24B is a perspective view of an embodiment of the stabilizer having removed the exterior of a stabilizer member;

FIG. 24C is a perspective view of an embodiment of the stabilizer having removed the exterior of a stabilizer member and having the stabilizer member in the collapsed position;

FIG. 24D is a partially exploded perspective view of an embodiment of the stabilizer having removed the exterior of a stabilizer member;

FIG. 24E is a partially exploded perspective view of an embodiment of the stabilizer having removed the exterior of a stabilizer member and having the stabilizer member in the collapsed position;

FIG. 24F is a cross section of an embodiment of the stabilizer locking mechanism having the bottom cam lock in the locked position;

FIG. 24G is a cross section of an embodiment of the stabilizer locking mechanism having the bottom cam lock in the unlocked position;

FIG. 24H is a detail view of an embodiment of the stabilizer locking mechanism having the dual thumb levers in the locked position;

FIG. 24I is a detail view of an embodiment of the stabilizer locking mechanism having the dual thumb levers in the unlocked position;

FIG. 24J is a perspective view of an embodiment of the stabilizer in the locked position;

FIG. 24K is a perspective view of an embodiment of the stabilizer in the unlocked position;

FIG. 24L is a bottom view of an embodiment of the stabilizer;

FIG. 24M is a bottom view of an embodiment of the stabilizer having a member in the collapsed position;

FIG. 24N is a bottom view of an embodiment of the stabilizer having both stabilizer members in the collapsed position;

FIG. 24O is a bottom perspective view of an embodiment of the stabilizer having switch locking mechanism;

FIG. 24P is an exploded top perspective view of an embodiment of the stabilizer;

FIG. 24Q is an exploded bottom perspective view of an embodiment of the stabilizer;

FIG. 24R is a cross section of an embodiment of the stabilizer locking mechanism in the locked position;

FIG. 24S is a cross section of an embodiment of the stabilizer locking mechanism in the unlocked position;

FIG. 24T is a detail view of an embodiment of the stabilizer locking mechanism in the locked position;

FIG. 24U is a detail view of an embodiment of the stabilizer locking mechanism in the unlocked position;

FIG. 24V is a detail view of an embodiment of the aft section of the fuselage detailing the "C" shaped slot;

FIG. 24W is a view of an embodiment of the stabilizer showing a cut-away view of one section of the stabilizer;

FIG. 25 is a front perspective view of an embodiment of the swimming apparatus with a propulsor member and a stabilizer member folded;

FIG. 25A is a is a back perspective view of an embodiment of the swimming apparatus with a propulsor member and a stabilizer member folded;

FIG. 25B is a front perspective view of an embodiment of the swimming propulsion device in a fully collapsed position;

FIG. 25C is a front perspective view of an embodiment of the swimming propulsion device in a fully collapsed position and a bungee; and FIG. 25D is an alternative folding embodiment of an embodiment of the swimming propulsion device.

DETAILED DESCRIPTION OF THE PREFERRED EMBODIMENTS

As used in this description and the accompanying claims, the following terms shall have the meanings indicated, unless the context otherwise requires.

The term "airfoil" is used herein to include any type of aerodynamic or hydrodynamic foil shape. Thus, although the exemplary embodiment and various other embodiments are described herein with reference to airfoil, the scope the apparatus includes any other foil shapes. In some instances the term "airfoil" may also be referred to as simply "foil" or "hydrofoil."

The term "cuff" is used herein to describe any type of device capable of capturing the lower leg of a swimmer. Thus, although the exemplary embodiment and various other embodiments are described herein with reference to cuffs, the scope the apparatus includes any other sports fastening device.

The term "swimmer" is used to describe a user of the device, whether on land or in the water.

The term "swimmer attachment mechanism" may be used synonymously with "swimmer attachment mechanism" or "attachment mechanism".

Figure 1:
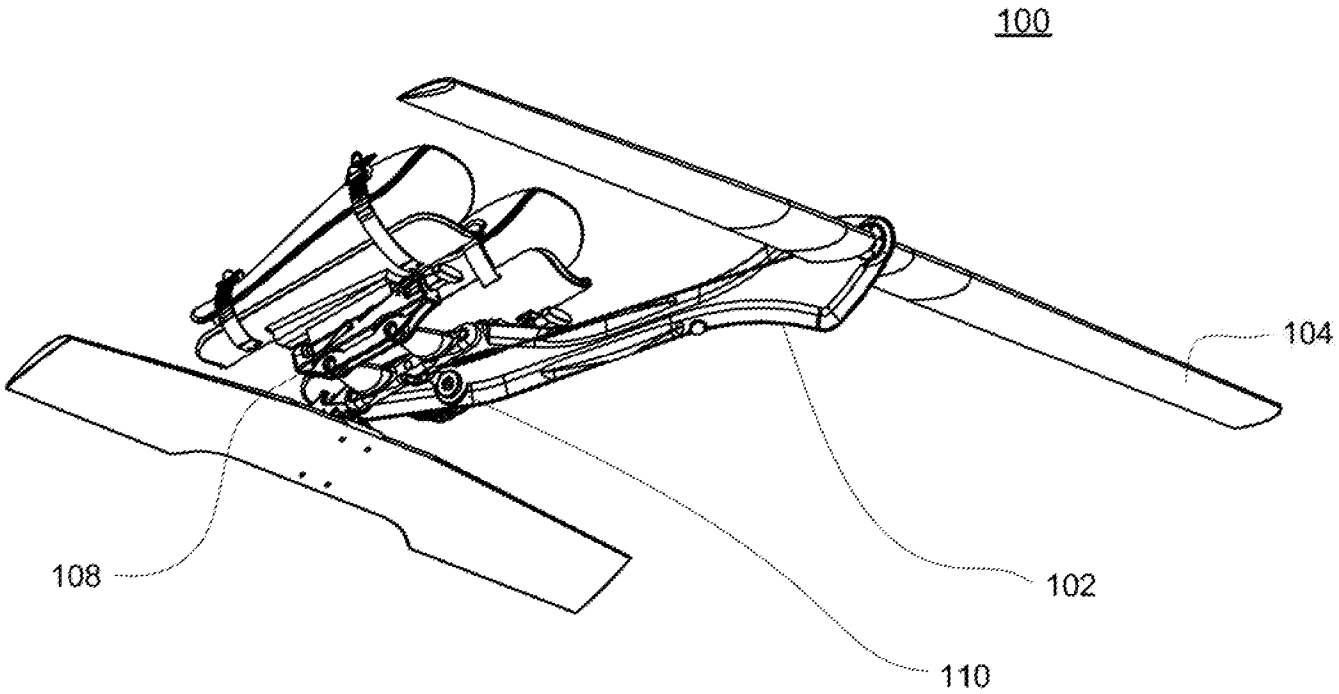
FIG. 1 is a front-bottom perspective view of the exemplary embodiment of the swimming propulsion device.
Figure 1A:
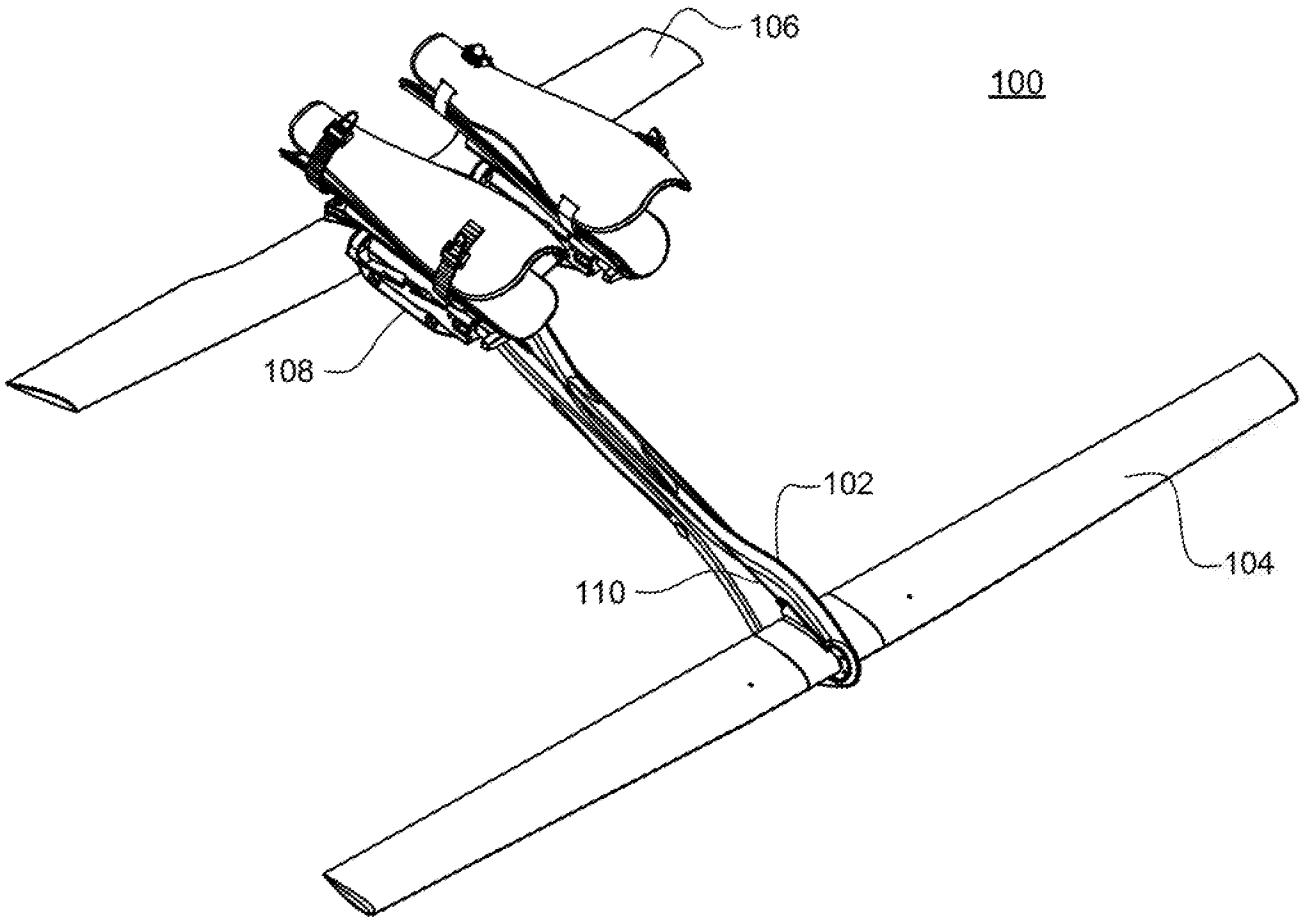
FIG. 1A is a front-top-perspective view of the exemplary embodiment of the swimming propulsion device shown in FIG. 1.

The swimming propulsion device described herein provides increased efficiency for a swimmer as well as stability and comfort. Referring to FIGS. 1-1F, one embodiment of the swimming propulsion device 100 is shown. For the purposes of this description, the embodiment shown in FIGS. 1-1F will be referred to as an exemplary embodiment. Other embodiments are contemplated some of which will be discussed herein. The swimming propulsion device 100 may include but is not limited to a fuselage 102 having a forward section and an aft section. The terms "forward section" and "aft section" are used for ease of description. Attached to the forward section of the fuselage 102 may be at least one propulsor 104. The propulsor 104 may include but is not limited to an airfoil 112, cable plate 114, bushings 116, an axle 118, and bushing housing 120. Similarly, at least one stabilizer 106 may be attached to the rear of the fuselage 102 using a mounting bracket 121. Also affixed to the aft section of the fuselage 102 may be an attachment mechanism 108. This mechanism may include but is not limited to cuffs 122, cleats 124, locking mechanisms 126, and mounting brackets 128. Furthermore, a control mechanism 110 may be connected to the fuselage 102 and the propulsor 104. The control mechanism 110 may include but is not limited to handle 130, spring 132, and cable 134.

Still referring to FIGS. 1-1F, in operation, in one embodiment of the device, the swimmer bends primarily at the knees with some contraction at the hips, forcing the propulsors 104 away from the body while being counteracted by the presence of the stabilizers 106, in a hybrid kicking/squatting motion. The force of this motion is transferred to the propulsors 104 and drives the propulsors 104 through the water in a downward motion. The swimmer then straightens their legs forcing the propulsors 104 in an upward motion against the resisting water. Given the constrains to the range of motion provided by the control mechanism 110 the propulsors 104 take an angle of attack with respect to their desired free position. This angle of attack allows the propulsors 104 to generate lift, which is then transferred to forward motion of the swimmer. As the swimmer continues this oscillating movement, a fishtail-like movement is created that propels the swimmer through the water.

Still referring to FIGS. 1-1F, in the exemplary embodiment, the cable plate 114 may be pivotally connected to the forward section of fuselage 102 using an axle 118. The axle 118 may be positioned within the bushing housing 120. The cable plate 114 may be attached to an axle 118 using a tapered plug (not shown). The axle 118 may have threaded ends to receive the tapered plug. In addition, at each end of the axle 118 are a plurality of slots allowing the end of the axle 118 to expand against the inner surface of the cable plate 114 when the tapered plug is installed. In yet other embodiments, the axle 118 may be attached to the cable plate 114 using a trantorque-keyless bushing. In the exemplary embodiment, the axle 118 may have a diameter sufficient to be received within the bushing housing 120 and not adversely affecting the radius of the airfoil-shaped propulsor 104.

Still referring to FIGS. 1-1F, in alternate embodiments, the axle 118 may be connected directly to the airfoil 112. In these embodiments the airfoil 112 may have an aperture at the proximal end to receive the axle 118. This aperture may have a diameter sufficiently large to slidably receive the axle 118. In other embodiments the airfoil 112 may contain a plastic insert to increase the structural strength of the airfoil 112. This plastic insert may be located at the proximal end of the airfoil 112 to receive the axle 118. The axle 118 may be connected directly to the airfoil 112 by drilling and pinning the axle 118 to the airfoil 112 upon assembly. Other embodiments may include an opening in the airfoil 112 providing access to the end of the axle 118 within the airfoil 112. With the end of the axle 118 exposed, a bolt may be installed to secure the airfoil 112 to the axle 118. Upon assembly of the axle 118 to the airfoil 112, the opening in the airfoil 112 may be covered using tape or other suitable material. In some embodiments a shim may be installed on the axle 118 between the propulsor 104 and the fuselage 102 to prevent the propulsor 104 from contacting the fuselage 102 during operation of the device 100. Other methods of connecting the airfoil 112 to the axle 118 may include but are not limited using a keyway.

Figure 20:
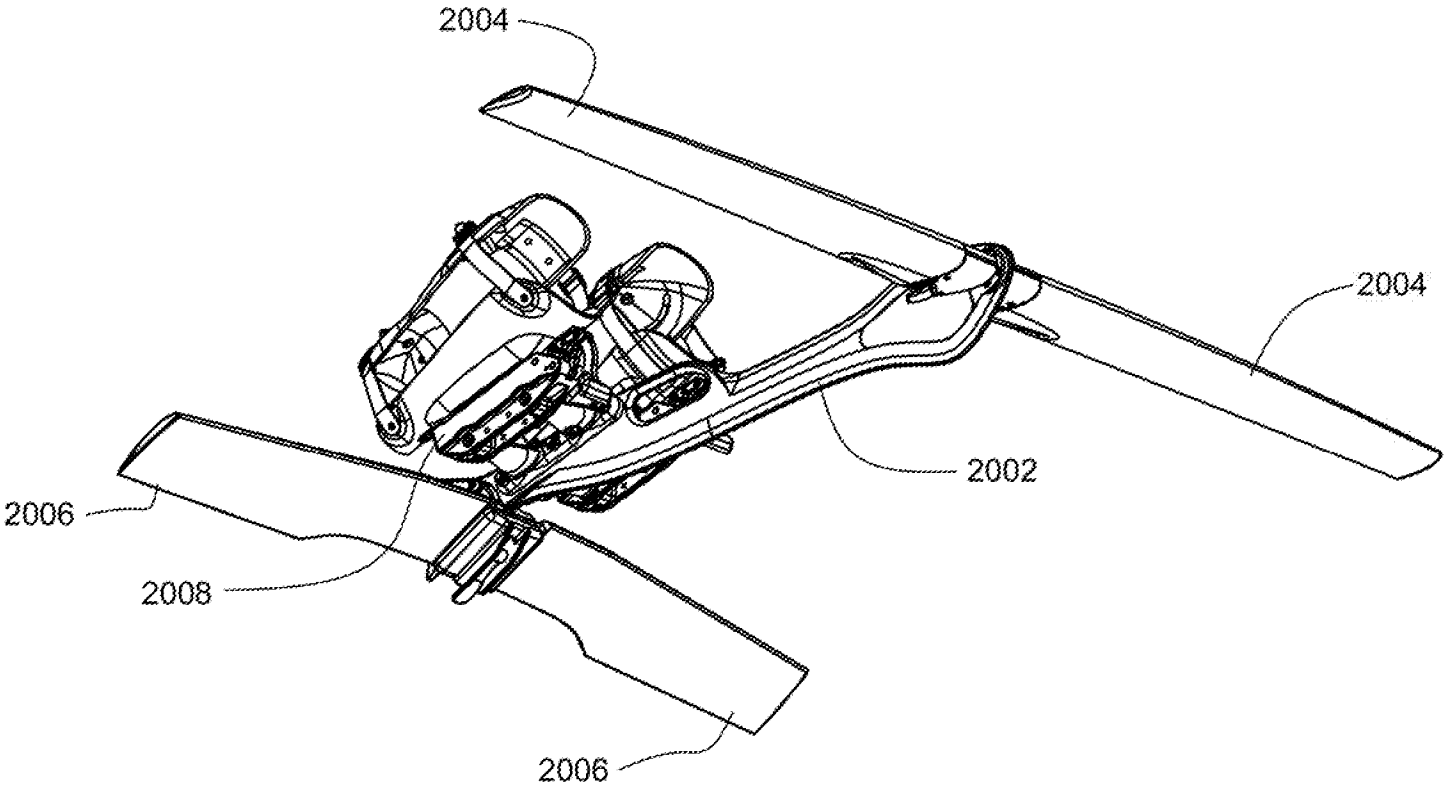
FIG. 20 is a front-bottom perspective view of an embodiment of the swimming propulsion device.
Figure 20A:
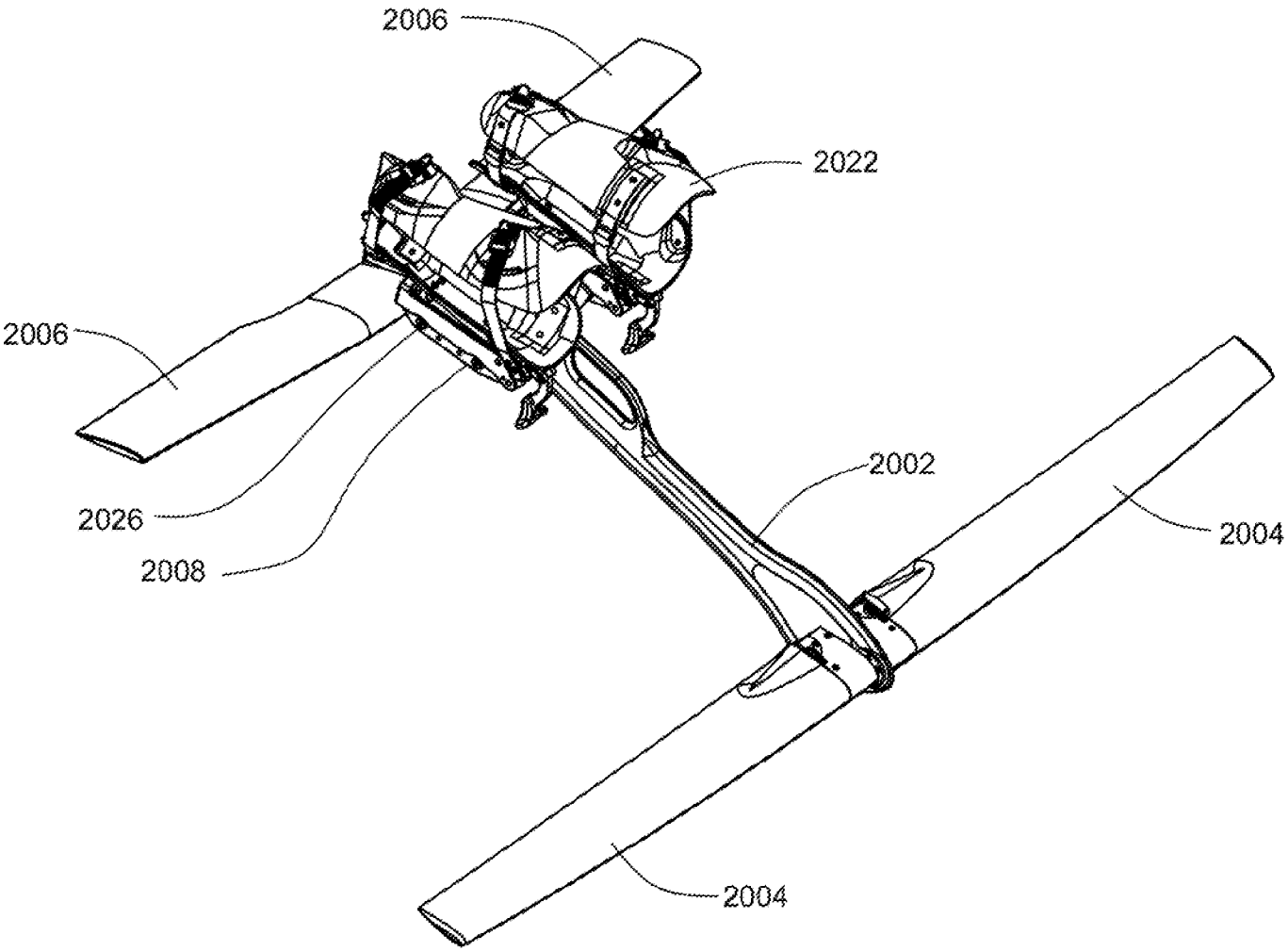
FIG. 20A is a front-top perspective view of an embodiment of the swimming propulsion device shown in FIG. 20.
Figure 20B:
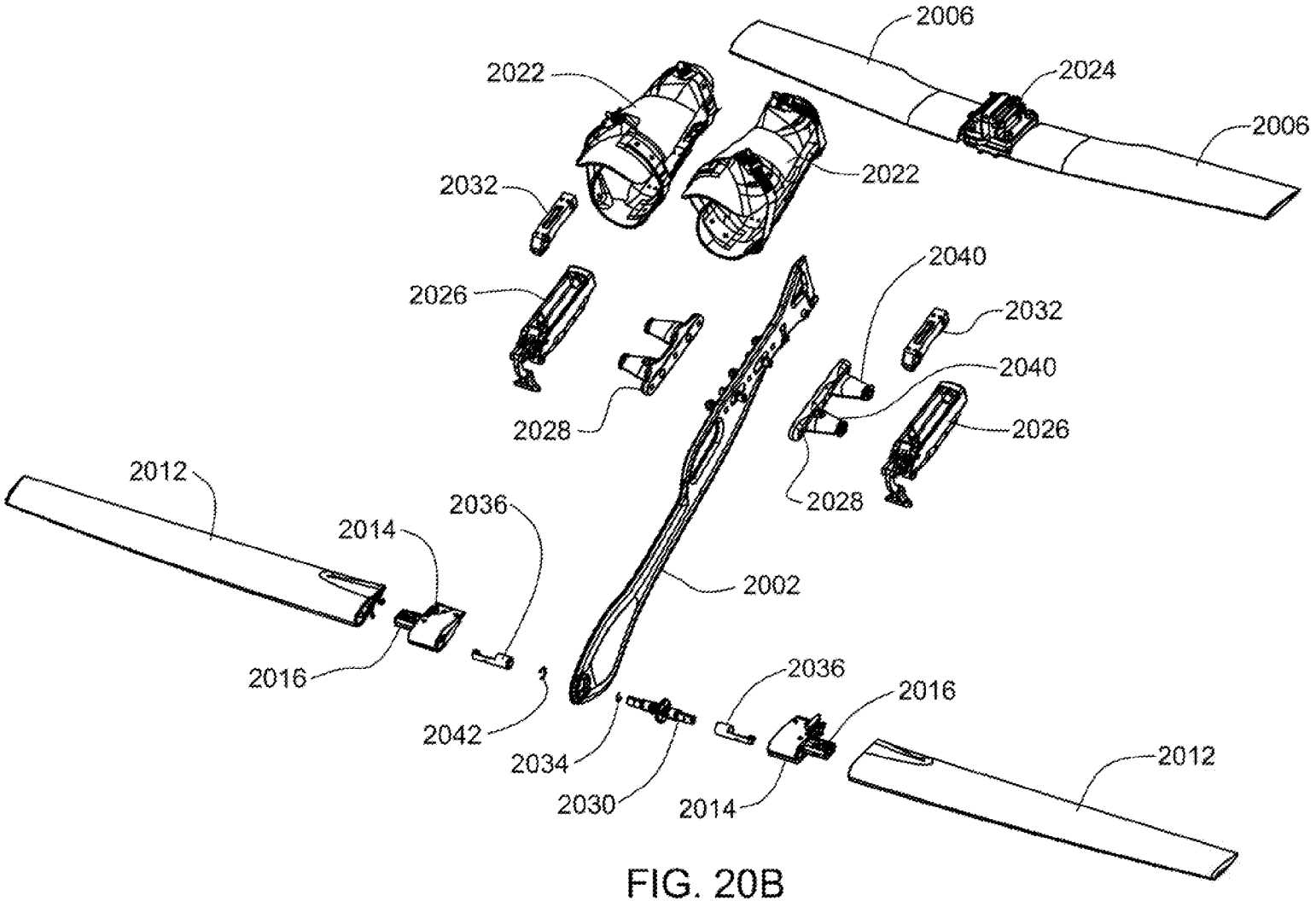
FIG. 20B is an exploded view of an embodiment of the swimming propulsion device shown in FIG. 20.
Figure 20C:
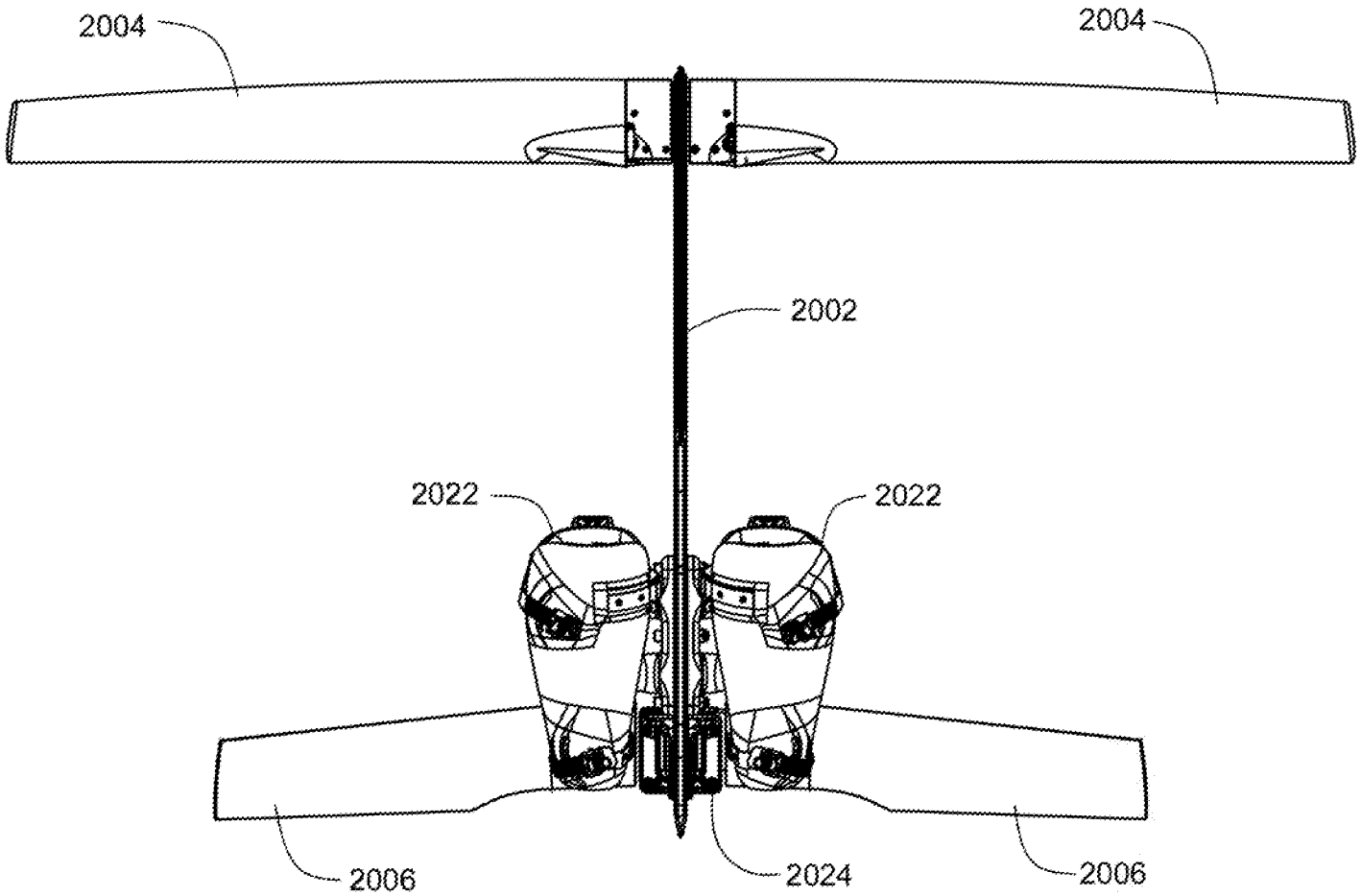
FIG. 20C is a top view of an embodiment of the swimming propulsion device shown in FIG. 20.
Figure 20D:
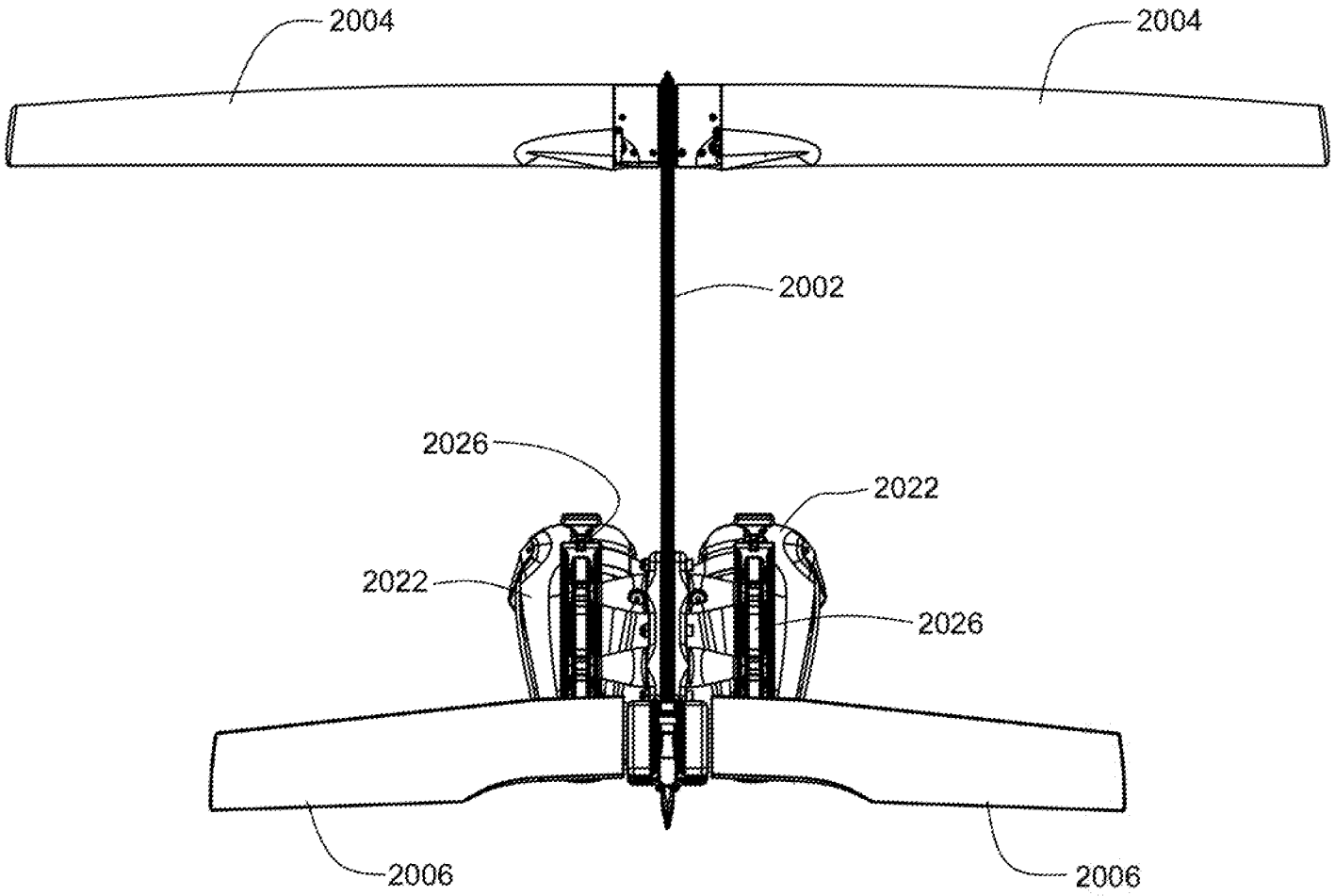
FIG. 20D is a bottom view of an embodiment of the swimming propulsion device shown in FIG. 20.
Figure 20E:
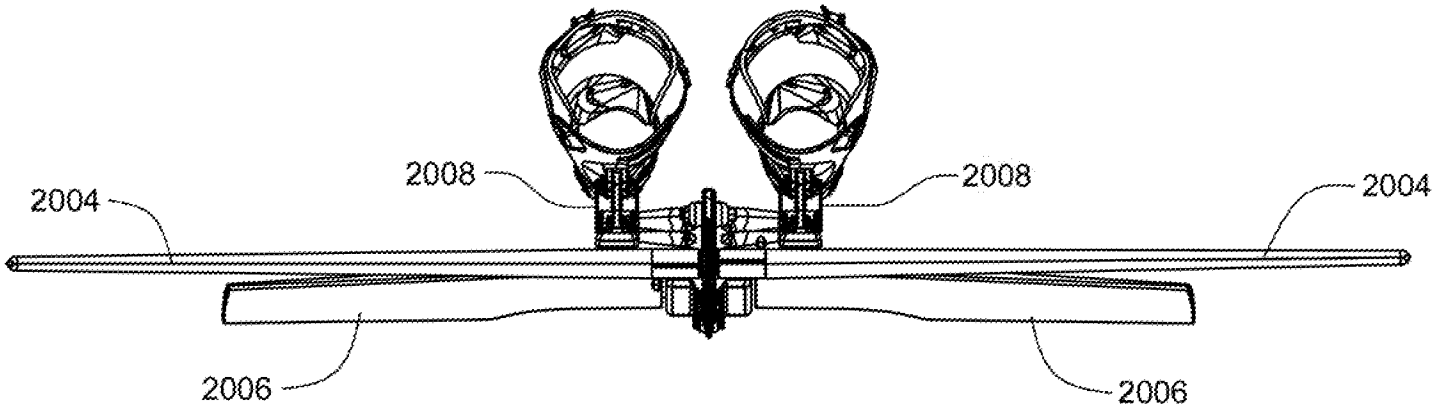
FIG. 20E is a front view of an embodiment of the swimming propulsion device shown in FIG. 20.
Figure 20F:
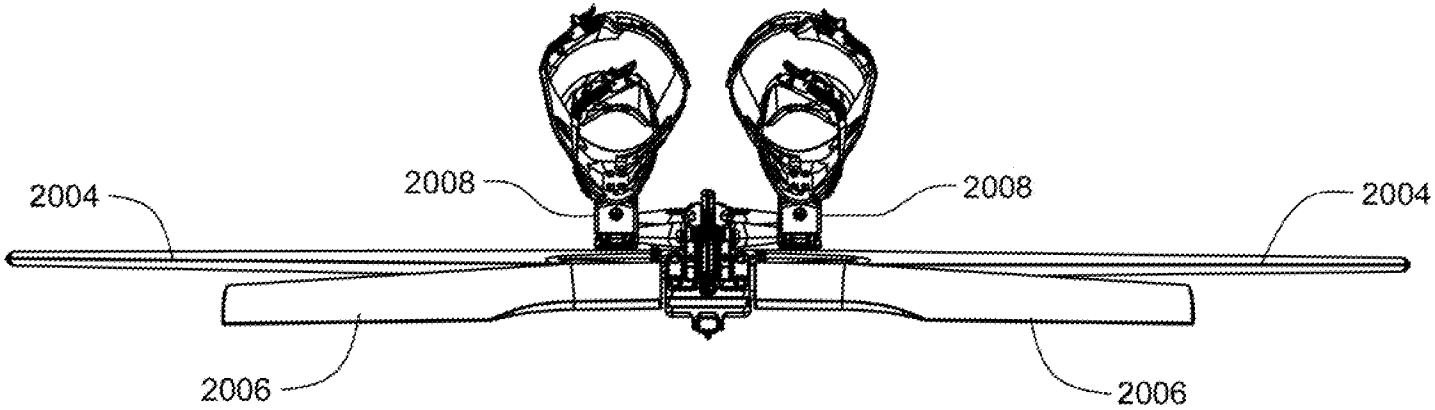
FIG. 20F is a rear view of an embodiment of the swimming propulsion device shown in FIG. 20.
Figure 20G:
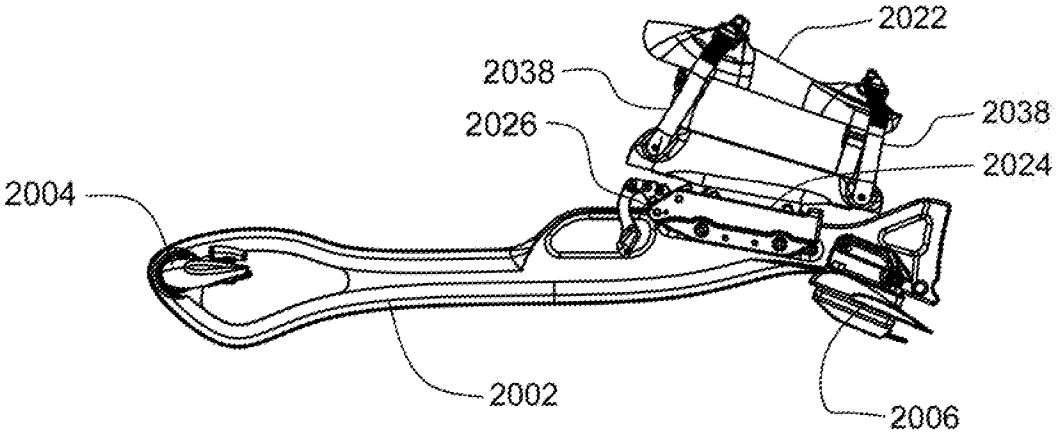
FIG. 20G is a left side view of an embodiment of the swimming propulsion device shown in FIG. 20.
Figure 20H:
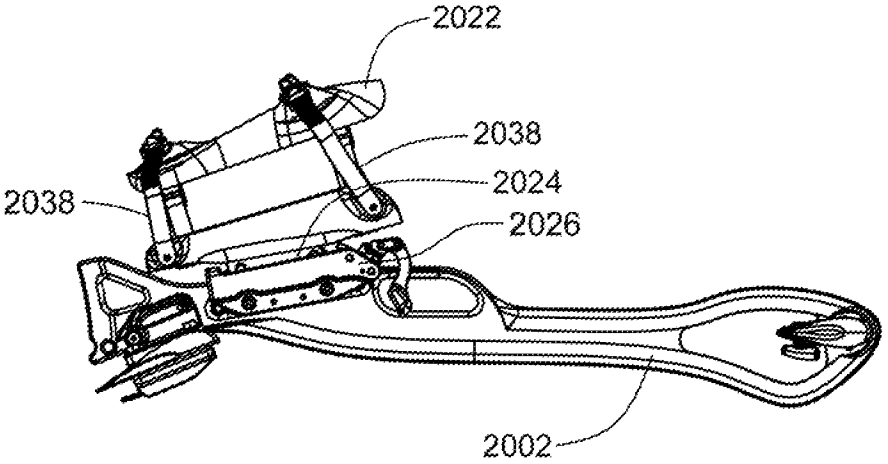
FIG. 20H is a right side view of an embodiment of the swimming propulsion device shown in FIG. 20.
Figure 21:
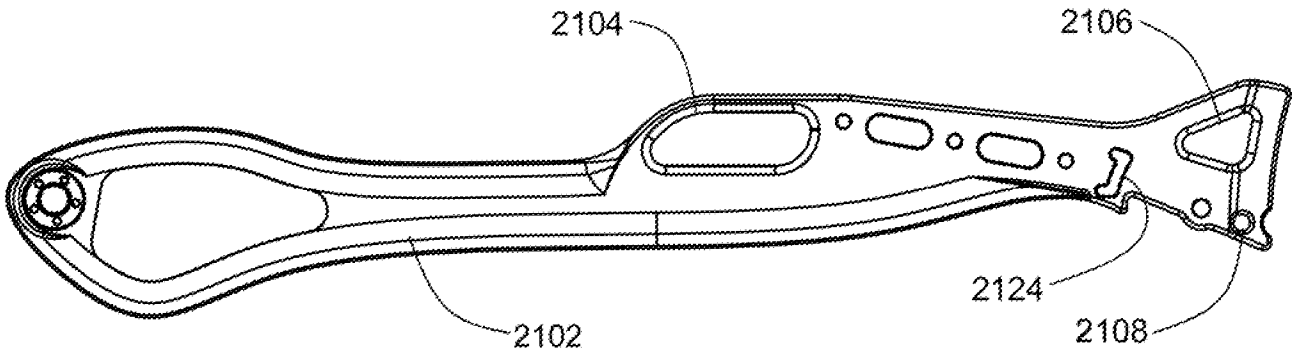
FIG. 21 is a side view of an embodiment of the fuselage.
Figure 21A:
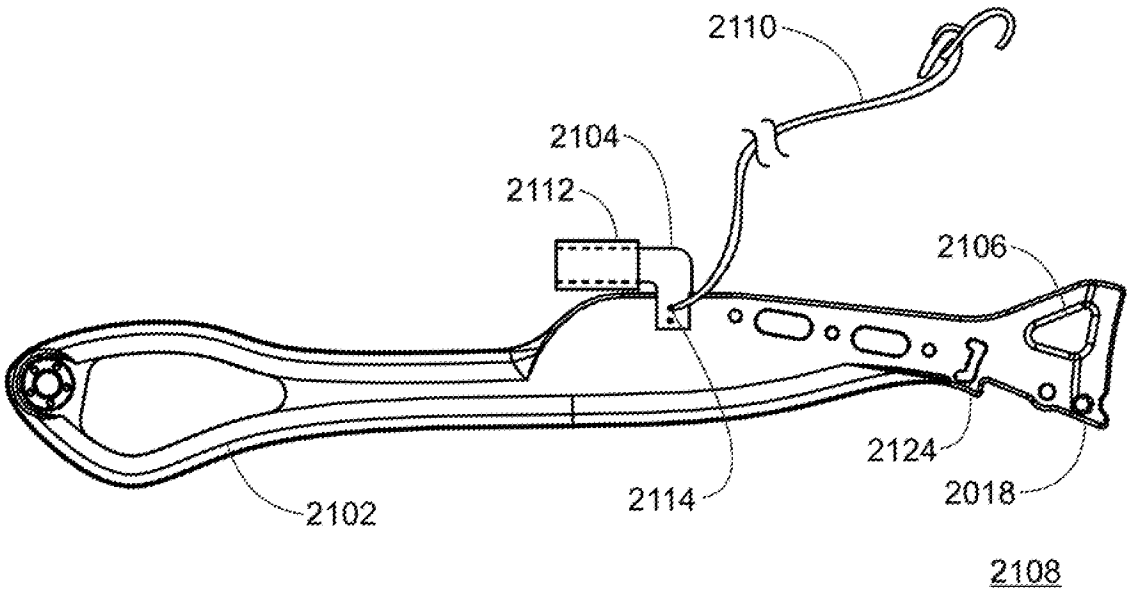
FIG. 21A is a side view of an embodiment of the fuselage.
Figure 21B:
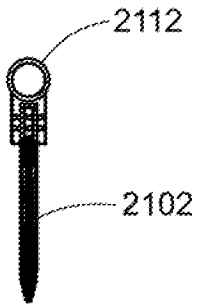
FIG. 21B is a front view of an embodiment of the fuselage.
Figure 21F:
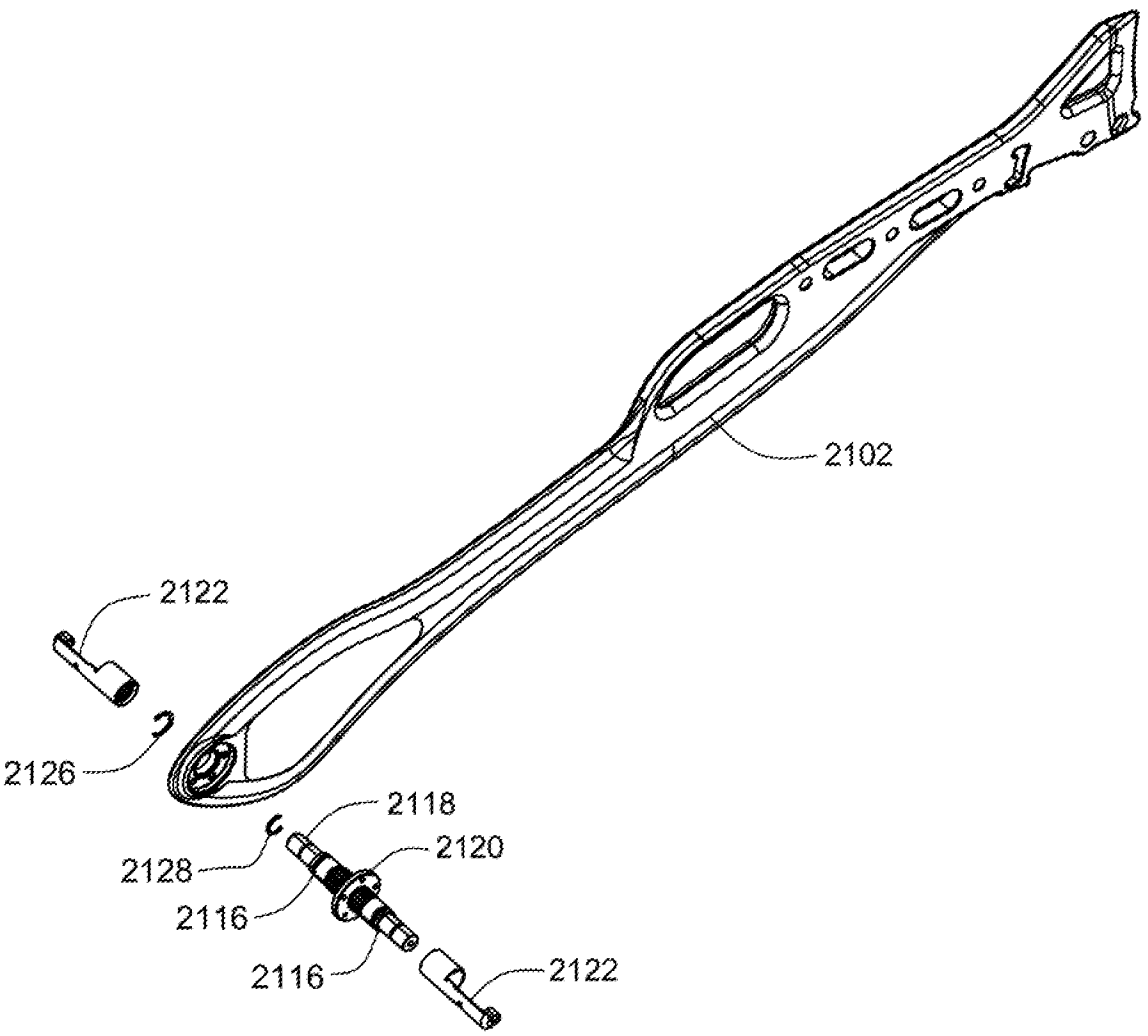
FIG. 21F is a top perspective view of an embodiment of the fuselage including a bushing assembly.
Figure 21G:
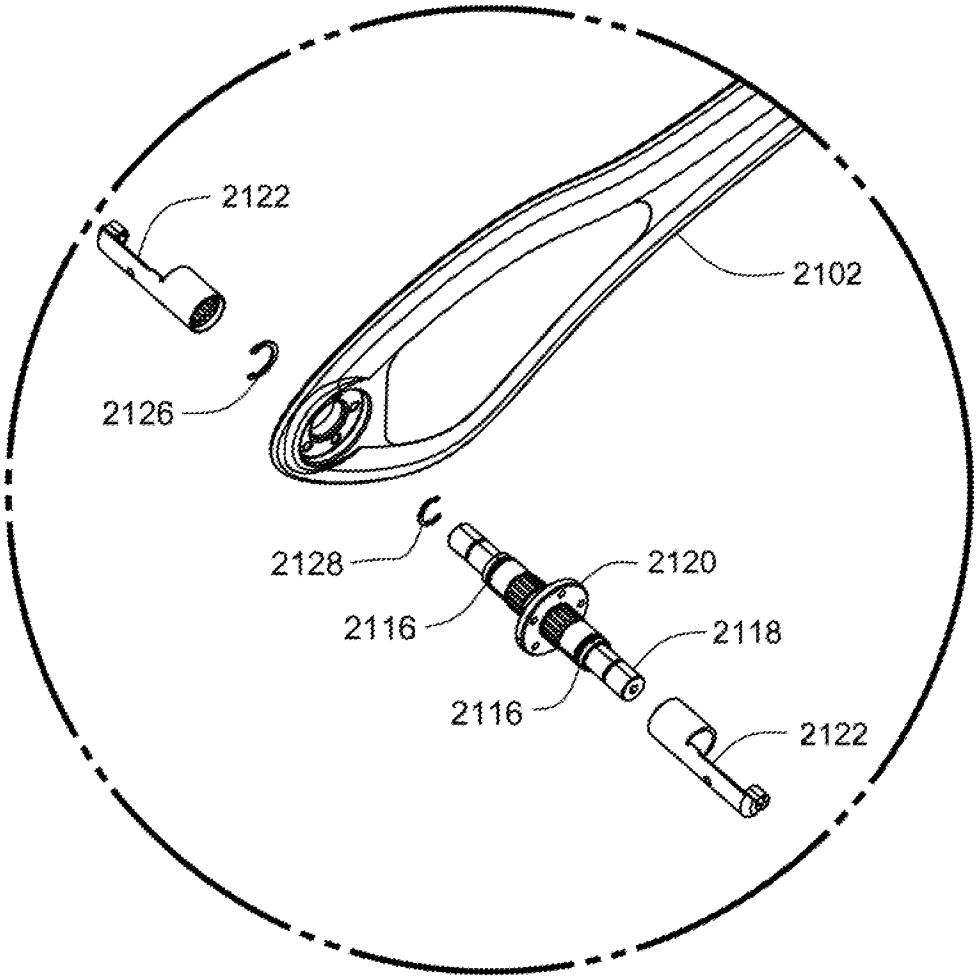
FIG. 21G is a detailed view of an embodiment of the fuselage including a bushing assembly shown in FIG. 21F.
Figure 22:
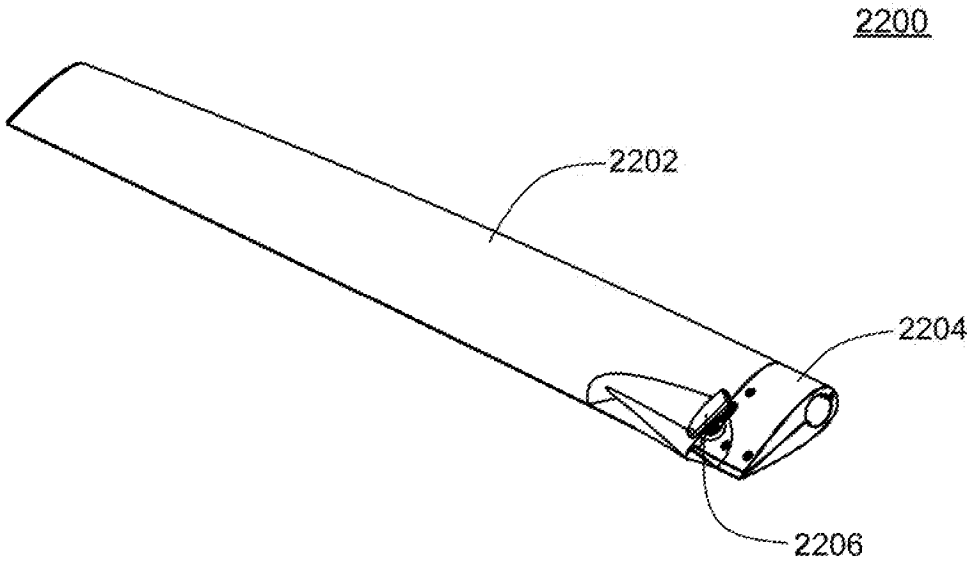
FIG. 22 is a perspective view of an embodiment of a propulsor member.
Figure 22A:
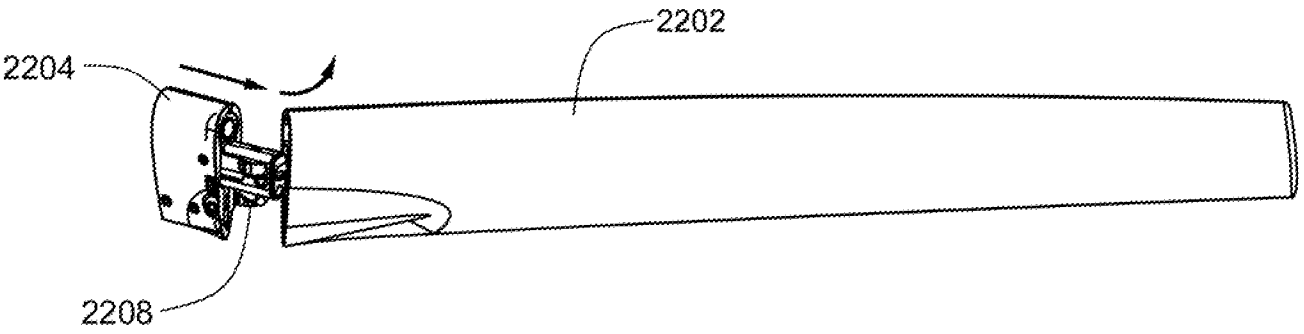
FIG. 22A is a front view of an embodiment of the propulsor having an airfoil in the midst of collapsing.
Figure 22B:
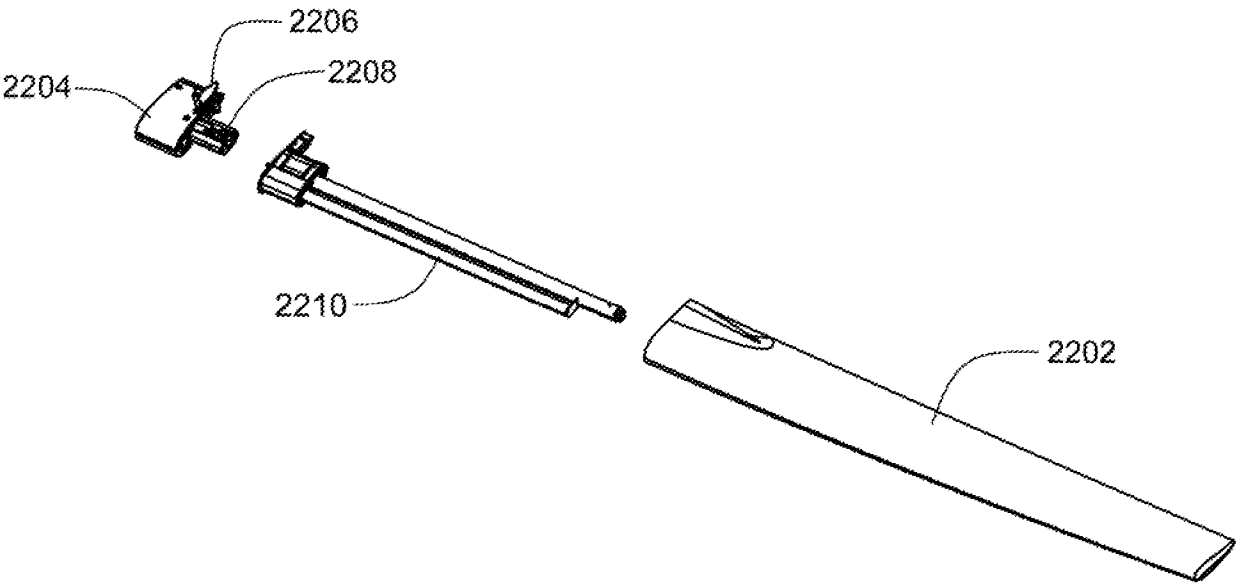
FIG. 22B is a partial exploded view of an embodiment of the propulsor.
Figure 22C:
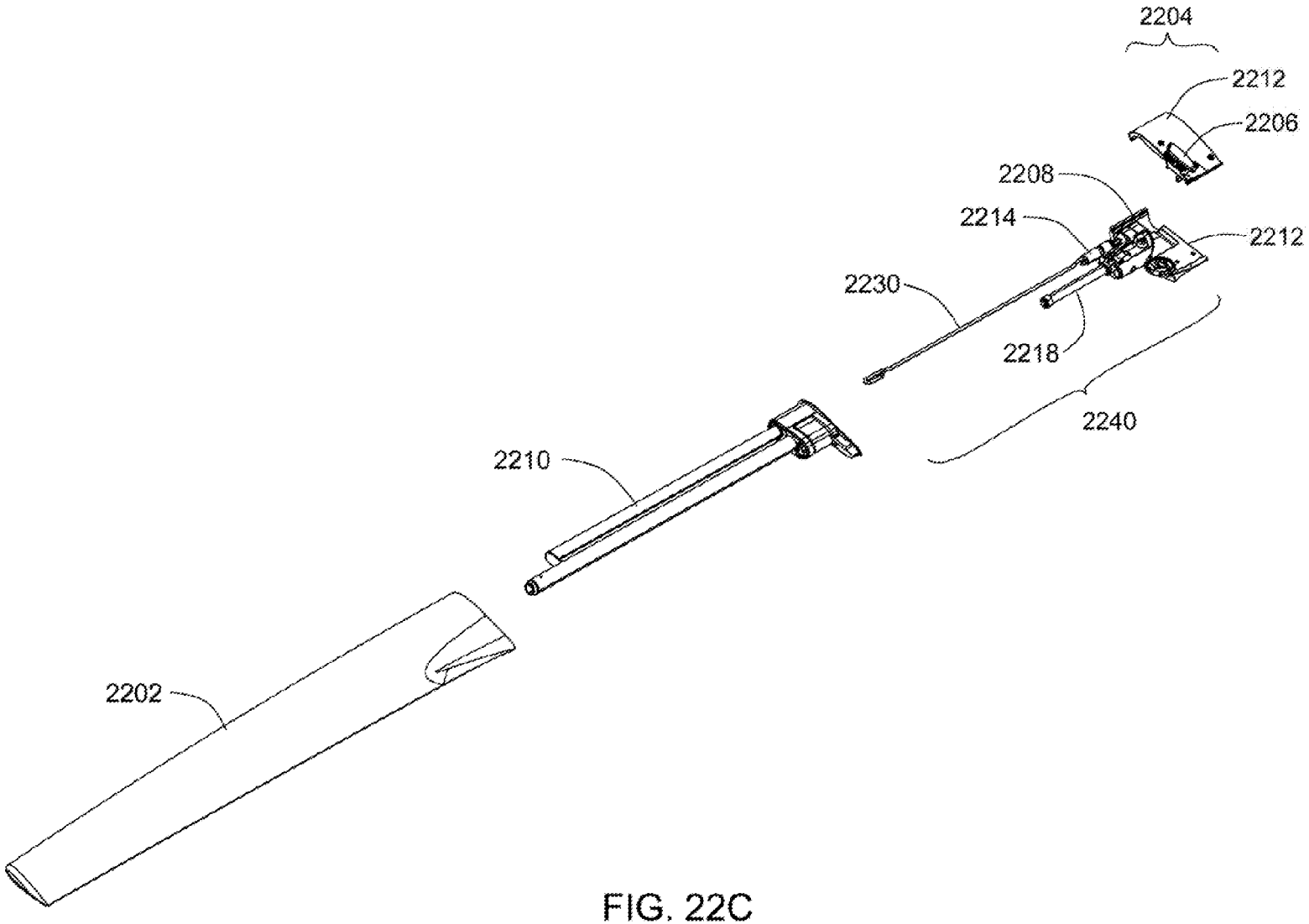
FIG. 22C is an exploded view of an embodiment of the propulsor.

Referring to FIGS. 20-20H and FIG. 21G and additionally FIG. 22C, one embodiment of the swimming propulsion device 2000 is shown. For the purposes of this description, the embodiment shown in FIGS. 20-20H, will be referred to as another exemplary embodiment. Other embodiments are contemplated some of which will be discussed herein. The swimming propulsion device 2000 may include but is not limited to a fuselage 2002 having a forward section, a middle section and an aft section. The terms "forward section" "middle section" and "aft section" are used for ease of description. Attached to the forward section of the fuselage 2002 may be at least one propulsor 2004. The propulsor 2004 may include but is not limited to an airfoil 2012, propulsor connector 2014, and a bushing assembly 2030. The bushing assembly 2030 may include, but is not limited to, at least one bushing 2116, an axle 2118, and a bushing housing 2120. In another exemplary embodiment the bushing housing 2120 may be made of anodized aluminum however any coating to make the bushing housing 2120 resistant to corrosion may be used. Similarly, at least one stabilizer 2006 may be attached to the rear of the fuselage 2002 using a stabilizer folding mechanism 2024. Also affixed to the aft section of the fuselage 2002 may be an attachment mechanism 2008. This attachment mechanism may include but is not limited to cuffs 2022, cleats 2032, locking mechanisms 2026, and mounting brackets 2028.

Figure 22D:
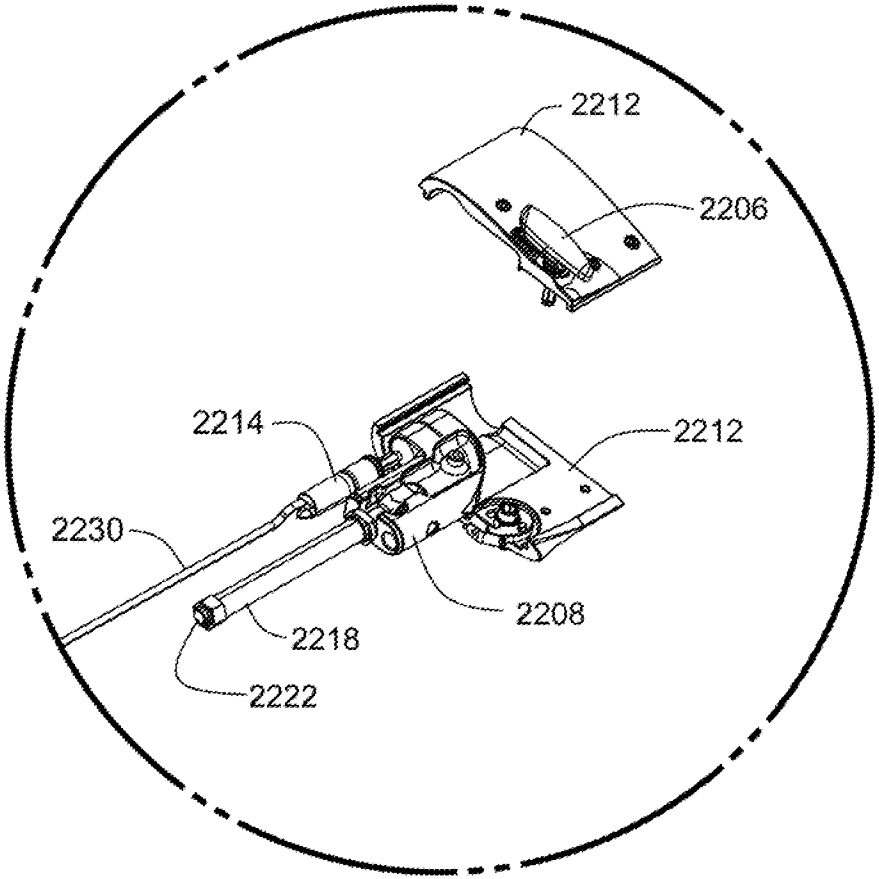
FIG. 22D is a detailed view of the exploded view of an embodiment of part of the propulsor member.
Figure 22E:
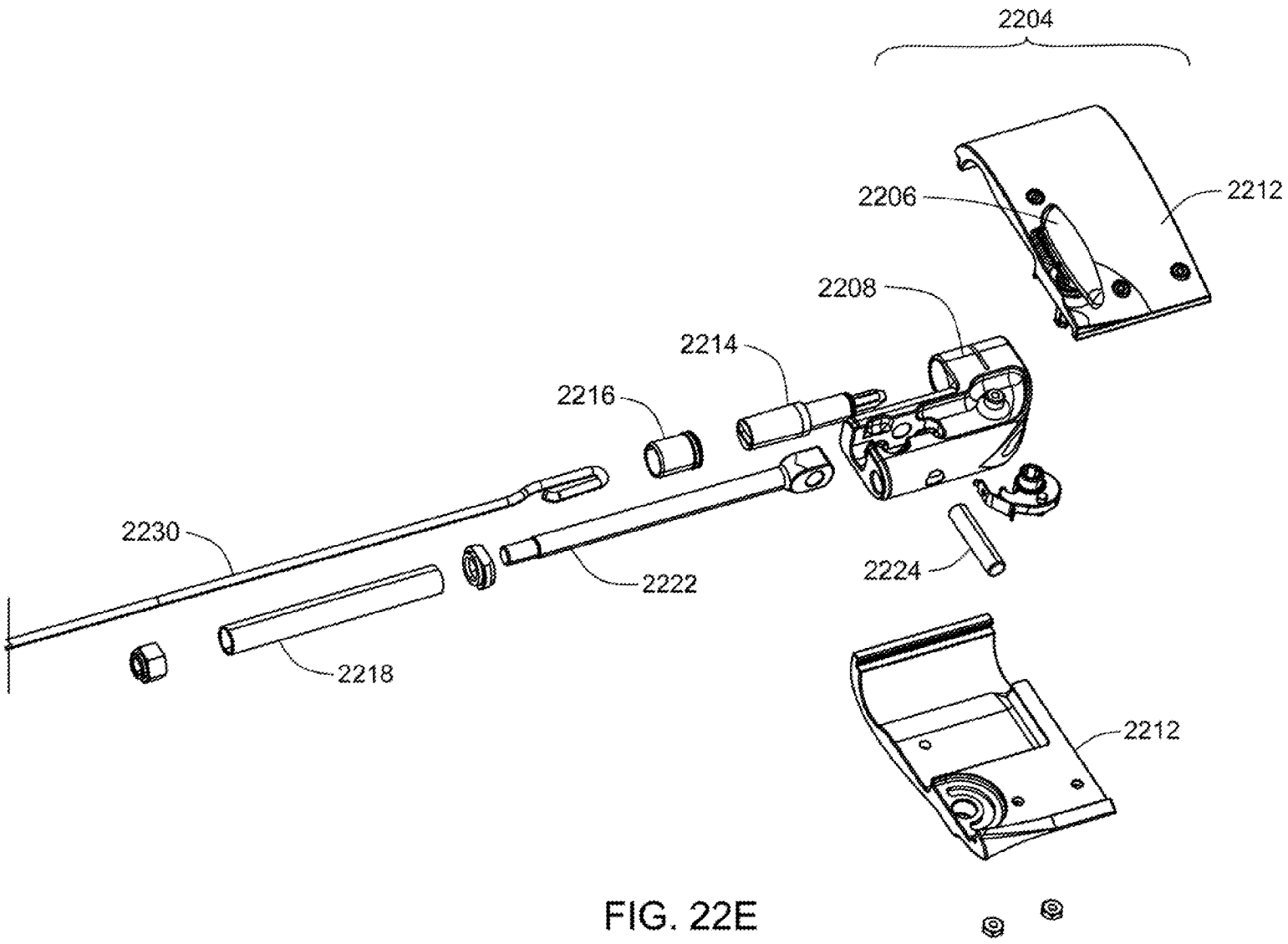
FIG. 22E is an enlarged detailed view of the exploded view of an embodiment of part of the propulsor member.

Furthermore, a control mechanism 2240, as shown in FIGS. 22C-E, may be within the airfoil 2012 and connected to the propulsor connector 2014. The control mechanism 2240 as shown in FIGS. 22C-F, may include but is not limited to a torsion bar 2230, a hex piece 2214, and a torsion bar anchor 2220.

Also referring to FIGS. 20-20H and FIG. 21G, in operation, in one embodiment of the device, the swimmer bends primarily at the knees with some contraction at the hips, forcing the propulsors 2004 away from the body while being counteracted by the presence of the stabilizers 2006, in a hybrid kicking/squatting motion. The force of this motion is transferred to the propulsors 2004 and drives the propulsors 2004 through the water in a downward motion. The swimmer then straightens their legs forcing the propulsors 2004 in an upward motion against the resisting water. Given the constrains to the range of motion provided by the torsion bar anchor 2122 in the control mechanism 2014 and the bushing assembly 2030, the propulsors 2004 take an optimum angle of attack with respect to their allowable movement. The torsion bar anchor 2122 may prevent the airfoil 2012 from twisting beyond the optimum angle of attack. This angle of attack allows the propulsors 2004 to generate lift, which is then transferred to forward motion of the swimmer. As the swimmer continues this oscillating movement, a fishtail-like movement is created that propels the swimmer through the water.

Still referring to FIGS. 20-20H, and additionally FIG. 21G, in another exemplary embodiment, the propulsor connector 2014 may be rotatably connected to the forward section of fuselage 2002 using an axle 2118. The axle 2118 may be positioned within the bushing housing 2120. The propulsor connector 2014 may be connected to the first propulsor member 2012 using a root block 2016. The root block 2016 may contain a keyway (not shown). The propulsor connector 2014 may be attached to the axle 2118 using the keyway and at least one c-clip 2126,2128. The axle 2118 may contain a torsion bar anchor 2122 to be received by the keyway in the root block 2016. In the exemplary embodiment, the axle 2118 may have a diameter sufficient to be received within the bushing housing 2120 and not adversely affecting the radius of the airfoil-shaped propulsor 2004.

Fuselage

The fuselage provides the central element to the swimming device and is the structure in which the additional elements of the swimming device are attached, at least indirectly, including, but not limited to, the cuffs, stabilizer and propulsor. Additionally, the fuselage serves as the element of the swimming device which allows for power, from the swimmer, to be transferred to the propulsor, to propel the swimmer and the device through the water.

The design of the fuselage, as well as the attachment of the various elements may vary in various embodiments. Some embodiments of the design of the fuselage may accommodate particular intended uses of the device, or the size of the intended user. However, these may not be the only factors in the fuselage design.

The fuselage may be any length desired. Some factors taken into consideration when determining the length of any embodiment of the fuselage include weight. Where weight is a concern, the fuselage may be sized accordingly. However, in some embodiments, where a longer fuselage, and therefore, heavier fuselage is used, this would require other components of the swimming propulsion device to be correspondingly more buoyant. Weight may also be an issue for another reason. Since the swimming device is portable, a higher weight may make the device more difficult to carry.

Another consideration with respect to the length of the fuselage is efficiency, i.e., the swimming device, in the exemplary embodiments, is designed to increase swimming efficiency (i.e., allow the swimmer to travel faster and further using less oxygen/energy). A longer fuselage can be more efficient and produce higher swimming velocities.

With respect to length, the fuselage length will dictate the arc of the stroke for the swimmer. A shorter fuselage will provide a smaller arc. A longer fuselage will provide a larger arc, which may be desired for higher swimming efficiency. However, in some embodiments, the desired efficiency may be mitigated against the desire for a particular length to accommodate an object held by the swimmer, for example, a front mounted Draeger under water breathing system (herein referred to as "a Draeger").

Figure 2:
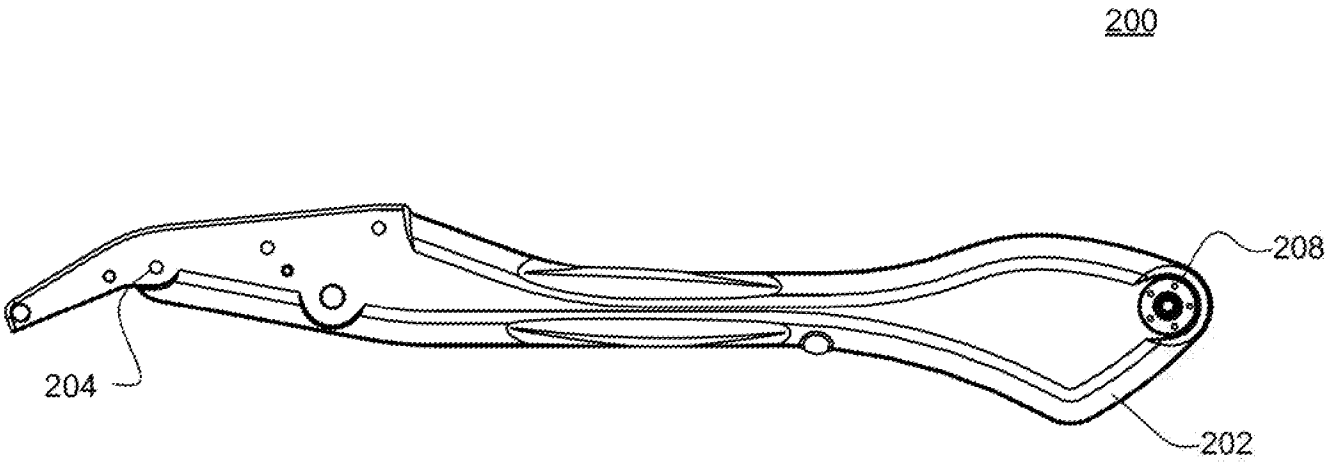
FIG. 2 is a side view of the exemplary embodiment of the fuselage.
Figure 2A:
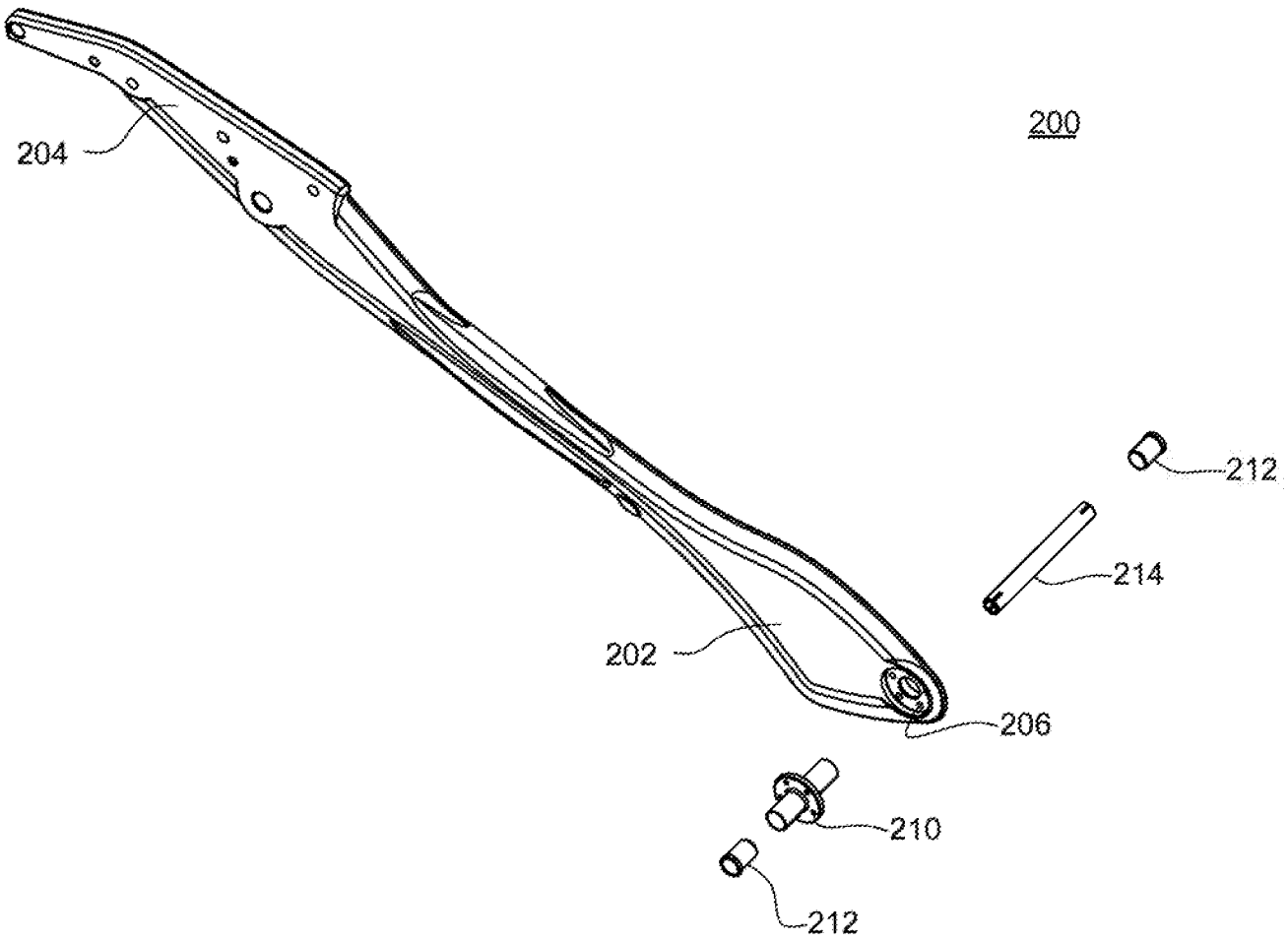
FIG. 2A is a perspective view of the exemplary embodiment of the fuselage.

Referring now to FIGS. 2-2A, these figures illustrate a fuselage 200 (also identified as 102 of FIG. 1) of the exemplary embodiment of the swimming propulsion device 100. The fuselage 200 may have a forward section 202 and an aft section 204. In the exemplary embodiment the center of the aft section 204 may be located on a different horizontal plane than the center of the forward section 202. The different orientations of the forward section 202 and the aft 204 may not be required in all situations, but under some circumstances the different horizontal planes may be desirable. Some embodiments of the fuselage may be designed to accommodate an object to be worn or carried by a swimmer of the device. Some object may run along the length of the body, such as a Draeger. In these embodiments, the fuselage design allows the swimmer to fully operate the device 100 without interference from the object that the swimmer is carrying. In other embodiments, the fuselage 200 may include an angular section to position the forward end 202 away from the operator of the device 100. Similarly, in an alternate embodiment the fuselage 200 may include a slight offset along the length of the fuselage.

The shape of the fuselage may vary in the various embodiments. The shapes described herein are meant as exemplary embodiments. Other shapes and designs are considered as any shape that may accommodate the intended use are possible. Still referring to FIGS. 2-2A, in the exemplary embodiment, the forward section 202 of the fuselage 200 may have an arrow shape to reduce drag and water turbulence. Similarly, in alternate embodiments the forward section 202 may be wedge-shaped to improve the operation of the swimming propulsion device 100 through the water. In yet another embodiment the front section of the fuselage 202 may be larger than the aft section 204 to reduce water resistance during operation of the device 100. In still other embodiments of the swimming propulsion device the fuselage 200 may have a uniform shape and/or thickness.

Apertures may be included in the fuselage. These apertures may vary in size, plurality and location, depending on a number of factors, including but not limited to, intended use of the device. Still referring to FIGS. 2-2A, in the exemplary embodiment, an aperture 206 may be located within the forward section 202 of the fuselage 200 to receive propulsors 104. The aperture 206 may be at any location within the fuselage, but in the exemplary embodiment, the aperture is preferably positioned near the forward edge of the fuselage 200. This position allows the swimmer to obtain increased propulsor travel causing larger lifting force to act on the device 100. In the exemplary embodiment the aperture 206 may be any size sufficient to support installation of the bushing assembly 208.

As discussed above, the fuselage serves as a central connecting point for other elements of the device including the cuffs, stabilizer and propulsors. The connection to the fuselage may vary for various elements, and throughout various embodiments. In the exemplary embodiment shown in FIGS. 2-2A, the propulsor installation or connection to the fuselage is supported by a bushing assembly. However, in various other embodiments, another type of assembly or connection may be used.

Still referring to FIGS. 2-2A, in the exemplary embodiment the aperture 206 may contain a bushing assembly 208 to support the installation of the propulsors (not shown, shown in FIG. 1, 104). The bushing assembly 208 may consist of but is not limited to a bushing housing 210 for slidably receiving at least one bushing 212. The housing 210 may be attached to the forward section 202 of the fuselage using fasteners. In addition, the housing 210 may be manufactured from but not limited to nickel-plated aluminum. Positioned within the bushing housing 210 may be at least one bushing 212 for slidably receiving the axle 214 supporting the propulsors 104. The bushing 212 may be manufactured from plastic. In the exemplary embodiment a bushing 212 is located within each end of the bushing housing 210. Furthermore, the axle 214 may be manufactured from but not limited to stainless steel, titanium or carbon steel. In other embodiments, a bearing assembly may be installed within the forward section 202 of the fuselage 200 to support the axle 214 rather than the bushing assembly 208.

The length of the fuselage 200 may vary. However, in the exemplary embodiments, the fuselage 200 has sufficient length to provide adequate thrust to propel the device 100 through the water. Still referring to FIGS. 2-2A, in the exemplary embodiment, the fuselage 200 may have a length of 27 inches. In addition, the edges of the fuselage 200 may be tapered to facilitate movement through the water and in particular the edges of the forward section 202 where velocities are greatest.

Still referring to FIGS. 2-2A, the fuselage 200 may be manufactured from any material, but material characteristics of low water absorption, structural strength, and lightweight are desirable. In the exemplary embodiment the fuselage 200 is manufactured from G10/FR4 plastic. Other materials may be used to manufacture the fuselage 200 including but not limited to Garolite, fiber reinforced plastic, wood-plastic composite, or other similar material.

Figure 2B:
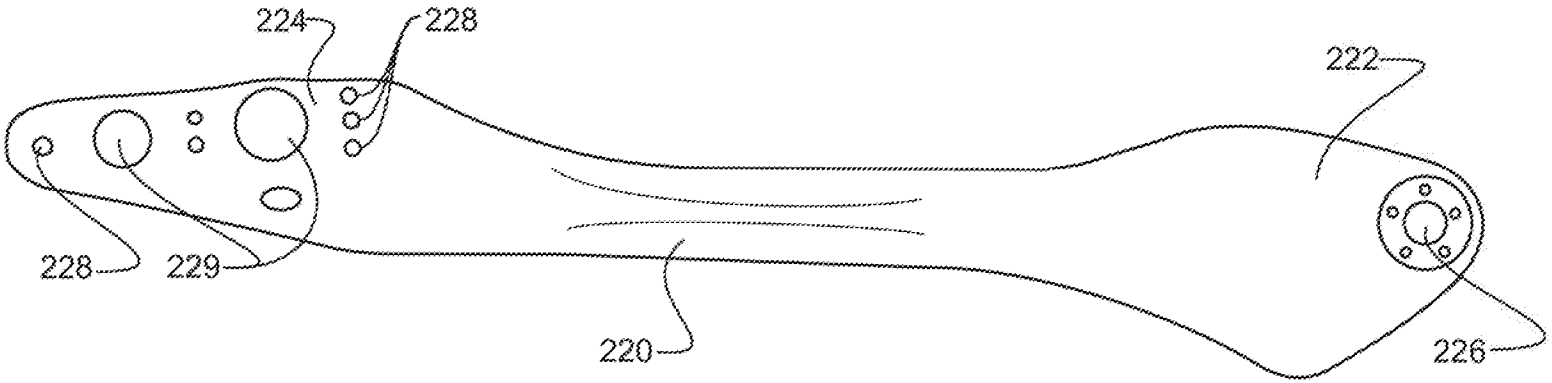
FIG. 2B is a side view of an alternate embodiment of a fuselage.

Now referring to FIG. 2B, another embodiment of the fuselage is shown. This embodiment of the fuselage 220 may have a forward section 222 and an aft section 224 similar to the previously described embodiment. In addition, the forward section may also include an aperture 226 for receiving a bushing or bearing assembly. The fuselage 220 may include a plurality of apertures 228 for adjusting, for example, the position of the fuselage 220 with respect to the attachment mechanism 108 allowing the swimmer's lower legs to be planar with the swimmer's body. In other embodiments the attachment mechanism may not be adjustable.

As discussed above, various modifications to the fuselage may be made to impart a variety of characteristics. For example, variations to decrease the weight or make the fuselage more suited to a desired use. In one embodiment shown in FIG. 2B, the fuselage 220 may also include additional apertures 229. These apertures may be added to reduce the weight of the device 100. The apertures 229 may be located any where in the fuselage, but the apertures are preferably located near the ends of the fuselage 200 where the bending stresses in the fuselage are smaller. In further embodiments, the apertures 229 may be covered to reduce drag as the water flows passed the fuselage 200. Coverings may include but are not limited to tape. In yet other embodiments the covering may be fiberglass or carbon fiber material attached to the fuselage 200 with an epoxy. In still further embodiments, the apertures 229 may be filled with foam before installing the covering. The installation of foam material may increase the buoyancy of the device 100. In such an embodiment the foam material may be but is not limited to a closed-cell foam. In other embodiments having no material within the apertures 229, the covering material may form a seal to prevent water from filling the covered apertures 229 adversely affecting the buoyancy of the device 100.

Again, as described above, the shape of the fuselage may vary depending on the desired characteristics. The shape may include, for example, an "L" shape. Now referring to FIG. 2C, one embodiment of an alternate shaped the fuselage 230 may be L-shaped. This fuselage configuration may allow a swimmer to carry an object on their chest and/or mid-section of the body without impeding the swimmer's ability to fully operate the device 100. Similar to previous embodiments, the fuselage 230 may have a forward section 232 and an aft section 234. The forward section 232 may have an aperture 236 for receiving a bushing or bearing assembly. In addition, similar to the previous embodiment the fuselage 230 may include a plurality of apertures 238 for reducing the weight of the device 100.

Figure 2C:
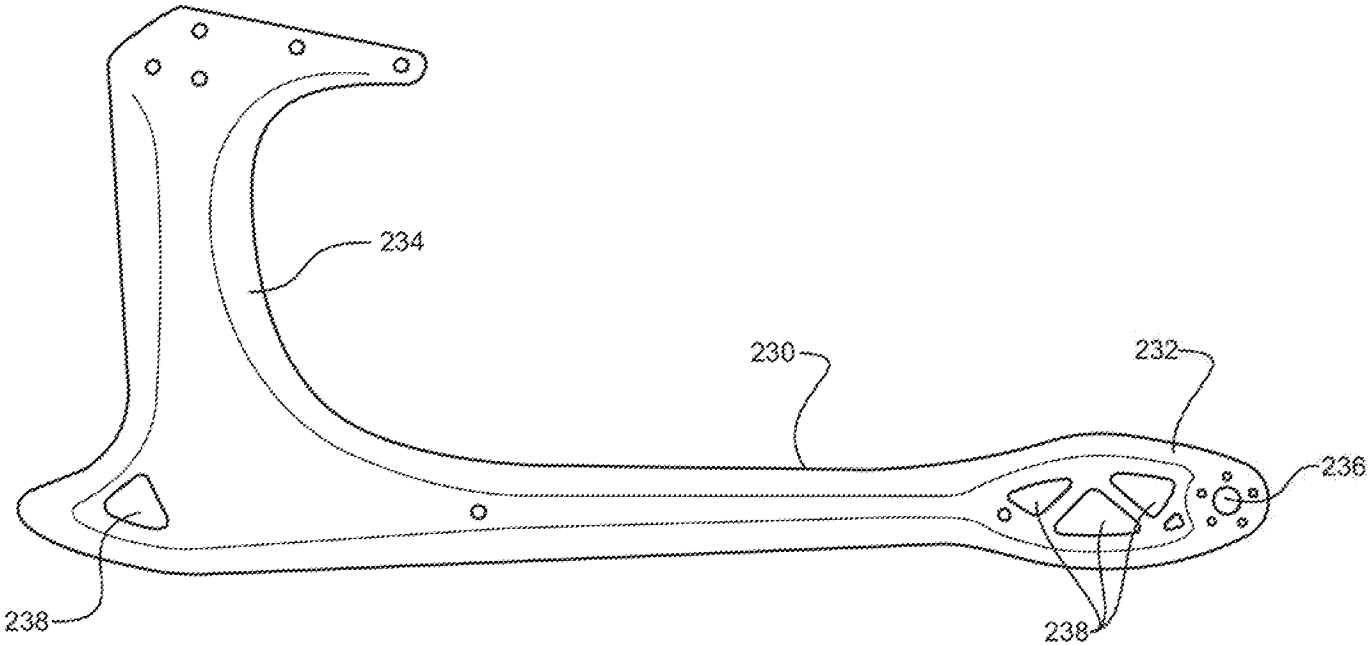
FIG. 2C is a side view of an alternate embodiment of fuselage having an L-shape.

Referring to FIGS. 2-2C, alternate embodiments may include a fuselage having a tow hook. Typically, the tow hook may be attached to the aft section of the fuselage. In other embodiments, however, the tow hook may be attached to the attachment mechanism 108 to maintain stability of the device 100. The tow hook may be used to attach objects, such as bags or other equipment, to the propulsion device 100. Some examples of a tow hook include but are not limited to a loop, hook or a carabiner. In some embodiments the tow hook may also be removable.

Figure 2D:
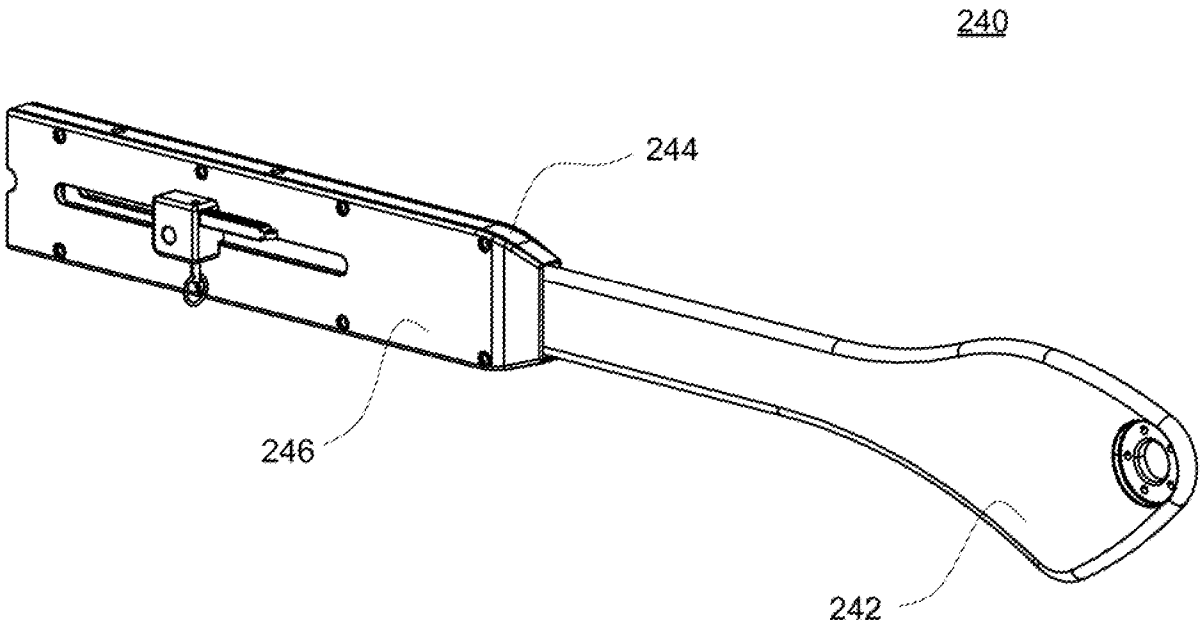
FIG. 2D is a perspective view of one embodiment of an adjustable-length fuselage.
Figure 2E:
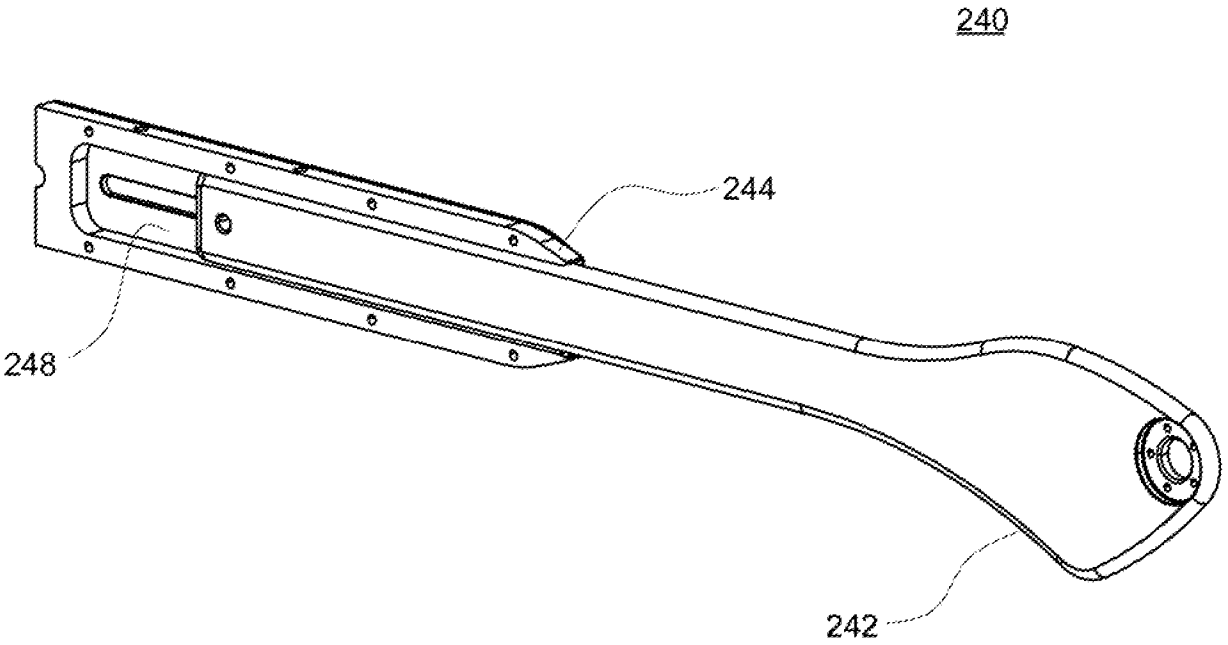
FIG. 2E is a perspective view of the fuselage shown in FIG. 2D with one side member removed.
Figure 2F:
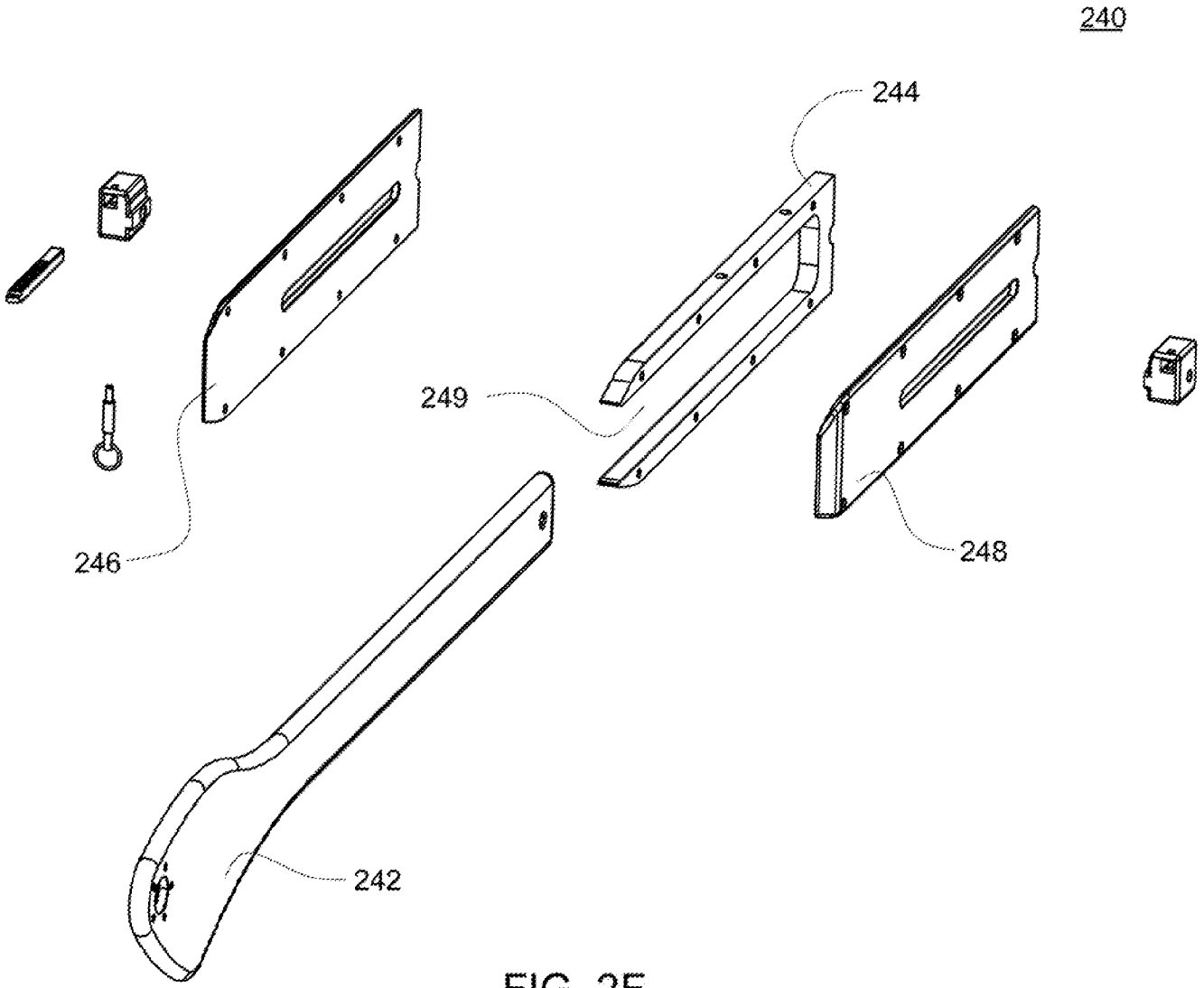
FIG. 2F is an exploded view of one embodiment of an adjustable-length fuselage.

The fuselage, in some embodiments, may include features that allow for adjustability of the length. One such embodiment is shown in FIGS. 2D-F. This embodiment is one embodiment of an adjustable fuselage. An adjustable fuselage may be included on the swimming propulsion device. In the adjustable embodiment shown, fuselage 240 may include but is not limited to a forward member 242, an aft member 244, a first side member 246 and a second side member 248. The aft member 244 may have a channel 249 for slidably receiving the aft end of the forward member 242. In this embodiment the aft end of the forward member may have a slightly smaller width when compared to the front end of the forward member 242. Upon positioning the forward member 242 at a desired location within the channel 249, the side members 246 and 248 secure the forward member 242 in position by clamping the forward member 242 between the two side members 246 and 248. In this embodiment, the side members 246 and 248 may be attached using fasteners. However, in various other embodiments, the side members 246 and 248 may be attached using other methods.

Figure 2G:
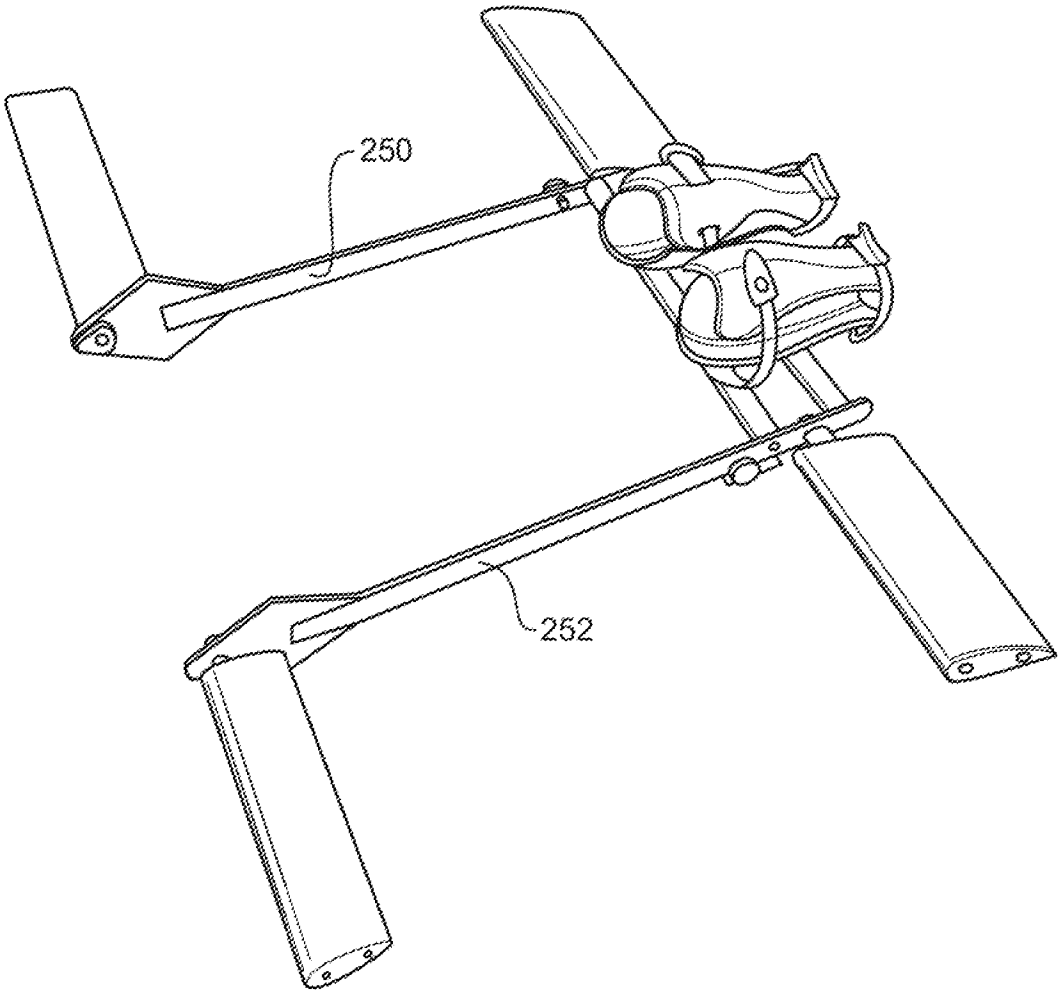
FIG. 2G is a top perspective view of one embodiment of the swimming propulsion device with a split fuselage.

Referring now to FIG. 2G, another embodiment of the fuselage is shown. In this embodiment, the fuselage includes two members, a first fuselage member 250 and a second fuselage member 252. The two fuselage members 250, 252 in the configuration as shown form a split-body fuselage that allows for the swimmer to be positioned between the two members 250, 252. This embodiment may be desirable for the purpose of positioning the swimmers such that they can carry a Draeger, for example, in front of them as they swim.

Now referring to FIGS. 21-21G in another exemplary embodiment, the fuselage 2102 may have a rounded arrow shape for a sleek look and to reduce drag and water turbulence. The fuselage 2102 may be smooth and also narrow as the sides meet. In one embodiment of this embodiment, the fuselage 2102 may have a forward section and an aft section. The fuselage 2102 may have a top edge and bottom edge. In another exemplary embodiment, the fuselage 2102 may have a handle 2104 to facilitate ease of carrying the device. The handle 2104 may be located towards the aft section of the fuselage 2102 and it may be on the top edge of the fuselage 2102. In other embodiments the handle 2104 may be in situated in different regions of the fuselage 2102. The handle 2104 may be an external member having a hand piece 2112, as shown in FIG. 21A. The hand piece 2112 may be removable and, in some embodiments, the hand piece 2112 may be the sheath of a dive knife (not shown). In another exemplary embodiment, the handle 2104 may alternately be part of the fuselage 2102 wherein the fuselage 2102 extends further above the device 2000 with a section removed from which a swimmer may hold and carry the device 2000, as shown in FIG. 21. This fuselage 2102 extension handle 2104 may prevent debris from entering the cervix of the handle 2000.

Still referring to FIGS. 21-21G and additionally FIG. 20 because weight is a concern and the swimmer may want the fuselage 2102 slightly longer but not want the increased weight, some embodiments may include a shark fin aperture 2106, wherein this shark fin aperture 2106 removes weight from the fuselage 2102 therefore making the device 2000 easier to carry and maintain a favored buoyancy. This shark fin 2106 is a large aperture strong enough to support equipment that may be attached and therefore may be used as a towing feature in some embodiments. Another exemplary embodiment may contain a circle aperture 2108 towards the aft section of the fuselage 2102 to provide room for a hooking device such as but not limited to a carabineer (not shown) as to allow the swimmer to carry equipment using the circle aperture 2108. Another exemplary embodiment may contain both the shark fin aperture 2106 as well as the circle aperture 2108.

Still referring to FIGS. 21-21G and FIG. 20, in another exemplary embodiment, a cord attachment may be attached to the device 2000. This cord may be, but is not limited to, a bungee 2110 and may be attached to the handle 2104. The bungee 2110 may keep the stabilizer members 2006 and the propulsor members 2012 together when carrying the swimming propulsion device 2000. This bungee 2110 may also loop through the shark fin 2106 when the device is in use to not have unfastened objects dangling on the device 2000. The bungee 2110 could additionally be used to as an additional element for carrying equipment or baggage when using the device 2000. In another exemplary embodiment, the handle 2104 may have at least one hook 2114 to attach the bungee cord 2110. The hook 2114 may be but is not limited to a location on the handle 2104 that allows the bungee 2110 to surround the fuselage and attach to the hook 2114 and remain there until the swimmer moves the bungee 2110.

Propulsors

The swimming device may be used by a swimmer to improve their speed and efficiency in the water. The propulsors are elements of the swimming device that contribute to the movement of the swimmer and device through the water. The propulsors are attached to the fuselage, described above.

The propulsors, as shown in the various embodiments herein, may be any size desired. As the surface area of the propulsor increases, the amount of power created by the propulsors also increases. However, propulsors of greater size include a greater weight. Where weight is a concern, the propulsors may be sized accordingly. However, a smaller propulsor presents less power from the device.

Weight may be an issue for similar reasons as described above with respect to the fuselage. In the exemplary embodiment, the propulsors have either a foam core or are hollow inside. Thus, although larger propulsors may be used, which may increase the total weight of the propulsors, this is compensated by the increased buoyancy from their construction. Propulsors weighing less will have less buoyancy, which may not be desired.

With respect to the span of the propulsors, a shorter span not only weighs less, but will be more maneuverable by the swimmer in use. For example, the propulsors are located mainly within the swimmer's field of vision. However, longer propulsors may present difficulties to the swimmer in avoiding collisions with objects, as the longer propulsors may be only slightly within the swimmer's peripheral vision, or outside their vision. Thus, in the exemplary embodiments, the span of the propulsors is shown in the exemplary embodiment to be both maneuverable and provide the desired propulsion in an efficient manner. However, in some embodiments, the span of the propulsors may be longer than shown, and in some embodiments, the span may be shorter than the propulsors shown.

Figure 1B:
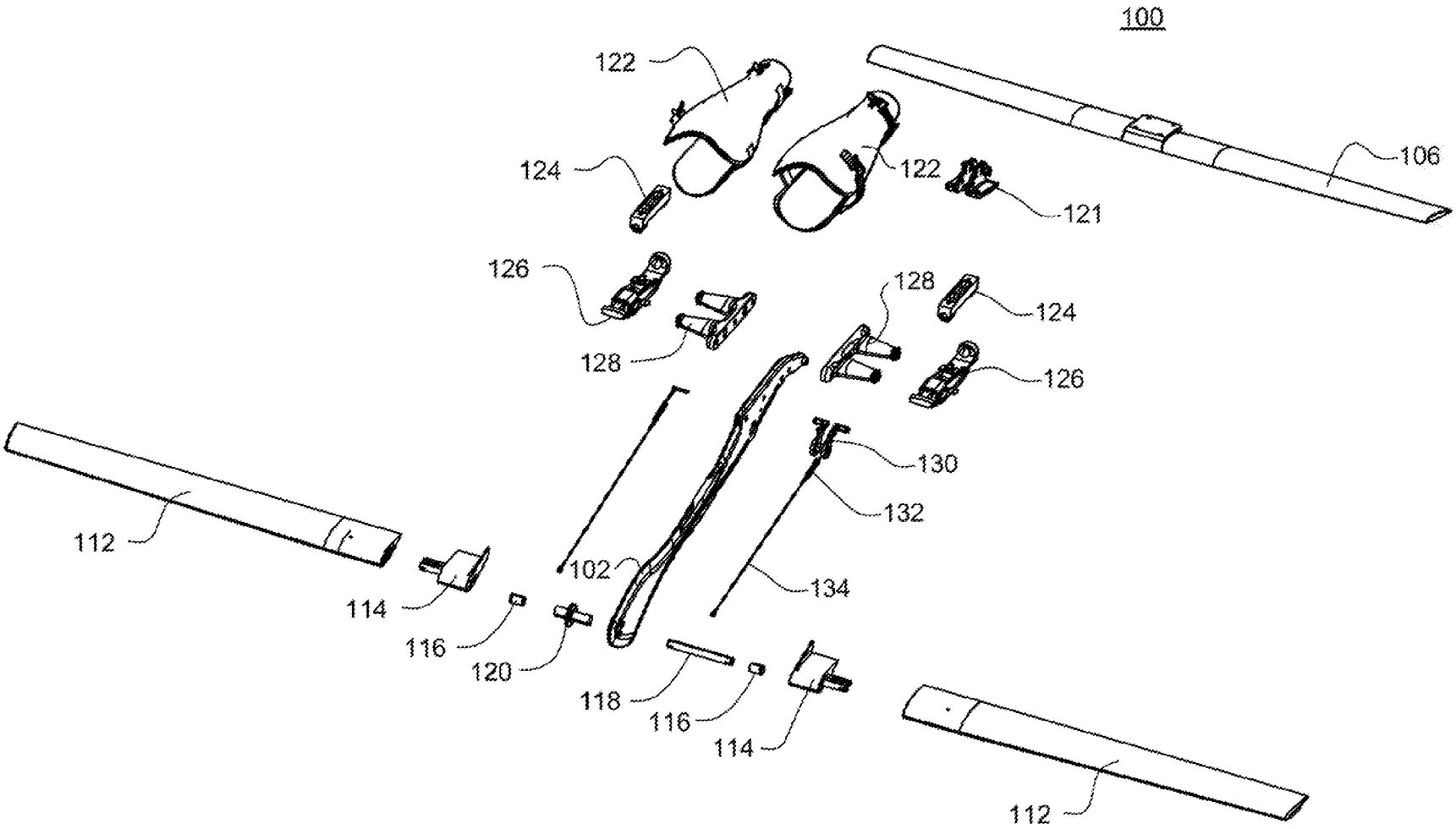
FIG. 1B is an exploded view of the exemplary embodiment of the swimming propulsion device shown in FIG. 1.
Figure 1C:
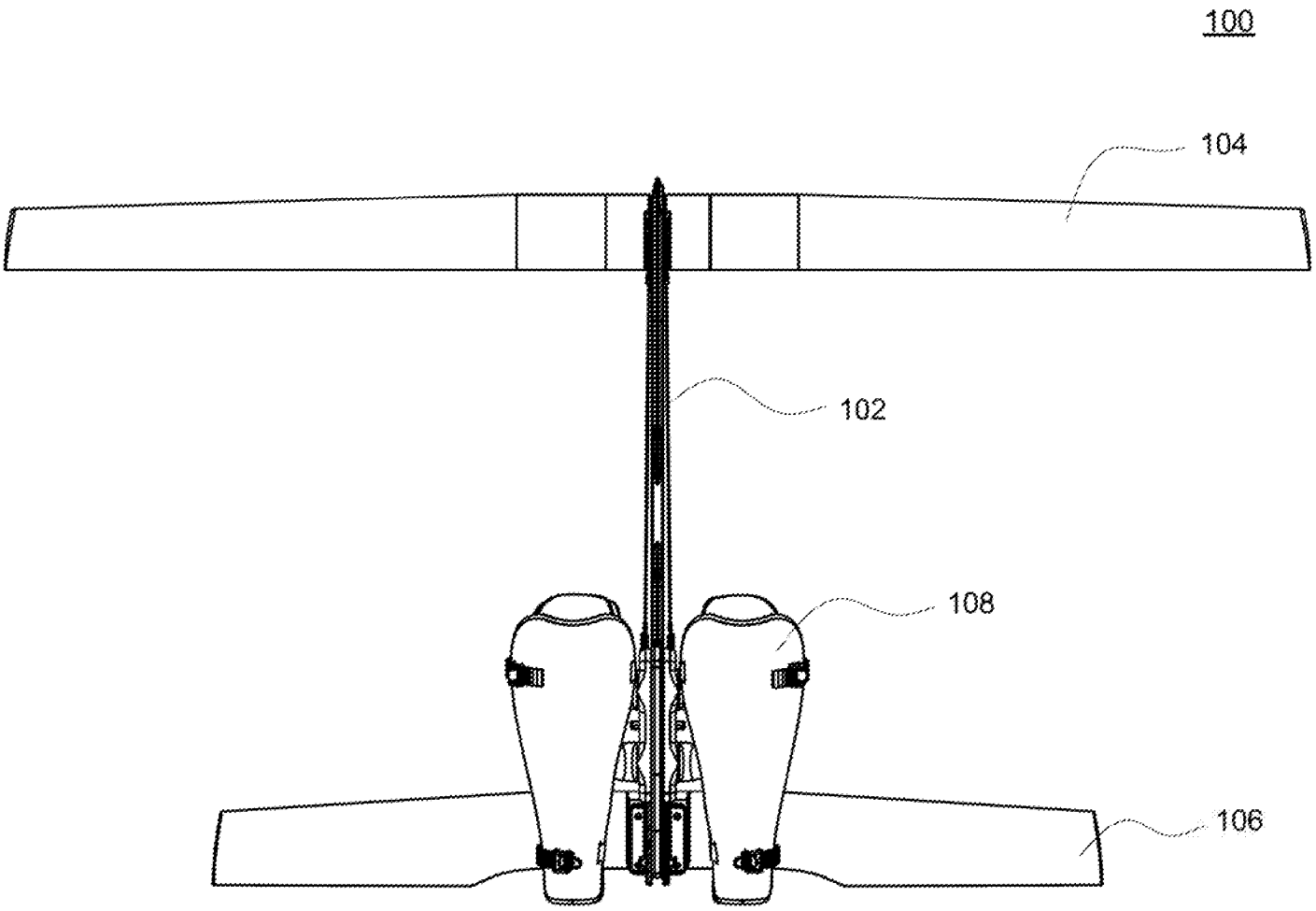
FIG. 1C is a top view of the exemplary embodiment of the swimming propulsion device shown in FIG. 1.
Figure 1D:
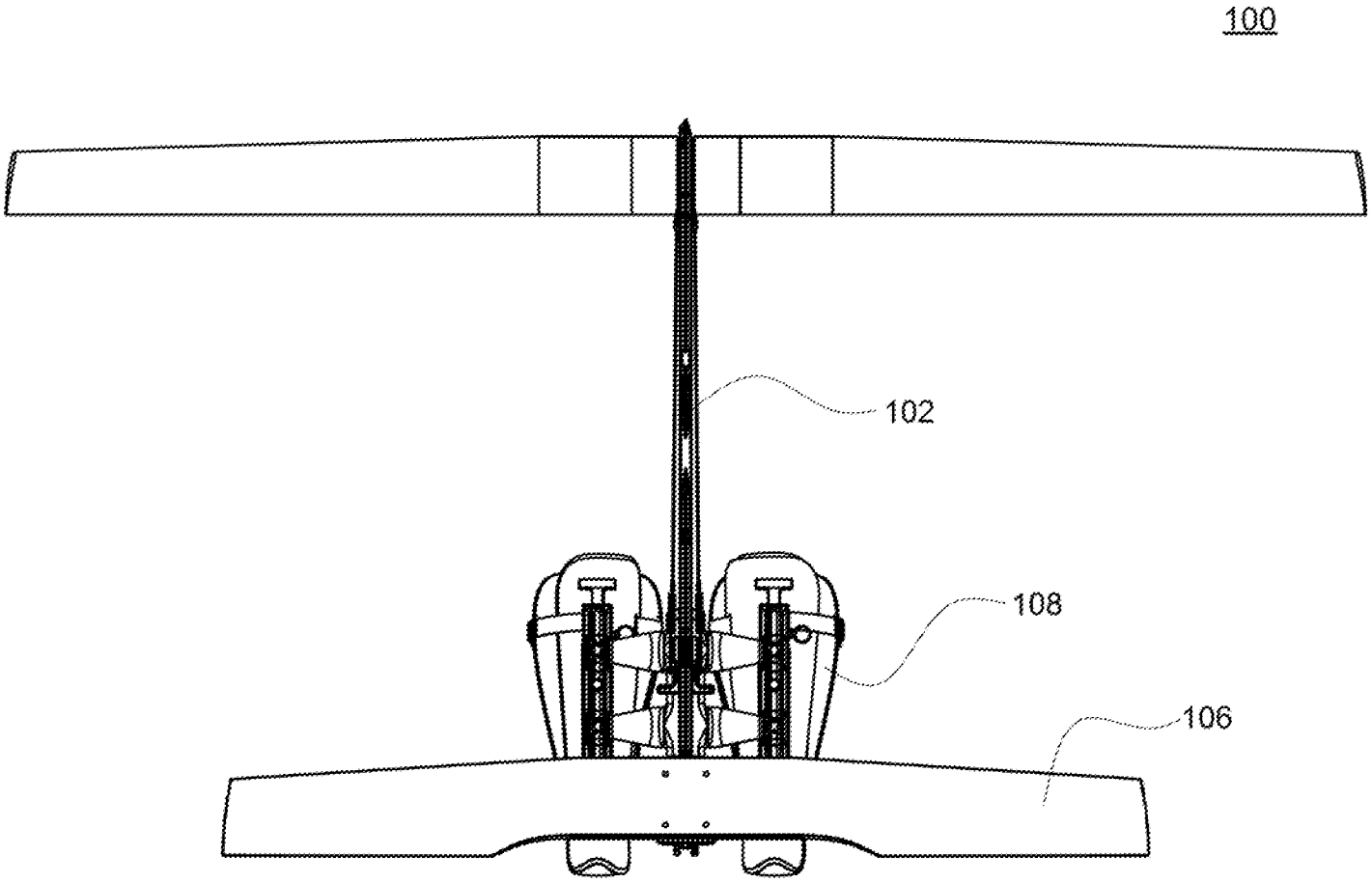
FIG. 1D is a bottom view of the exemplary embodiment of the swimming propulsion device shown in FIG. 1.
Figure 1E:
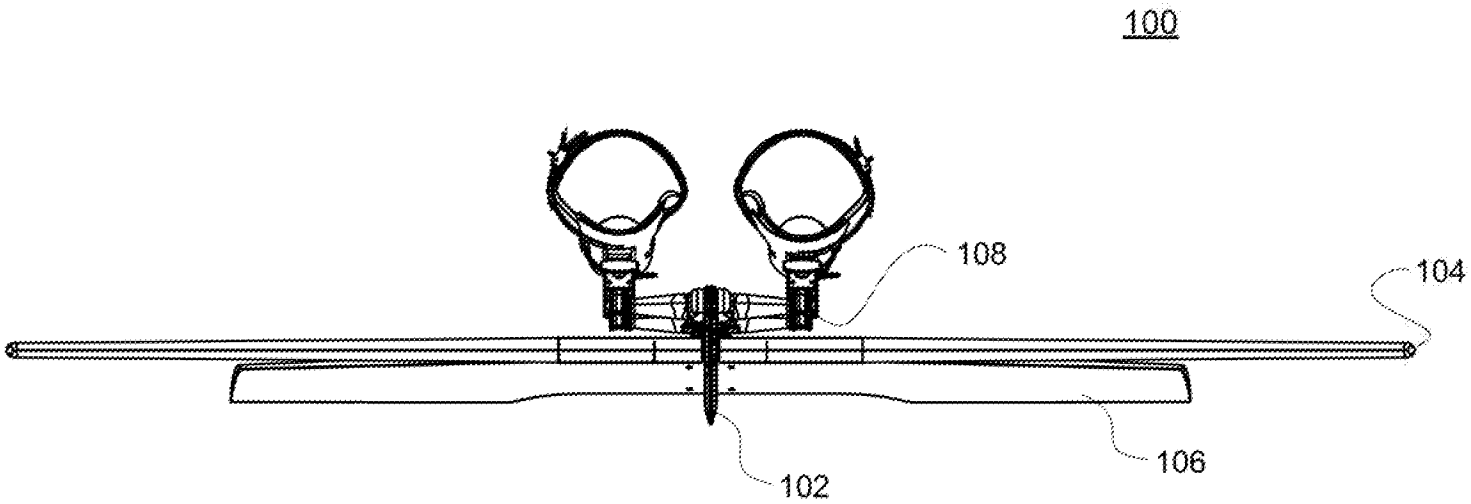
FIG. 1E is a front view of the exemplary embodiment of the swimming propulsion device shown in FIG. 1.
Figure 1F:
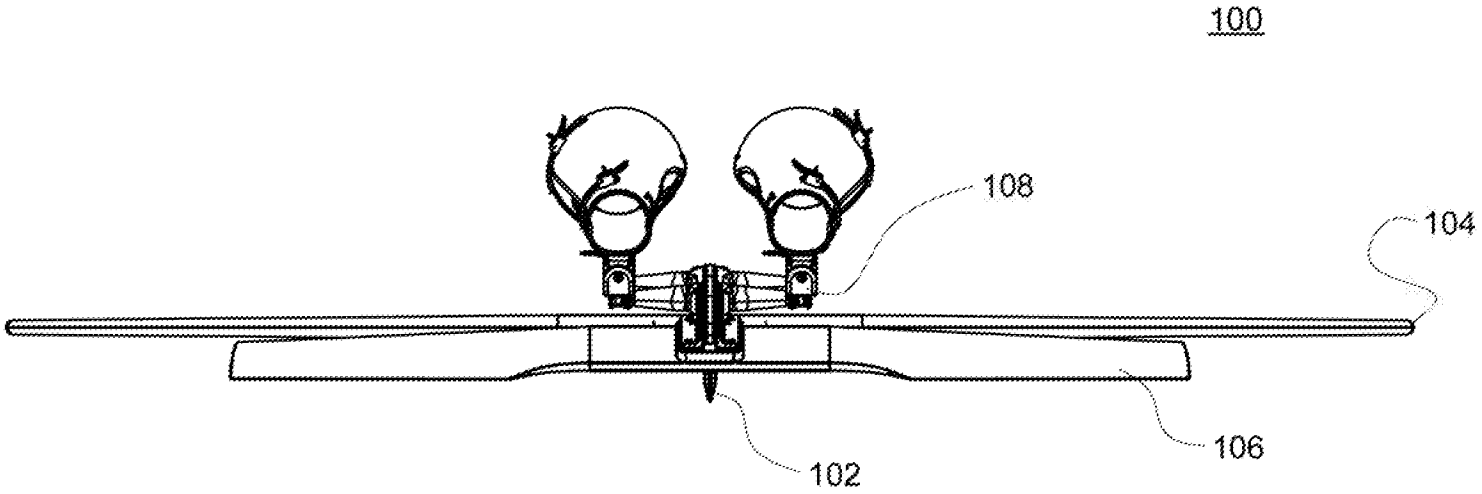
FIG. 1F is a rear view of the exemplary embodiment of the swimming propulsion device shown in FIG. 1.
Figure 1G:
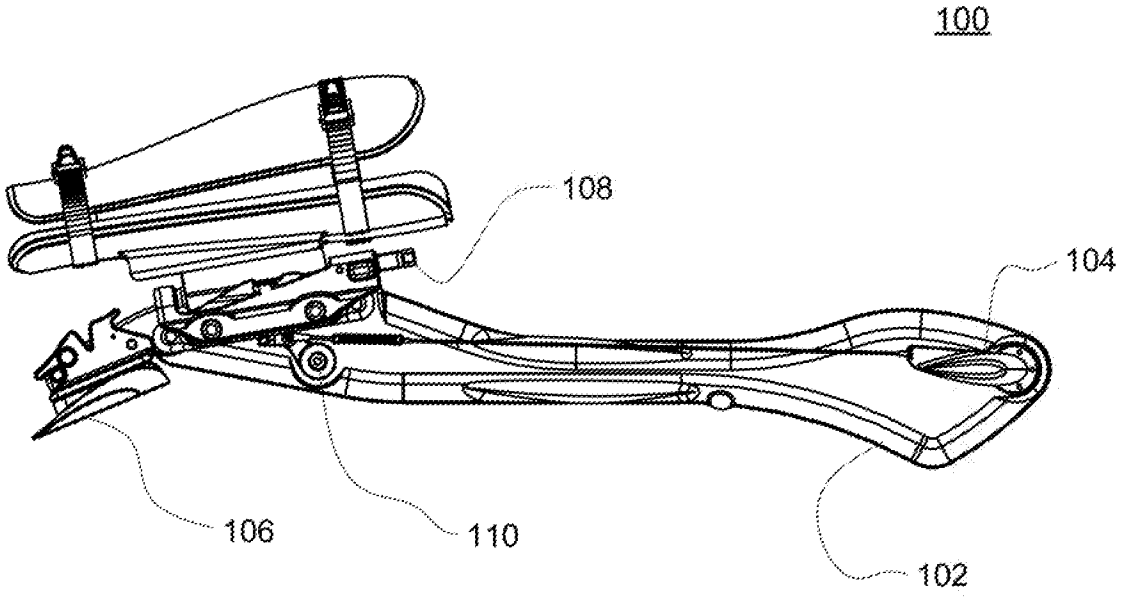
FIG. 1G is a side view of the exemplary embodiment of the swimming propulsion device shown in FIG. 1.
Figure 3:
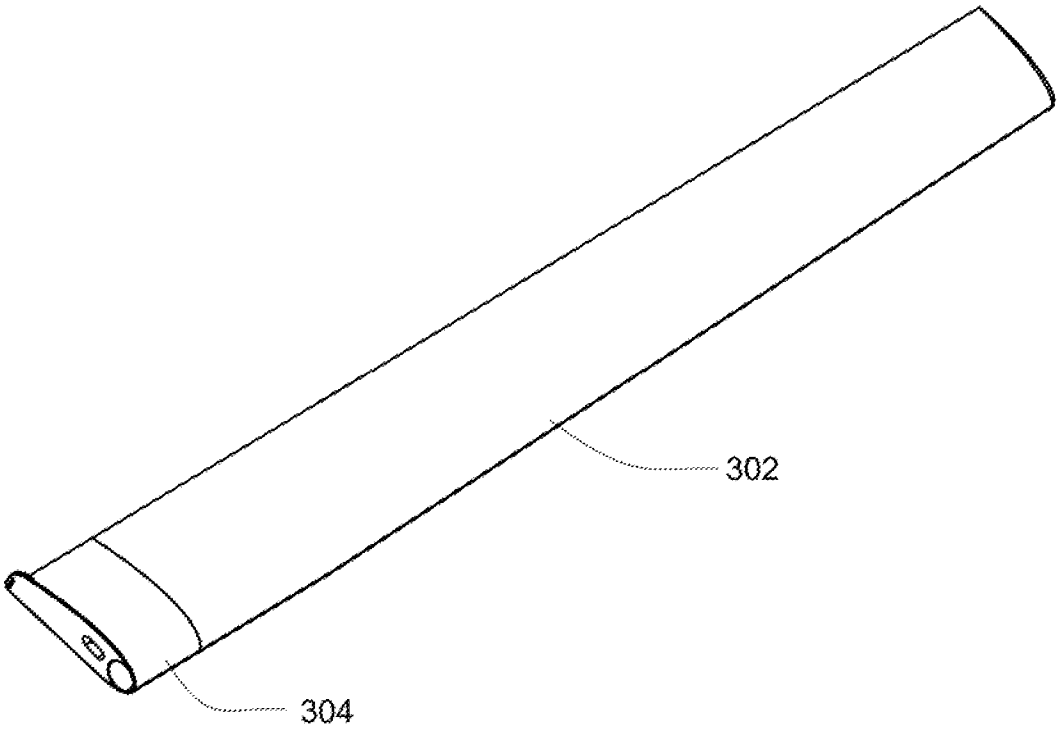
FIG. 3 is a perspective view of the exemplary embodiment of the propulsor.
Figure 3A:
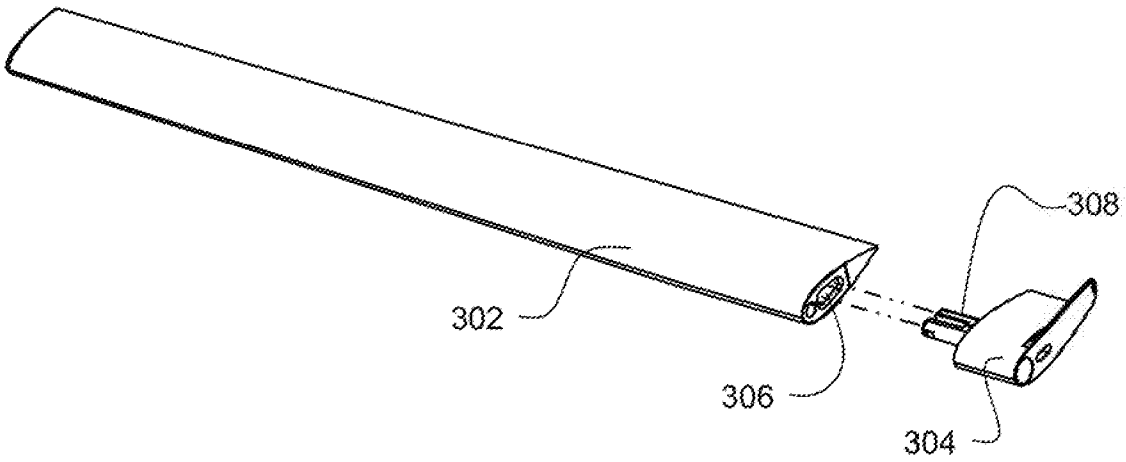
FIG. 3A is an exploded view of the exemplary embodiment of the propulsor.
Figure 3B:
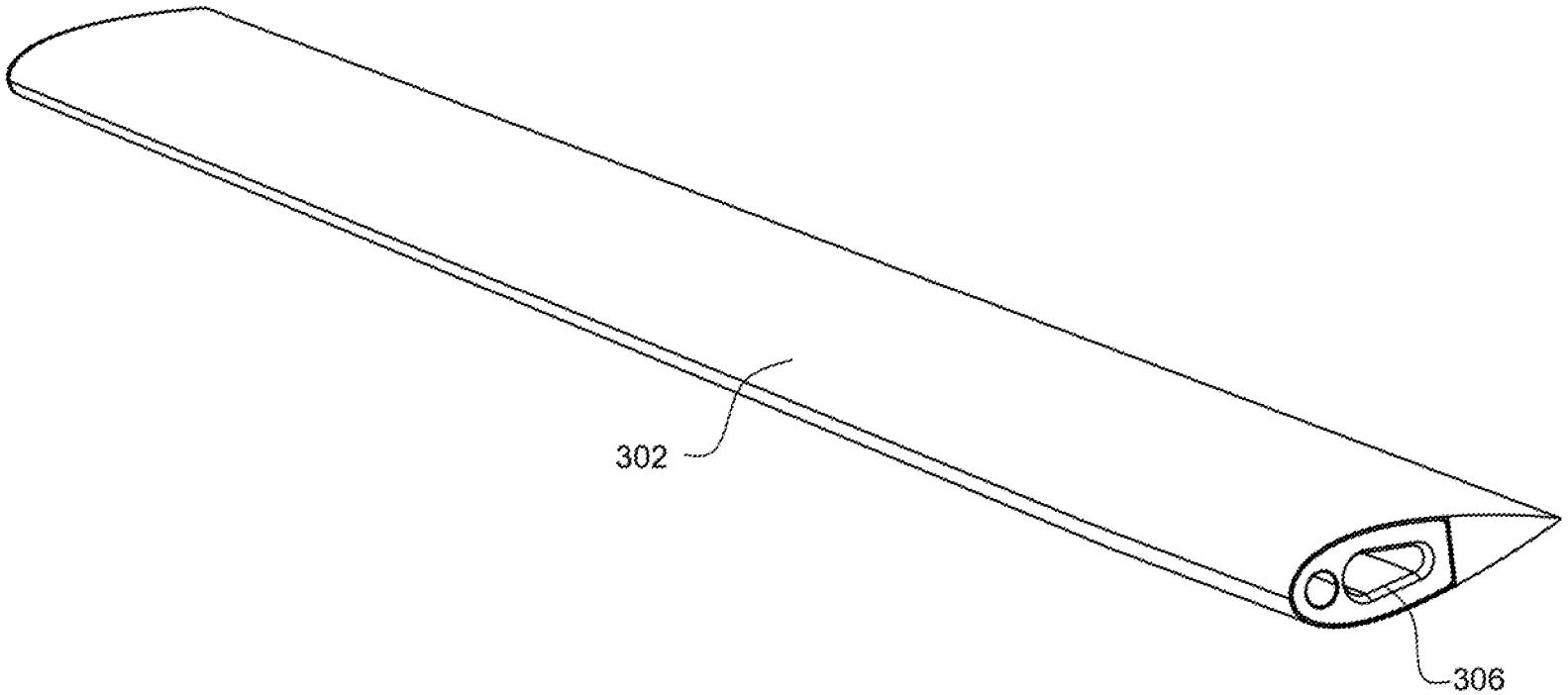
FIG. 3B is a detail view of the exemplary embodiment of the airfoil.

Referring now to FIGS. 3-3B, together with FIG. 1B, in the exemplary embodiment, each propulsor (also identified as 104 on FIG. 1) may include but is not limited to, a first member 302, referred to herein as an "airfoil" or a first propulsor member, and a second member 304, referred to herein as a "cable plate" or as a second propulsor member. The proximal end of the airfoil 302 may have a slot 306 for receiving the cable plate 304. The slot 306 may have dimensions sufficient to receive the horizontal member 308 attached to the cable plate 304. In the exemplary embodiment the cable plate 304 may have a shape and dimension such that it may mate with the airfoil 302. The span of the cable plate 304 may be any span sufficient to support installation of the axle 118 to the cable plate 304. In other embodiments the cable plate 304 may be a thin plate directly attached to the proximal end of the airfoil 302 instead of an airfoil-shaped member attached to the axle 118.

Still referring to FIGS. 3-3B, the airfoil 302 and the cable plate 304 may be mechanically connected with an elastic member (not shown). In the exemplary embodiment the elastic member may be a bungee cord. The elastic member may be attached to the airfoil 302 and the cable plate 304 by passing the member through the slot 306 of the airfoil 302 and an aperture 307 (see FIGS. 3E-F) within the horizontal member 308 of the cable plate 304. After the elastic member is positioned within each component a knot may be tied at each end of the elastic member connecting the airfoil 302 to the cable plate 304. The elastic member may have a span sufficient to produce a tensional force to maintain the cable plate 304 and airfoil 302 in a mated relationship during operation of the device 100 and allow the airfoil 302 to be collapsibly positioned. In other embodiments the elastic member may be but is not limited to a spring and cable assembly. In this embodiment a spring may be positioned within the airfoil 302. Attached to the distal end of the spring may be a cable connecting the airfoil 302 to the cable plate 304. The spring may provide the tensional force to maintain the components in a mated relationship, but may be compressed allowing the components to be collapsibly positioned.

Still referring to FIGS. 3-3B, the airfoil 302 and the cable plate 304 may be manufactured from materials including but not limited to plastic G10/FR4, Garolite, fiber reinforced plastic, wood-plastic composite, or other similar material. In the exemplary embodiment, the airfoil 302 is manufactured from carbon fiber and the cable plate 304 is manufactured from G10/FR4 plastic. Alternate embodiments may include manufacturing an airfoil 302 and/or a cable plate 304 from any other material. In the exemplary embodiments, characteristics of the materials include but are not limited to: low water absorption, structural strength, and lightweight. In other embodiments the airfoil 302 may be hollow to vary buoyancy of the device.

Figure 3D:
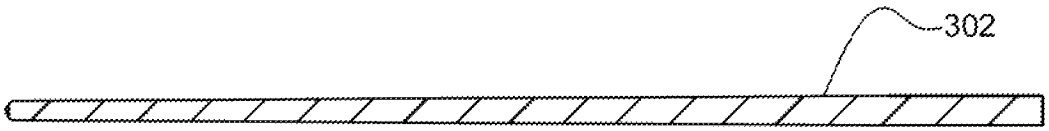
FIG. 3D is a longitudinal cross-section view of the airfoil.
Figure 3C:
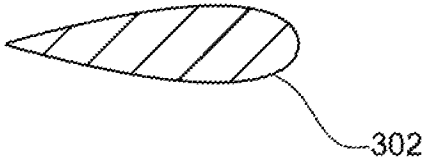
FIG. 3C is a transverse cross-section view of the airfoil.

Referring now to FIGS. 3C-3D, in the exemplary embodiment, the airfoil 302 may have a chord dimension of 3.37 inches, a span of 27.0 inches, and a thickness of approximately 1.0 inch. In addition, the airfoil 302 may have a tapered-airfoil shape. In other embodiments, the airfoil 302 may have different dimensions, but those dimensions may affect the lifting force generated by the device 100. In the exemplary embodiment, a NACA 0030 profile is used.

Figure 3F:
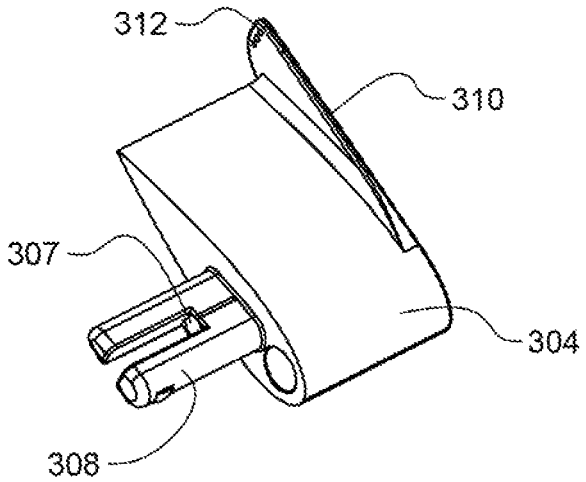
FIG. 3F is a perspective view of the cable plate.
Figure 3E:
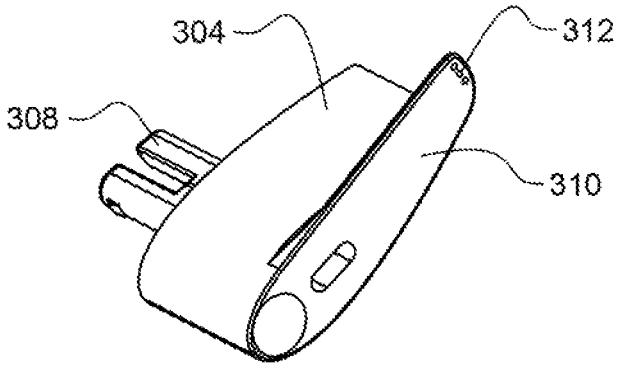
FIG. 3E is a perspective view of the cable plate.

Referring now to FIGS. 3E-F, in the exemplary embodiment, the cable plate 304 may include a vertical member 310 located at the edge nearest the fuselage. The location of the vertical member 310 near the fuselage reduces additional turbulence created by the propulsor. In other embodiments, the vertical member 310 may be located anywhere on the cable plate 304 such that the control mechanism (not shown, shown in FIGS. 1-1A as 110 and described in more detail below) may be attached to the vertical member 310. Within the vertical member 310 may be a plurality of apertures 312 for receiving the control mechanism. Attaching the control mechanism to the vertical member 310 allows the device to maintain a desired propulsor angle. In alternate embodiments, the control mechanism may be attached directly to the airfoil 302 or to the horizontal surface of the cable plate 304.

Figure 3G:
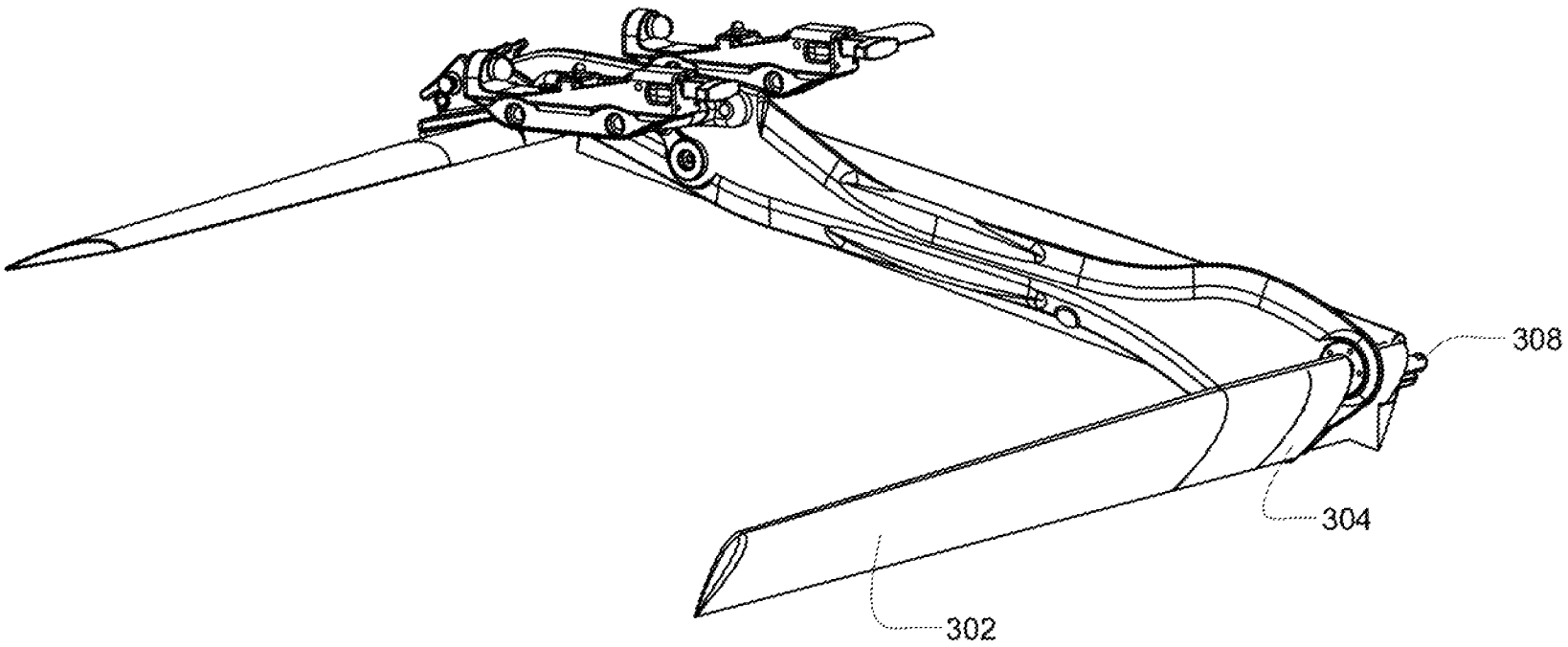
FIG. 3G is a front-perspective view of the exemplary embodiment of the swimming propulsion device having an airfoil in the collapsed position.
Figure 3H:
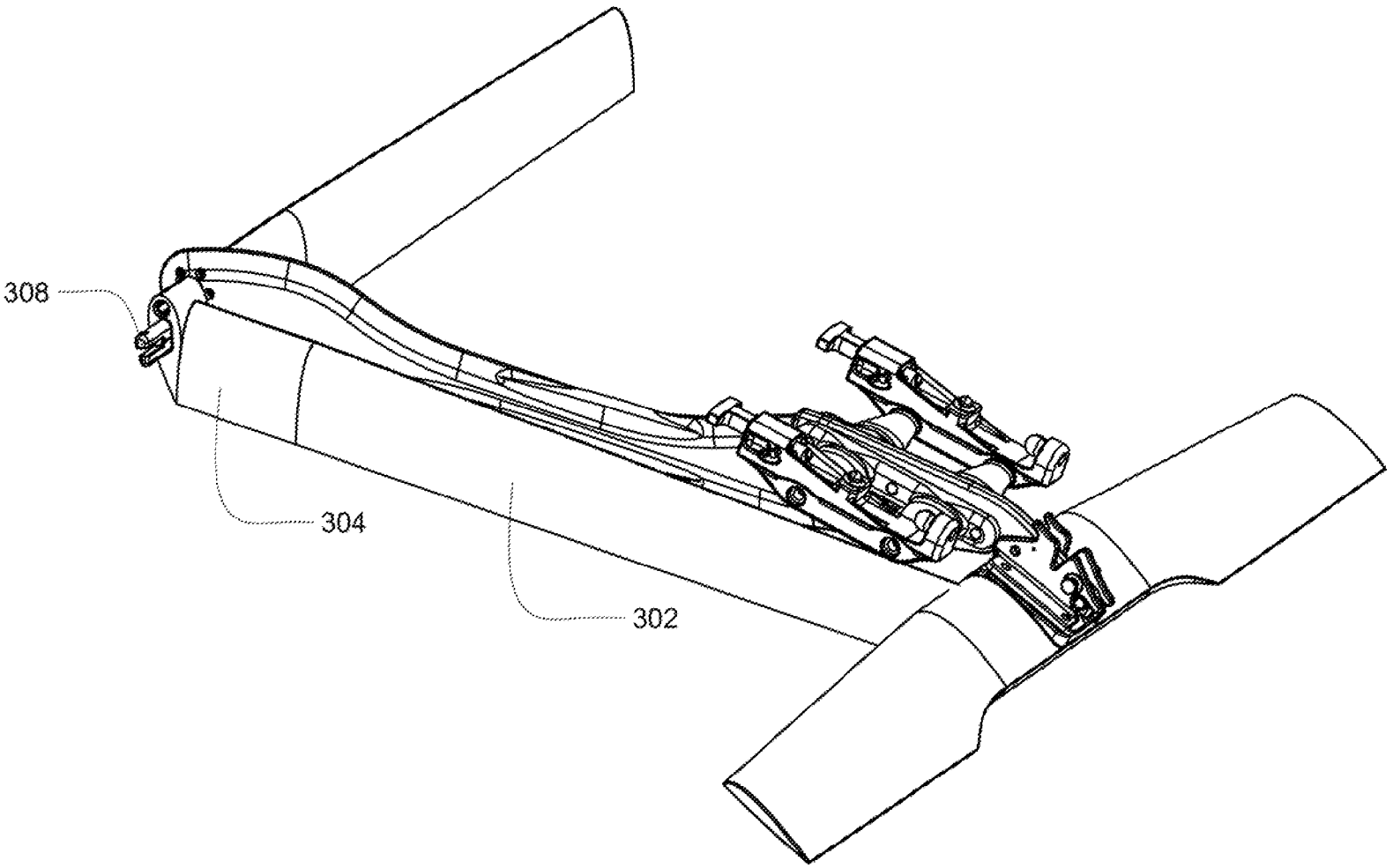
FIG. 3H is a rear-perspective view of the exemplary embodiment of the swimming propulsion device having an airfoil in the collapsed position.

Still referring to FIGS. 3G-H, in the exemplary embodiment, on the distal end of the cable plate 304 a horizontal member 308 may be included. The member 308 supports the airfoil 302 when the airfoil 302 is in an operating or collapsed position. In use, the propulsor 300 may be collapsed by applying a pulling force onto the airfoil 302, pulling the airfoil away from the fuselage. Once the proximal end of the airfoil 302 is beyond the horizontal member 308 of the cable plate 304, rotating the airfoil 302 towards the aft end of the fuselage 102 followed by lowering the airfoil 302 onto the upper surface of the horizontal member 308, as shown in FIGS. 3G-3H, will yield an airfoil 302 collapsed position.

Figure 3I:
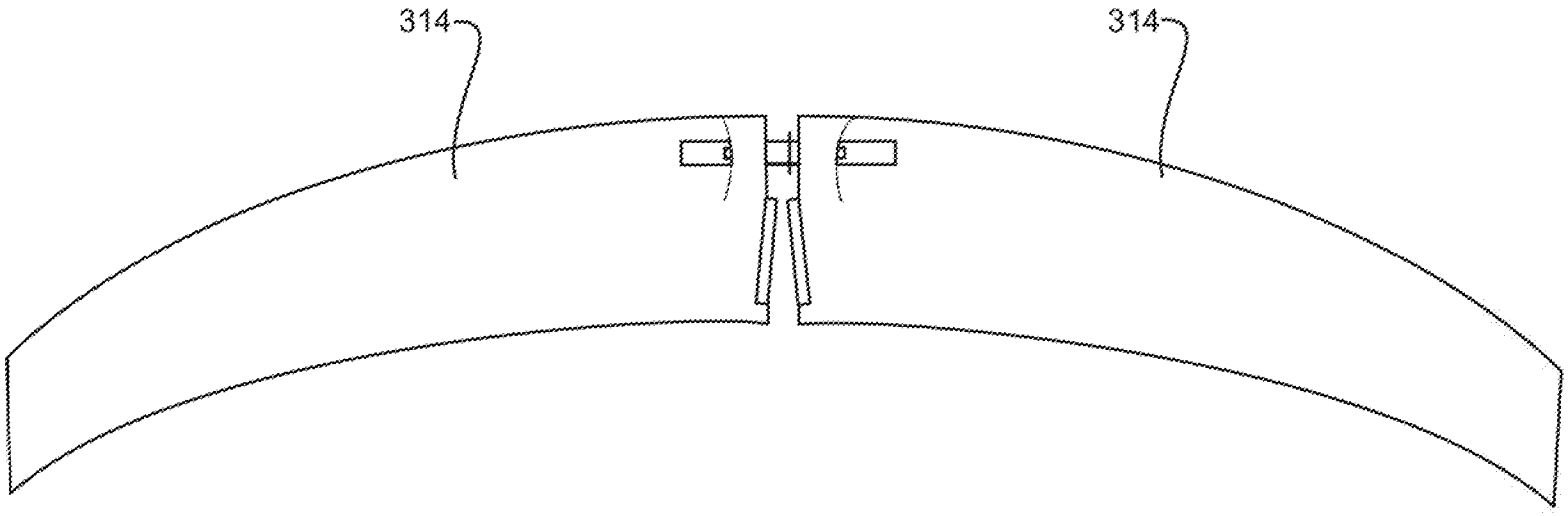
FIG. 3I is a top view of an alternate embodiment of the propulsor having a curved-airfoil shape.
Figure 3J:
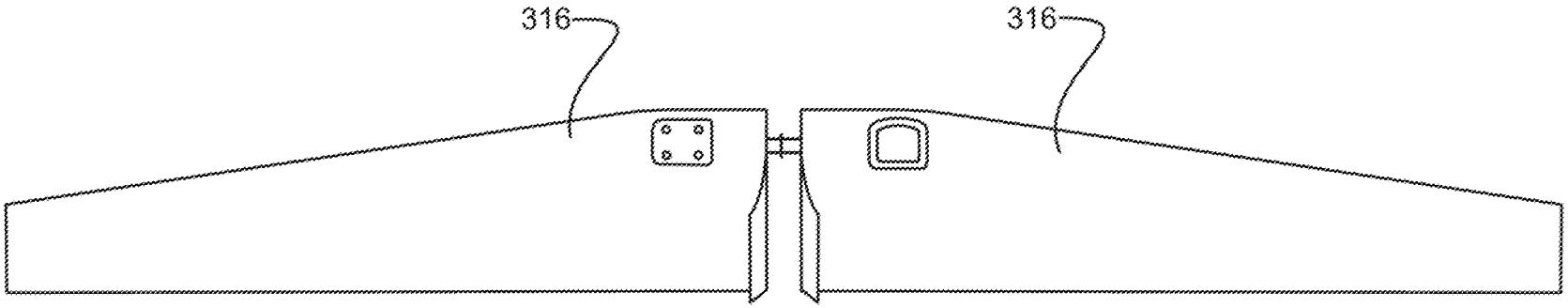
FIG. 3J is a top view of an alternate embodiment of the propulsor having a tapered airfoil shape.
Figure 3K:
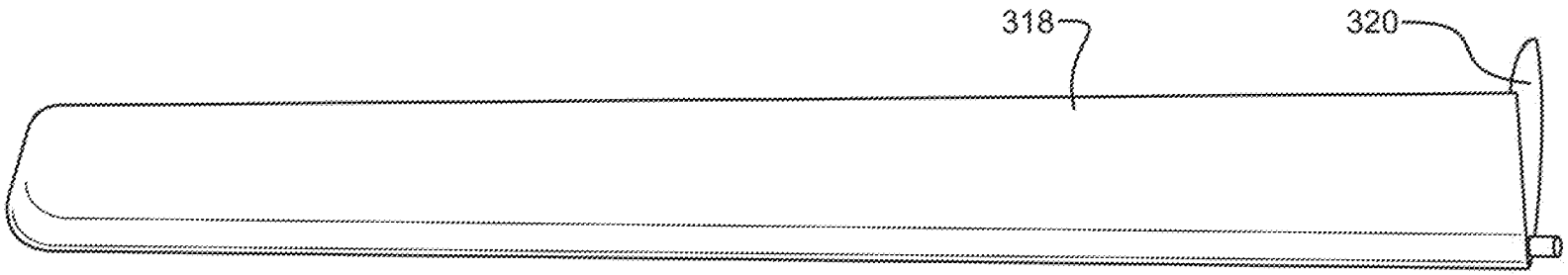
FIG. 3K is a top view of alternate embodiments of the propulsors.
Figure 3L:
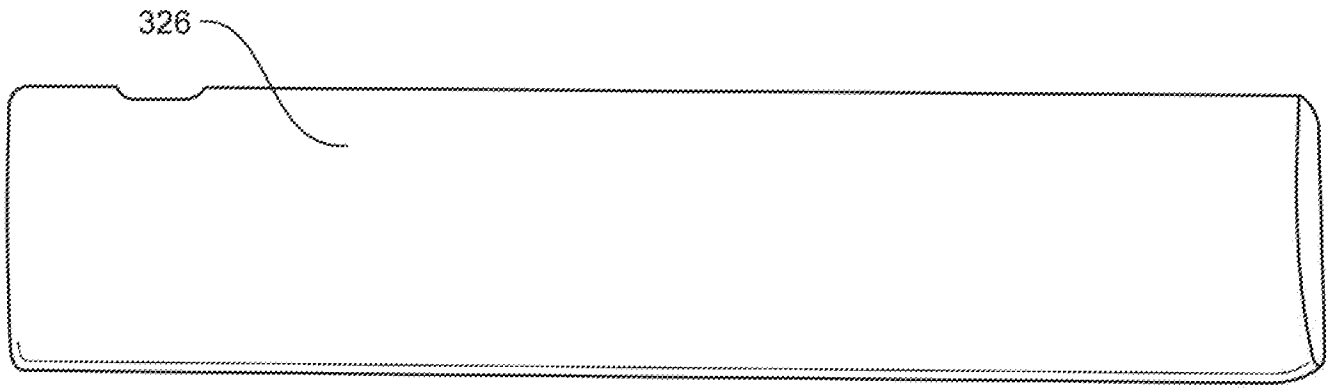
FIG. 3L is a top view of an alternate embodiment of the propulsor having a rectangular-airfoil shape.

Referring now to FIGS. 3I-L, alternate embodiments may include airfoils having various shapes. FIG. 3I illustrates one embodiment for airfoils 314 having a curved-tapered-airfoil shape. In other embodiments, such as the one shown in FIG. 3J, an airfoil 316 may include a rectangular shape having a tapered front edge. In other embodiments, such as the one shown in FIG. 3K, an airfoil 318 may include a cable plate 320 having minimal thickness and attached directly to the airfoil 318 rather than the axle (not shown, shown in FIG. 1B as 118). Referring now to FIG. 3L, in yet another alternate embodiment, airfoil 326 may be one piece having a rectangular-airfoil shape without cable plates. In other embodiments, winglets may be attached to the distal end of the airfoil. Although these various embodiments of the airfoils have been shown with respect to specific embodiments, in other embodiments, the various characteristics described may be mixed and matched, such that an embodiment may include a number of the characteristics described above.

Figure 22F:
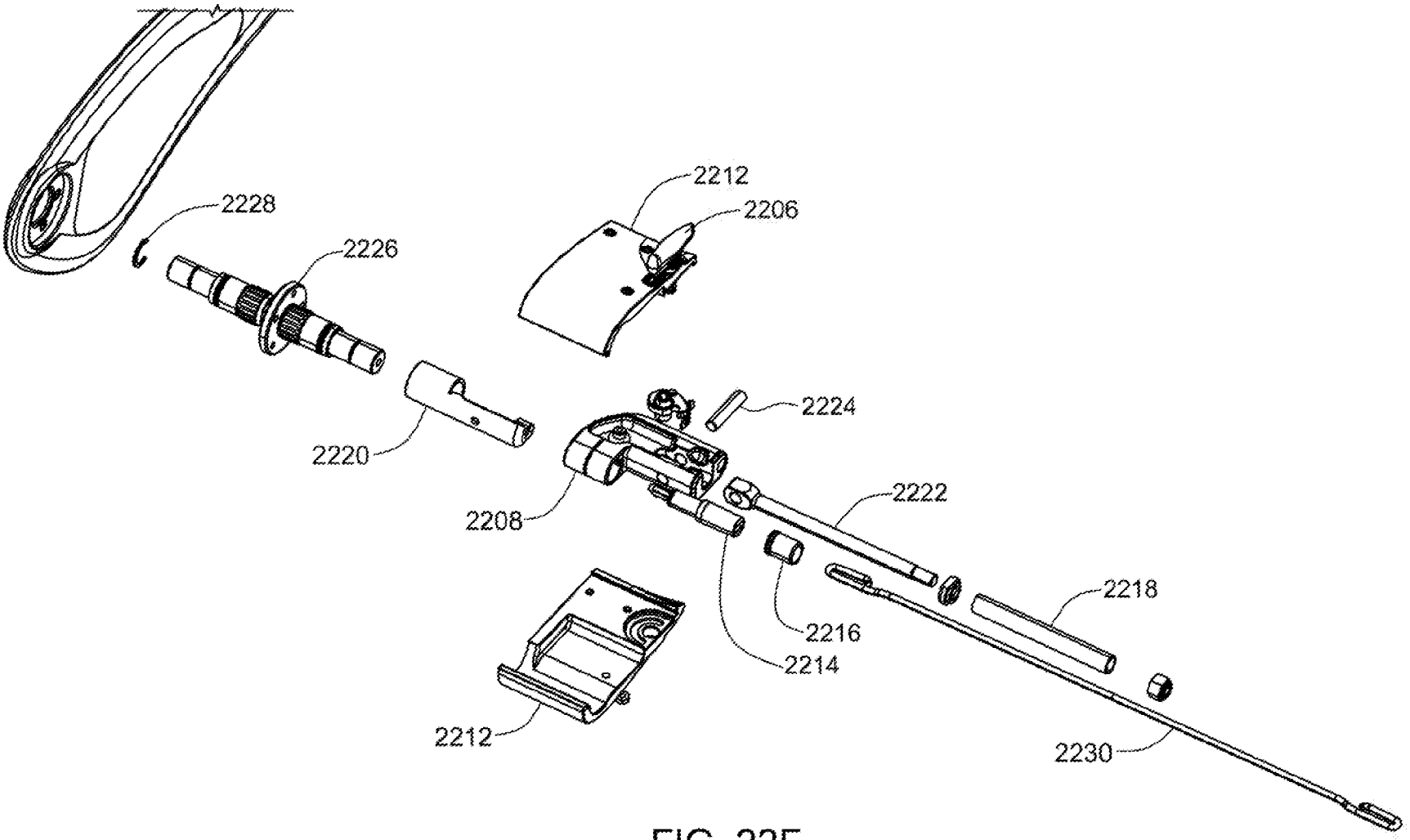

Referring now to FIGS. 22-22F and 20B, in another exemplary embodiment, each propulsor 2200 may include but is not limited to, a first member 2202, referred to herein as an "airfoil" or a first propulsor member, and a second member 2204, referred to herein a propulsor connector or a second propulsor member. In another exemplary embodiment the propulsor connector 2204 may replace the cable plate 114, shown in FIG. 1B and the propulsor 2200 may further contain a torsion bar 2230. The torsion bar 2230 may be used for controlling the angle of attack of the propulsor 2200 and will be further described later on. The proximal end of the airfoil 2202 may have a slot for receiving the second propulsor member 2204. The slot may have dimensions sufficient to receive a root block 2208 fixedly attached to the second propulsor member 2204. In the exemplary embodiment the second propulsor member 2204 may have a shape and dimension such that it may mate with a pivot bar 2222 within the airfoil 2202. The span of the second propulsor member 2204 may be any span sufficient to support installation of the axle 2018 to the second propulsor member 2204.

Still referring to FIG. 22-22F, in another exemplary embodiment, the airfoil 2202 may be manufactured using a urethane reaction in mold. The manufacturing may, in some embodiments, begin with a stainless steel internal structure 2210 then includes a lighter foam core then finishes with an outside RIM material. The finished product is a mold part. The structure, stainless steel, was chosen for its stiffness and strength. Though stainless steel was chosen for the internal structure 2210 this is not the only material that may be used, any material with similar stiffness and strength may be used.

Referring now to FIGS. 22-22F and 20B, in another exemplary embodiment, each propulsor 2200 may include but is not limited to, a first member 2202, referred to herein as an "airfoil" or a first propulsor member, and a second member 2204, referred to herein a propulsor connector or a second propulsor member. The second propulsor member 2204 may be made of any material that will take in minimal water and effects of water on the material are minimal, such as, but not limited to, nylon. In another exemplary embodiment the propulsor connector 2204 may replace the cable plate 114, shown in FIG. 1B and the propulsor 2200 may further contain a control mechanism 2240 shown in FIG. 22E. The control mechanism 2240 may contain a torsion bar 2230. The torsion bar 2230 may be used for controlling the angle of attack of the propulsor 2200 and will be further described later on. The proximal end of the airfoil 2202 may have a slot (not shown) for receiving the propulsor connector 2204. The slot may have dimensions sufficient to receive a root block 2208 fixedly attached to the propulsor connector 2204. In another exemplary embodiment the propulsor connector 2204 may have a shape and dimension such that it may mate with a pivot bar 2222 within the airfoil 2202. The span of the propulsor connector 2204 may be any span sufficient to support installation of the axle 2018 to the propulsor connector 2204.

Still referring to FIGS. 22-22F, in another exemplary embodiment, the airfoil 2202 may be manufactured using a urethane reaction in mold. The making starts with a stainless steel internal structure 2210 then includes a lighter foam core then the internal structure 2210 and foam core are encompassed with an outside RIM material. The finished product is a mold part. The structure, stainless steel, was chosen for its stiffness and strength. Though stainless steel was chosen for the internal structure 2210 this is not the only material that may be used, any material with similar stiffness and strength may be used.

Referring now to FIGS. 22-22F and FIG. 20, in another exemplary embodiment, the airfoil 2202 may have a chord dimension of 3.37 inches, a span of 27.0 inches, and a thickness of approximately 1.0 inch. In addition, the airfoil 302 may have a tapered-airfoil shape. In other embodiments, the airfoil may have different dimensions, but those dimensions may affect the lifting force generated by the swimming propulsion device 2000. In another exemplary embodiment, a NACA 0030 profile is used.

Still referring to FIGS. 22-22F, in another exemplary embodiment, a root block 2208 may be included on the distal end of the propulsor connector 2204. The root block 2208 supports the airfoil 2202 when the airfoil 2202 is in an operating or collapsed position. In use, the propulsor 2200 may be collapsed by applying a pulling force onto the airfoil 2202, pulling the airfoil 2202 away from the propulsor connector 2204. Once the proximal end of the airfoil 2202 is beyond the root block 2208 in the propulsor connector 2204, rotating the airfoil 2202 towards the aft end of the fuselage 2002, shown in FIG. 20, followed by moving the airfoil 2202 to perpendicular of the root block 2208, as shown in FIG. 22A and FIG. 25, will yield an airfoil 2202 in the collapsed position. In some embodiments of another exemplary embodiment, the propulsor 2200 may include a tightening mechanism 2206 on the second propulsor member 2204 which hooks onto the first propulsor member 2202 further securing the first and second propulsor members 2202,2204, respectively, together. This tightening mechanism 2206 may loosen to allow the swimmer to pull the first propulsor member 2202 away from the propulsor connector 2204.

Referring to FIGS. 22C-F, in another exemplary embodiment, a root block 2208 may be included on the distal end of the propulsor connector 2204. The root block 2208 supports the airfoil 2202 when the airfoil 2202 is in operation or folded position. The propulsor 2200 may contain a pivot bar 2222 within the airfoil 2202 that pivotably attaches to the root block 2208 using a pin 2224 in the second propulsor member 2208 and anchored at the distal end within the airfoil 2202. The pivot bar 2222 is encompassed by a spring 2218 that may be used to pull the airfoil 2202 towards the propulsor connector 2204 when putting the propulsor 2200 in the operational form. The spring 2218 keeps the propulsor 2200 in place for operation and it makes it easier to hold the propulsor 2200 in place for the tightening mechanism 2206 to take action. This pivot bar 2222 allows the airfoil 2202 to pivot away from the operating position and move to the collapsed position without detaching the airfoil 2202 from the rest of the device. The pivot bar 2222 allows the airfoils 2202 to collapse vertically along the fuselage 2002, shown in FIG. 20, when in the folded position. In another exemplary embodiment, the pivot bar 2222 may be replaced with a cable (not shown) allowing the airfoil 2202 to fold horizontally above the folded stabilizer members 2218.

Now referring to FIGS. 25-25D, from operating position the propulsor 2504 may collapse by applying a pulling force to the first member 2508 away from the fuselage 2502 and allowing the first propulsor member 2508 to separate from the second propulsor member 2510, turning and closing the first propulsor member 2508 towards the fuselage 2502. This process is then repeated for the other first propulsor member 2508.

Attachment Mechanism

The device receives power from a swimmer. The swimmer transfers force to the device. This force is transferred to the propulsors to propel the device through the water.

Thus, an attachment mechanism/swimmer attachment mechanism/swimmer connection mechanism or attachment device is used in the exemplary embodiment to attach the device to the swimmer. Various embodiments of the attachment mechanism include, but are not limited to, any device or mechanism that may both attach to the swimming device and connect or attach to the swimmer such that the movement or force generated by the swimmer may be transferred to the device. Below, various embodiments of the attachment mechanism are discussed. However, these embodiments are not meant to be exhaustive as other embodiments or devices are contemplated. Further, as used herein, the term "attachment mechanism" and "attachment device" has the same meaning.

Figure 4:
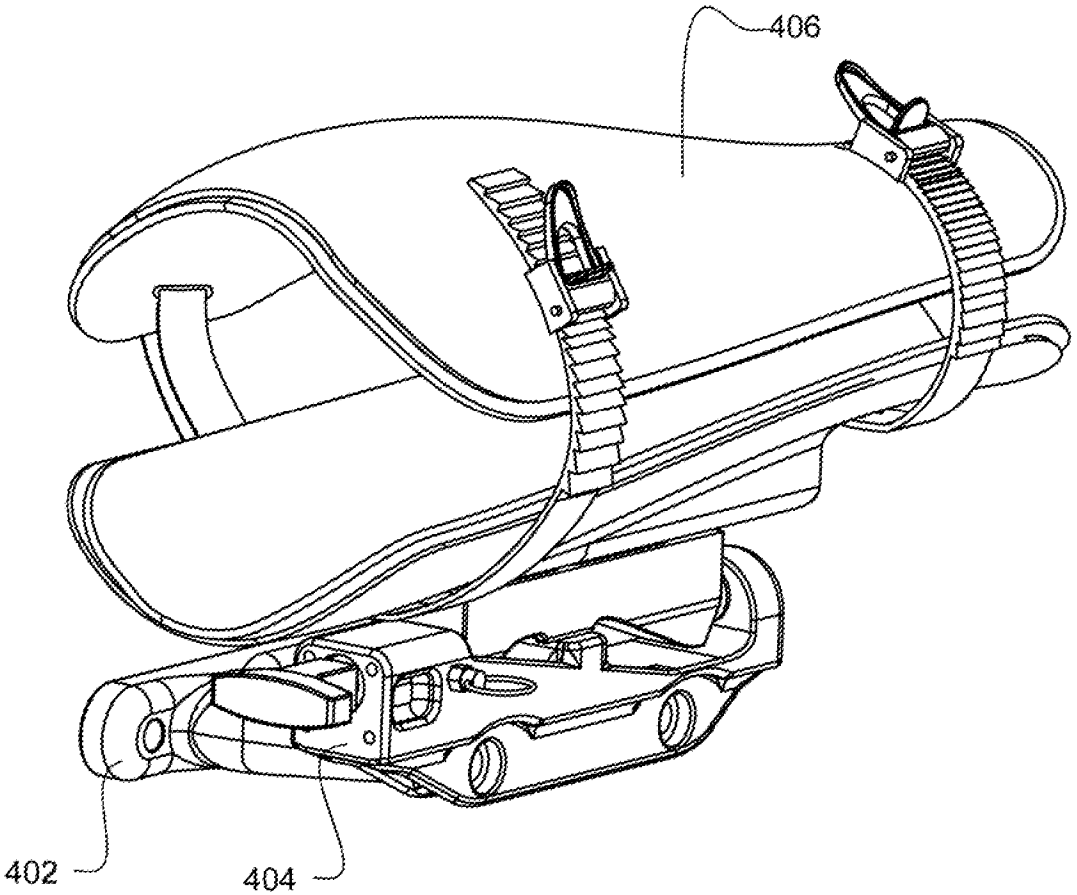
FIG. 4 is a perspective view of the exemplary embodiment of the attachment mechanism.
Figure 4A:
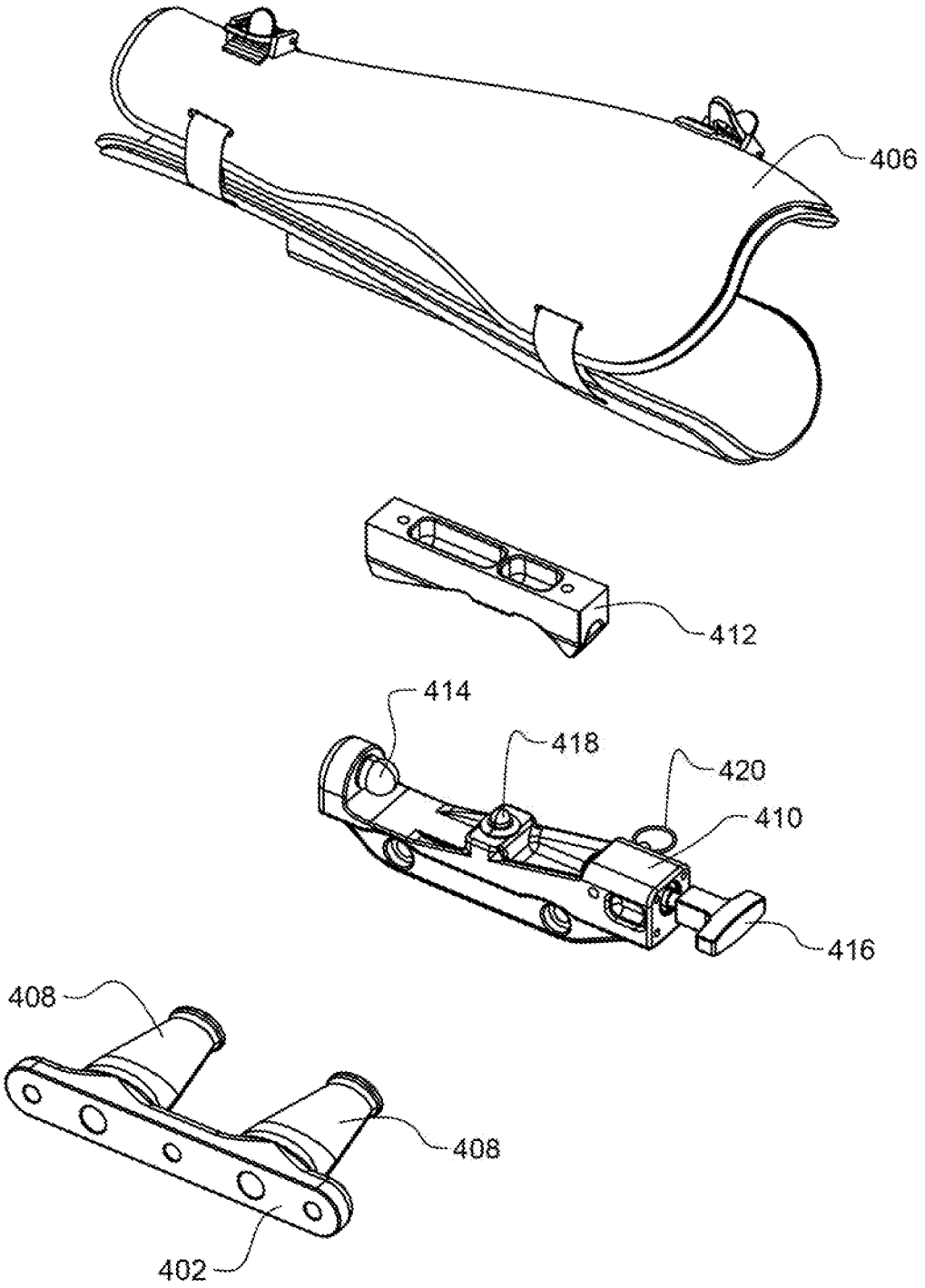
FIG. 4A is a exploded view of the exemplary embodiment of the attachment mechanism shown in FIG. 4.
Figure 4B:
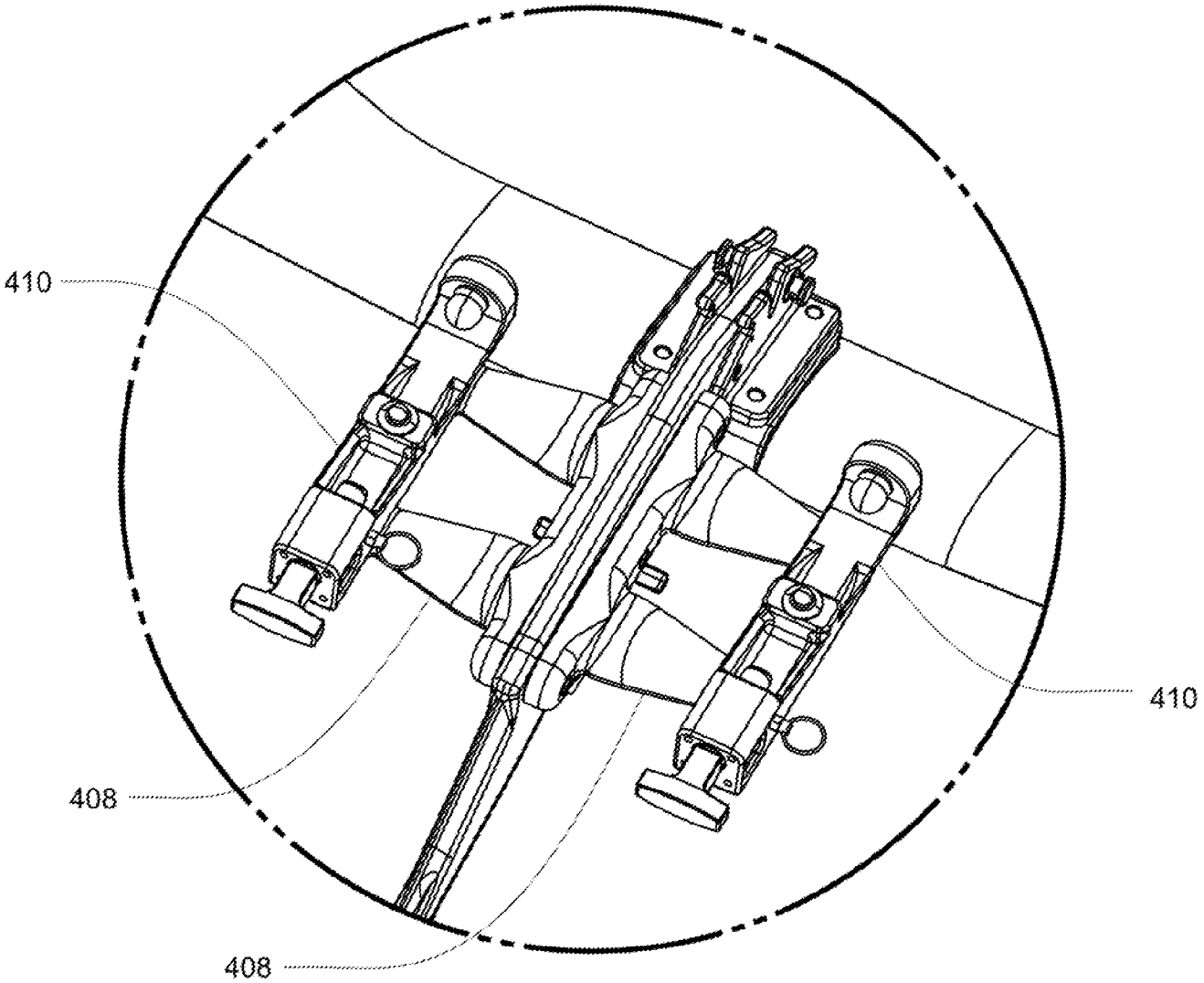
FIG. 4B is a top view of the exemplary embodiment of the mounting bracket shown in FIG. 4.

Referring now to FIG. 4, in the exemplary embodiment, the cuffs 406 are used as the attachment mechanism. Although one cuff 406 is shown in FIG. 4, in the exemplary embodiments, the device includes two cuffs. However, as described in further detail below, as the cuffs are removable, it may be desirable in some embodiments to include one cuff on the device. In the exemplary embodiment, each cuff includes two members. In the exemplary embodiment, the cuffs are ergonomically shaped to a swimmer's bottom leg. As discussed below, in the exemplary embodiment, the cuffs further include a lining that may be shaped to provide further comfort and snug-fitting to the swimmer.

As discussed above, the attachment mechanism connects the swimmer to the swimming propulsion device. Still referring to FIG. 4, in the exemplary embodiment, the attachment mechanism may include but is not limited to a mounting bracket 402, a locking mechanism 404, and cuffs 406. Although not shown in this FIG., the mounting bracket 402 connects to the fuselage.

Figure 4C:
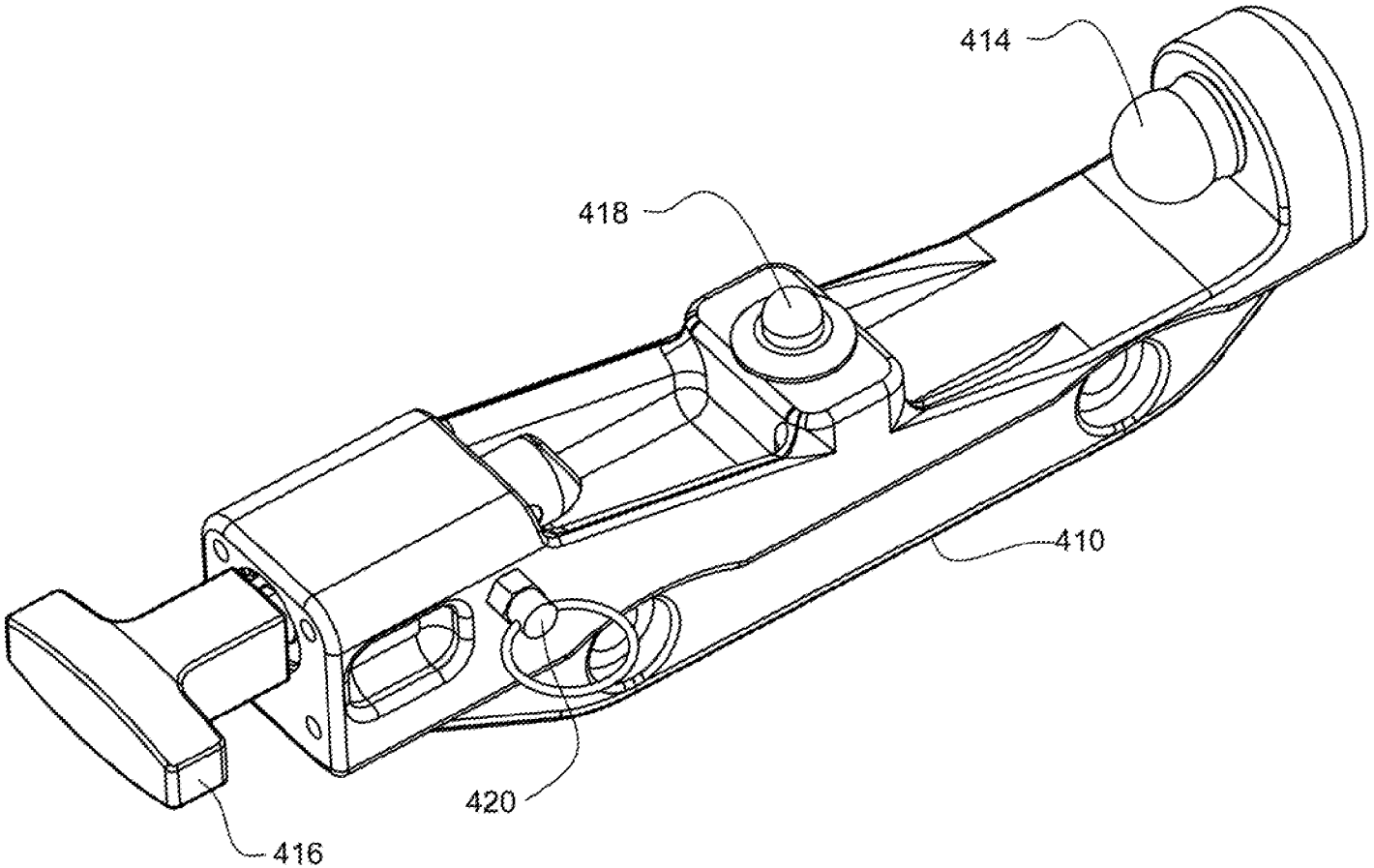
FIG. 4C is a detail view of the exemplary embodiment of the locking mechanism.

Referring now to FIGS. 4-4C, in the exemplary embodiment the mounting bracket 402 may include two flanges 408 connected to the aft section of the fuselage. In the exemplary embodiment the flanges 408 may be manufactured from any type of material, but in the exemplary embodiment, is manufactured from G10/FR4 plastic material. In alternate embodiments the flanges 408 may be manufactured from materials including but not limited to stainless steel, titanium, Garolite, fiber reinforced plastics, continuous-woven glass fabric laminate with epoxy resin, wood-plastic composites, or other similar material.

Still referring collectively to FIGS. 4-4C, in the exemplary embodiment, a locking mechanism 404 may be attached to the mounting bracket 402. The locking mechanism 404 removably attaches the cuffs 406 to the swimming propulsion device. In other embodiments, the cuffs 406 may be fixedly attached to the mounting bracket 402. In the exemplary embodiment the locking mechanism 404 may be manufactured from aluminum. In other embodiments the locking mechanism 404 may be manufactured from other materials including but not limited to stainless steel or titanium. As described below, there are many embodiments of the locking mechanism contemplated herein. Any of the embodiments described may be used in conjunction with any of the various embodiments of the various other elements of the device described herein.

Still referring to FIGS. 4-4C, the locking mechanism 404 may have a first member 410 and a second member 412. The second member 412 will be referred to herein as a "cleat." The first member 410 may be connected to the mounting bracket 402. In the exemplary embodiment the first member may include a ball 414 positioned on the aft end of the member. The ball 414 guides the cleat 412 into the first member 410. Located on the forward end of the first member 412 may be a spring-loaded pin 416. This pin 416 secures the cleat 412 to the first member 410. Furthermore, the first member 410 may also include a ball detent mechanism 418 positioned on the top surface of the member 410. This mechanism 418 assists with the disengagement of the cleat 412 from the first member 410 by providing a vertical force against the bottom surface of the cleat 412. In addition, the cleat 412 may have an indent located on its forward and aft surfaces. The aft indent may receive the ball 414 of the first member 410. Similarly, the indent on the forward surface of the cleat 412 may receive the spring-loaded pin 416. In addition, the locking mechanism 404 may also include a second spring-loaded pin 420 to secure the first spring-loaded pin 416 in the retracted position.

Still referring to FIGS. 4-4C, in operation, the aft end of the cleat 412 may be positioned such that the ball 414 is received within the indent on the aft surface of the cleat. Next, the swimmer may lower the front end of the cleat 412 into the first member 410. As the cleat 412 is positioned in the first member 410 the spring-loaded pin 416 engages the indent on the forward surface of the cleat 412 locking the cleat 412 within the first member 410. The swimmer may disengage the cleat 412 from the first member 410 by pulling the handle of the spring-load pin 416 forward. As the pin 416 is moved forward the second spring-loaded pin 420 engages the first pin 416 securing the pin 416 in the retracted position allowing the swimmer to fully disengage from the locking mechanism 408. In addition, the ball detent mechanism 418 assists with disengagement of the swimmer from the device 100 by providing a force against the bottom surface of the cleat 412 causing the cleat 412 to move away from the first member 410.

Figure 4D:
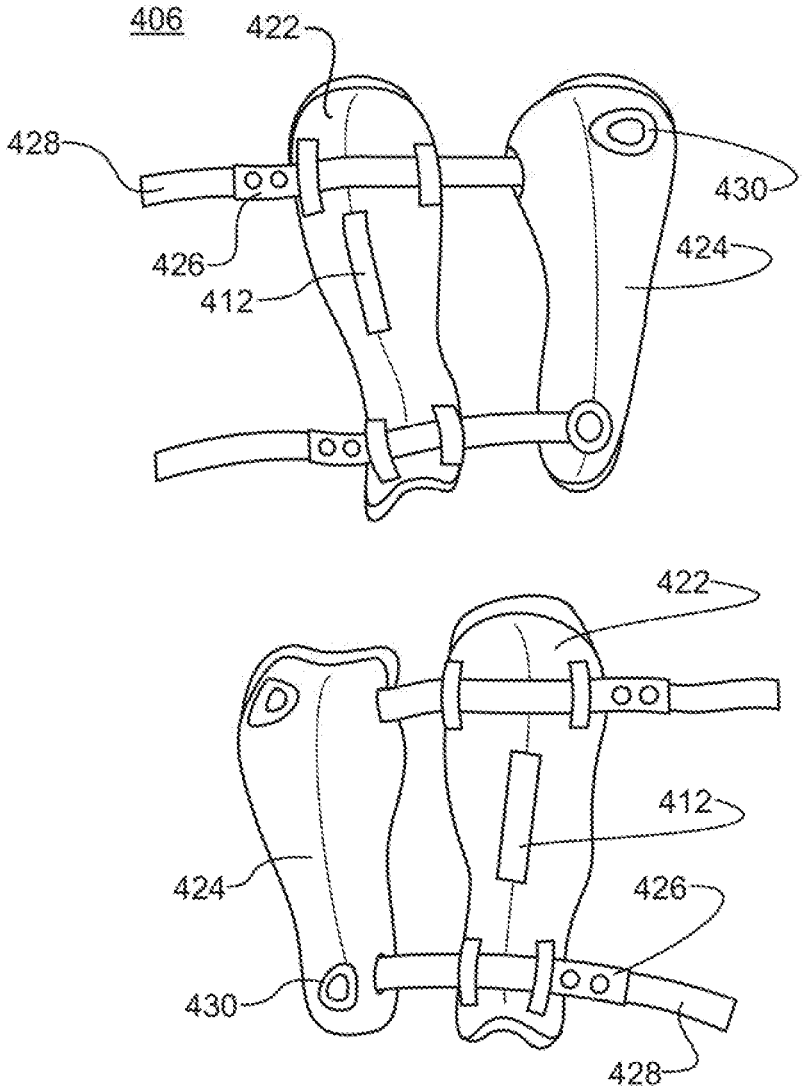
FIG. 4D is a top view of a pair of cuffs.

Referring now to FIG. 4D, the cleat 412 may be attached to the outer surface of cuffs 406. The cuffs 406 may include a front member 422 and a back member 424 (or a first cuff member and a second cuff member respectively). The front member 422 may be adapted to fit the front of a swimmer's lower leg while the back member 424 may be adapted to fit the back of the swimmer's lower leg. The cuff members 422 and 424 may be manufactured from durable waterproof lightweight material such as fiber reinforced plastic, fiberglass, carbon fiber, or similar. In the exemplary embodiments, the cuff members 422 and 424 include a hard shell. In the exemplary embodiment, the cuffs 406 may also include a neoprene foam rubber padding or foam layer to provide the swimmer with comfort while using the propulsion device. In other embodiments, materials other than or in addition to neoprene may be used, for example, any type of foam or rubber or other materials used to shape or pad an area intended for use in a water environment. Additionally, the cuffs 406 may be custom molded to the exact shape of the swimmers leg for optimum comfort and power transmission. For example, in some embodiments, this may be done using memory foams where the foam is heated then applied to the swimmer's leg for a predetermined time while the foam cools and maintains the cooled shaped.

Still referring to FIG. 4D, the exemplary embodiment may include a fastening mechanism 426 connecting the two members 422 and 424 around the swimmer's leg. In the exemplary embodiment, the fastening mechanism 426 is a strap 428 and buckle 430, as shown FIG. 4D. In the exemplary embodiment, the buckle 430 may be a ratchet type mechanism commonly used with water-sports footwear, ski boots or snowboard bindings. In other embodiments, other fastening mechanism may be used including but not limited to: hook and loop configurations, zippers, buttons, snaps, or other varieties of buckle mechanisms, or any other fastening mechanisms. In some embodiments, the fastening mechanism may be a strap and grab mechanism, where the strap doubles through a grab and secures the strap in a desired location, similar to those devices used on backpacks. In one embodiment where a strap is used, the strap is made from 1" nylon webbing from McMaster-Carr Santa Fe Springs, Calif. However in other embodiments, the strap may be made from other materials, including but not limited to those materials with endurance and strength while wet. In the exemplary embodiment, the fastening mechanism is made from plastic, but in other embodiments, the fastening mechanism may be made from any material including but not limited to stainless steel or titanium. In the exemplary embodiment, the fastening mechanism is a plastic generic snowboard binding. However in other embodiments, the snowboard binding may be one made by Burton Snowboards, Burlington, Vt.

Still referring to FIG. 4D, in operation, the swimmer wraps each removable cuff 406 around the lower part of their leg and adjusts the fit with the fastening mechanism 426. In the exemplary embodiment, the swimmer moves the strap 428 to the buckle 430 until the cuffs 406 are comfortable and snug around their legs. The swimmer may secure the fit of the cuff 406 by closing the buckle 430. The swimmer then snaps the cleats 412 of the cuffs 406 into the locking mechanism 404 on the swimming propulsion device. The attachment of the propulsion device to the cuffs 406 may be, but does not necessarily have to be, done while the swimmer is in the water.

Figure 4E:
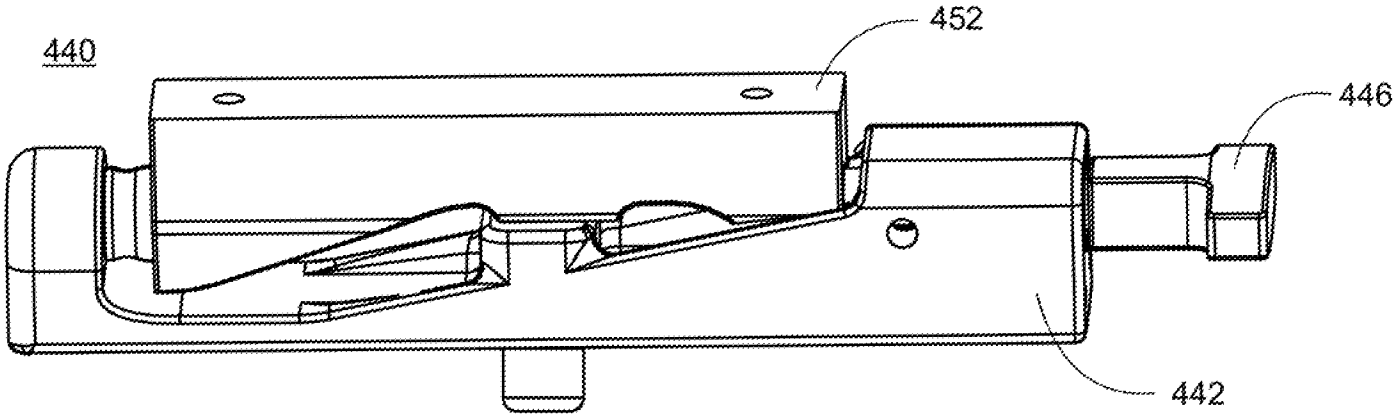
FIG. 4E is an assembly view of an alternate embodiment of the locking mechanism.
Figure 4F:
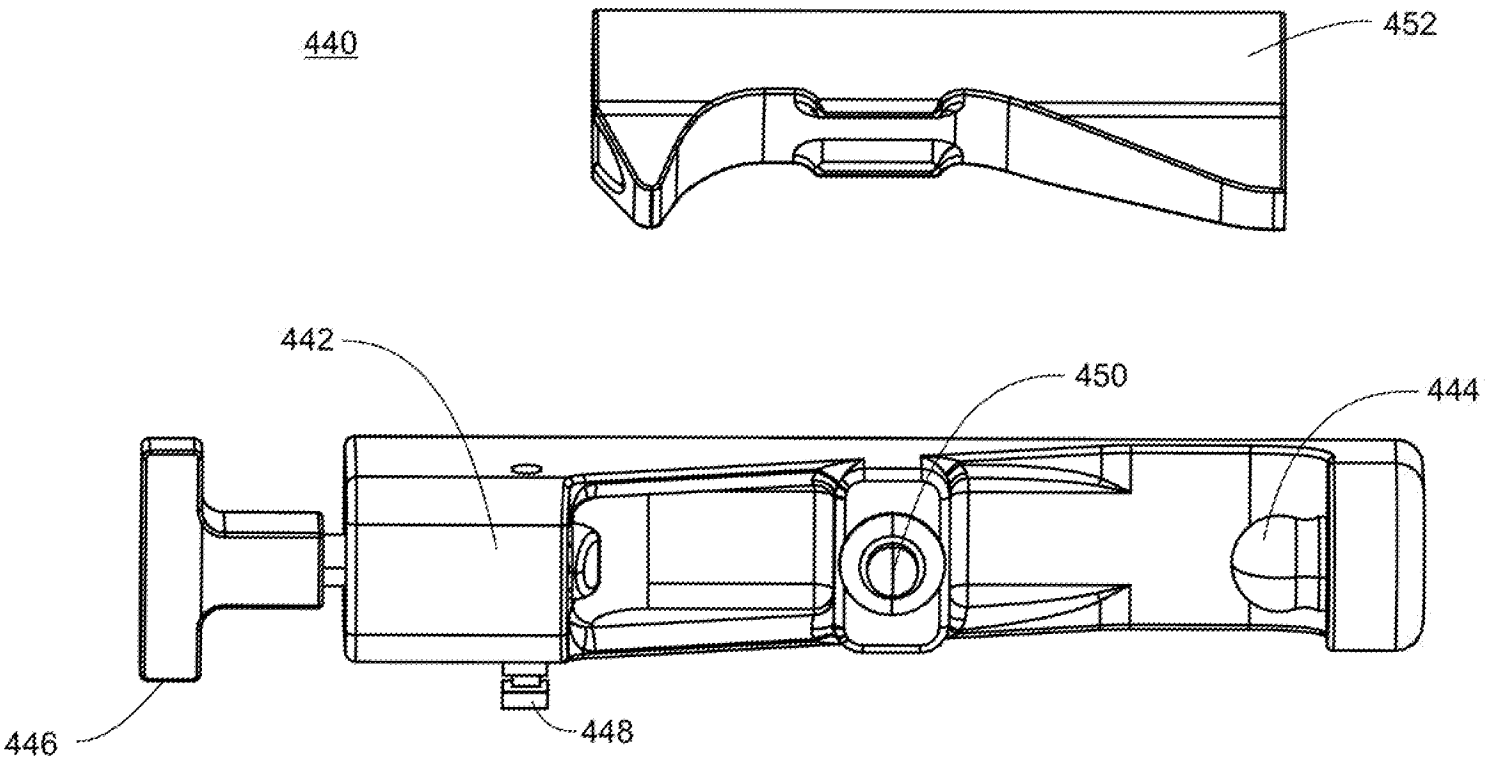
FIG. 4F is a perspective view of the alternate embodiment of the locking mechanism shown in FIG. 4E.

Below, in addition to the embodiments of the locking mechanism described above, various addition embodiments of the locking mechanism are described. Referring now to FIGS. 4E-F, these figures illustrate another embodiment of a locking mechanism 440 that may be used with the device. Similar to the previous embodiment, this mechanism includes a first member 442 having a ball 444, a first spring loaded pin 446, a second spring loaded pin 448, and a ball detent mechanism 450. In addition the mechanism includes a cleat 452 that is received by the first member 442. The operation of the locking mechanism 440 is similar to the locking mechanism 410 previously described. In the exemplary embodiment of this embodiment of the locking mechanism, the locking mechanism 440 is constructed from stainless steel, however, in other embodiments; the locking mechanism may be constructed from any material including but not limited to titanium and plastic.

Figure 4G:
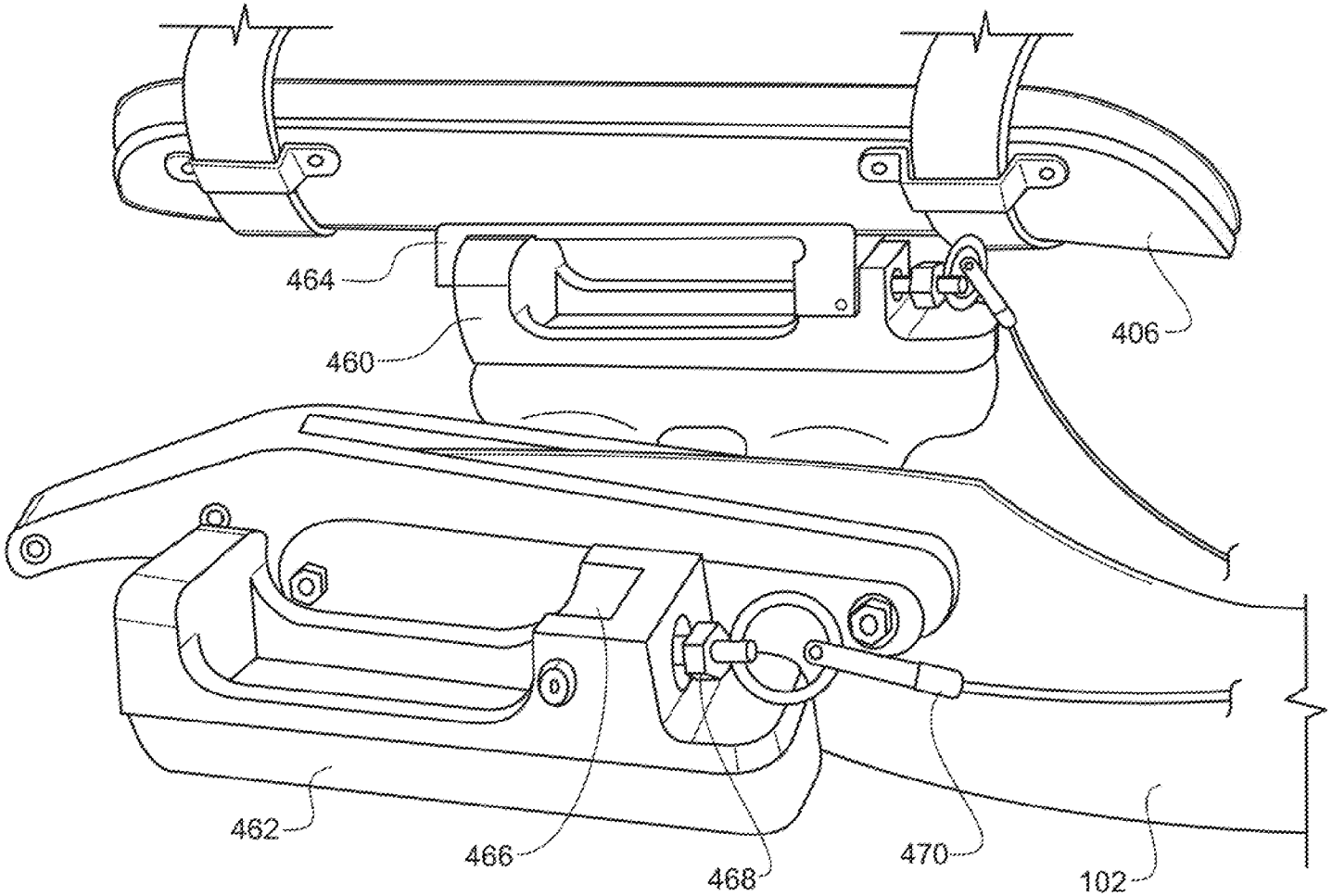
FIG. 4G is a perspective view of an alternate embodiment of the locking mechanism.

Referring now to FIG. 4G, this figure illustrates yet another embodiment of a locking mechanism 460. The locking mechanism 460 may include but is not limited to a first member 462 and a second member 464. The second member 464 is now referred to as a "cleat." The aft end of the first member 462 has an indent for receiving the aft end of the cleat 464. In addition, the forward end of the first member has a recess 466 for receiving the forward end of the cleat 464. The cleat 464 may have a ball-shaped member attached to the aft end of the cleat which is received by the indent on the aft end of the first member 462. Attached to the forward end of the cleat 464 is a member for receiving the spring-loaded pin 468. When the forward end of the cleat 464 is received within the forward end of the first member 462, the pin 468 engages the cleat 464 securing the cleat 464 to the first member. To disengage the cleat 464 from the first member 462 the operator pulls the cable 470 connected to the pins 468 to remove the pins and release the cleat 464 from the first member. Other embodiments may not include a cable 470. In yet still other embodiments the cable 470 from each locking mechanism 460 may be connected such that the swimmer may disengage both cuffs 406 from locking mechanisms 460 simultaneously.

Figure 4H:
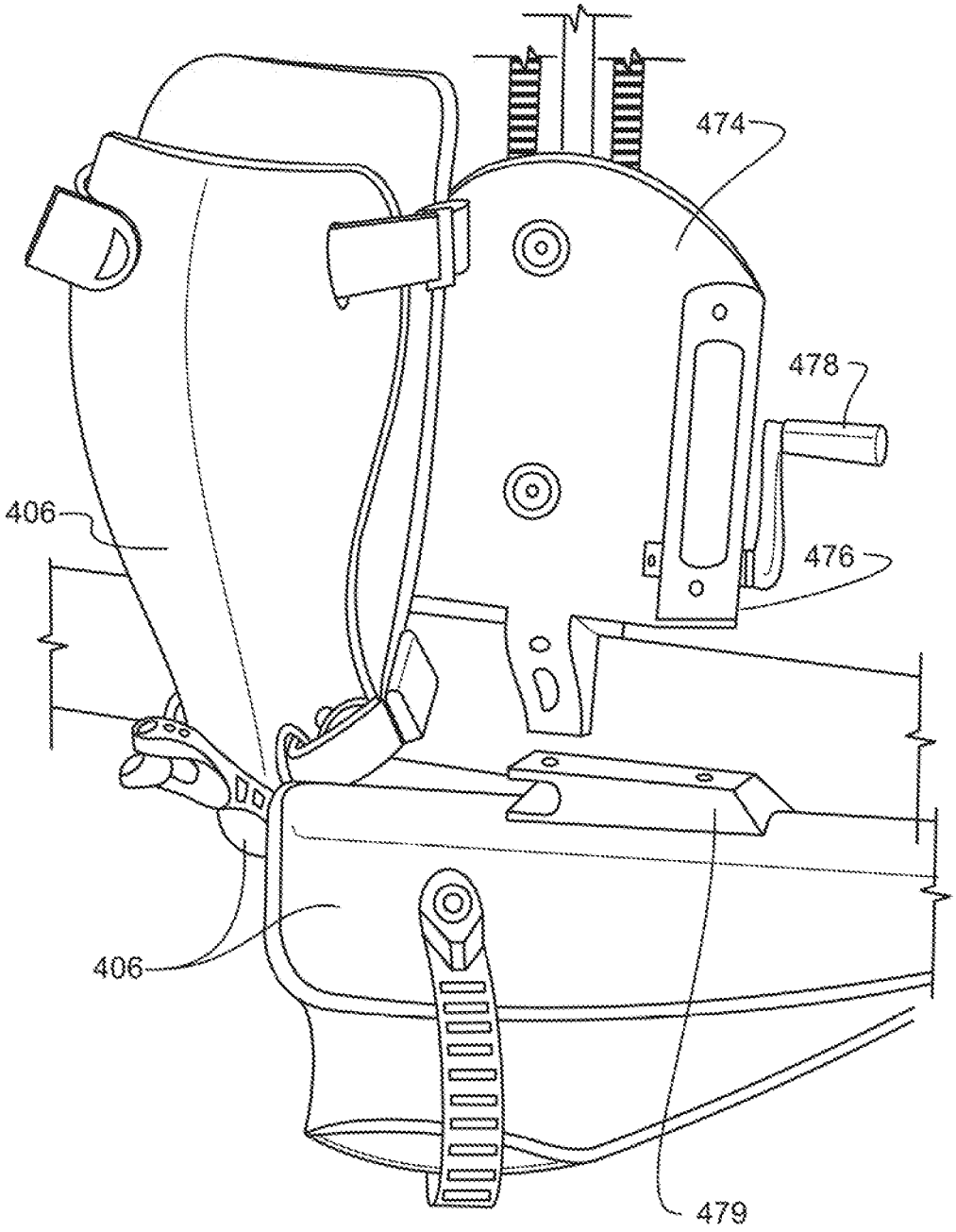
FIG. 4H is a top view of an alternate embodiment for the attachment mechanism including a locking mechanism having a handle assembly.
Figure 4I:
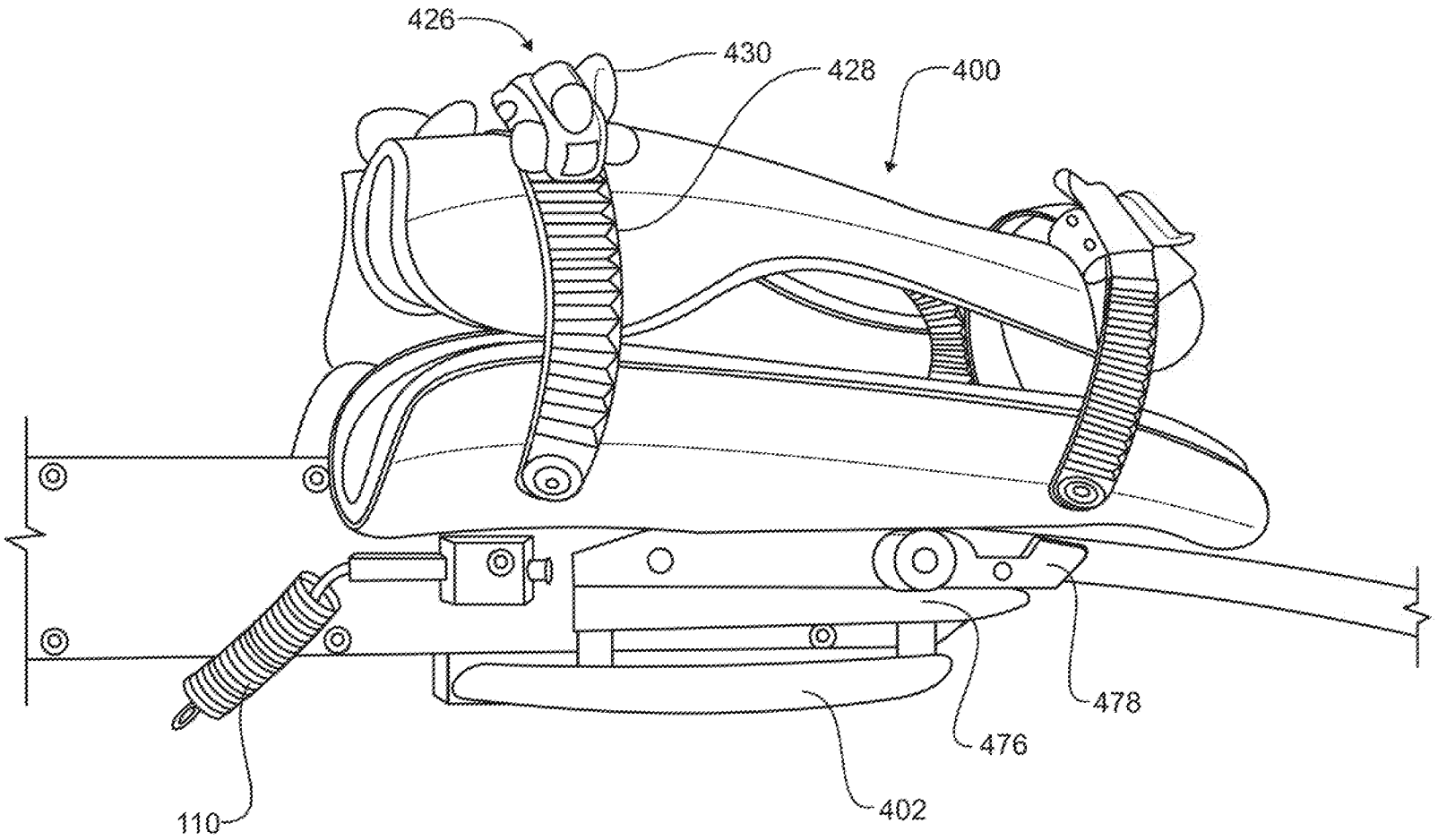
FIG. 4I is a side view of an alternate embodiment for the locking mechanism having a handle assembly.
Figure 4J:
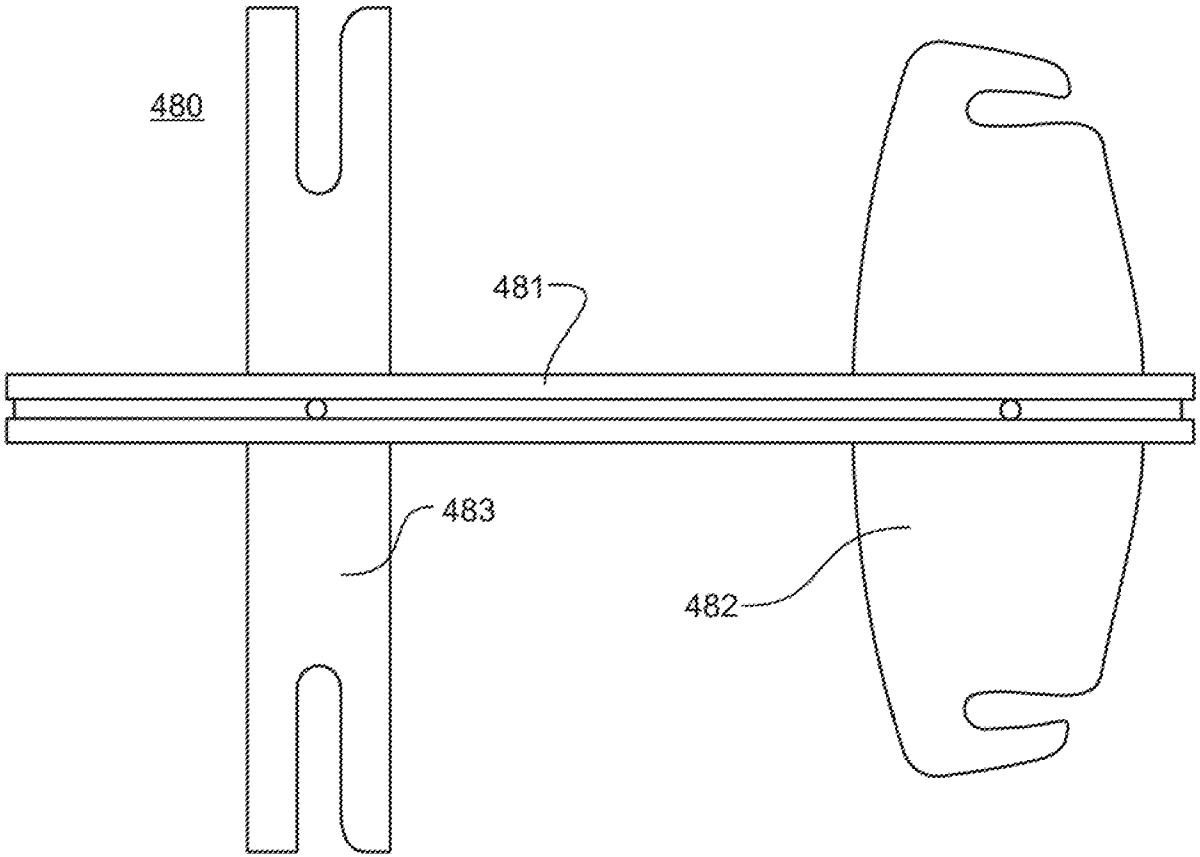
FIG. 4J is a top view of a mounting bracket for alternate embodiment of an attachment mechanism.
Figure 4K:
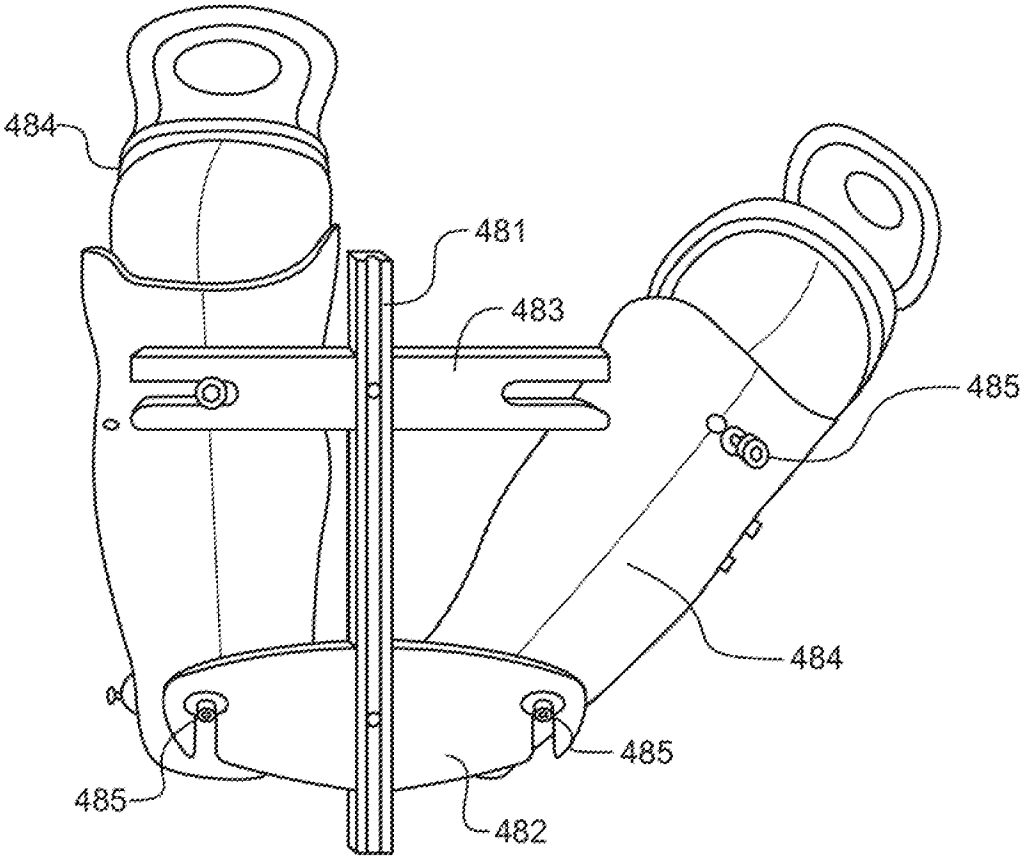
FIG. 4K is a bottom view of an alternate embodiment of the attachment mechanism illustrating the connection of the cuffs to the mounting bracket shown in FIG. 4J.
Figure 4L:
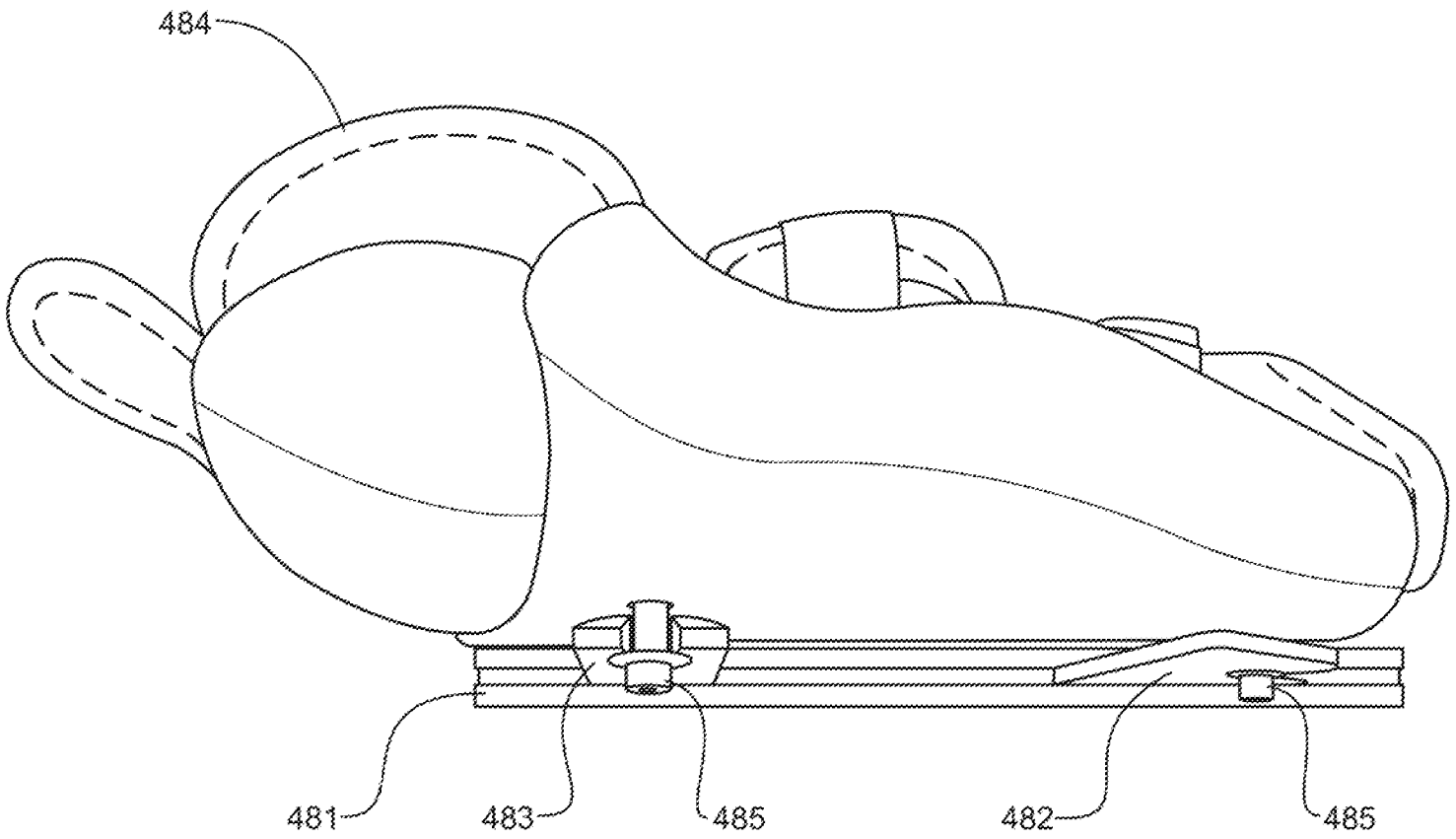
FIG. 4L is a side view of the attachment mechanism in FIG. 4K.
Figure 4M:
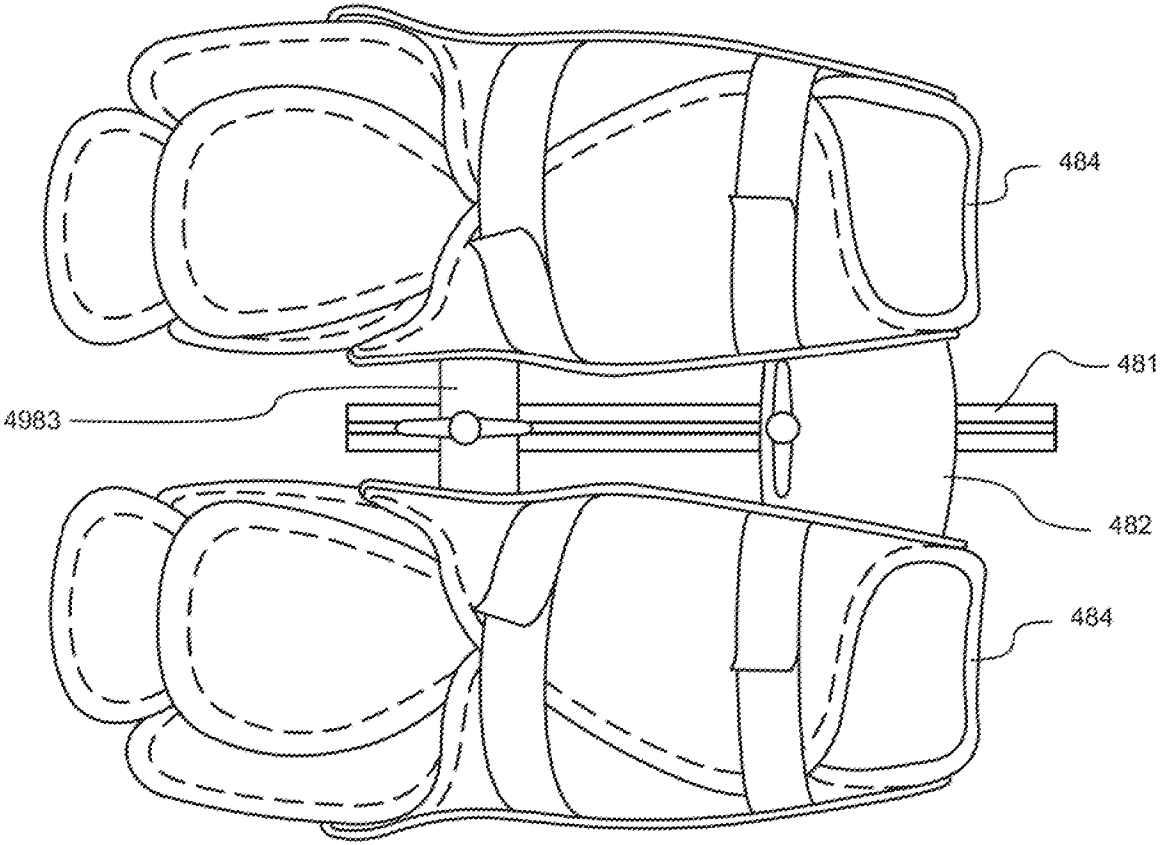
FIG. 4M is a top view of the attachment mechanism in FIG. 4K.
Figure 4N:
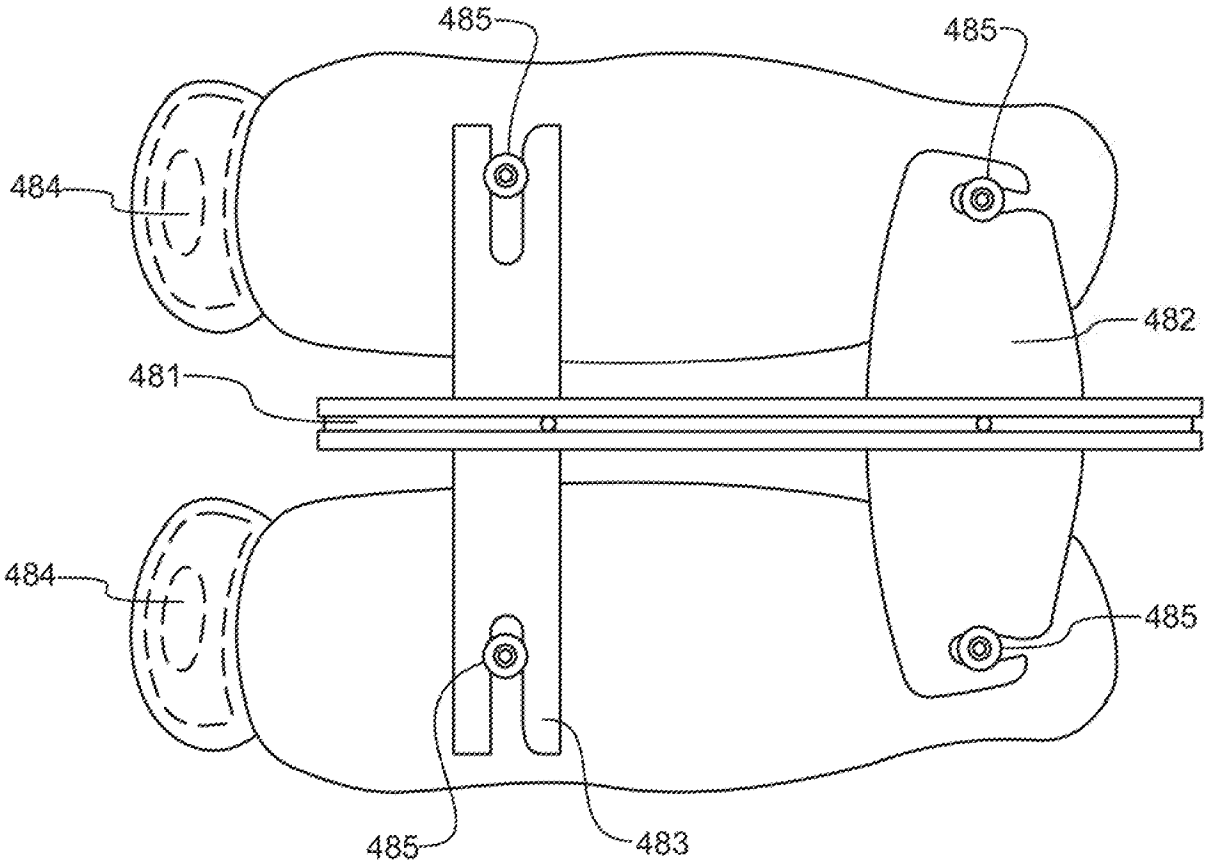
FIG. 4N is a bottom view of the attachment mechanism in FIG. 4K.

Referring now to FIGS. 4H-I, another embodiment of the attachment mechanism is shown. The attachment mechanism may include a mounting bracket 474 and a locking mechanism 476. In this embodiment, the mounting bracket 474 is a single plate attached to the top surface of the aft section of the fuselage rather than the sides. This mounting bracket 474 may be connected to the fuselage using fasteners/control mechanism 110. The mounting bracket 474 may be manufactured from any material, including but not limited to those materials including characteristics, including but not limited to: low water absorption, structural strength, and lightweight.

Still referring to FIGS. 4H-I, the locking mechanism 476 may include a handle assembly 478. This assembly secures the cleat 479 in place when the cleat is slidably received by the locking mechanism 476. In operation, the swimmer may position one end of the cleat 479 into the end of the locking mechanism 476 opposite of the handle assembly 478. Next, the swimmer inserts the second end of the cleat 479 into the end of the locking mechanism 476 nearest to the handle assembly 478. With the cleat 479 received within the locking mechanism 476 the handle assembly may be rotated such that the assembly secures the cleat within the mechanism. In another embodiment, the handle assembly 478 of the locking mechanisms 476 may be connected such that the swimmer only need pull one handle assembly 478 to release both cuffs 406 from the locking mechanisms 476.

Referring now collectively to FIGS. 4J-N, some embodiments of the swimming propulsion device may include an attachment mechanism that does not include a locking mechanism. In these embodiments, the swimming propulsion device may include a mounting bracket 480 having a base 481, an aft plate 482 and a forward plate 483 as shown on FIG. 4J. The base 481 may be adjustable to allow the swimmer to reposition the aft plate 482 or the forward plate 483. Other embodiments may not include a mounting bracket 480 but rather have the forward plate 483 and aft plate 481 attach directly to the fuselage 102. In addition, the aft plate 482 and forward plate 483 may have a plurality of slots or channels for slidably receiving cuffs 484. In this embodiment, the mounting bracket 480 may be manufactured from any material, including but not limited to those materials including characteristics, including but not limited to: low water absorption, structural strength, and lightweight.

Still collectively referring to FIGS. 4J-N, similar to the embodiments described above, cuffs 484 may be used to attach the device to the swimmer. In this embodiment, the cuffs 484 may be similar to the cuffs described above but may include a plurality of T-shaped members 485 in place of cleats. In operation, the swimmer positions the cuffs 484 such that the T-shaped members 485 are slidably received within the channels of the aft plate 482. The channels may have a width that is greater than the small diameter section of the T-shaped member 485, but is smaller than the large diameter section of the T-shaped member 485. The large diameter section of the T-shaped members 485 prevents vertical displacement between the swimmer and the device. Thus, when the T-shaped members 485 are inserted within the channels of the forward plate 483 and aft plate 482 the swimmer is physically attached to the device.

Figure 4O:
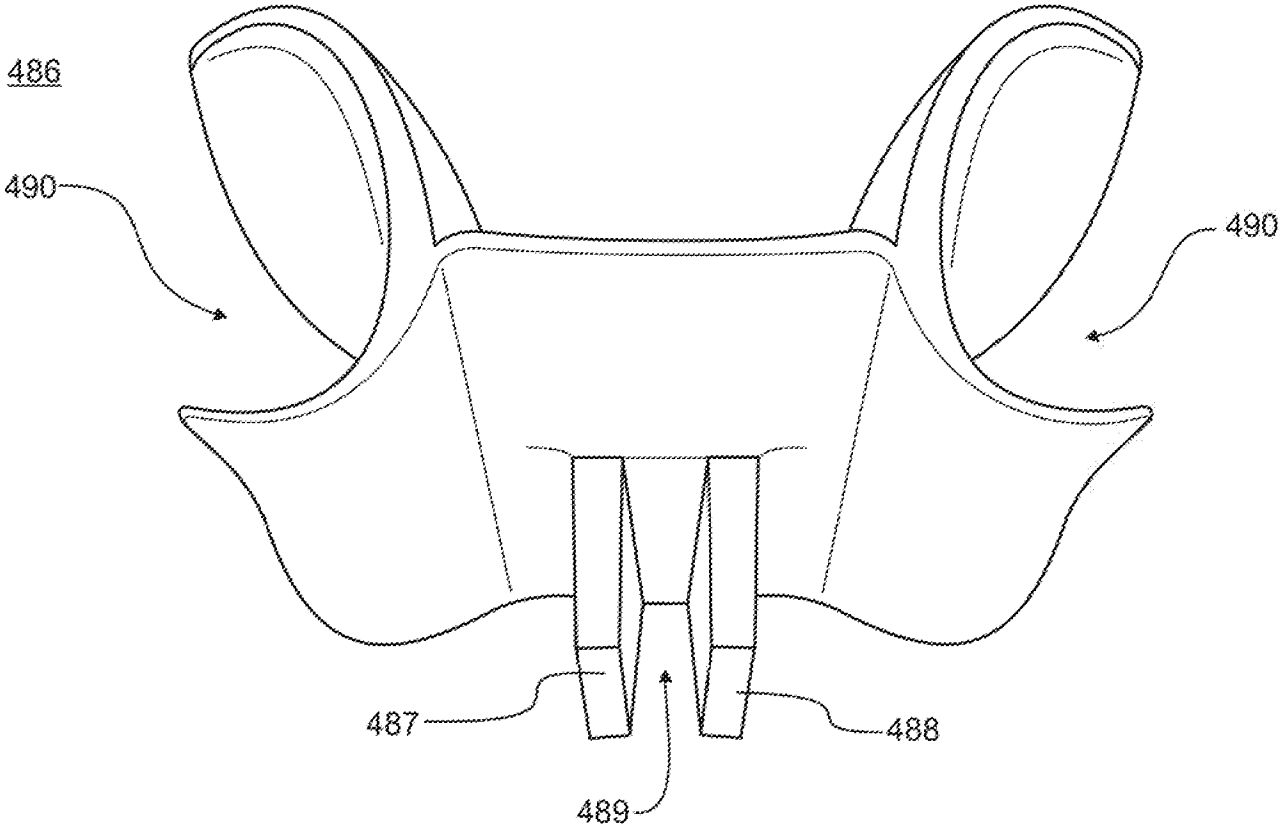
FIG. 4O is a front view of an alternate embodiment of the attachment mechanism.
Figure 4P:
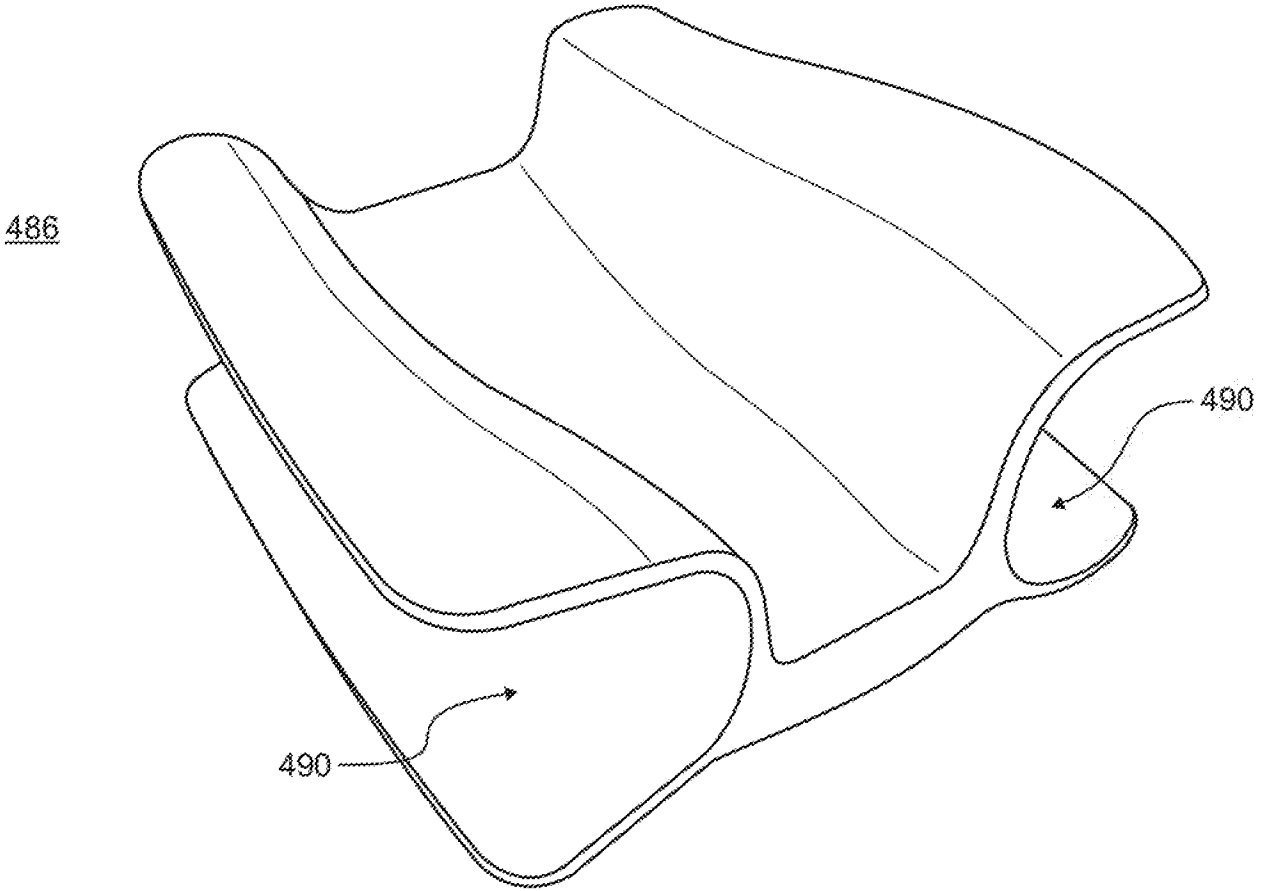
FIG. 4P is a front-perspective view of the attachment mechanism in FIG. 4O.
Figure 4Q:
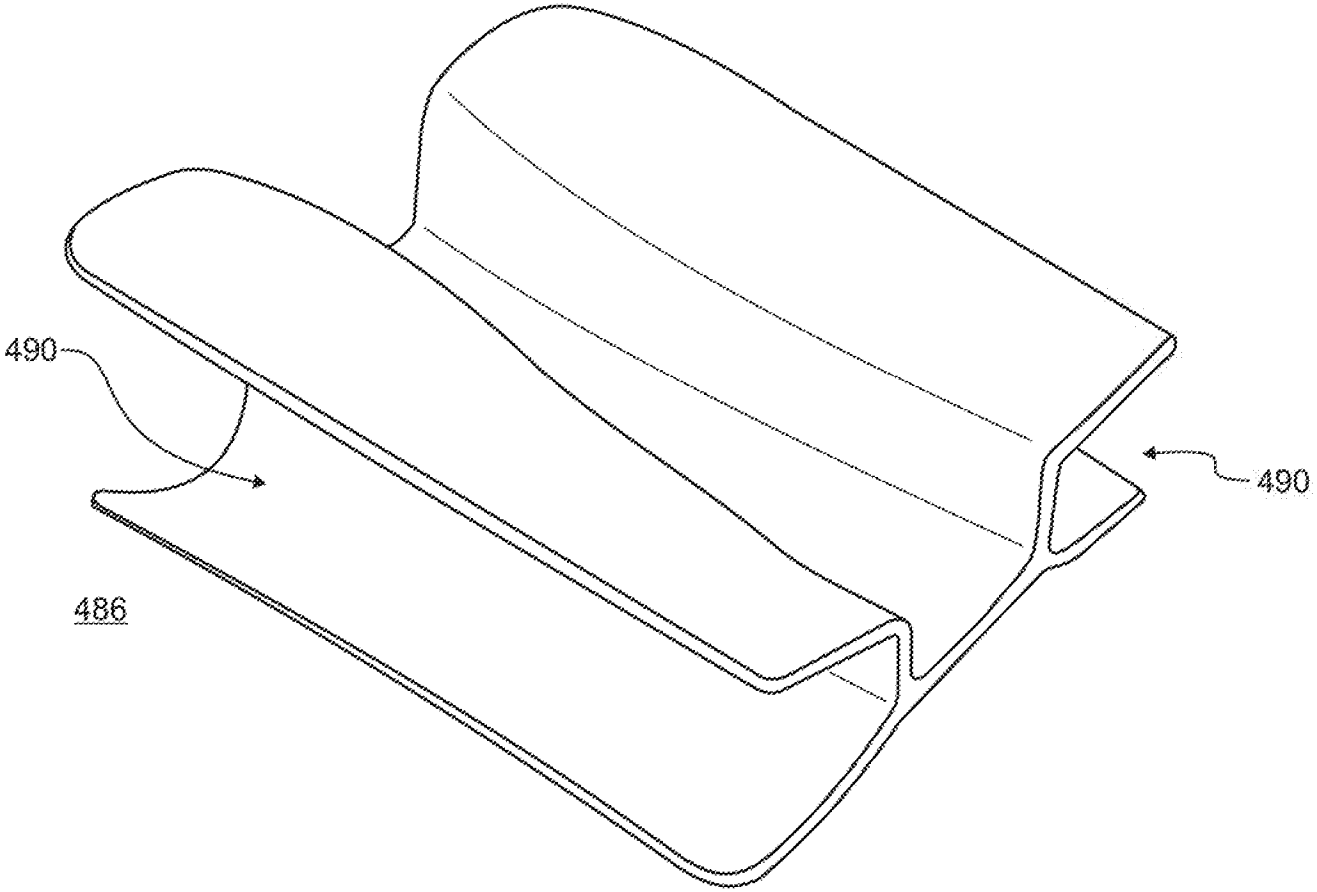
FIG. 4Q is a rear-perspective view of attachment mechanism in FIG. 4O.

Referring collectively to FIGS. 4O-Q, another embodiment of the attachment mechanism 486 is shown. This attachment mechanism 486 may attach directly to the aft end of the fuselage (not shown). In this embodiment the attachment mechanism 486 may include mounting brackets 487 and 488 that define a slot 489. The attachment mechanism 486 may be positioned on the fuselage such that the aft end of the fuselage is located within the slot 489. The attachment mechanism 486 may be connected to the fuselage using fasteners that pass through apertures in the mounting brackets 487 and 488 and the aft section of the fuselage. In the exemplary embodiment of this embodiment, the attachment mechanism 486 may be manufactured from a fiberglass and wood composite. Other materials that may be used to manufacture the attachment mechanism 486 in various embodiments, those materials include but are not limited to carbon fiber or plastic. In operation the swimmer may slide his legs into the channels 490 located on either side of the attachment mechanism 486. The channels 490 may contain the lower part of the swimmer's legs attaching the swimmer to the propulsion device 100. The channels 490 may be sufficiently elastic or flexible to allow the swimmer to manipulate the opening of the channels 490 to allow the swimmer to insert his/her leg. In addition, the attachment mechanism 486 may have channels 490 that sufficiently wrap around the swimmer's leg to maintain a secure connection between the swimmer and the device, but also allow sufficient access for the swimmer to insert and remove his/her leg from the device. In alternate embodiments the channels may be tapered or custom fitted to the swimmer's lower legs.

Figure 4R:
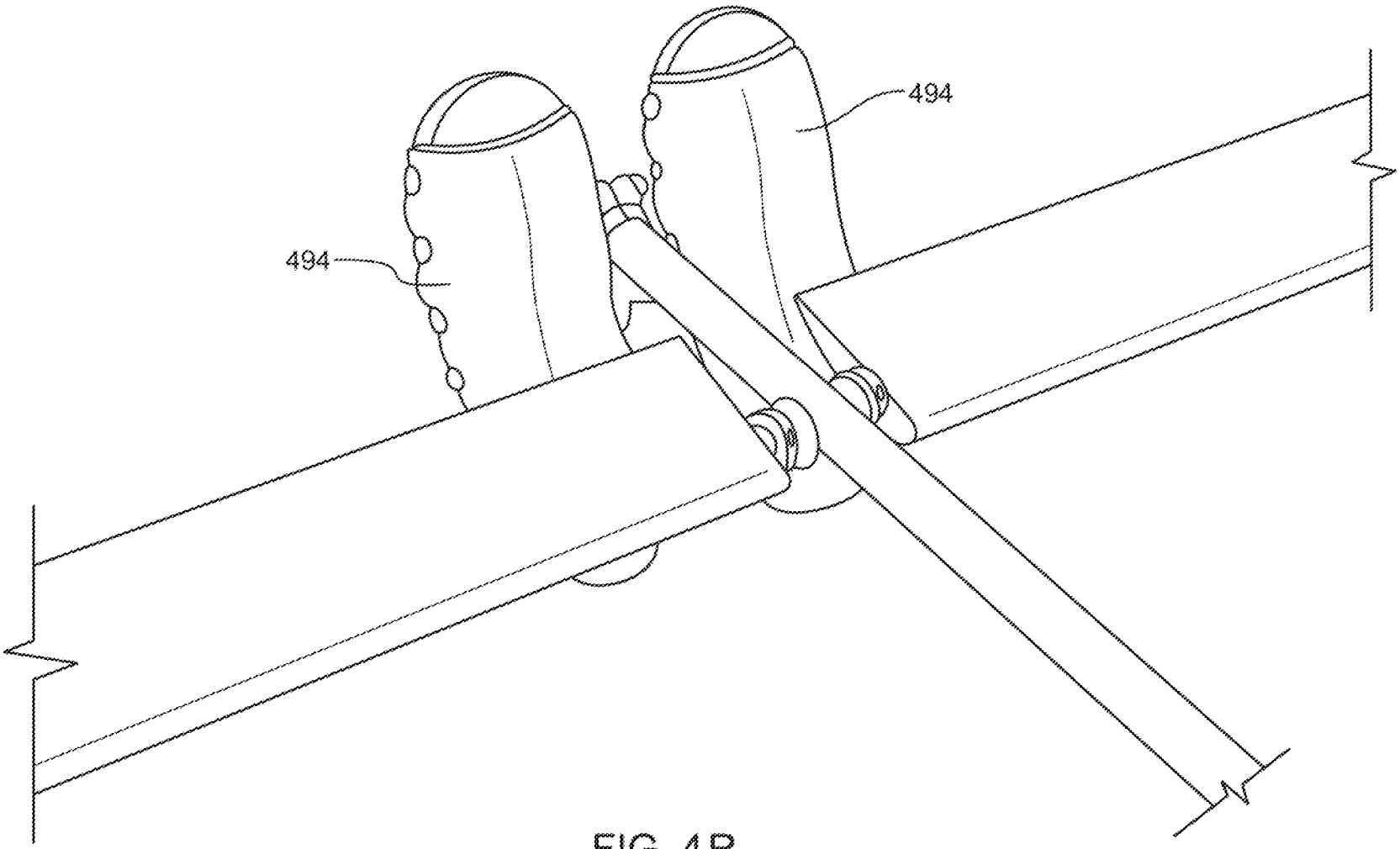
FIG. 4R is a perspective view of an alternate embodiment of the attachment mechanism.
Figure 4S:
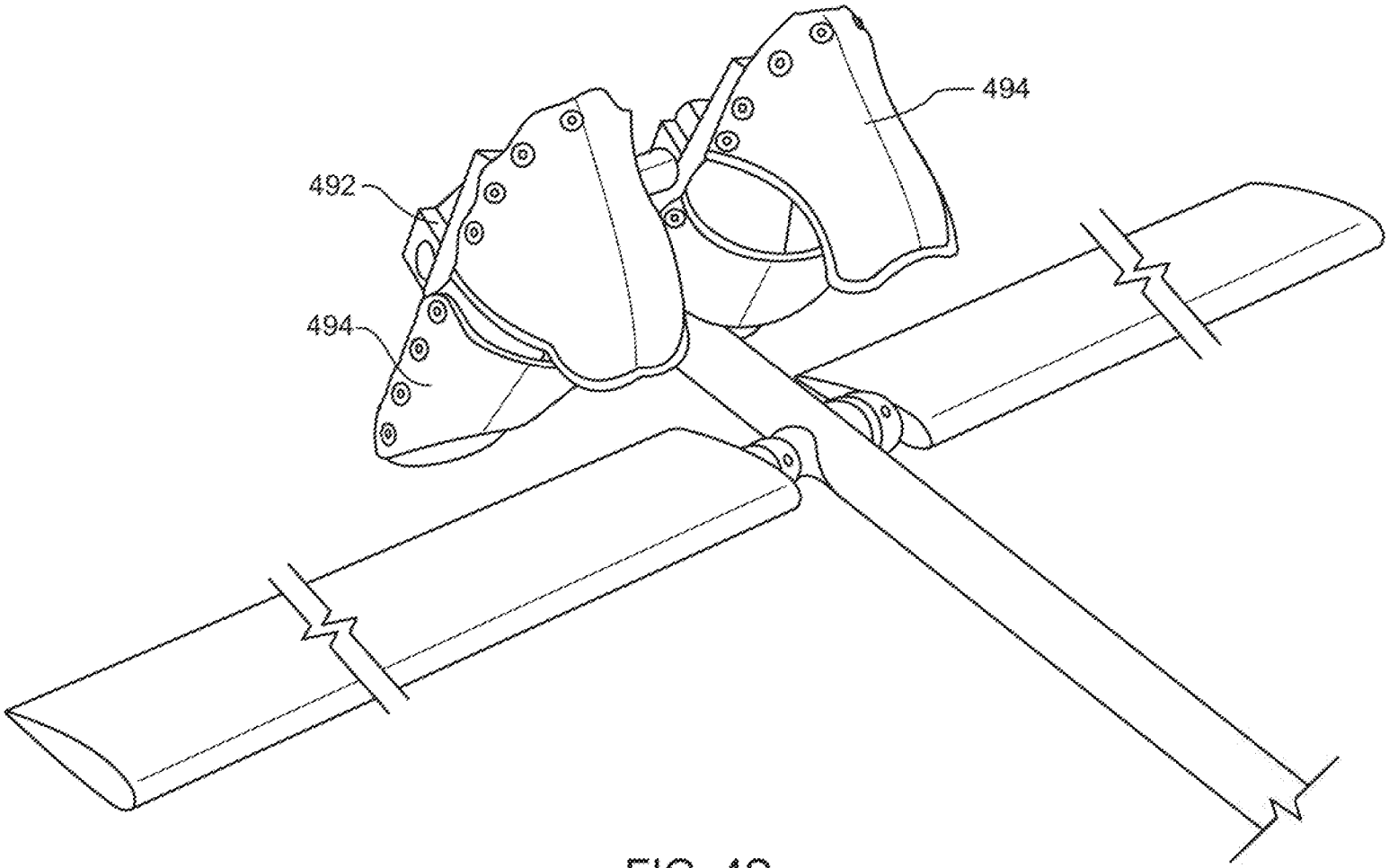
FIG. 4S is a perspective view of the attachment mechanism in FIG. 4R.

In various additional embodiments of the swimming device, the attachment mechanism may include embodiments designed to attach the swimmer's feet or feet/ankle area to the device, rather than the embodiments described above which are designed to attach the swimmer's legs to the device. Referring now to FIGS. 4R-S, one embodiment of the foot attachment mechanism is shown. In this embodiment a platform 492 may be pivotally attached to the aft section of the fuselage. Attached to the platform 492 may be a housing 494 for receiving the swimmer's feet. The housing 494 in some embodiments is a "bootie" type housing for feet. In some embodiments each foot may be independent of the other. In addition to securing the swimmer's feet, some embodiments of this embodiment of the swimming device may include a strap (not shown) or series of straps designed to attach the upper part of the swimmer's leg to the fuselage of the swimming device. This embodiment may provide greater comfort to the swimmer.

Referring now to FIGS. 23-23K and FIG. 20 and FIG. 20B, in another exemplary embodiment the mounting bracket 2028 may include two flanges 2040 connected to the aft section of the fuselage 2002. In another exemplary embodiment the flanges may be manufactured from any type of material, but in another exemplary embodiment, is manufactured from G10/FR4 plastic material. Still referring collectively to FIGS. 23-23K and FIG. 20 and FIG. 20B, in another exemplary embodiment, a locking mechanism 2300 may be attached to the mounting bracket 2028. The locking mechanism 2300 removably attaches the cuffs 2350 to the swimming propulsion device 2000.

Still referring to FIGS. 23-23K, and additionally FIG. 20, the locking mechanism 2300 may involve two parts, a first member herein called a mating part, or mounting attachment 2302 and a second member herein called a cleat 2304. In another exemplary embodiment, the mounting attachment 2302 may have raised sides to assist the swimmer with finding the proper location for the cleat 2304 to attach the cuff 2350. The walls may also provide strength in the mounting attachment 2302. The mounting attachment 2302 may be connected to the mounting bracket 128. In another exemplary embodiment the first member 2302 may include a ball 2312 positioned on the aft end of the member 2302. The ball 2312 guides the cleat 2304 into the first member 2302. In another exemplary embodiment, the mounting attachment 2302 may utilize an over the center latch 2308 to enter and exit the device 2000 easily. The over the center latch 2308 may involve at least one spring 2306 to provide a secure attachment of the cuffs 2350 to the mounting attachment 2302. The cuffs 2350 may include a fastening mechanism 2324 to secure the swimmer within the cuffs 2350. The fastening mechanism 2324 may be, but not limited to a generic snowboard binding 2324. In another exemplary embodiment, the cuffs 2350 may contain slits 2316 on the side nearest the binding 2324 to allow the swimmer to move the bindings 2324 to an angle to ease adjustments.

Still referring to FIGS. 23-23K, the indent 2314 on the forward surface of the mounting attachment 2302 may receive the top portion of the latch 2330. In addition, the locking mechanism 2300 may also include a cantilever spring 2306 to secure the latch 2308 on the mounting attachment 2302 in a locked position. In another exemplary embodiment, the mating part 2302 and cleat 2304 may be manufactured from plastic.

Still referring to FIGS. 23-23K, in operation, the aft end of the cleat 2304 may be positioned such that the ball 2312 is received within the indent 2310 on the aft surface of the cleat 2304. Next, the swimmer may lower the front end of the cleat 2304 into the first member 2302. As the cleat 2304 is positioned in the first member 2304 the over the center latch 2308 engages the indent 2314 of the forward surface of the cleat 2304 locking the cleat 2304 within the first member 2302 by closing the latch 2318 below the cleat 2304. The swimmer may disengage the cleat 2304 from the first member 2302 by pulling the handle 2318 of the over the center latch 2308 up and forward from under the cleat 2304. As the handle 2318 is moved up, the cantilever spring 2306 pushes the cleat 2304 up from the locked position to disengage the swimmer from the device 2000.

Still referring to FIGS. 23-23K, the cleat 2304 may be attached to the outer surface of cuffs 2350. The cuffs 2350 may include a front member 2320 and a back member 2322 (or a first cuff member and a second cuff member respectively). The front member 2320 may be adapted to fit the front of a swimmer's lower leg while the back member 2322 may be adapted to fit the back of the swimmer's lower leg. The cuff members 2350 may be manufactured from durable waterproof lightweight material such as fiber reinforced plastic, fiberglass, carbon fiber, or similar. In another exemplary embodiment, the cuff members 2350 include a hard shell made from pressure form molded kydex. However any thermoplastic may be used in place of kydex also a pressure formed mold is not required to make the hard shell in other embodiments. Another exemplary embodiment uses kydex however other tough plastics and carbon fiber may be used in place of the kydex. In another exemplary embodiment, the cuffs 2350 may also include an EVA foam rubber padding or foam layer (not shown) to provide the swimmer with comfort while using the propulsion device.

Still referring to FIGS. 23-23K, another exemplary embodiment may include a fastening mechanism 2324 connecting the two members 2320,2322 around the swimmer's leg. In another exemplary embodiment, the fastening mechanism 2324 is a strap and buckle, as shown in FIG. 23F. In one embodiment of another exemplary embodiment, the buckle may be a ratchet type mechanism commonly used with water-sports footwear, ski boots or snowboard bindings. In another exemplary embodiment, the fastening mechanism 2324 is made from plastic, but in other embodiments, the fastening mechanism 2324 may be made from any material including but not limited to stainless steel or titanium. In one embodiment of another exemplary embodiment, the fastening mechanism 2324 is a plastic generic snowboard binding. Another exemplary embodiment may further involve Velcro to attach any excess part of the strap to the outer side of the front cuff member 2320. This Velcro secures the excess strap for the swimmer's safety as to prevent the strap from snagging anything in the water.

Stabilizer

The swimming propulsion device includes a stabilizer. The stabilizer is provided to act against the force applied to the propulsor. Various embodiments of the stabilizer may be used with the device, some of which are described herein. However, although the various embodiments of the device shown herein include a stabilizer, in other embodiments, the device does not include a stabilizer. In these embodiments, the swimmer may use traditional swimming fins as a stabilizing device. Although in these embodiments, the swimming device may not be optimally stabilized, the decrease in stabilization may be mitigated by an increased maneuverability.

The stabilizer, as shown in the various embodiments herein, may have any size desired. However, the same considerations regarding buoyancy, weight and size as described above with respect to the propulsors also may be applied to the stabilizers.

With respect to the span of the stabilizer, a shorter span not only weighs less, but will be more maneuverable by the swimmer in use. For example, as the stabilizer is located behind the swimmer's field of vision, a longer stabilizer may present difficulties to the swimmer in avoiding collisions with objects. Thus, in the exemplary embodiments, the span of the stabilizer is shown to be shorter in span than the propulsors. Where the propulsors are within the swimmer's field of vision, if the swimmer is traveling in a straight path, if the propulsor clears an object, there's a high probability that the stabilizer will as well.

However, in some embodiments, the span of the stabilizer may be longer than the propulsors, and in some embodiments, the span may be shorter than the propulsors, but longer than shown in the accompanying figures herein. In the exemplary embodiments of the stabilizer, the stabilizer is designed to work outside of the turbulent vortex given off by the swimmer.

Figure 5:
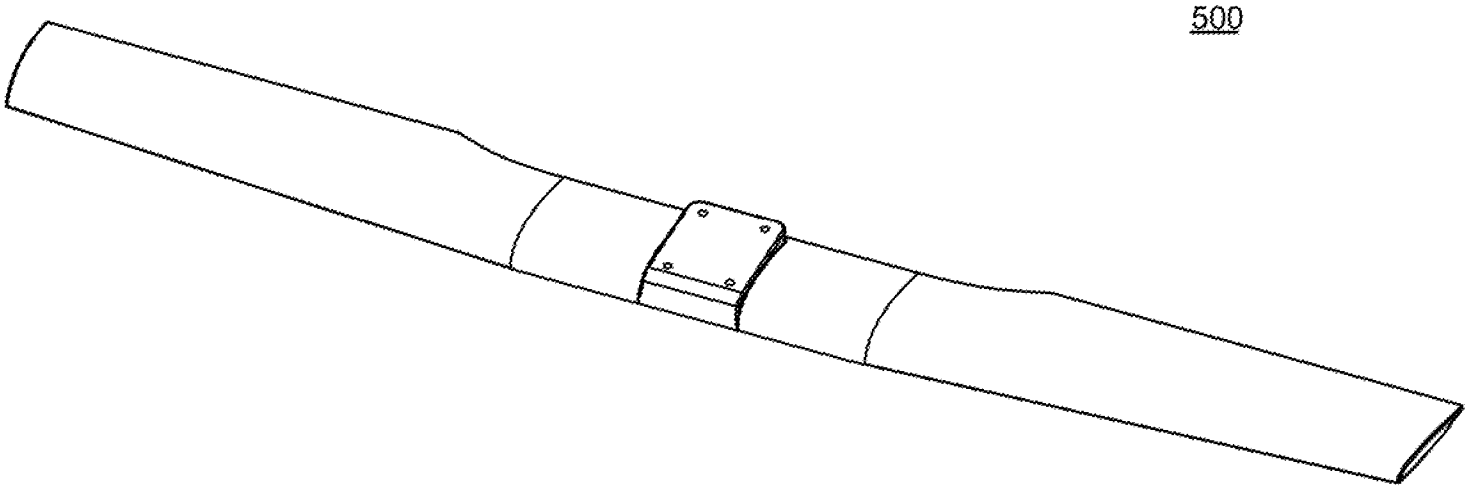
FIG. 5 is a perspective view of the exemplary embodiment of the stabilizer.
Figure 5B:
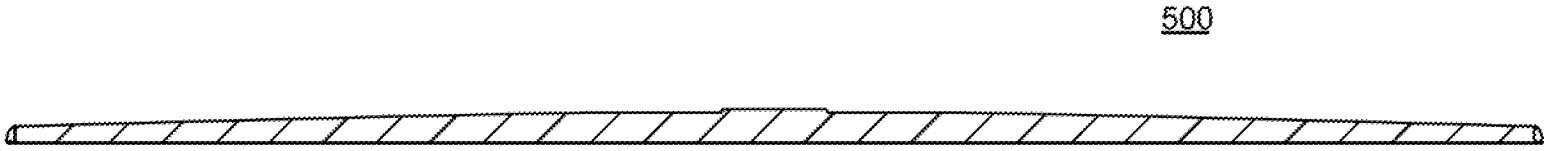
FIG. 5B is a longitudinal cross-section view of the stabilizer illustrated in FIG. 5.
Figure 5A:
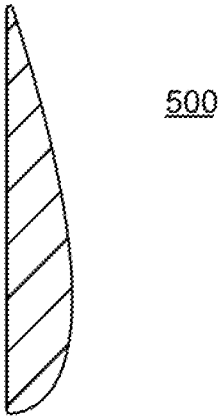
FIG. 5A is a transverse cross-section view of the stabilizer illustrated in FIG. 5.
Figure 5C:
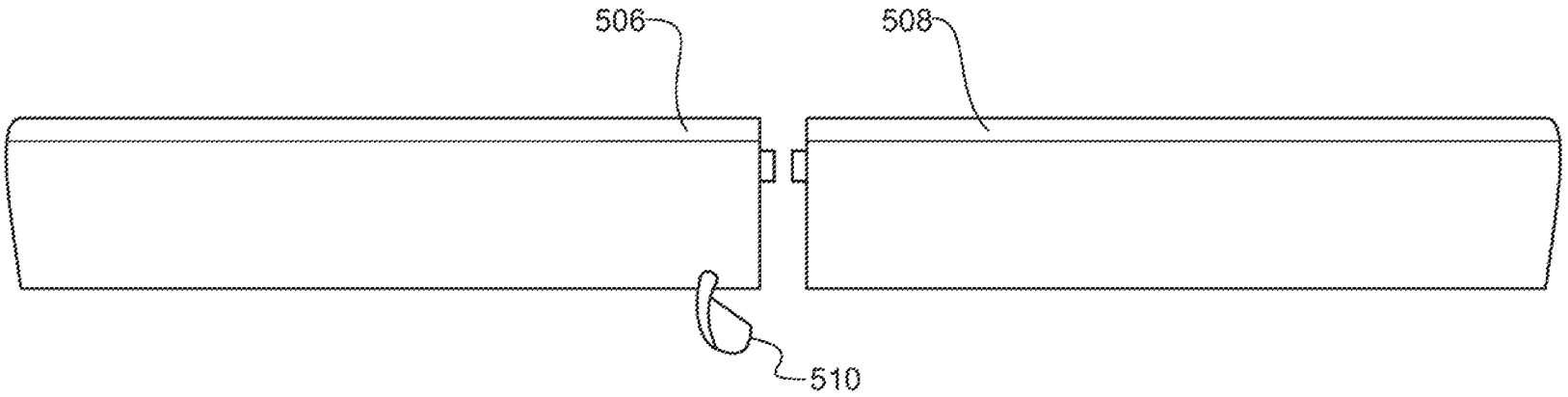
FIG. 5C is a top view of one embodiment of the stabilizer having two rectangular-airfoil shaped members.

Referring collectively to FIGS. 5-5C, the exemplary embodiment of the swimming propulsion device may include at least one stabilizer 500 (also identified as 106 on FIG. 1). As described above, some embodiments of the device do not include a stabilizer. The stabilizer 500 may be attached to the aft section of the fuselage (not shown). The stabilizer 500 may be angled such that at the mid point during the swimming stroke the stabilizer is parallel to the plane of forward motion thereby reducing drag as the swimmer travels through the water. In addition, the stabilizer 500 may be positioned on the aft section of the fuselage 102 allowing the stabilizer 500 to rotate with the device 100 rather than moving vertically during operation. Furthermore, in the exemplary embodiment, the stabilizer 500 may have sufficient surface area to provide support for the swimmer to prevent flailing or waiving of his legs during use the propulsion device 100.

Still referring to FIGS. 5-5C, the stabilizer 500 may be manufactured from materials including but not limited to plastic G10/FR4, Garolite, fiber reinforced plastic, wood-plastic composite, or other similar material. In the exemplary embodiment, the stabilizer 500 is manufactured from a combination of wood and carbon fiber. Alternate embodiments may include a stabilizer 500 manufactured from any other material, and in some embodiments the material may have one or more of the following characteristics: low water absorption, structural strength, and lightweight.

Still referring to FIGS. 5-5C, in the exemplary embodiment, the stabilizer 500 may include a single member or body having a tapered-airfoil shape on top, and in the exemplary embodiment, the stabilizer has a NACA profile on top, with a flat-bottom surface as shown on FIG. 5A. In the exemplary embodiment, the stabilizer 500 has a chord length of 4.6 inches, a span of 40 inches, and a thickness of 0.88 inches. In other embodiments the span or chord length may vary to increase the stability of the device, or may vary to decrease the weight of the device. In addition, the stabilizer 500 may include a notch 502 located on the aft edge of the stabilizer 500 to accommodate the swimmer's feet. In other embodiments the shape of the stabilizer 500 may include but is not limited to tapered airfoils or rectangular airfoils. The airfoil shape shown in the exemplary embodiment is only one embodiment. However, other airfoil shapes may be used. Similarly, in alternate embodiments, the stabilizer 500 may be curved and/or have tubercles.

Still referring to FIGS. 5-5C, in the exemplary embodiment the stabilizer 500 may be fixedly mounted to the aft section of the fuselage. In addition, the stabilizer 500 may also be removably attached to the fuselage 102. In this embodiment, a mounting bracket (not shown, shown in FIG. 1B as 121) may be affixed to the top surface of the stabilizer 500. A pin secures the mounting bracket to the fuselage. In operation the stabilizer 500 may be removed from the fuselage by removing the pin. When the pin is completely removed the stabilizer may be rotated downwardly until the mounting bracket is orientated, such that, the bracket may be removed from the fuselage. In yet further embodiments, the stabilizer 500 may be collapsibly attached to the fuselage using an elastic member similar to the method previously described for the propulsors herein.

Still referring to FIGS. 5-5C, in other embodiments, the stabilizer 500 may be adjustably mounted allowing the swimmer to change the angle of the stabilizer. Changing the angle of the stabilizer 500 may be desirable if the swimmer is towing another swimmer or an object. By changing the angle of the stabilizer 500, the swimmer may ensure his legs stay relatively stable as he uses the propulsion device 100.

Still referring to FIGS. 5-5C, although in the exemplary embodiment, as described above, the stabilizer 500 is a single member or body, in other embodiments, the stabilizer may consist of a first member 506 and second member 508 as shown on FIG. 5C. This embodiment may further include where the stabilizers 506 and 508 hingedly attach to the aft section of the fuselage to allow the stabilizers to collapse. In some embodiments, the stabilizers 506 and 508 may have curved proximal ends and be located at a distance from the fuselage. This provides clearance to fold the stabilizers 506 and 508. In another embodiment, a tow hook 510 may be attached directly to the stabilizers 504 and 506 as shown in FIG. 5C.

Now referring to FIGS. 24-24V and FIG. 20, in another exemplary embodiment the stabilizer 2400 may comprise a first member 2402 and a second member 2404. An embodiment of another exemplary embodiment may include where the stabilizer members 2402,2404 are hingedly attached to a stabilizer folding mechanism 2406 allowing the stabilizer 2400 to collapse to a carrying position from the operating position. The stabilizer folding mechanism 2406 may include a securing mechanism 2410 to prevent the stabilizer members 2402,2404 from moving when in the locked position. The folding mechanism 2406 may also include a shifting mechanism 2408 to change the angle of the stabilizer members 2402,2404 from the operating angle to the folding angle. Another exemplary embodiment utilizes a cam lock latch as a securing mechanism 2410 and a thumb lever mechanism for the shifting mechanism 2408. In other embodiments of the exemplary embodiment the securing mechanism 2410 may be a lock and release lever and a movable pin for the shifting mechanism 2408. The lock and release lever may utilize a spring to force the locking mechanism into a locked position while the lever may be pulled by the swimmer to allow release. This embodiment may be beneficial in allowing easy release when the swimmer desires while not allowing the swimmer to release accidentally. In another embodiment, the shifting mechanism 2408 may create a clicking noise notifying the swimmer the appropriate angle has been reached. In some embodiments the shifting mechanism 2408 may not make any noise at all. The folding angle may be approximately perpendicular to the fuselage 2002 as to clear the rest of the swimming propulsion device 2000 and fold to allow the two members 2402,2404 to meet. This is one embodiment, in other embodiments the folding angle is not perpendicular but rather at any angle appropriate for a compact manner of carrying the device 2000.

Still referring to FIGS. 24-24V in another exemplary embodiment, the stabilizer folding mechanism 2406 may be comprised of several elements. The stabilizer folding mechanism 2406 may contain at least one metal plate 2426, at least one plastic plate 2422, a bottom cover plate 2420, an upper portion 2440 containing the shifting mechanism 2408 and the locking mechanism 2410. The plastic plate 2422 may be used for stability and slidability as to allow the stabilizer members 2402,2404 to rotate to a desired direction. The metal plate 2426 may be utilized for stability purposes.

Still referring to FIGS. 24-24V and FIG. 20, the stabilizer folding mechanism 2406 may use a "C" shaped slot 2424 used to keep the stabilizer members 2402,2404 within the range of one of the two angles. In another exemplary embodiment, this "C" shaped slot 2424 may contain an angled upper portion 2424*a* allowing the pin in the stabilizer folding mechanism to become locked in the operating position. This angle may make it easier to change to an angle of operation and secure the folding mechanism into this position until the swimmer desires to change the angle. The lower portion 2424*b* of the "C" shaped slot 2424 may be rounded slightly to allow the folding mechanism to enter a folding position and remain there but not locking it in place. Once the thumb levers 2408 are moved from the locked position, the stabilizer members 2402,2404 are free to move between the two settings of operation or folded. Due to the "C" shape slot 2424, it is unlikely the stabilizer members 2402,2404 will stop at an angle not specified. Once the stabilizer members 2402,2404 have been moved to the folding angle, the swimmer may then move the stabilizer members 2402,2404 towards the fuselage 2002 until a point wherein the device 2000 is easier to carry. The location of the stabilizer members 2402,2404 for easy carrying may be, but is not limited to, where the stabilizer members' 2402, 2404 distal ends meet. Once the members 2402,2404 are at the desired location, the swimmer may engage the locking mechanism 2410 preventing the stabilizer members 2402, 2404 from moving or shifting from the desired position.

Still referring to FIGS. 24-24V and FIG. 20, in another exemplary embodiment, the stabilizer 2400 may be manufactured using a urethane reaction in mold. The making of the stabilizer 2400 starts with an aluminum internal structure 2414 then utilizes a lighter foam core then coats the foam and aluminum with an outside RIM material 2416. The finished product is a mold part. The structure, aluminum, was chosen for its stiffness, strength and how light the material is. In other embodiments, the internal structure 2414 may be a welded tubing wherein the tubes decrease in size as the tubing reaches towards the distal end of the stabilizer member 2400.

In another exemplary embodiment, the stabilizer 2400 has a NACA profile on top, with a flat-bottom surface as shown in FIG. 24. In another exemplary embodiment, the stabilizer 2400 has a chord length of 4.6 inches, a span of 40 inches, and a thickness of 0.88 inches. The airfoil shape shown in another exemplary embodiment is only one embodiment.

Control Mechanism

Figure 6:
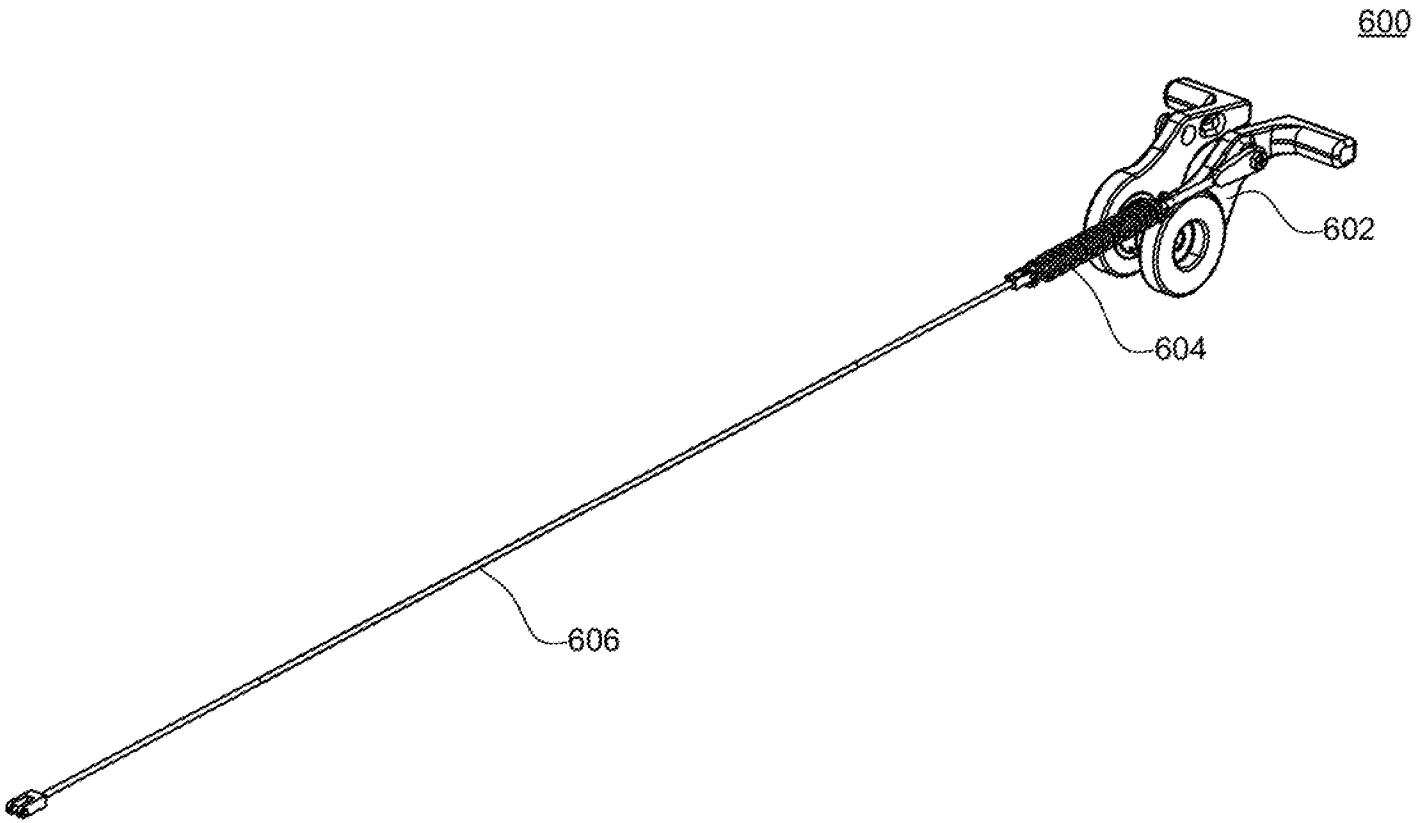
FIG. 6 is an assembly view of the exemplary embodiment of the control mechanism.
Figure 6A:
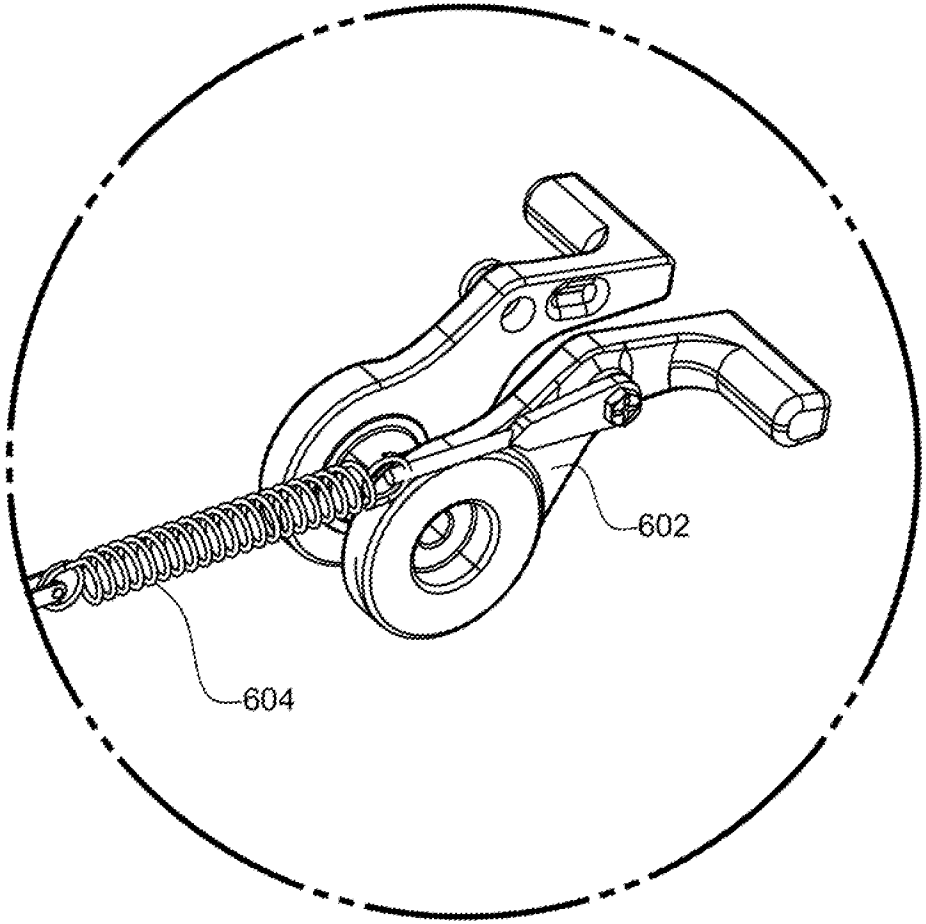
FIG. 6A is a detail view of the exemplary embodiment of the control mechanism.

Referring now to FIGS. 6-6A, the exemplary embodiment of the swimming propulsion device includes a control mechanism 600 (also identified as 110 of FIG. 1). The control mechanism 600 allows the device to maintain an optimal angle of attack of the propulsor, thus maximizing propulsion through the water, as the propulsors pivot against the pressure of the resisting water. By maintaining an optimal angle of attack, the lift produced by the propulsors (and therefore forward motion) is maximized. The mechanism 600 may be attached parallel to the fuselage. In the exemplary embodiment the control mechanism 600 is attached to the aft section of the fuselage and the propulsor. In other embodiments the control mechanism 600 may be attached at different locations. For example, in one embodiment the control mechanism 600 may be attached to the mounting bracket of the attachment mechanism. In the various embodiments described herein, the control mechanism includes a device for adjusting the angle of the propulsors by adjusting the tension of the cable. However, in other embodiments, the angle of the propulsors may be fixed.

Still referring to FIGS. 6-6A, in the exemplary embodiment, each propulsor may have a control mechanism 600. In alternate embodiments, one control mechanism may be used, but having two mechanisms distributes the rotational forces applied to the control mechanism 600. In the exemplary embodiment, the control mechanism 600 may include but is not limited to, a handle 602, a spring 604, and a cable 606. In alternate embodiments, however, the angle of attack may also be maintained by having cables without springs.

Still referring to FIGS. 6-6A, handle 602 of the control mechanism 600 may be rotatably attached to the aft section of the fuselage 102. In the exemplary embodiment the handle 602 may be manufactured from G10/FR4 plastic. In other embodiments the handle 602 may be manufactured from materials including but not limited to aluminum or stainless steel.

Still referring to FIGS. 6-6A, the spring 604 may be connected to the handle 602 allowing the tension in the cable 606 to increase or decrease when the handle is rotated. The spring 604 may be, but is not limited to, a torsion or coil spring. In the exemplary embodiment the spring 604 is a stainless steel extension spring having a spring rate of 1.57 pounds per inch, part number 94135K57 from McMaster-Carr Co., Elmhurst, Ill. 60126-2081. One end of the spring 604 may be connected to the handle 602. Similarly, the other end of the spring 604 may be connected to the propulsor 104 also using a cable 606.

Still referring to FIGS. 6-6A, in the exemplary embodiment, the cable 606 may be manufactured from braided stainless steel. The cable 606 may have a size sufficient to withstand the applied forces produced when the angular position of the propulsors 104 changes as the swimmer operates the device. In the exemplary embodiment the cable 606 is wire rope having a diameter of approximately 0.034 inches, Part Number 34235T22 from McMaster-Carr Corporation 600 N County Line Rd, Elmhurst, Ill. 60126-2081. However, in various other embodiments, the type, material and diameter of the cable may vary.

Figure 6B:
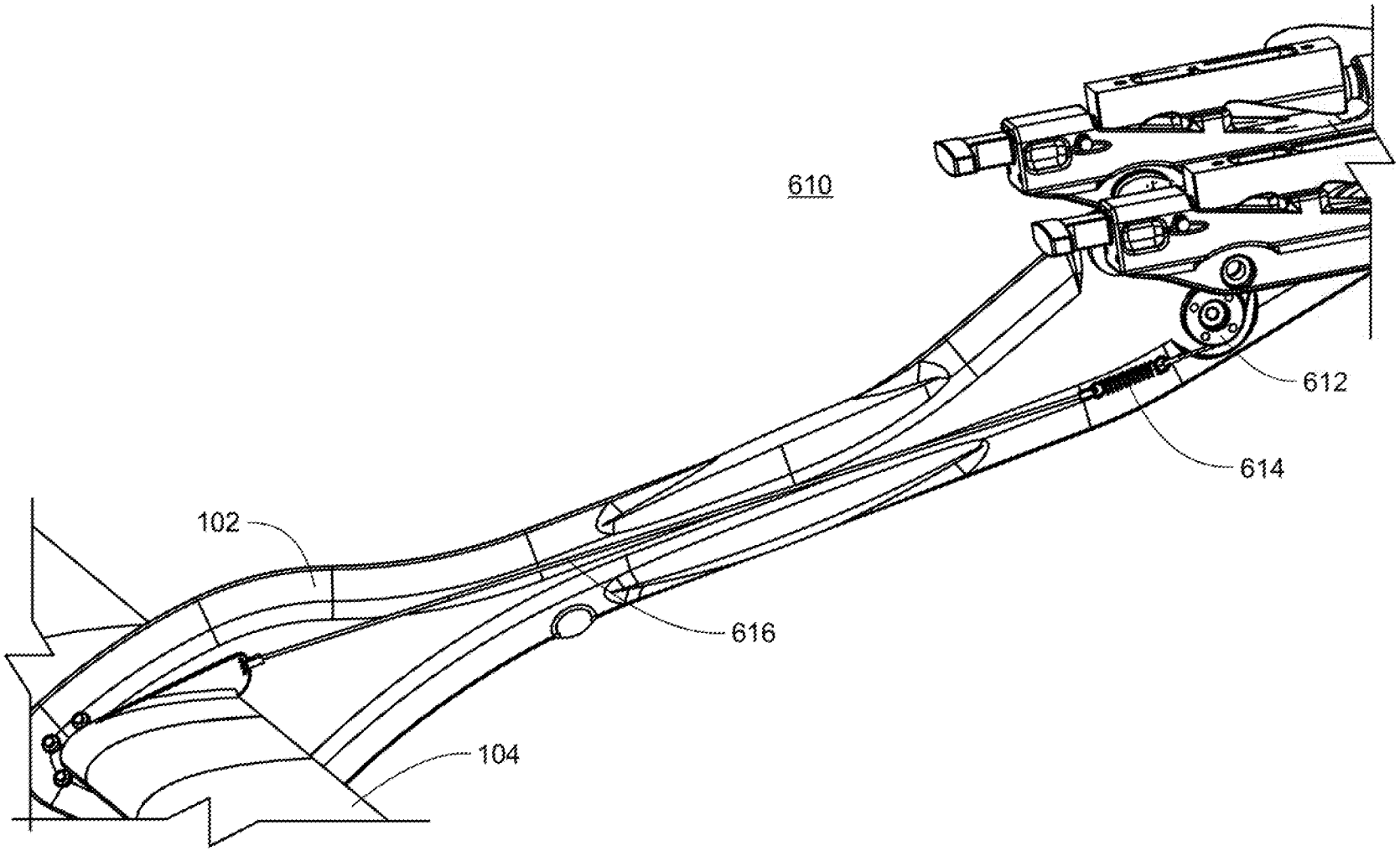
FIG. 6B is a perspective view of an alternate embodiment of the control mechanism.
Figure 6C:
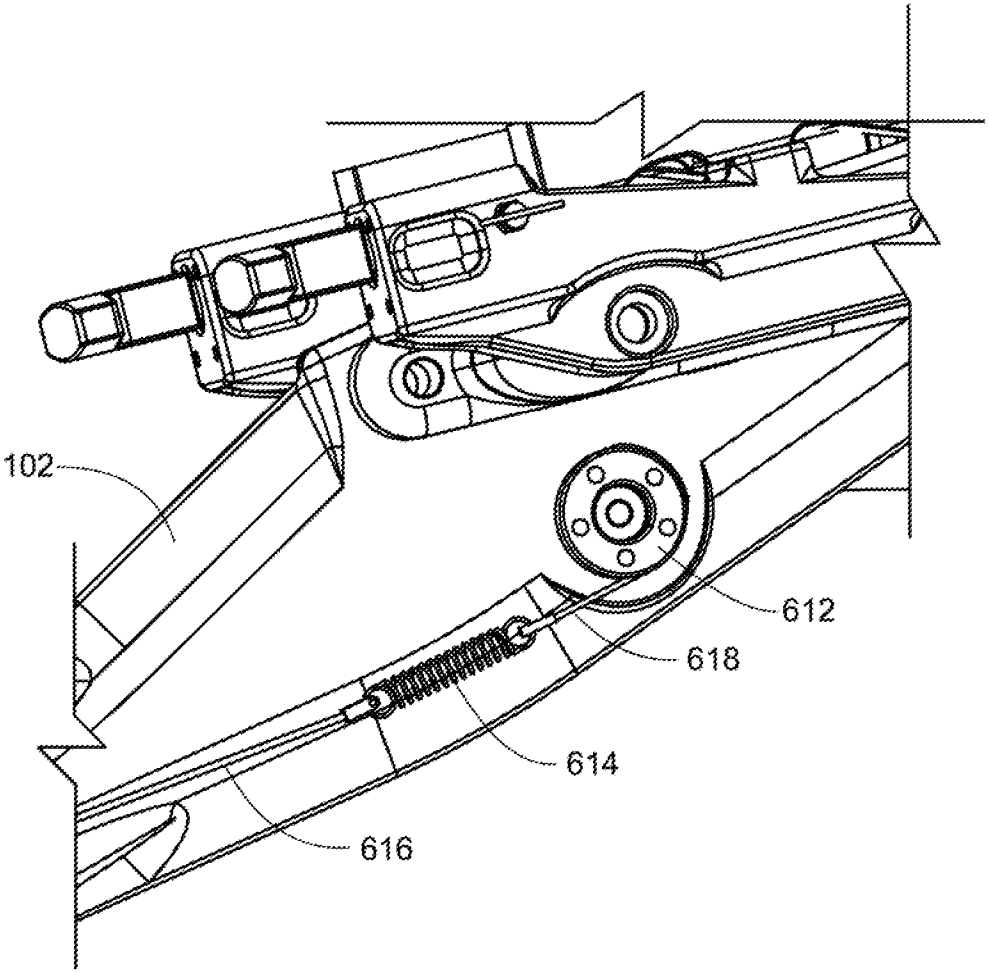
FIG. 6C is a detail view of the control mechanism in FIG. 6B.

Referring now to FIGS. 6B-C, various embodiments of the swimming propulsion device may include another embodiment of the control mechanism for optimizing the angle of attack for the propulsor. The control mechanism may include but is not limited to a knob assembly 612, spring 614, and a cable 616. In this embodiment the spring 614 and the cable 616 may be the same or similar to those components previously described herein. The knob assembly 612 may be rotatably attached to the aft section of the fuselage 102. This assembly may include a ball detent mechanism (not shown) positioned between the knob 612 and the fuselage 102. The detent mechanism secures the knob 612 in place preventing the knob 612 from rotating freely. The knob assembly 612 may also include a cable 618. The cable 618 connects the knob assembly 612 and the spring 614. In operation the angle of attack of the propulsor may be adjusted by rotating the knob assembly 612. As the knob assembly 612 is rotated, the tension on the cable 616 may be increased or decreased, changing the angle of attack of the propulsor.

Figure 6D:
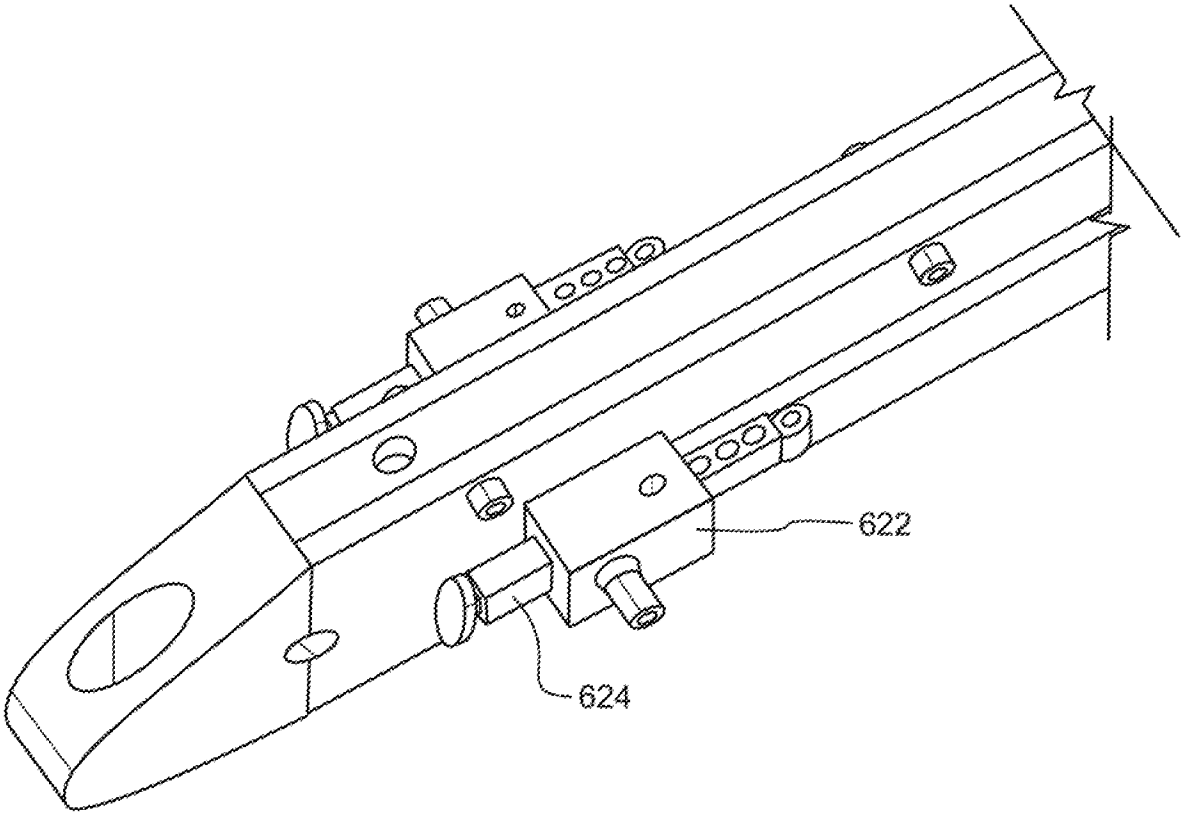
FIG. 6D is a perspective view of an alternate embodiment of the control mechanism.
Figure 6E:
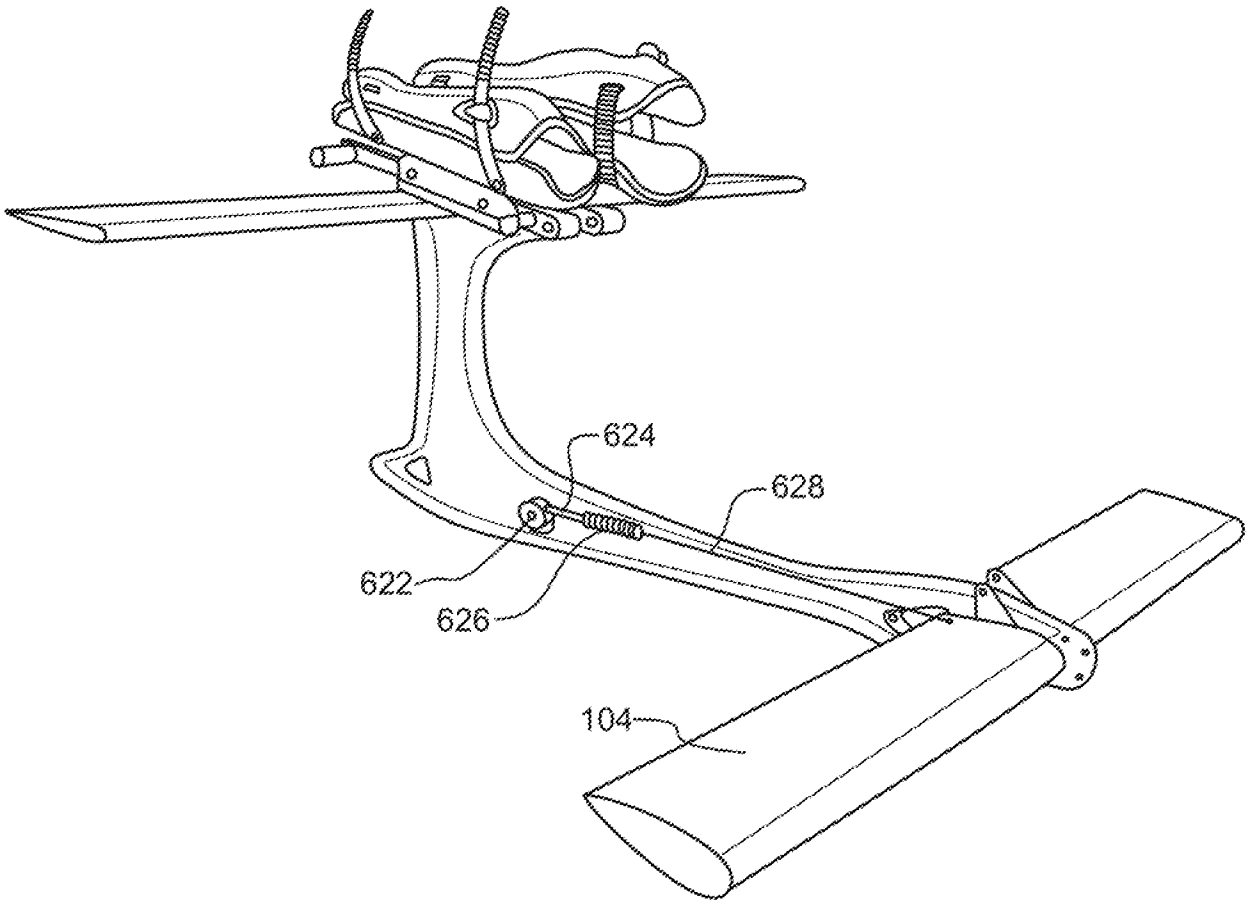
FIG. 6E is a perspective view of one embodiment of the swimming propulsion device including the alternate embodiment of the control mechanism shown in FIG. 6D.

Referring now to FIGS. 6D-E, in another embodiment of the swimming propulsion device, another embodiment of the control mechanism may be used. The control mechanism may include but is not limited to a first member 622, a second member 624, a pin (not shown), a spring 626, and a cable 628. The first member 622 may be affixed to the aft section of the fuselage. The member 622 may have an aperture within the forward surface of the member for slidably receiving the second member 624. In addition, the first member 622 may also have an aperture within the bottom surface of the member for slidably receiving a pin. The second member 624 may have a plurality of apertures for receiving the pin. In addition, the second member 624 may also include an aperture at one of end the member to receive the spring 626 as shown in FIG. 6E. Attached to the other end of the spring 626 may be a cable 628 connecting the spring 626 to the propulsor.

Still referring to FIGS. 6D-E, in operation, the angle of attack for the propulsor may be adjusted by changing the position of the second member 624 relative to the first member 622. Removing the pin from the bottom of the first member 622 allows the second member 624 to be repositioned. Once the second member 624 is in the desired position, the pin is installed within the bottom of the first member 622 and slidably received within one of the apertures of the second member 624 thereby securing the second member in place. Changing the position of the second member 624 may increase or decrease the tension of the spring 626 changing the angle of attack of the propulsor 104.

Now referring to FIGS. 22C-F and FIG. 21G and additionally FIG. 20 in another exemplary embodiment of the swimming propulsion device 2000 may include a control mechanism 2240 within the at least one propulsor 2200. The control mechanism 2240 allows the propulsor 2200 to remain at an optimum angle of attack thus maximizing propulsion through the water, as the propulsor 2200 pivots against the pressure of the resisting water. By maintaining an optimal angle of attack, the lift produced by the propulsors 2200 (and therefore forward motion) is maximized. The mechanism 2240 may involve but is not limited to a torsion bar 2230, a torsion bar anchor 2122, and a slot within the internal structure 2210 of the propulsor containing the torsion bar 2230. In another exemplary embodiment, the torsion bar 2230 may be made of titanium however in other embodiments the torsion bar 2230 may be made of materials having the desired properties of strength, weight and flexibility. Another exemplary embodiment contains one torsion bar in one propulsor 2004. There is one torsion bar 2230 due to the desire to keep a specific spring constant, if there was no desire to keep the spring constant there may be more than one torsion bar 2230 in various embodiments. In other various embodiments containing the desire for a specific spring constant, there may be more than one torsion bar 2230 in the device however the torsion bars 2230 may be of a smaller size and smaller spring constant to sum to the desired spring constant. Titanium was chosen because it does not deform as easily as some other metals if pushed beyond its stress point. A metal that will not deform at the maximum force used in the device 2000 would be a metal that may be used in the torsion bar 2230.

Still referring to FIGS. 22C-F and FIG. 22C in another exemplary embodiment, the torsion bar 2230 possesses a rectangle cross section however a round cross section may be used in other embodiments. The torsion bar 2230 allows for twisting of the at least one propulsor 2200 allowing the propulsor 2200 to enter the optimal range for the angle of attack. The control mechanism 2240 may include a torsion bar anchor 2122 which, in conjunction with other elements, prohibits the torsion bar 2230 from rotating beyond the optimal angle of attack. In another exemplary embodiment, the torsion bar anchor 2122 may securely fasten to a hex piece 2214, the hex piece 2214 may contain a bushing. The hex piece 2214 connects to the proximal end of the torsion bar 2230 and securely fastens the proximal end of the torsion bar 2230 allowing the distal end of the torsion bar 2230 to twist. The torsion bar anchor 2220 slides through the keyway of the root block 2208 to mate with the hex piece 2214. The distal end of the torsion bar 2230 may be located within the slot within the internal structure 2210 of the propulsor 2200. This slot allows for the twisting of the distal end of the torsion bar 2230 while the proximal end of the torsion bar is anchored securely to refrain from movement and prevent the torsion bar from leaving the range of optimal angle of attack. In another exemplary embodiment, the torsion bar anchor 2122 may be manufactured from stainless steel and the hex piece 2214 may be manufactured from aluminum or stainless steel. This is just one embodiment of the torsion bar anchor 2122, in other embodiments, the torsion bar anchor 2122 may be manufactured from other materials including but not limited to aluminum, stainless steel and titanium.

ALTERNATE EMBODIMENTS

Figure 7:
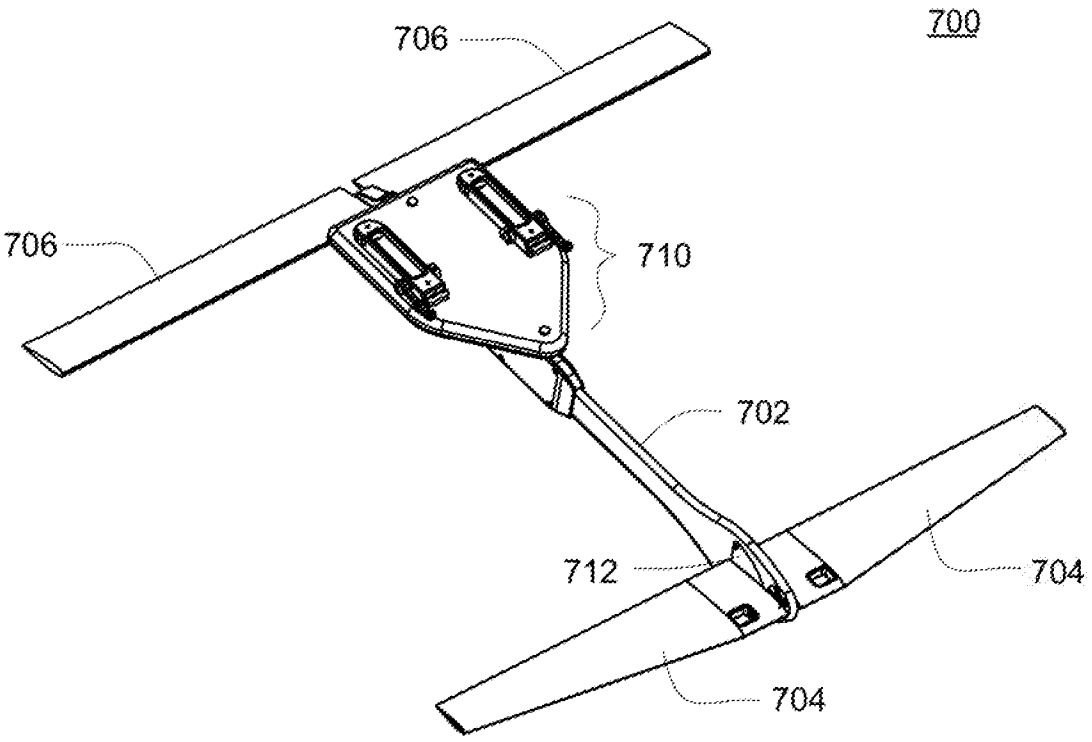
FIG. 7 is a front-perspective view of an alternate embodiment of the swimming propulsion device having an adjustable fuselage.
Figure 7A:
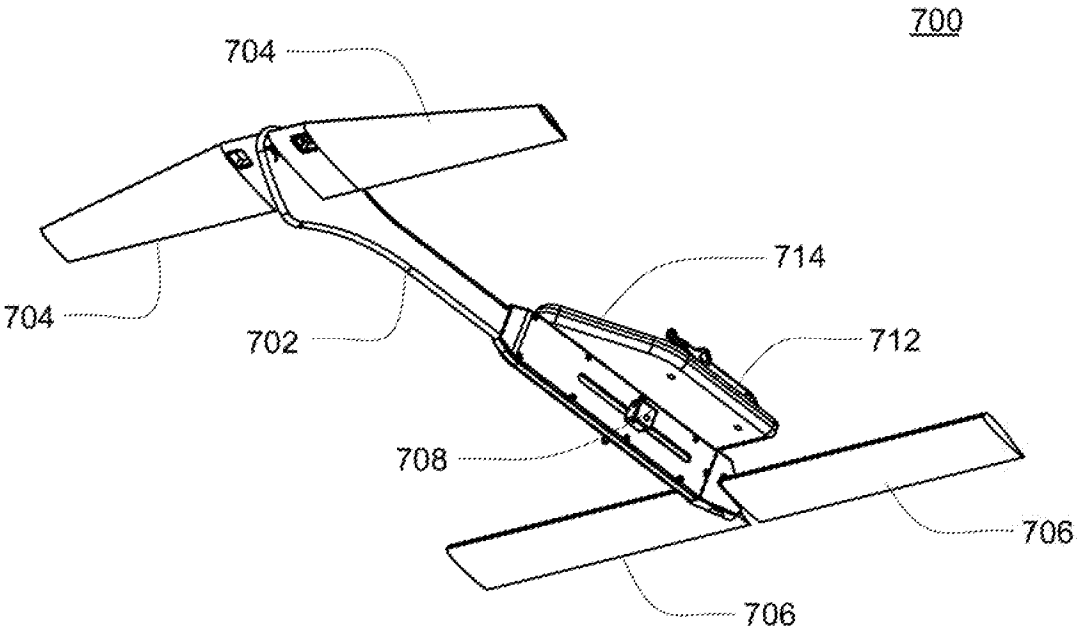
FIG. 7A is a bottom-perspective view of an alternate embodiment of the swimming propulsion device shown in FIG. 7.

Referring now to FIGS. 7-7A, these figures illustrate another embodiment of the swimming propulsion device 700. This embodiment may include but is not limited to an adjustable fuselage 702, propulsors 704, stabilizers 706, a control mechanism 708 and an attachment mechanism 710 (cuffs not shown). The propulsors 704 may have a tapered-airfoil shape and be pivotally connected to the fuselage 702. Also, the propulsors may include a cable plate 712 positioned at the proximal end of the propulsor 704. The cable plate 712 provides a location for connecting the control mechanism 708 to the propulsors 704.

Still referring to FIGS. 7-7A, the stabilizer 706 may include two members adjustably attached to the aft section of the fuselage 702. In other embodiments the stabilizers 706 may be fixedly attached to the fuselage 702. In the embodiment shown in FIGS. 7-7A, the stabilizers 706 may be airfoil shaped but in other embodiments the stabilizers 706 may have any shape including but not limited to those shapes previously described herein.

Still referring to FIGS. 7-7A, the attachment mechanism 710 may include but is not limited to a pair of cuffs (not shown), a set of locking mechanisms 712 and a mounting plate 714. In this embodiment the locking mechanisms 712 may include a handle assembly for securing the cuffs to the mounting plate 714.

Figure 7B:
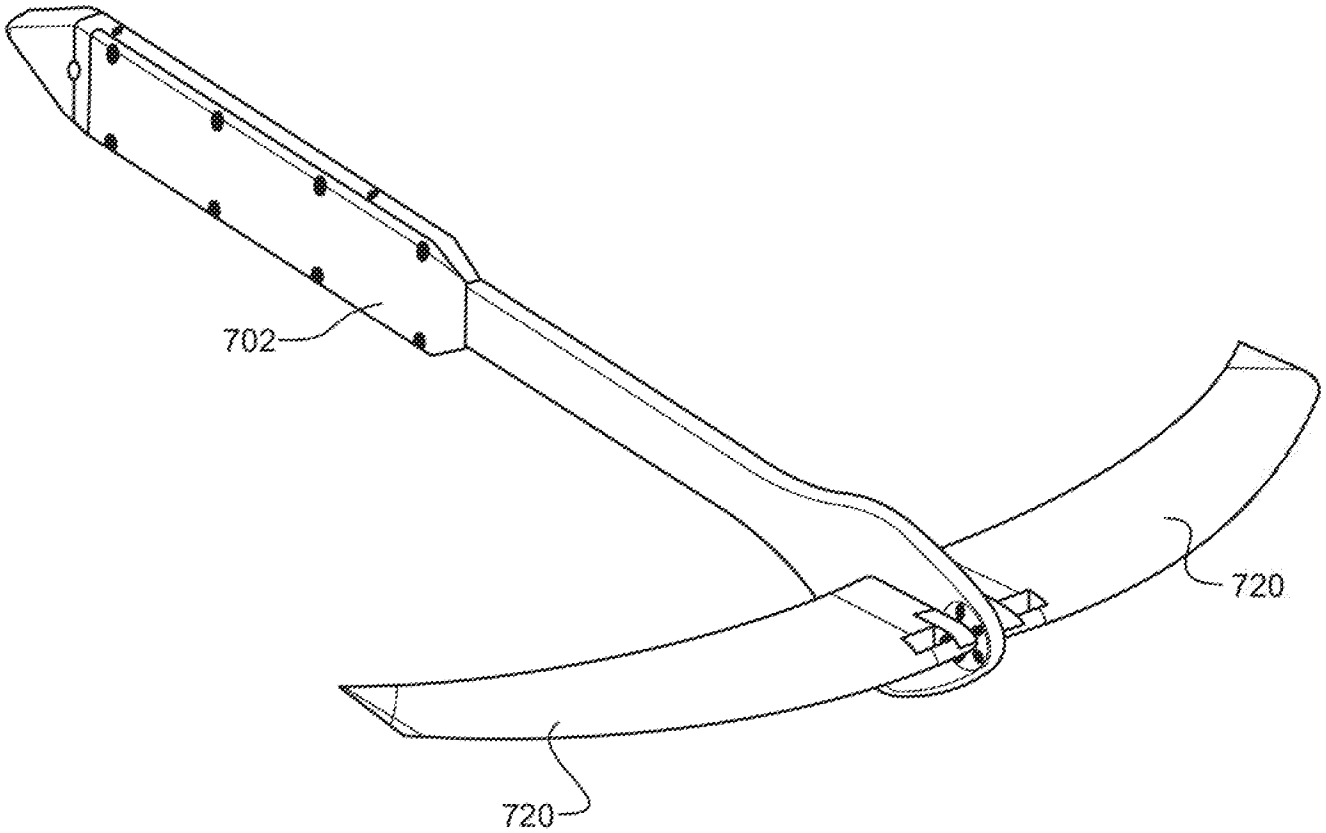
FIG. 7B is a top-perspective view of an alternate embodiment of the swimming propulsion device including shaped propulsors.
Figure 7C:
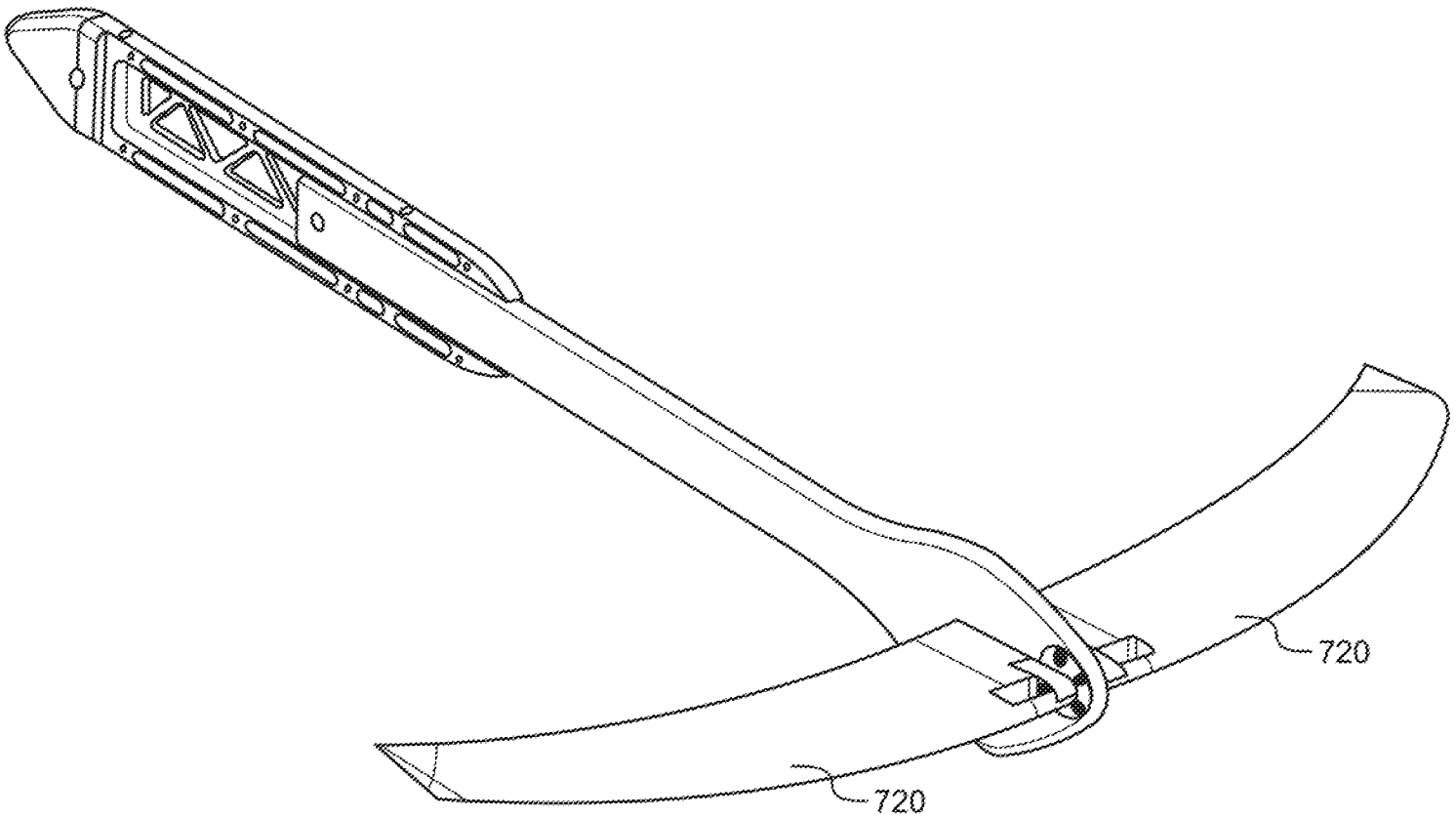
FIG. 7C is a top-perspective view of the device shown in FIG. 7B with a side member removed.

Referring now to FIGS. 7B-C, other embodiments may include propulsors 720 having a curved shape and an adjustable fuselage 702. FIG. 7C illustrates the fuselage 702 with a side member removed.

Figure 8:
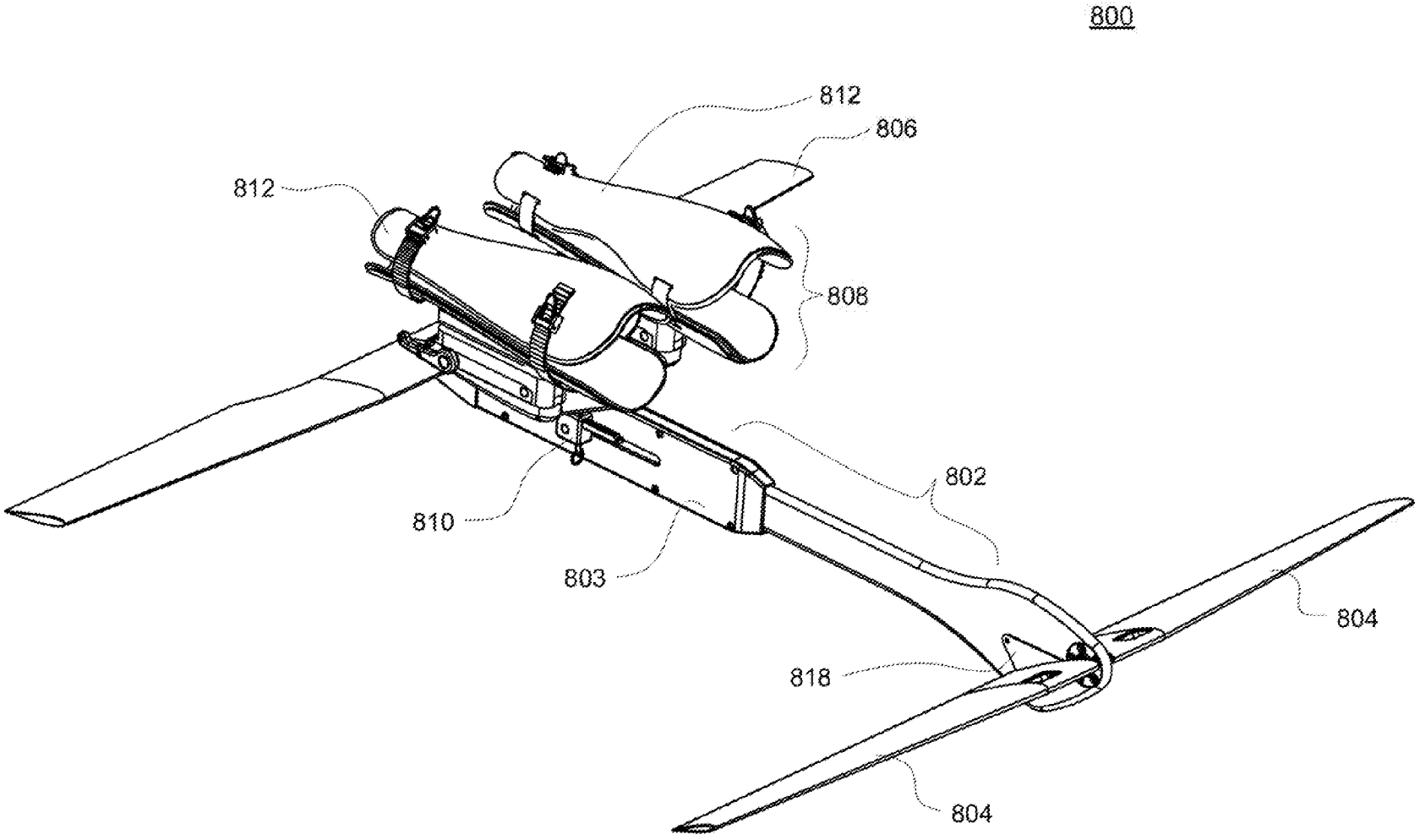
FIG. 8 is a perspective view of an alternate embodiment of the swimming propulsion device having a single stabilizer and adjustable fuselage.
Figure 8A:
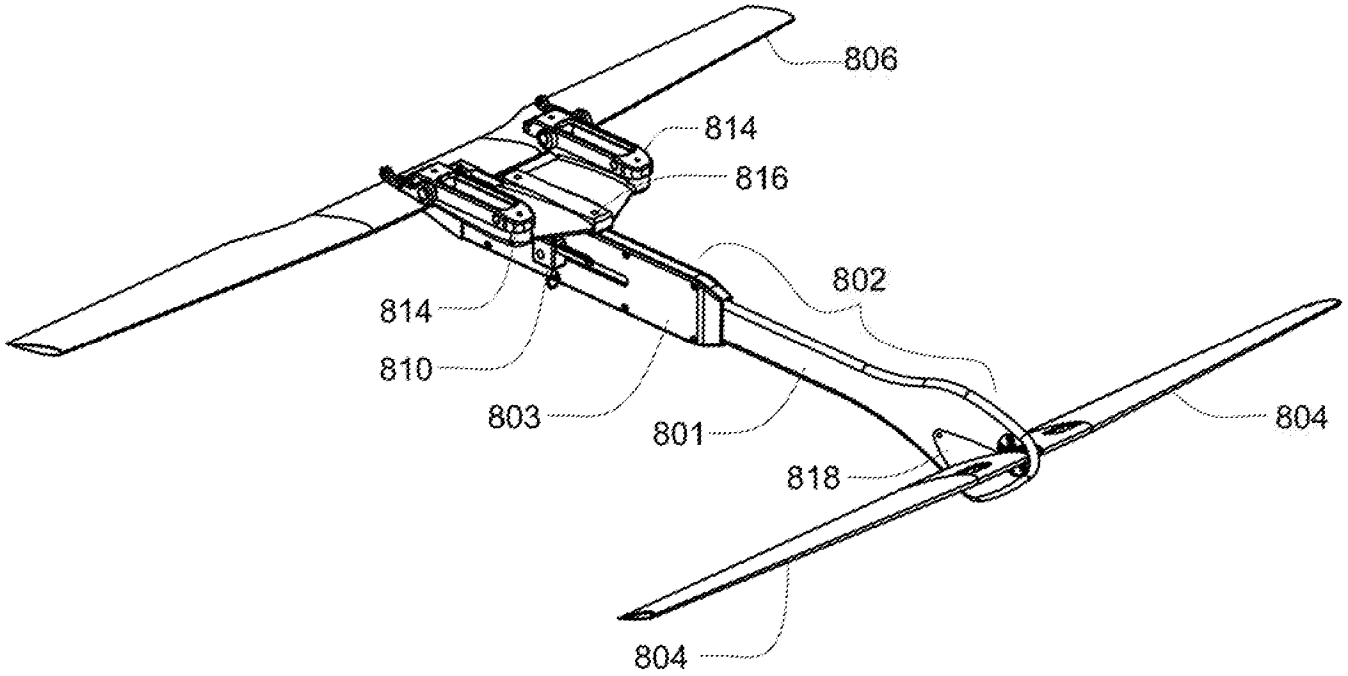
FIG. 8A is a perspective view of the device in FIG. 8 without cuffs attached.
Figure 8B:
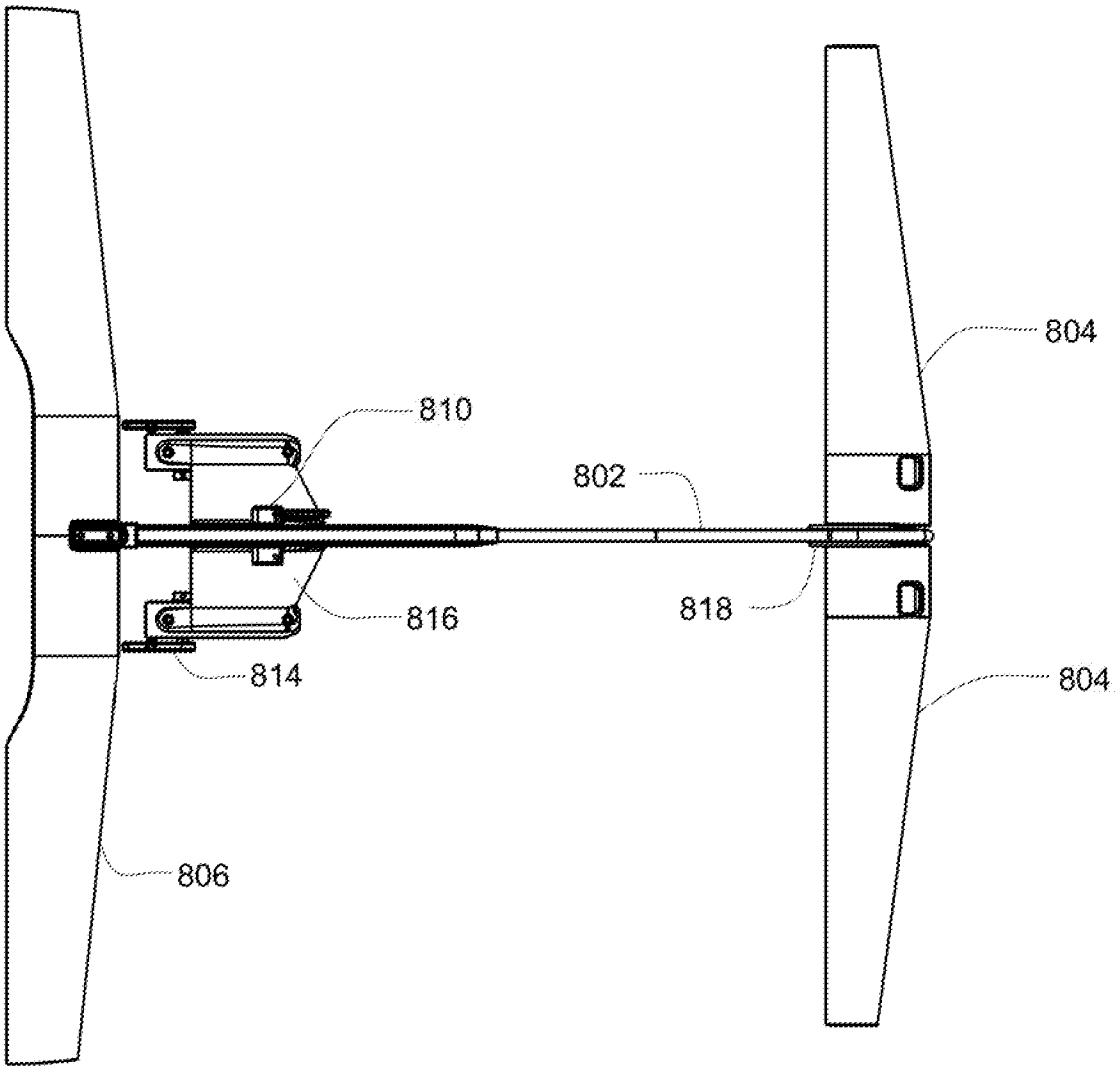
FIG. 8B is a bottom view of the device shown in FIG. 8.
Figure 8C:
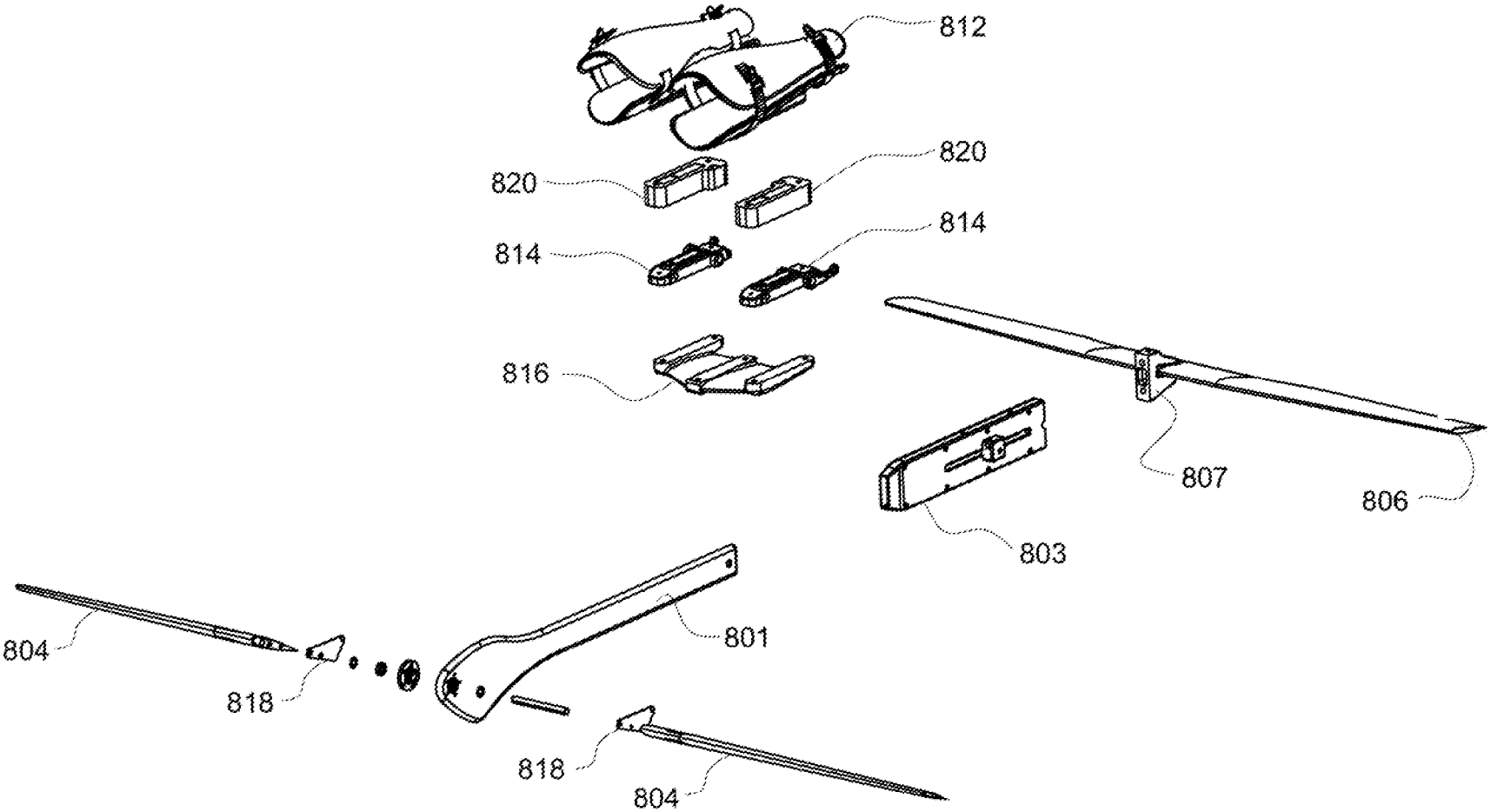
FIG. 8C is an exploded view of the device shown in FIG. 8.

Referring now to FIGS. 8-8C, these figures illustrate a swimming propulsion device 800 having an adjustable fuselage 802 similar to the previously described fuselage (shown in FIGS. 2D-E as 240). Pivotally attached to the forward section 801 of the fuselage 802 may be propulsors 804. These propulsors may have a tapered-airfoil shape. In addition, a cable plate 818 may be attached to proximal end of the propulsors 804 providing an attachment location for the control mechanism 810. Furthermore, in this embodiment, the stabilizer 806 may be one member or one body and fixedly attached to the aft section 803 of the fuselage 802 with a bracket 807. The stabilizer 806 may have an airfoil shape and may include a notch located on the aft edge of the stabilizer 806 for accommodating the swimmer's feet. The stabilizer 806 may also have a larger span than the propulsors 804.

Still referring to FIGS. 8-8C, the attachment mechanism 808 may include but is not limited to a pair of cuffs 812, a set of locking mechanisms 814, and a mounting plate 816. The mounting plate 816 may be attached to the top surface of the fuselage 802. Attached to the mounting plate 816 are the locking mechanisms 814. These mechanisms may use a handle assembly for securing the cuffs 812 to the mounting plate 816 as previously described. In alternate embodiments, any one of the disclosed attachment mechanisms may be included in the swimming device 800.

Still referring to FIGS. 8-8C, in the embodiment shown, the control mechanism 810 may be attached to the fuselage 802. The control mechanism 810 may be similar to the mechanism shown in FIGS. 6D-E and described previously herein. This embodiment may include one control mechanism 810 for each propulsor 804. In other embodiments, the control mechanism 810 may be any of the previously described mechanisms for optimizing the angle of attack of the propulsor 804 to maximize propulsion through the water as the propulsors 804 pivot against the pressure of the resisting water.

Figure 8D:
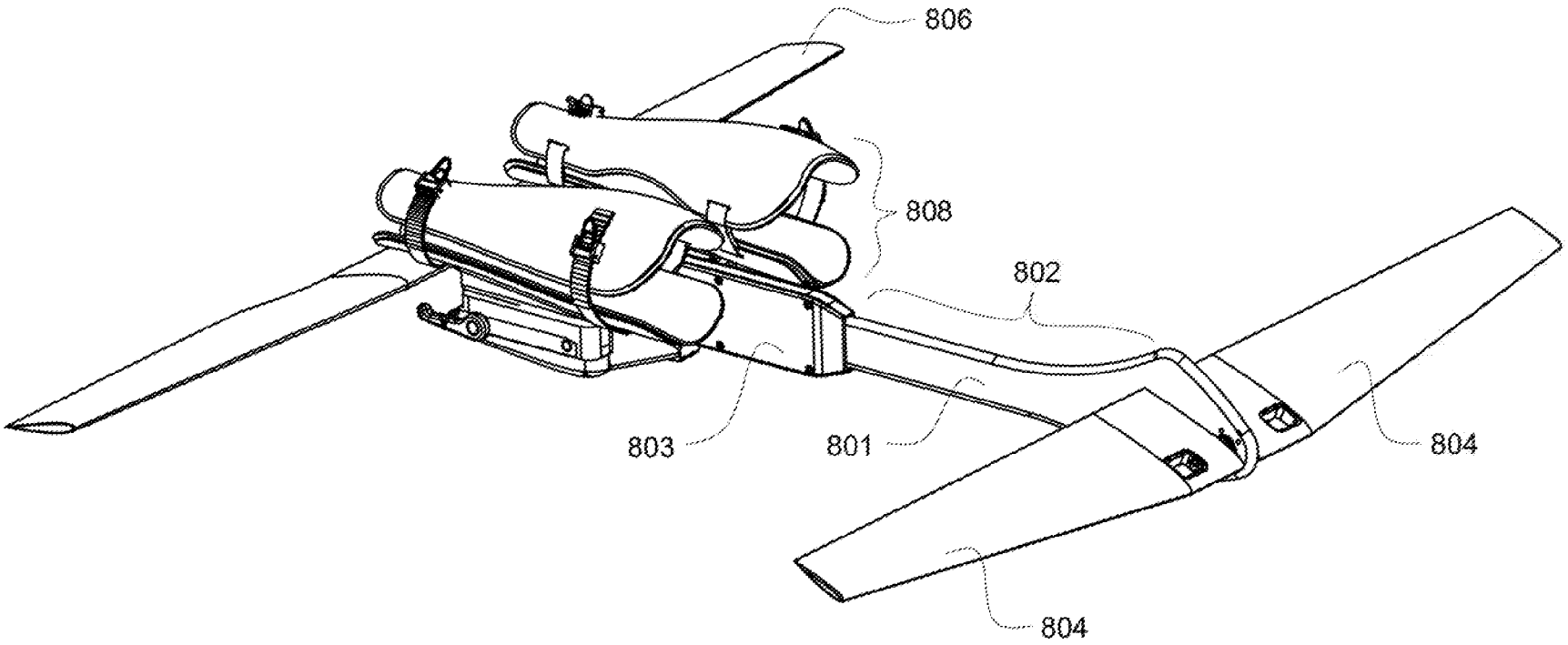
FIG. 8D is a is a front-perspective view of an alternate embodiment of the swimming propulsion device including a mounting bracket attached to the bottom of the fuselage.
Figure 8E:
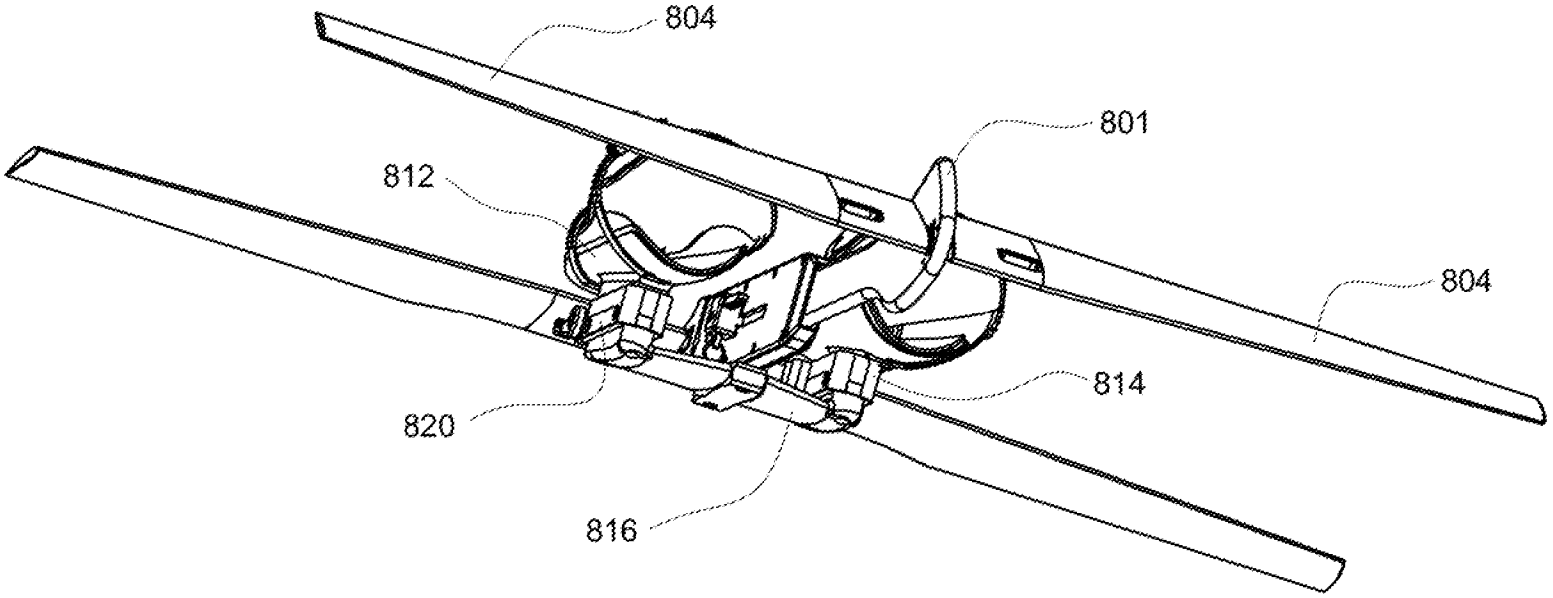
FIG. 8E is a bottom-perspective view of the device shown in FIG. 8D.
Figure 8F:
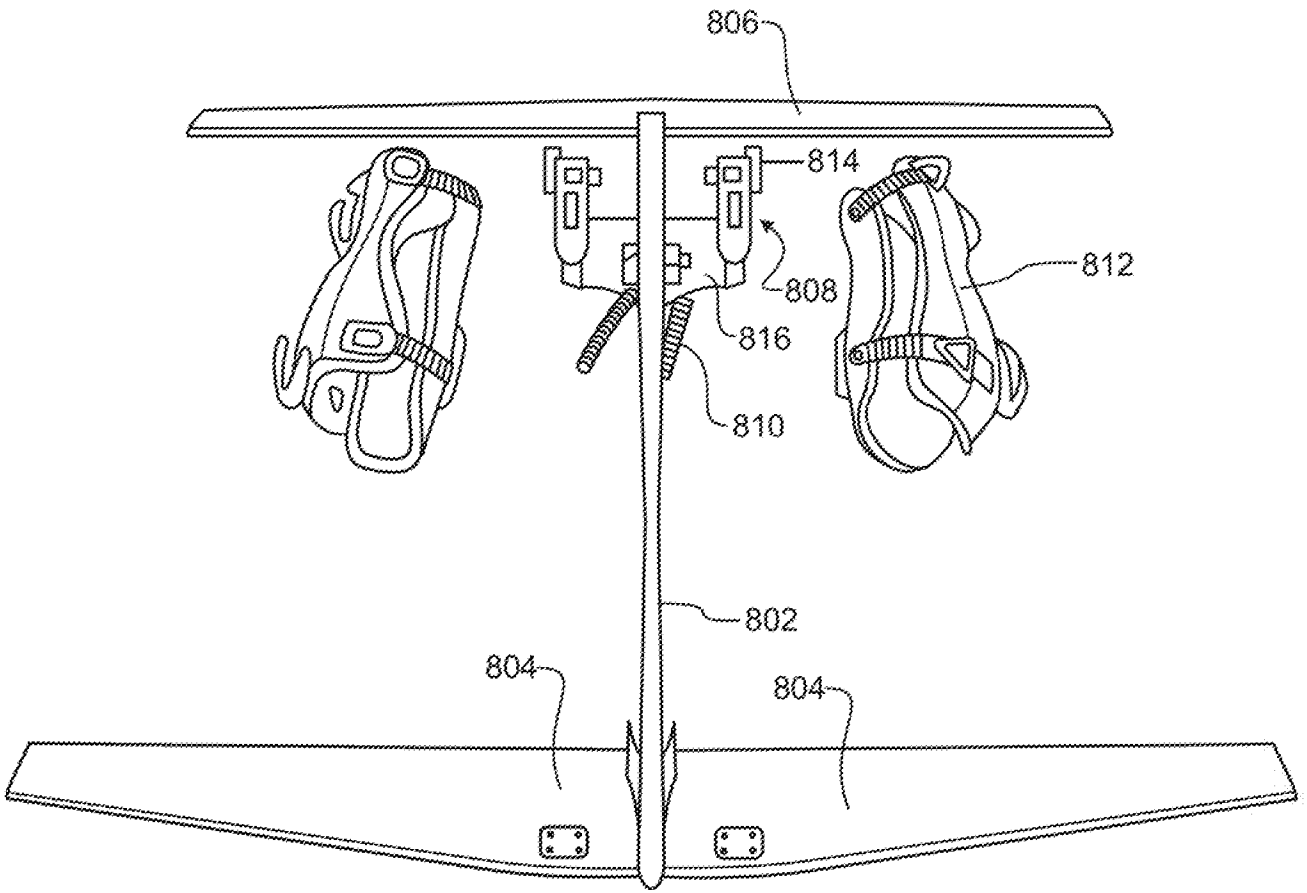
FIG. 8F is a perspective view of the device shown in FIG. 8D.

Referring now to FIGS. 8D-F, these figures illustrate an alternate embodiment of the swimming propulsion device 800 wherein the mounting plate 816 may be attached to the bottom surface of the fuselage 802. In this configuration a member 820 is positioned between the mounting plate 816 and the locking mechanism 814 to raise the position the locking mechanisms. The mounting plate may be attached to the bottom of the fuselage 802 allowing the device 800 to be closer to the swimmer's body.

Figure 9:
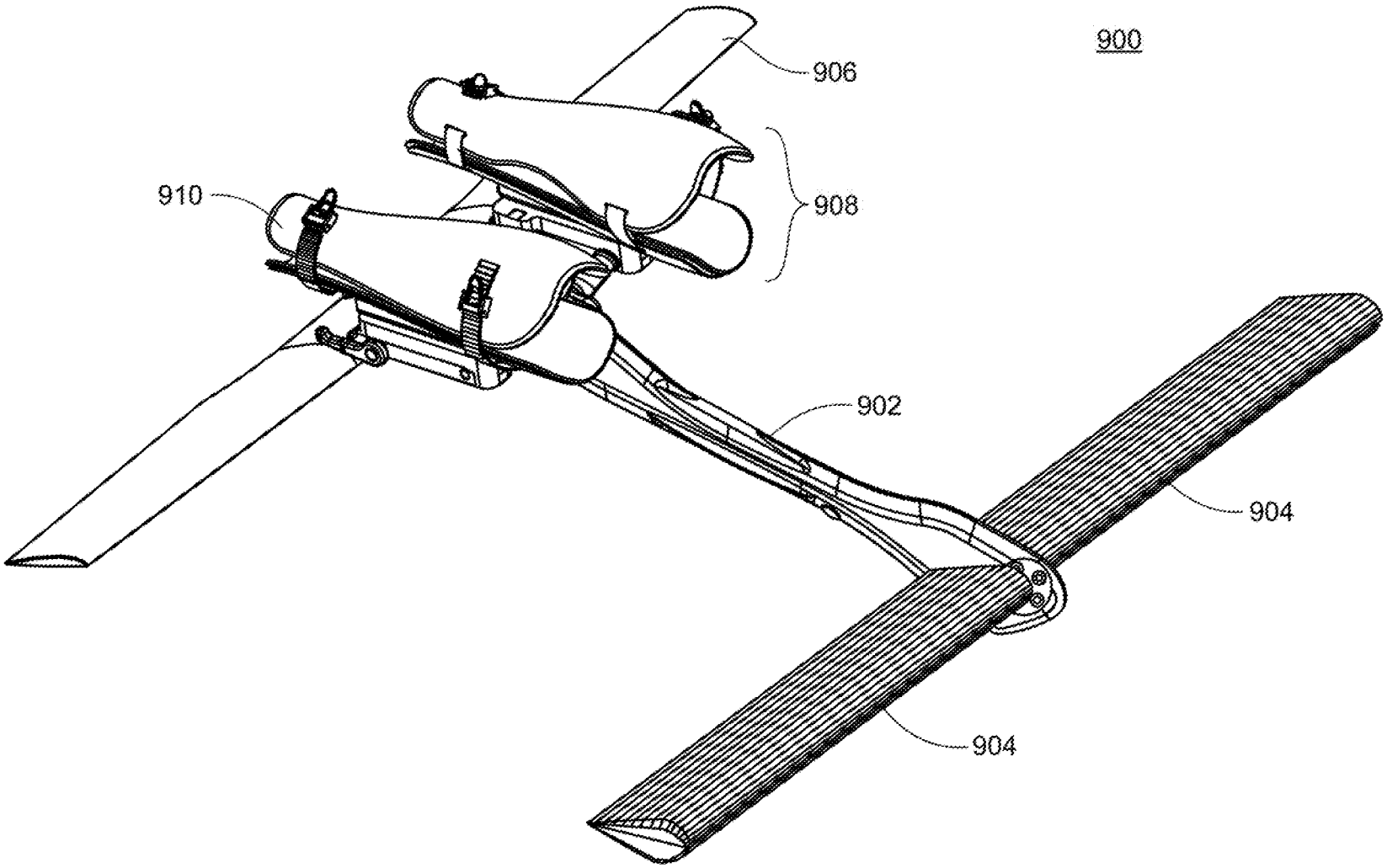
FIG. 9 is a perspective view of an alternate embodiment of the swimming propulsion device having rectangular propulsors and a non-adjustable fuselage.
Figure 9A:
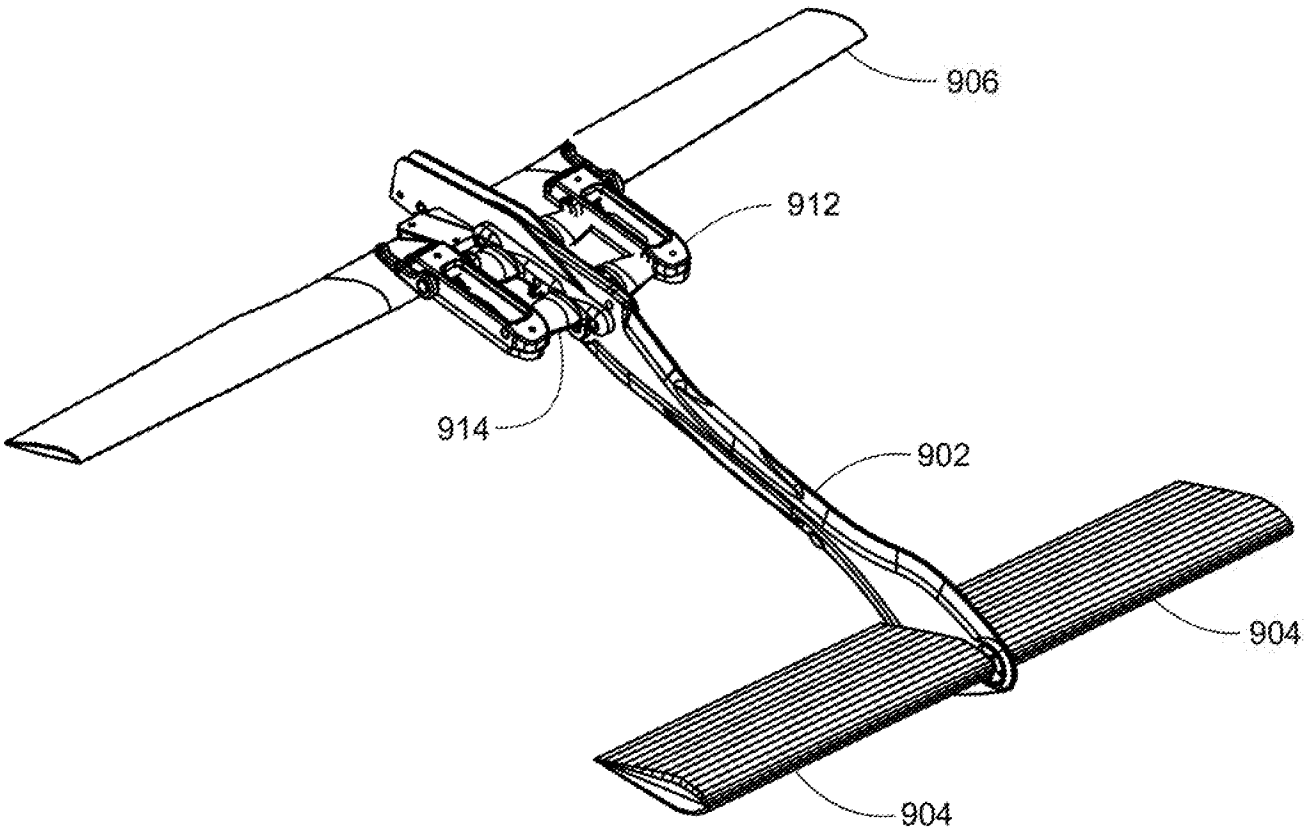
FIG. 9A is a perspective view of the device shown in FIG. 9 without the cuffs attached.

Referring now to FIGS. 9-9A, these figures illustrate an alternate embodiment of the swimming propulsion device 900. This embodiment may include a fuselage 902 having the center of the forward section located on a different horizontal plane than the center of the aft section. In addition, edges of the fuselage 902, and in particular, the edges of the forward section where velocities are greatest, may be tapered, facilitating movement through the water.

Still referring to FIGS. 9-9A, the propulsors 904 may be pivotally connected to the forward section of the fuselage 902. These propulsors 904 may have rectangular-airfoil shape. In other embodiments, the propulsors 904 may have different shapes including but not limited to tapered-airfoils or curved-airfoil shapes. Similar to previous embodiments, the propulsor 904 may be manufactured from materials including but not limited to plastic G10/FR4, Garolite, fiber reinforced plastic, wood-plastic composite, or other similar material.

Still referring to FIGS. 9-9A, fixedly attached to the aft section of the fuselage 902 may be a stabilizer 906 having a tapered-airfoil shape. In this embodiment the stabilizer 906 may be one member or one body fixedly mounted to the fuselage. In other embodiments, the stabilizer 906 may be removably attached to the fuselage. In addition, the stabilizer 906 may include a notch on the rear edge of the stabilizer 906, accommodating the swimmer's feet. Similar to previous embodiments, the stabilizer 906 may be manufactured from materials including but not limited to plastic G10/FR4, Garolite, fiber reinforced plastic, wood-plastic composite, or other similar material.

Still referring to FIGS. 9-9A, some embodiments of the swimming propulsion device 900 may include an attachment mechanism 908. This mechanism may include, but is not limited to, a pair of cuffs 910, a locking mechanism 912, and mounting brackets 914. The mounting brackets 914 may be attached to the aft section of the fuselage 902. These brackets may support the locking mechanisms 912. The locking mechanisms 912 may be similar to the previously described embodiments herein and may include a handle assembly for securing the cuffs 910 to the mounting bracket 914. In other embodiments, any one of the previously described attachment mechanisms may be included in the propulsion device 900.

Still referring to FIGS. 9-9A, this embodiment of the swimming propulsion device 900 may also include a control mechanism. Although not shown, the control mechanism may be any of the previously described mechanisms for optimizing the angle of attack of the propulsor 904 to maximize propulsion through the water as the propulsors 904 pivot against the pressure of the resisting water.

Figure 10:
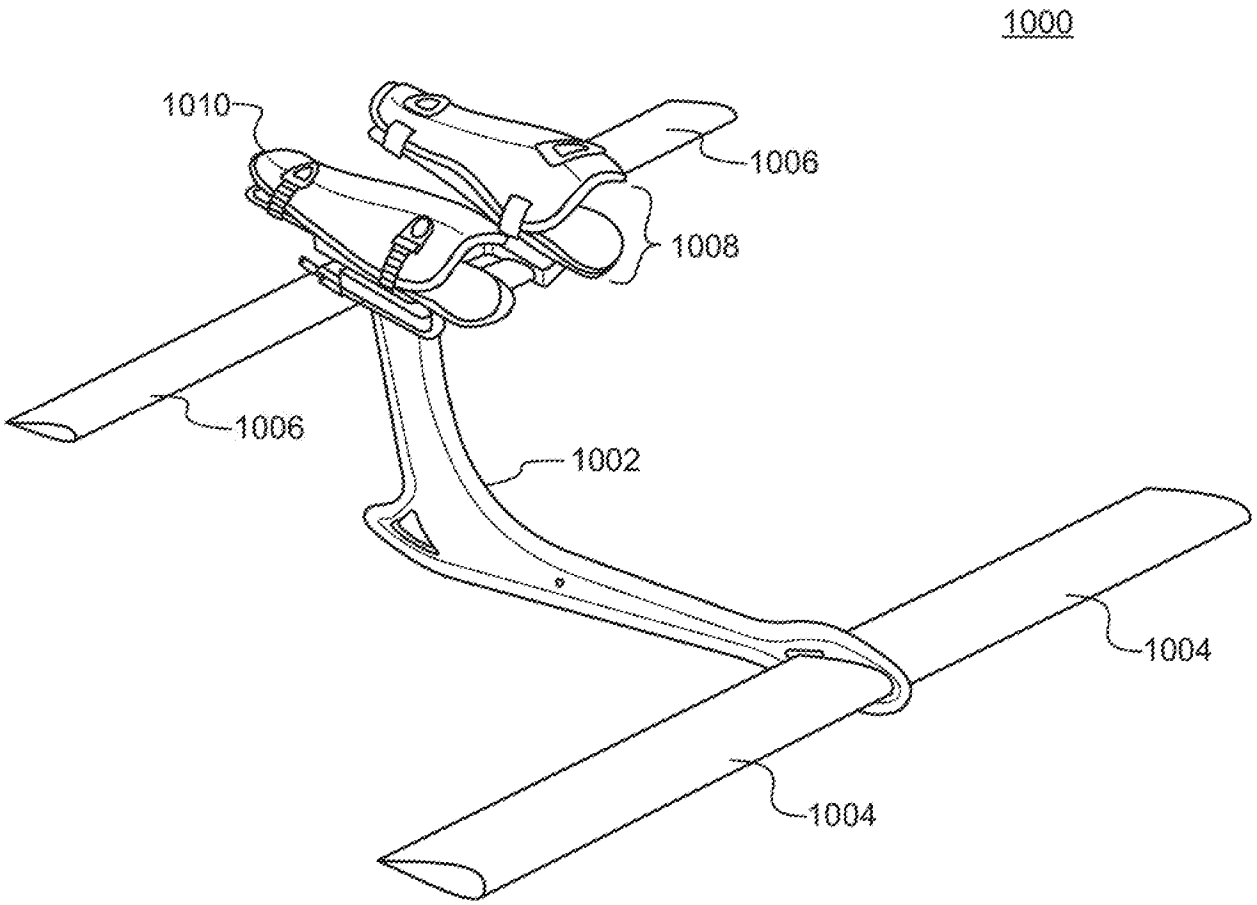
FIG. 10 is a perspective view of an alternate embodiment of the swimming propulsion device having an L-shaped fuselage.
Figure 10A:
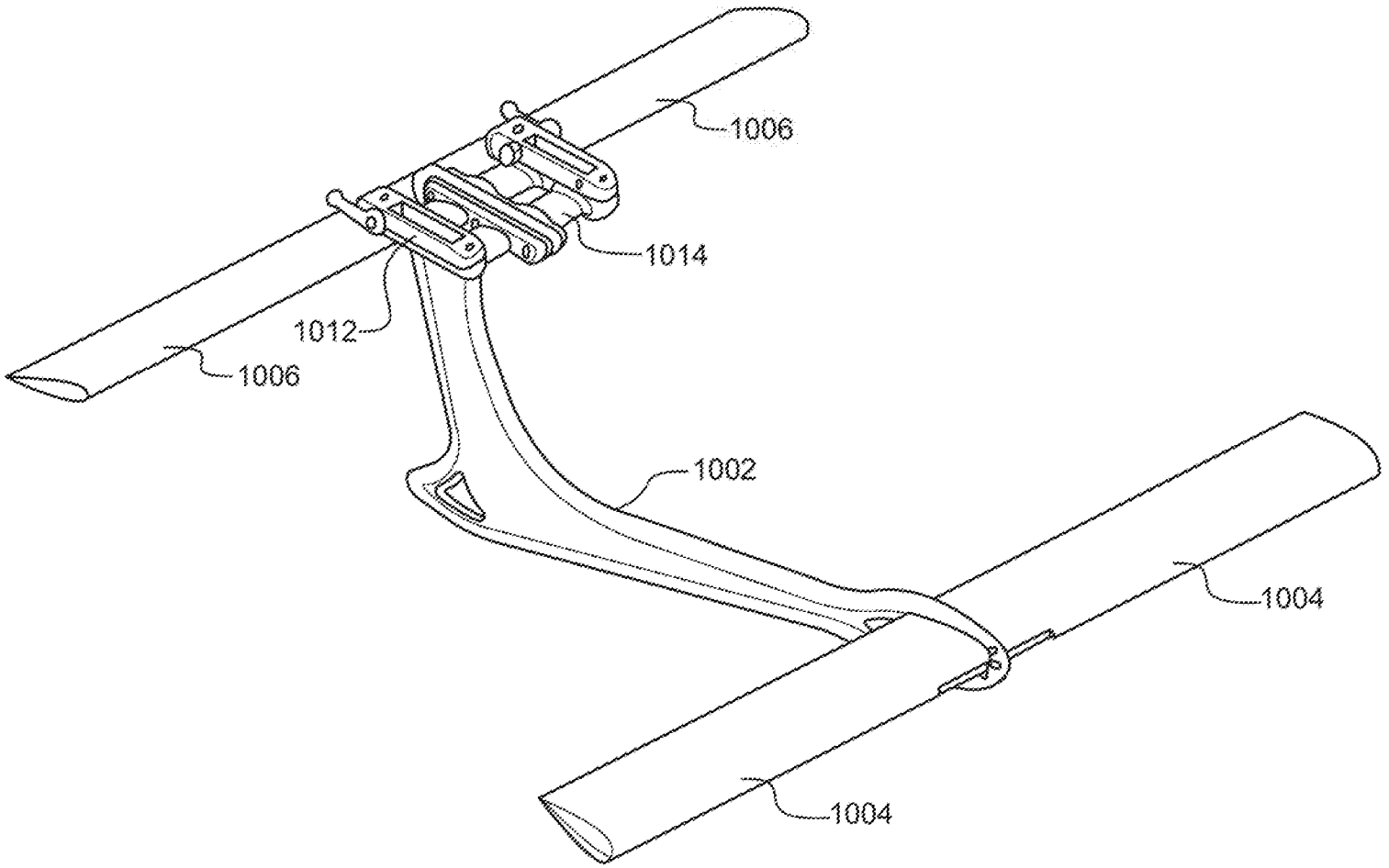
FIG. 10A is a perspective view of the device shown in FIG. 10 without the cuffs attached.
Figure 10B:
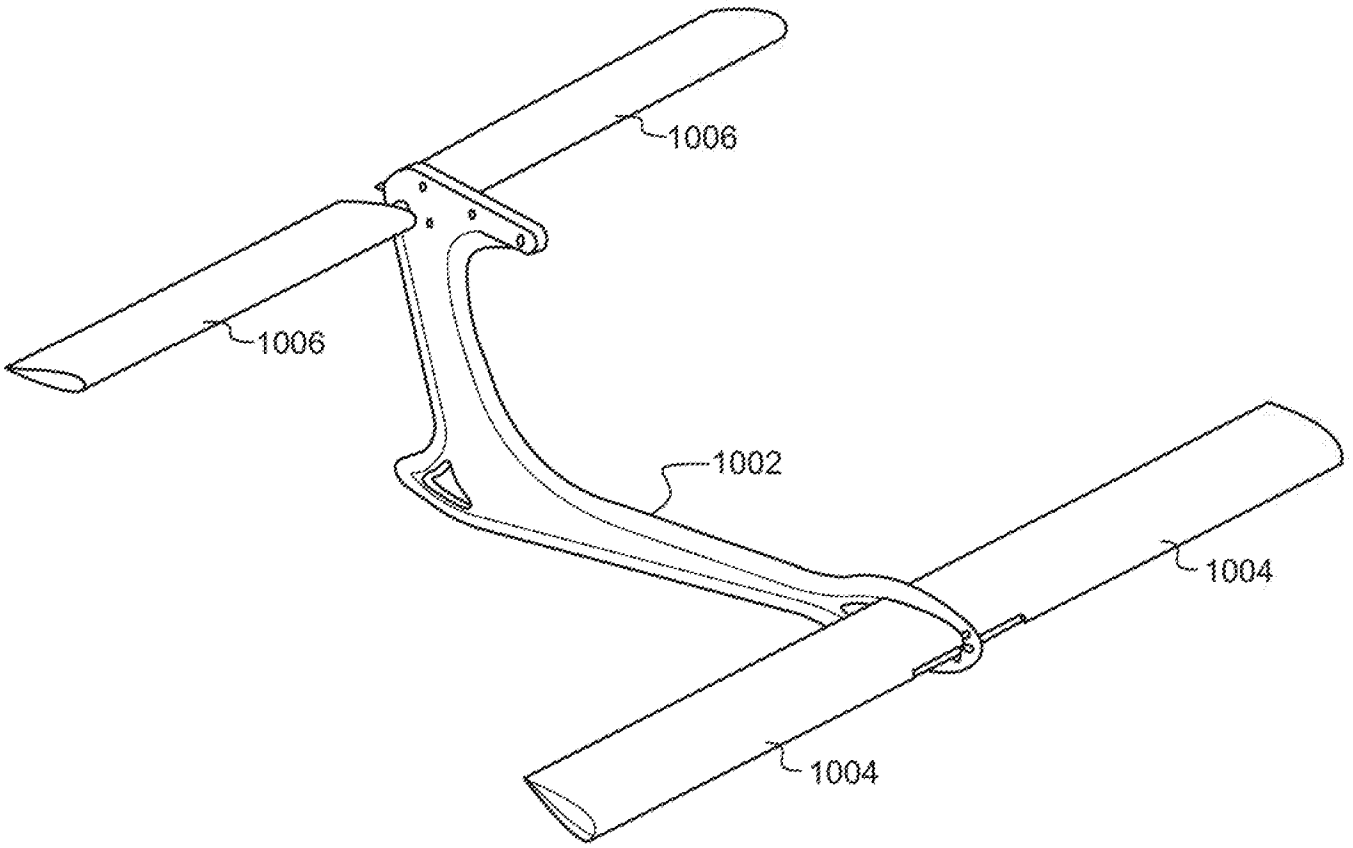
FIG. 10B is a perspective view of the device shown in FIG. 10 without the mounting bracket and locking mechanism.
Figure 10C:
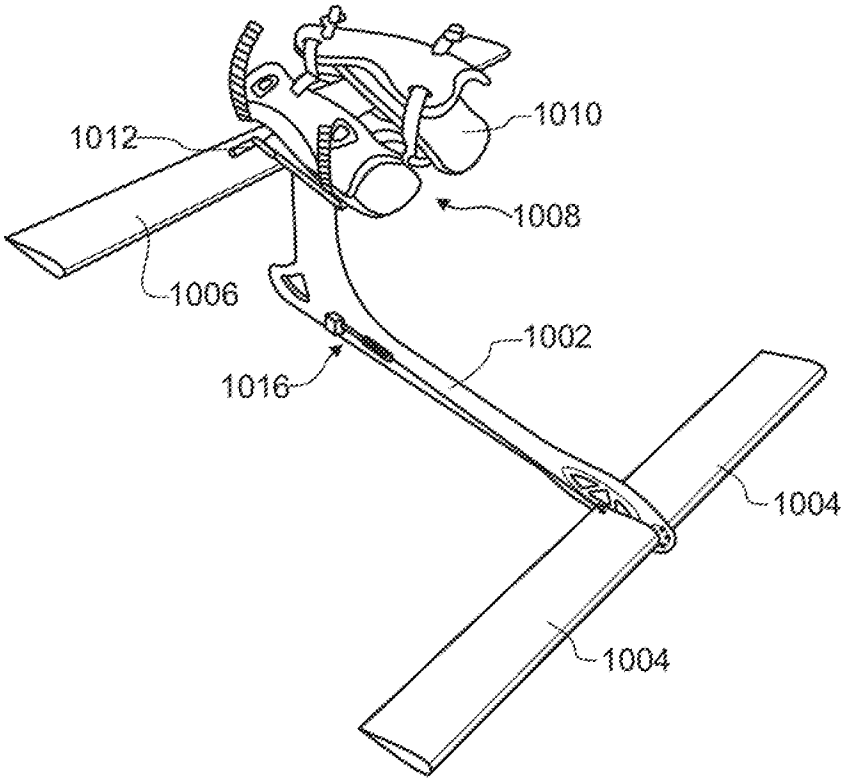
FIG. 10C is a perspective view of one embodiment of the device in FIG. 10 that includes a control mechanism.

Referring now to FIGS. 10-10C, these figures illustrate another embodiment of the swimming propulsion device 1000 having an L-shaped fuselage 1002. This fuselage configuration may allow a swimmer to carry an object on their chest and/or mid-section of the body without impeding the swimmer's ability to fully operate the device 1000. In addition, the edges of the fuselage 1002 may be tapered facilitating movement through the water.

Still referring to FIGS. 10-10C, the propulsors 1004 may have a rectangular-airfoil shape. In addition, these propulsors may be pivotally attached to the fuselage 1002. In other embodiments, the propulsors may be removably or collapsibly attached to the fuselage 1002. Similar to previous embodiments, the propulsor 1004 may be manufacture from materials including but not limited to plastic G10/FR4, Garolite, fiber reinforced plastic, wood-plastic composite, or other similar material.

Still referring to FIGS. 10-10C, the stabilizers 1006 may be attached to the aft section of the fuselage 1002 near the attached mechanism 1008. The stabilizers 1006 may be fixedly attached to the fuselage 1002. In another embodiment the stabilizers 1006 may be adjustably attached or collapsibly attached to the fuselage 1002. Other similar embodiments may include a stabilizer 1006 being one piece and including a notch for accommodating the swimmer's feet. Similar to previous embodiments, the stabilizer 1006 may be manufactured from materials including but not limited to plastic G10/FR4, Garolite, fiber reinforced plastic, wood-plastic composite, or other similar material.

Still referring to FIGS. 10-10C, the propulsion device 1000 may include an attachment mechanism 1008. This mechanism may include but is not limited to a pair of cuffs 1010, locking mechanisms 1012, and mounting brackets 1014. The mounting brackets 1014 may attach to the aft section of the fuselage 1002. These brackets may support the locking mechanism 1012. The locking mechanisms 1012 are similar to the previous embodiments and may include a handle assembly for securing the cuffs 1010 to the mounting brackets 1014. In other embodiments, any one of the previously described attachment mechanisms may be included in the propulsion device 1000.

Referring now to FIG. 10C, this embodiment of the swimming propulsion device 1000 is similar to the embodiments shown in FIGS. 10-10B, only this embodiment includes a control mechanism 1016. The control mechanism 1016 may also be included in the embodiments shown in FIGS. 10-10B. The control mechanism 1016 may be similar to the mechanism shown in FIGS. 6D-E and described previously. In some embodiments, one control mechanism 1016 may be included for each propulsor 1004. In other embodiments, the control mechanism 1016 may be any one of the previously described mechanisms for optimizing the angle of attack of the propulsor 1004 to maximize propulsion through the water as the propulsors 1004 pivot against the pressure of the resisting water.

Figure 11:
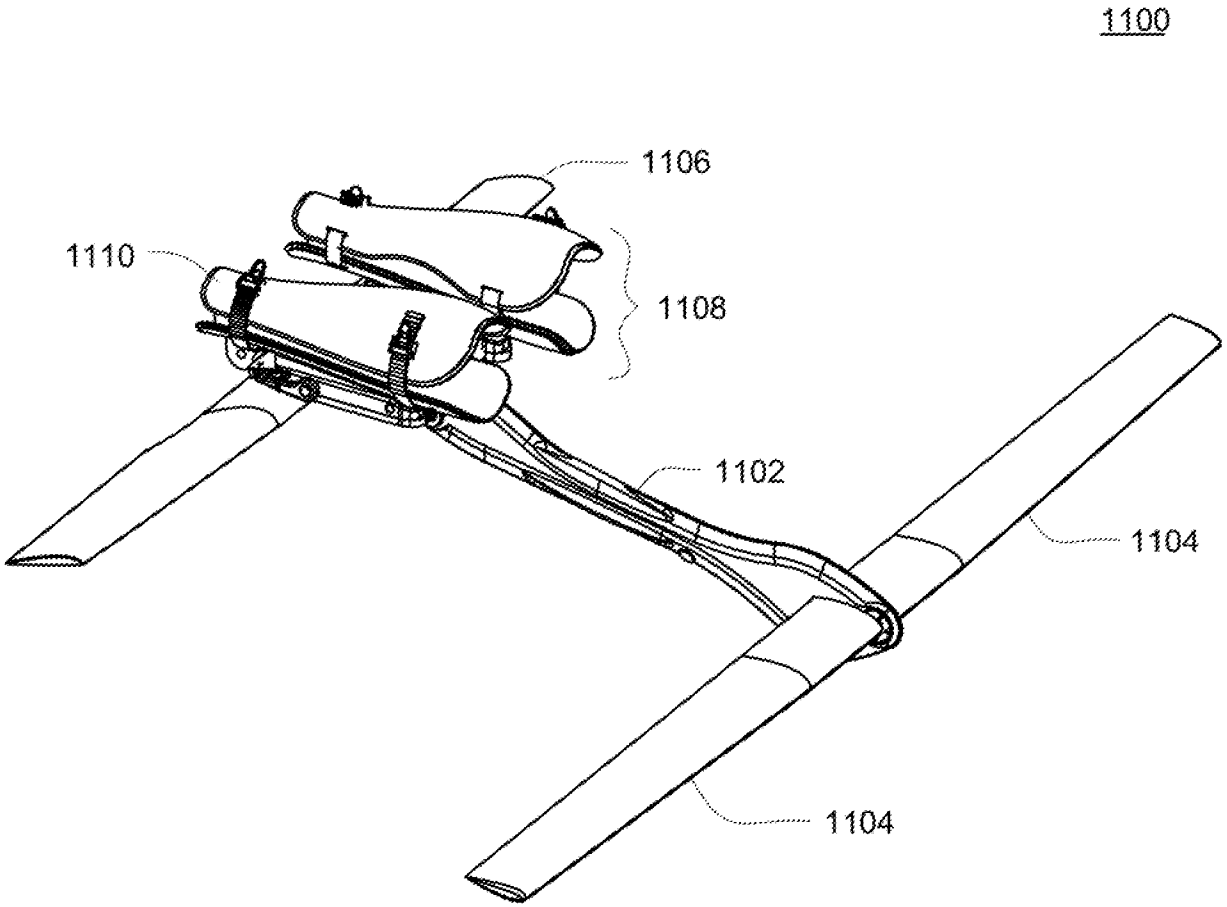
FIG. 11 is a perspective view of an alternate embodiment of the swimming propulsion device having a single stabilizer and tapered-airfoil-shaped propulsors.
Figure 11A:
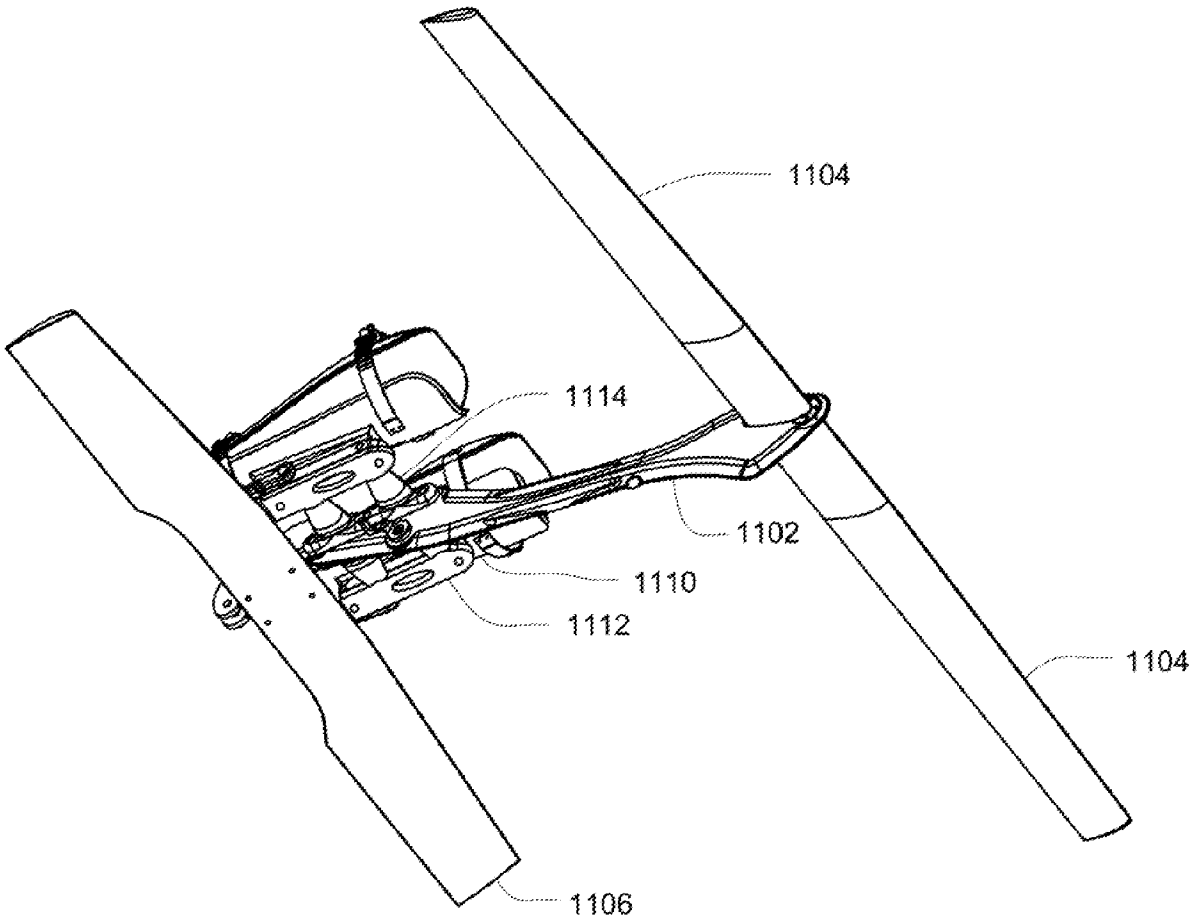
FIG. 11A is a bottom-perspective view of the device shown in FIG. 11.
Figure 11B:
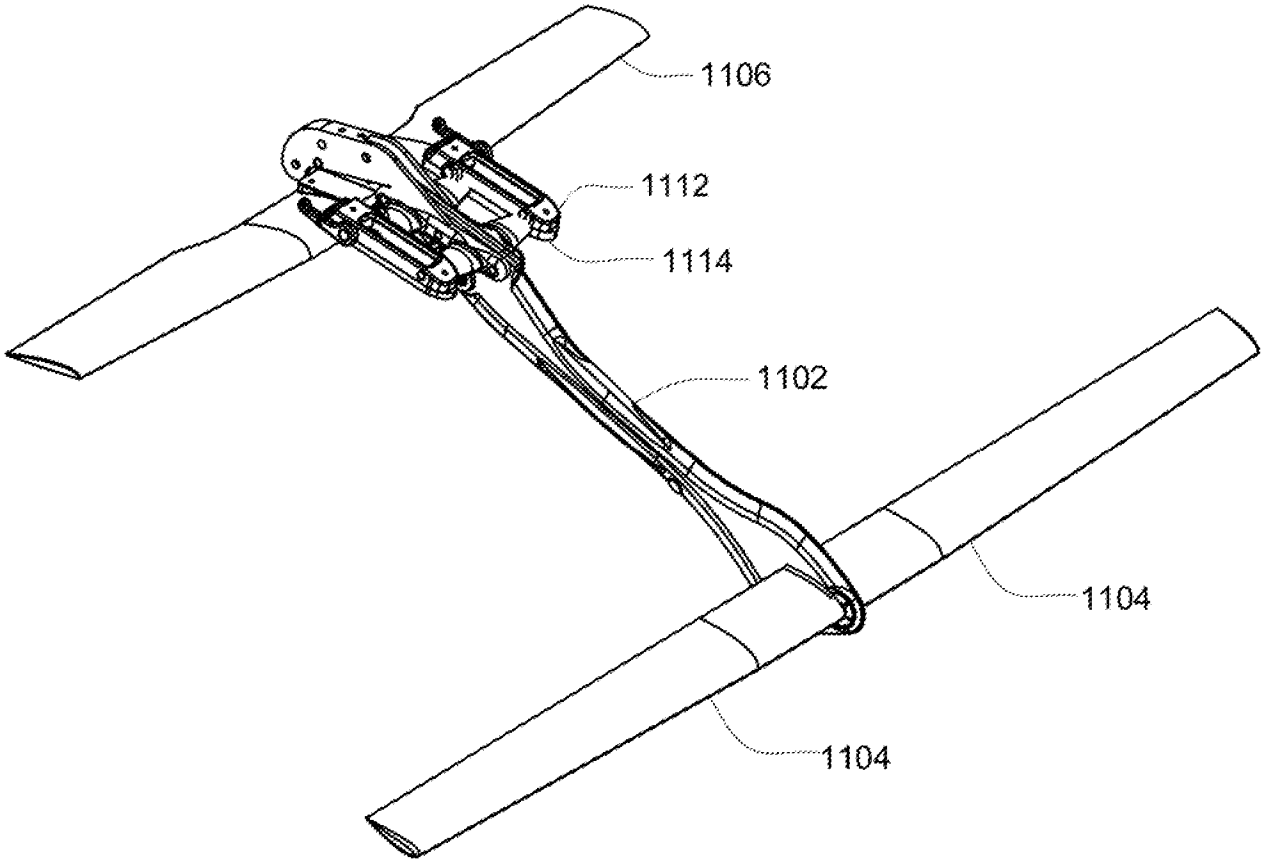
FIG. 11B is a perspective view of the device shown in FIG. 11 without cuffs attached.
Figure 11C:
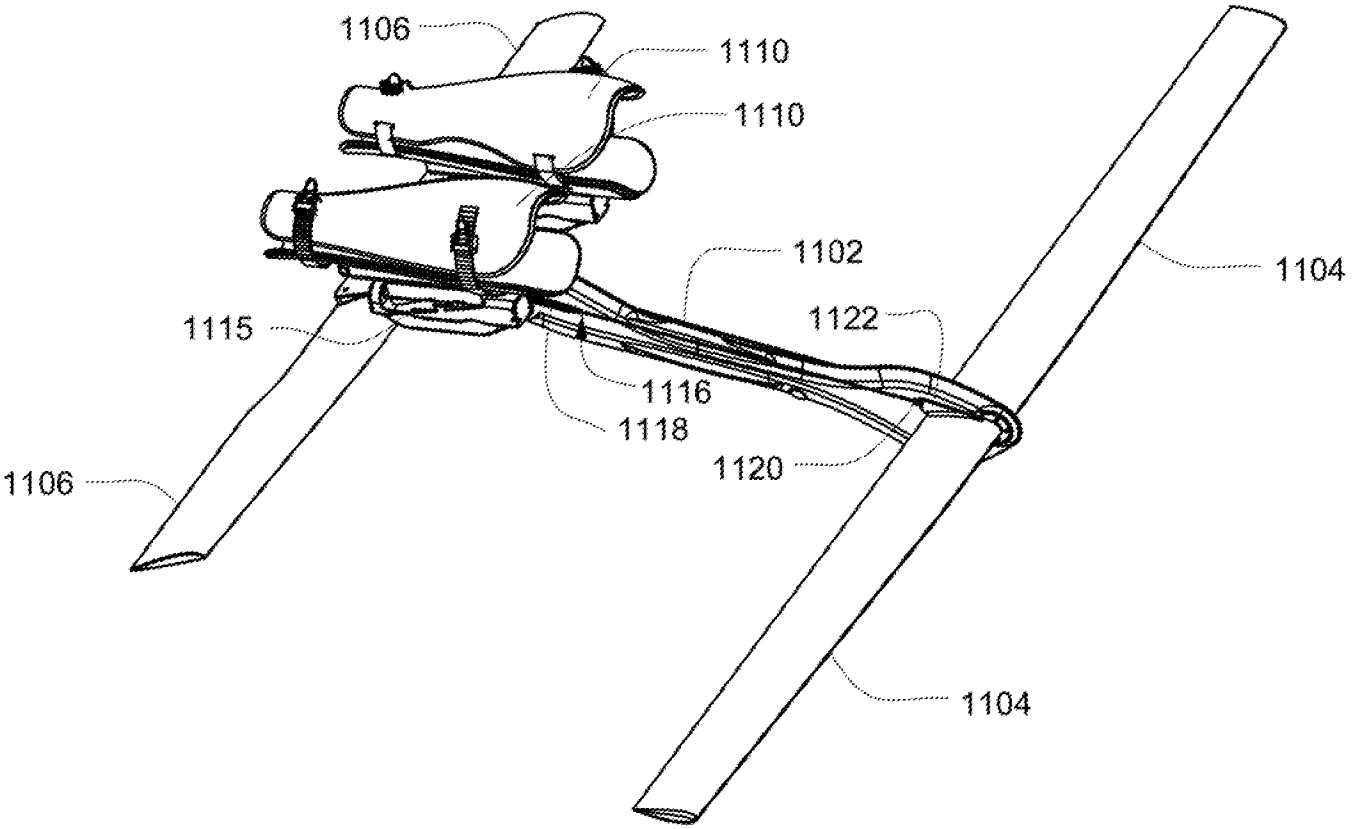
FIG. 11C is an embodiment of the device shown in FIG. 11 including a control mechanism.
Figure 11D:
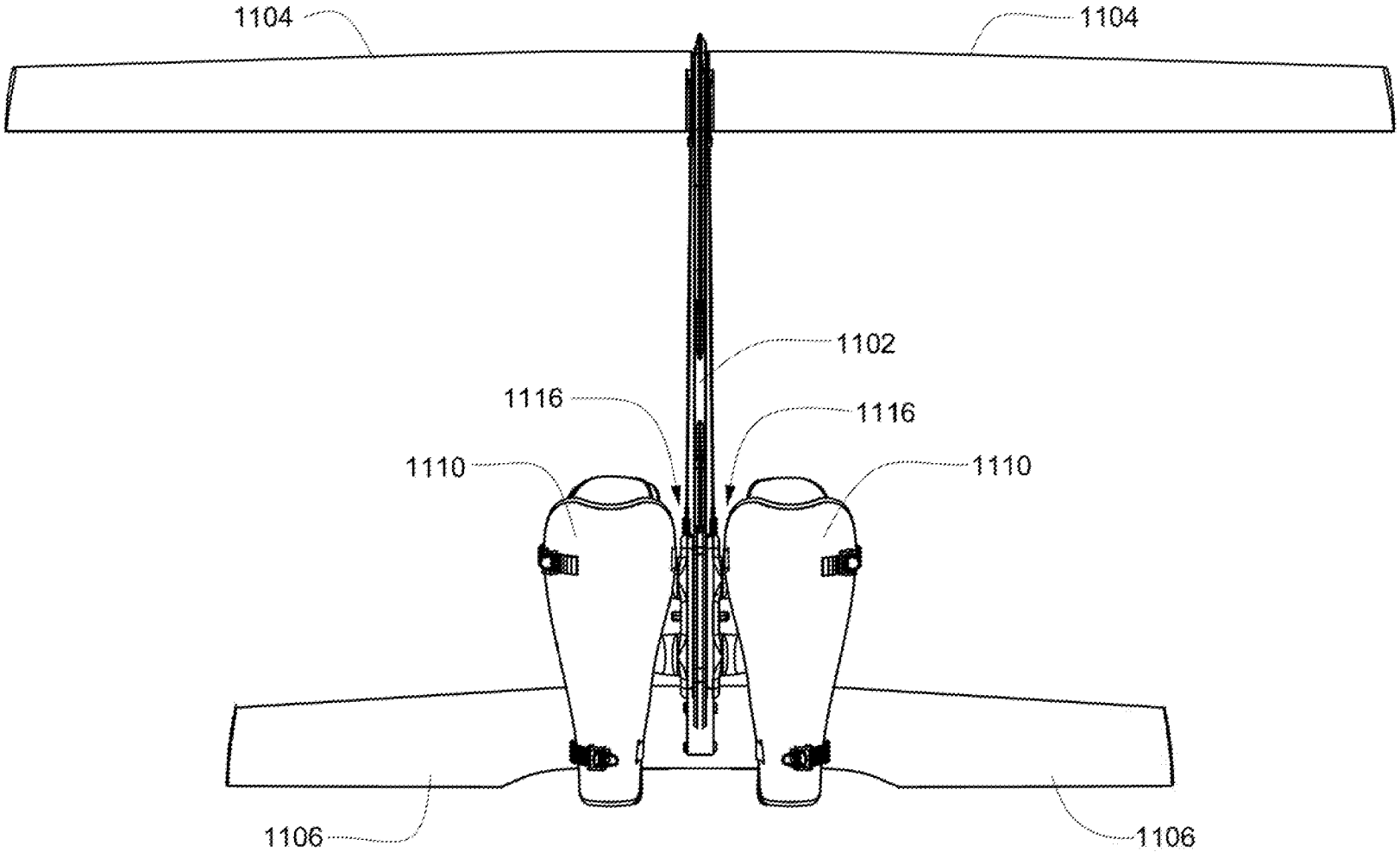
FIG. 11D is a top view of the device shown in FIG. 11C.

Referring now to FIGS. 11-11D, these figures illustrate yet another embodiment of the swimming propulsion device 1100. This embodiment may include a fuselage 1102 having the center of the forward section located on a different horizontal plane than the center of the aft section. In addition, edges of the fuselage 1102 and in particular the edges of the forward section where velocities are greatest may be tapered facilitating movement through the water. Similar to previously describe embodiments, the fuselage 1102 may be manufacture from materials including but not limited to G10/FR4, Garolite, fiber reinforced plastic, wood-plastic composite, or other similar material.

Still referring to FIGS. 11-11D, in some embodiments, the propulsors 1104 may be pivotally attached to the forward section of the fuselage 1102. In addition, the propulsors 1104 may have a tapered-airfoil shape. Furthermore, the propulsors may include a cable plate 1122 attached to the proximal end of the propulsors as shown in FIGS. 11C-D. The cable plate 1122 provides a location for adjustably attaching the cable 1120 of the control mechanism 1116 to the propulsor 1104. Similar to previous embodiments, the propulsor 1104 may be manufactured from materials including but not limited to plastic G10/FR4, Garolite, fiber reinforced plastic, wood-plastic composite, or other similar material.

Still referring to FIGS. 11-11D, the stabilizer 1106 may be fixedly and adjustably attached to the aft section of the fuselage 1102. In this embodiment the stabilizer 1106 may be one member or one body, but in other embodiments, the stabilizer 1106 may be two or more members, sections or bodies. Furthermore, the stabilizer 1106 may have a tapered-airfoil shape and may include a notch for accommodating the swimmer's feet. The stabilizer 1106 may have a smaller span length than the propulsors 1104 as illustrated in FIG. 11D. Similar to previous embodiments, the stabilizer 1106 may be manufactured from materials including but not limited to plastic G10/FR4, Garolite, fiber reinforced plastic, wood-plastic composite, or other similar material.

Still referring to FIGS. 11-11D, also mounted to the aft section of the fuselage 1102 may be an attachment mechanism 1108. In one embodiment the mechanism may include a pair of cuffs 1110, a locking mechanism 1112, and a pair of mounting brackets 1114. The mounting brackets 1114 may attach to the aft section of the fuselage 1102 and support the locking mechanism 1112. In this embodiment the locking mechanism 1112 may include a handle assembly as shown previously in FIG. 4H. In other embodiments, another embodiment of the locking mechanism 1115 may be used, for example, as illustrated on FIG. 11C and described above. In some embodiments, the locking mechanism 1115 may be similar to the mechanism shown in FIGS. 4-4G and described previously herein.

Referring now to FIG. 11C-D, this embodiment of the swimming propulsion device 1100 includes a control mechanism 1116. The control mechanism 1116 may include but is not limited to a spring 1118 and a cable 1120. In this configuration, one end of the spring 1118 may be connected directly to the aft section of the fuselage 1102 or mounting brackets 1114. The other end of the spring 1118 may be attached to a cable 1120. This cable may connect the spring 1118 to the propulsor 1104 by attaching to the cable plate 1122 as shown in both FIGS. 11C-D. This embodiment may include one control mechanism 1116 for each propulsor 1104. In other embodiments, the control mechanism 1116 may be any of the previously described mechanisms for optimizing the angle of attack of the propulsor 1104 to maximize propulsion through the water as the propulsors 1104 pivot against the pressure of the resisting water.

Figure 12:
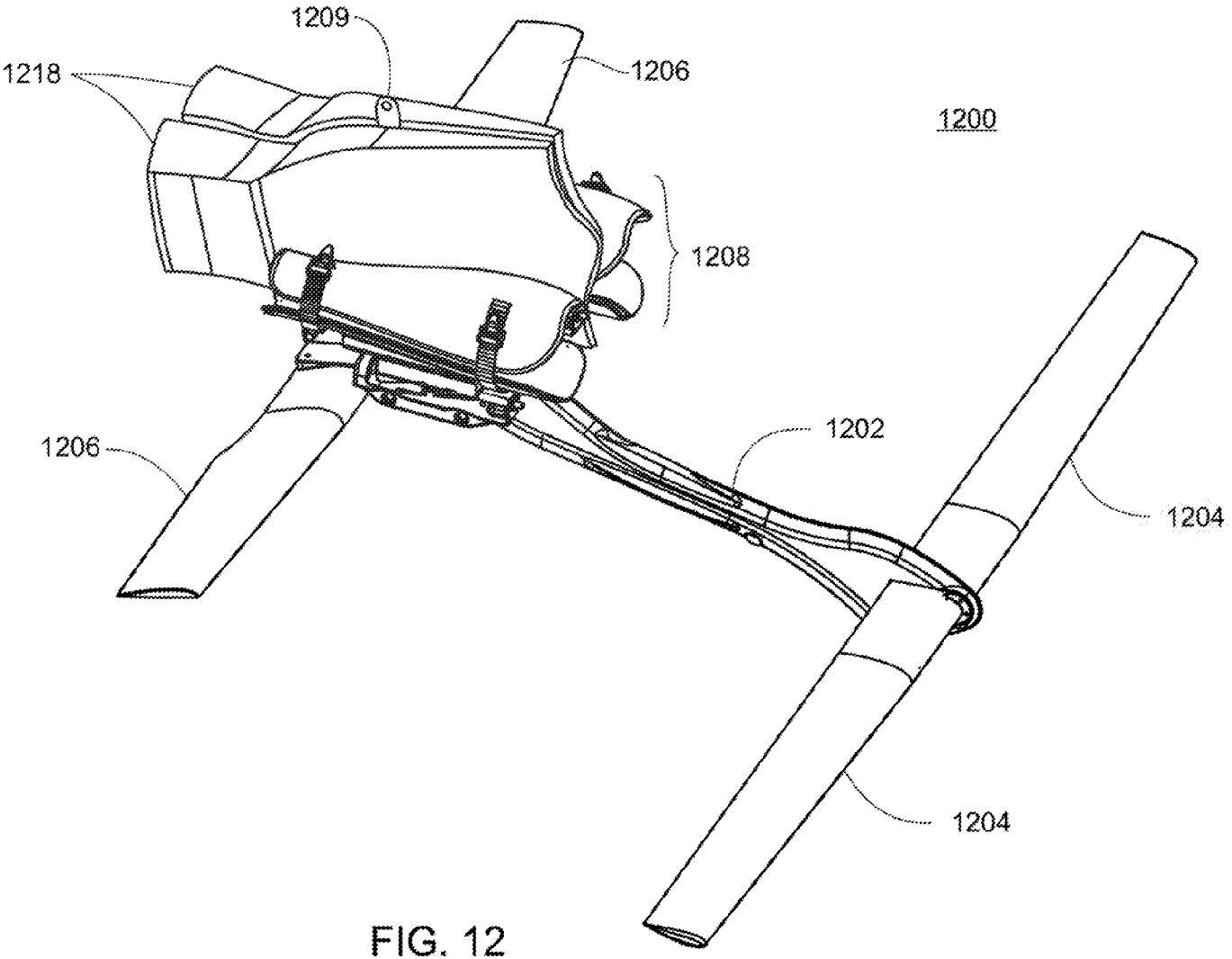
FIG. 12 is a perspective view of an alternate embodiment of the swimming propulsion device including a fin-attachment mechanism.
Figure 12A:
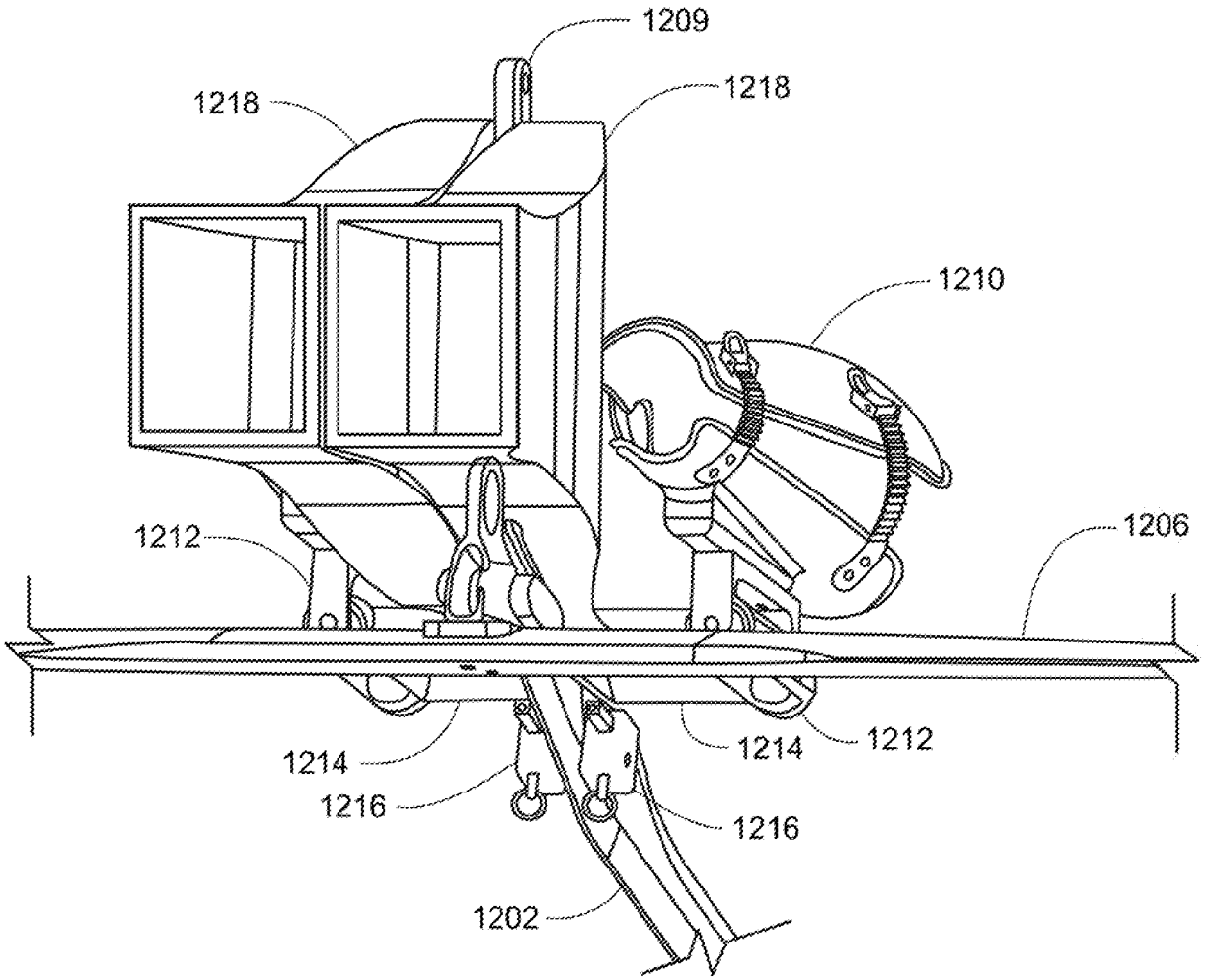
FIG. 12A is a rear-perspective view of an alternate embodiment of the swimming propulsion shown in FIG. 12.
Figure 12B:
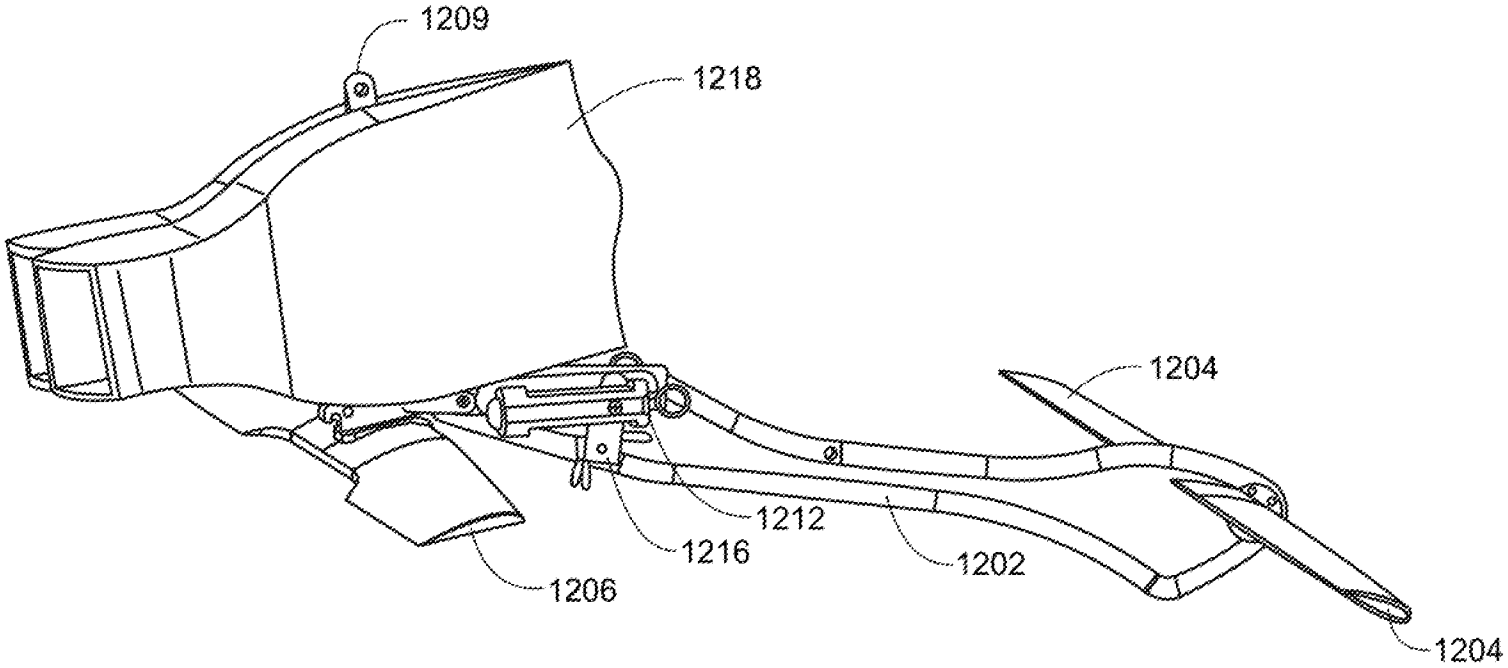
FIG. 12B is a side view of the device shown in FIG. 12.
Figure 12C:
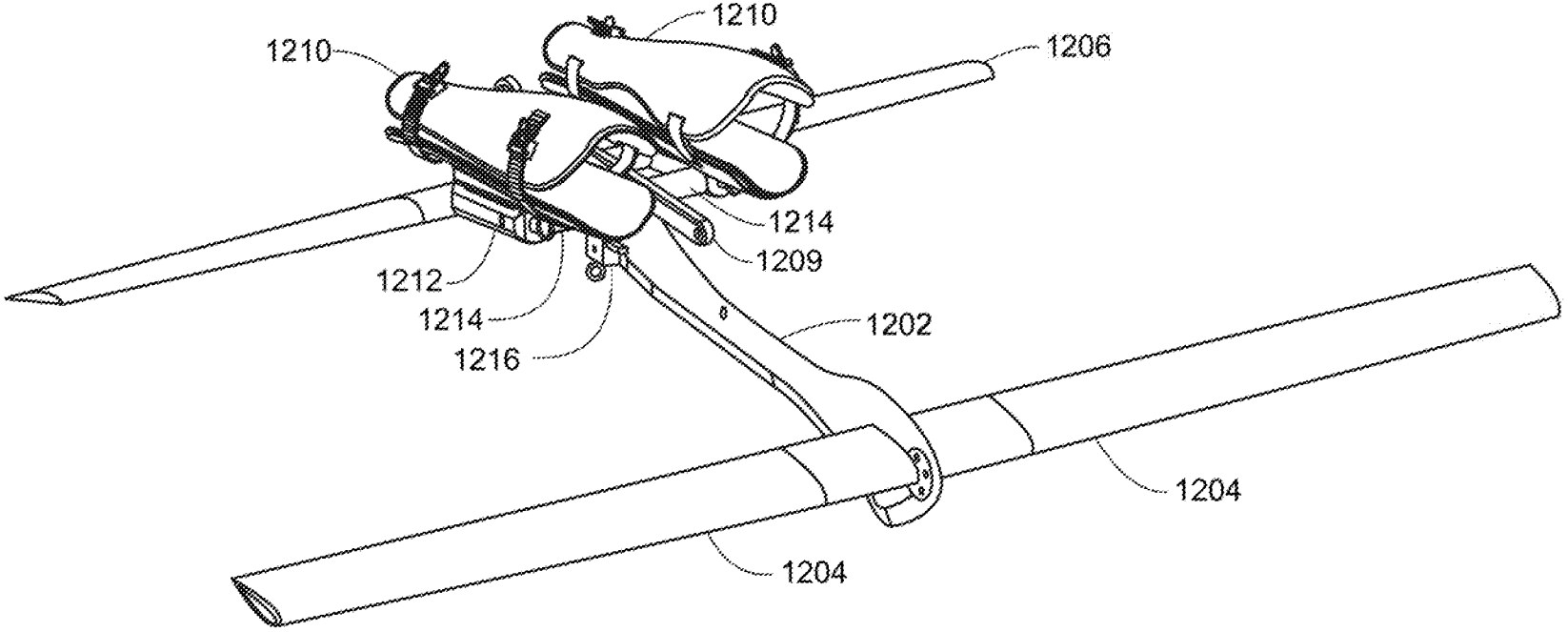
FIG. 12C is a perspective view of one embodiment of the device shown in FIG. 12 without fins attached.
Figure 12D:
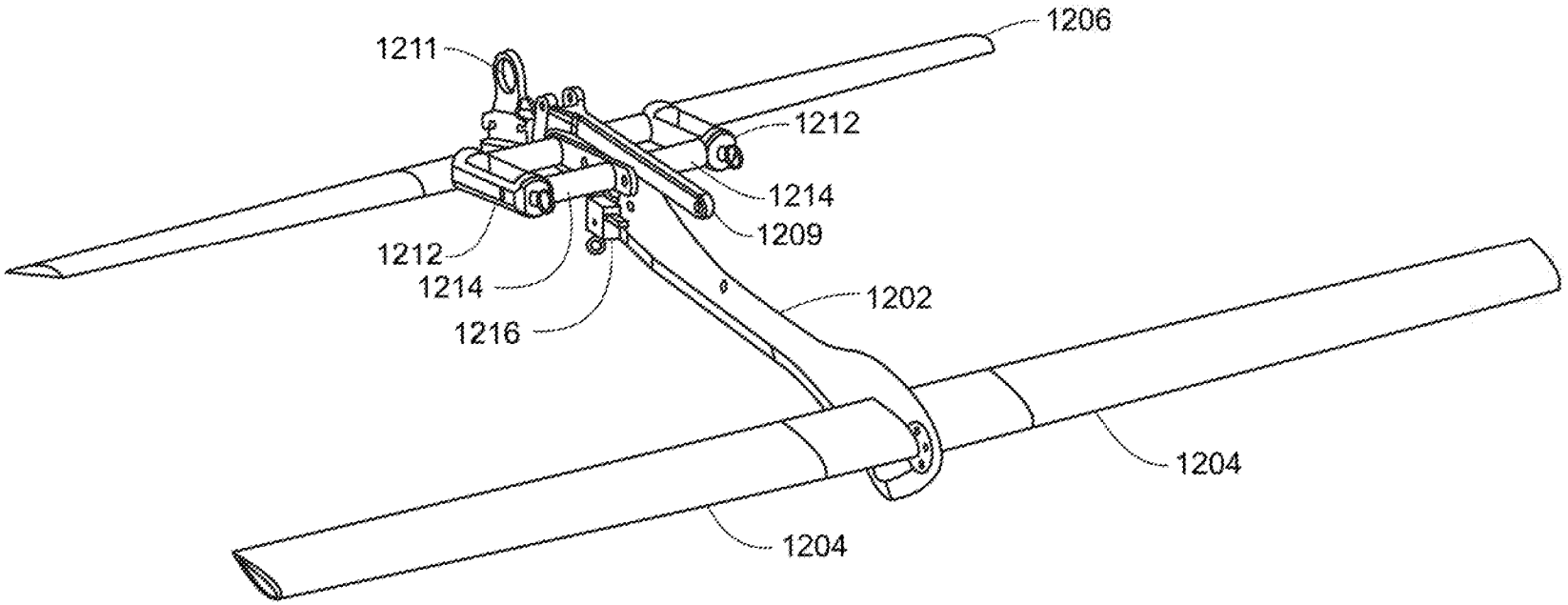
FIG. 12D is a perspective view of one embodiment of the device shown in FIG. 12 without fins and cuffs attached.
Figure 12E:
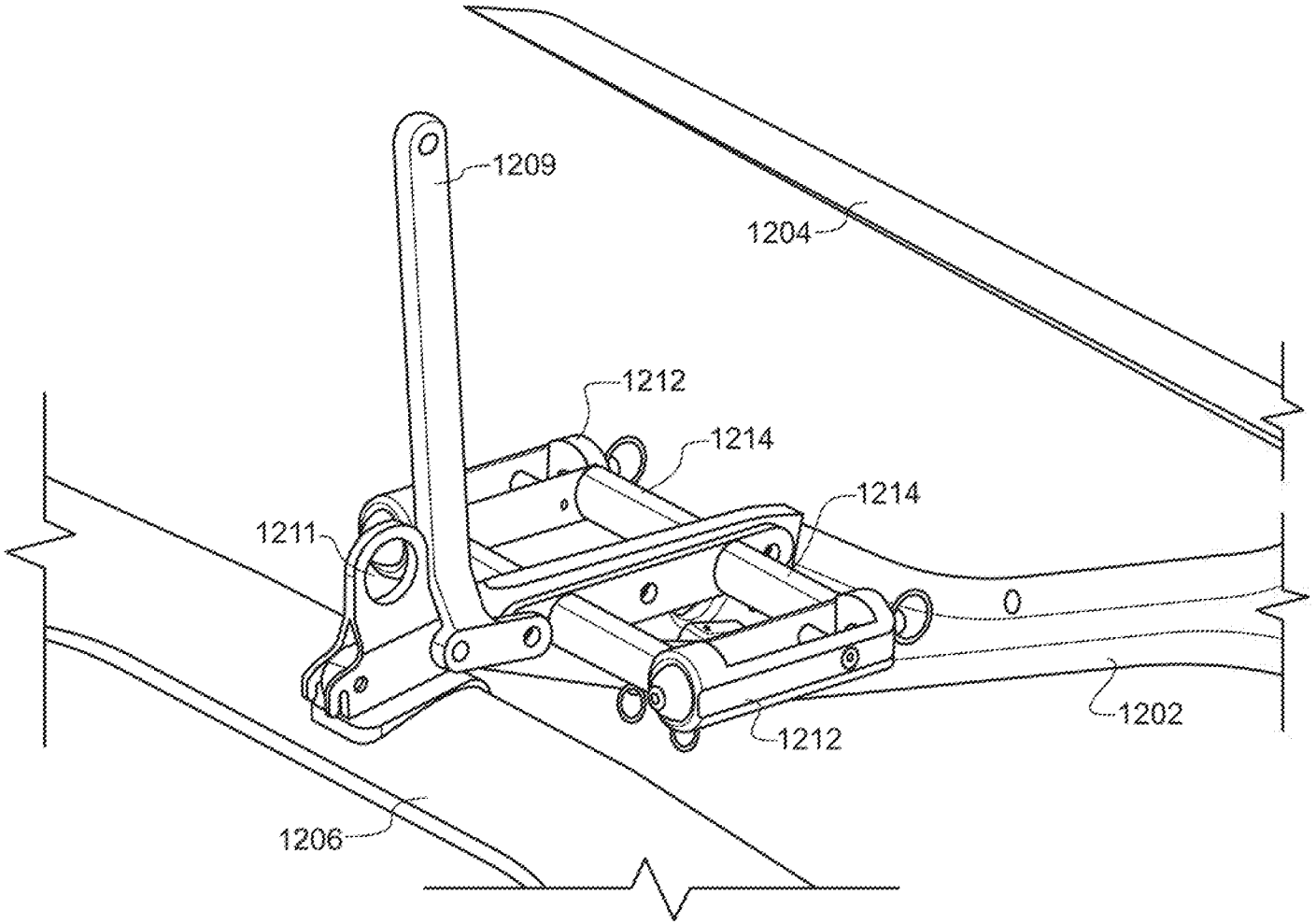
FIG. 12E is a rear-detail view of the device shown in FIG. 12 with the fin-attachment mechanism in the vertical position.
Figure 12F:
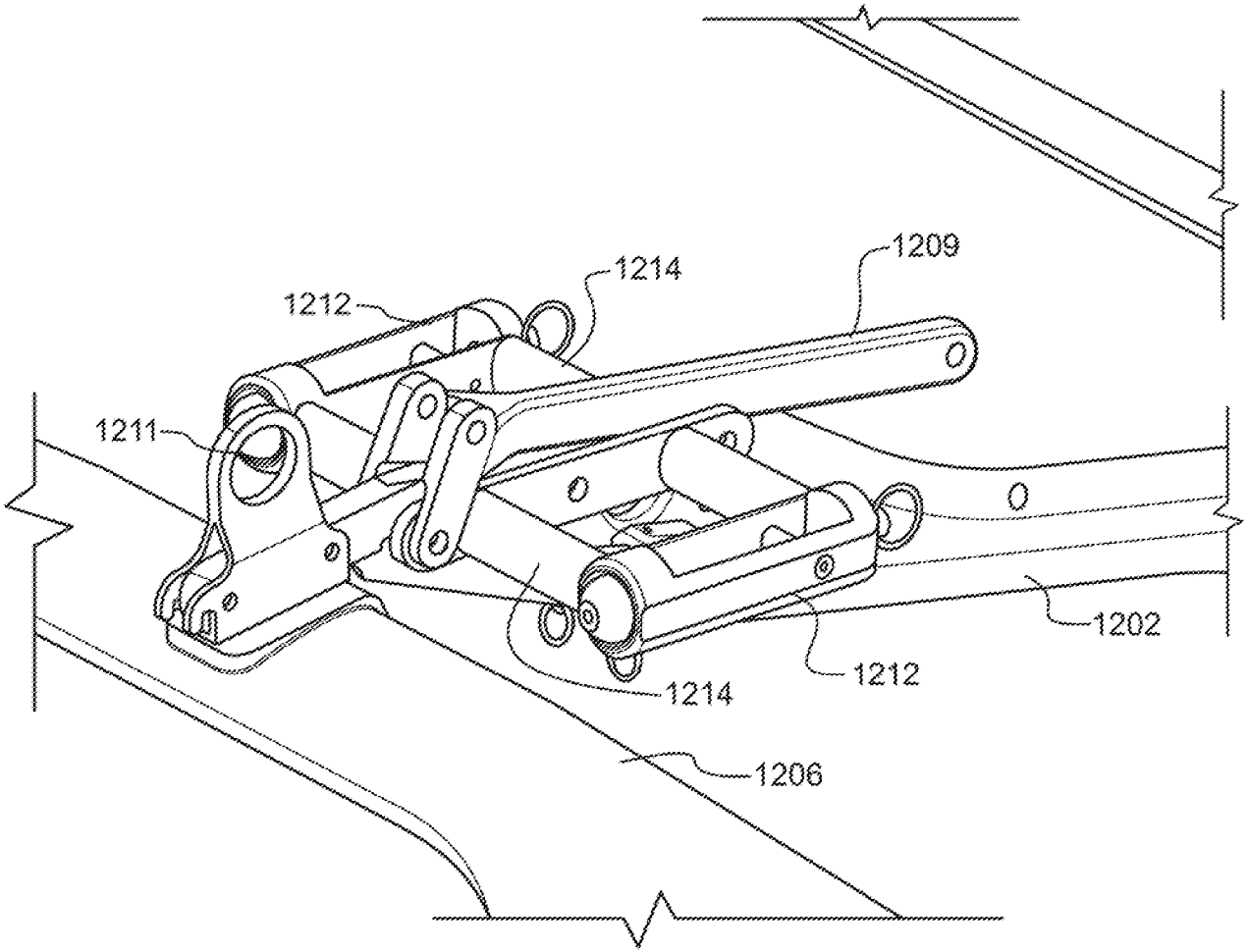
FIG. 12F is a rear-detail view of the device shown in FIG. 12 with the fin-attachment mechanism in the down position.
Figure 12G:
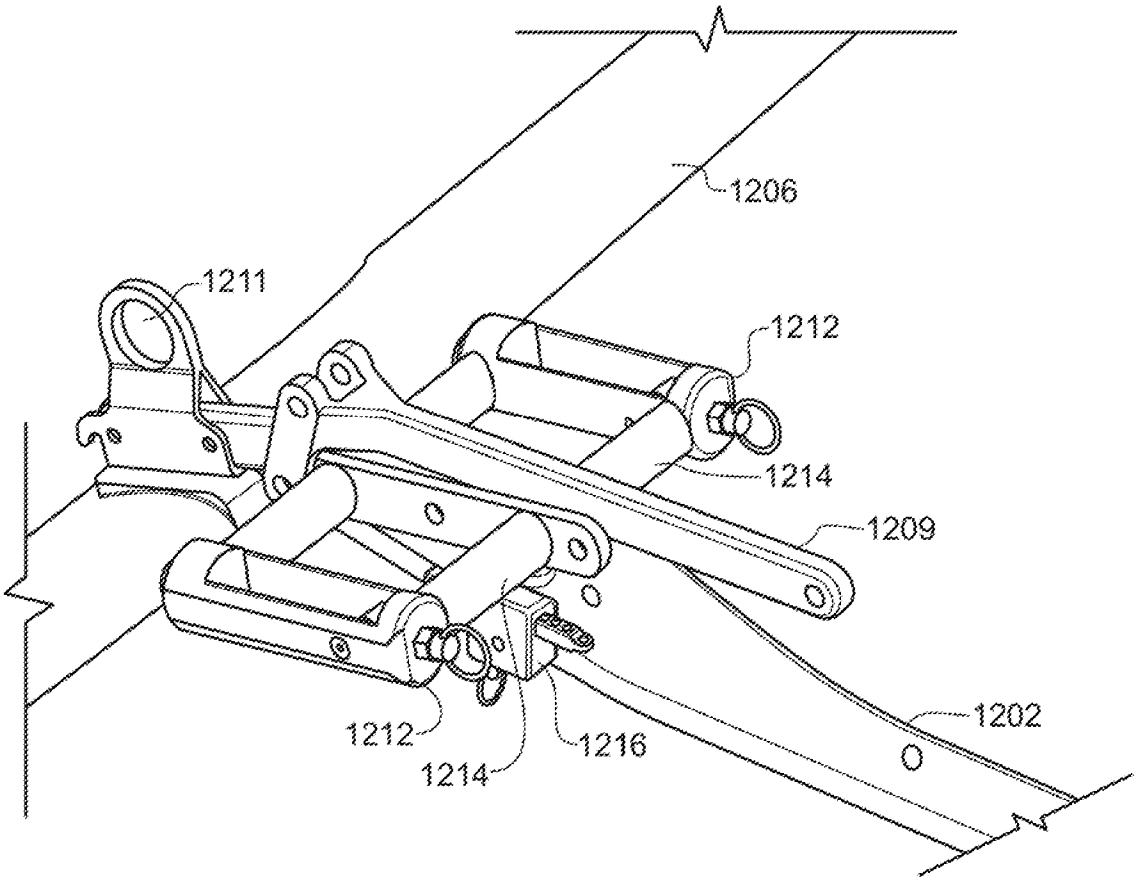
FIG. 12G is a front-detail view of the device shown in FIG. 12 with the fin-attachment mechanism in the down position.

Referring now to FIGS. 12-12G, these figures illustrate another embodiment of the swimming propulsion device 1200. This embodiment includes, but is not limited to, a fuselage 1202, propulsors 1204, a stabilizer 1206, an attachment mechanism 1208, a fin attachment mechanism 1209, and a control mechanism 1216. Also shown in FIGS. 12-12B is a pair of swimming fins 1218 attached to the device 1200 using the fin attachment mechanism 1209. The fins 1218 are shown on the device 1200 to illustrate one possible method of attaching fins to the device. Although the figures shown herein represent some embodiments, in other embodiments, the fin attachment mechanism is attached to the fuselage on a swimming propulsion device that does not include a stabilizer.

Still referring to FIGS. 12-12G, the fuselage 1202 may include a forward section and an aft section located on different horizontal planes as described previously and shown on FIGS. 2-2A herein. In other embodiments the fuselage 1202 may have a uniform shape and thickness. In yet other embodiments the fuselage 1202 may have an L-shape or may also include tapered edges facilitating movement through the water. The fuselage 1202 may have any of the various features described above with respect to the various embodiments of the fuselage. In addition, the fuselage 1202 may be manufactured from materials including but not limited to G10/FR4, Garolite, fiber reinforced plastic, wood-plastic composite, or other similar material.

Still referring to FIGS. 12-12G, propulsors 1204 may be pivotally and collapsibly attached to the forward section of the fuselage 1202. In this embodiment the propulsors 1204 may have a tapered-airfoil shape. However, in other embodiments, the propulsors may have a shape similar but not limited to the propulsor shapes previously described herein. Similar to previously described embodiments, the propulsors 1204 may be manufactured from materials including but not limited to plastic G10/FR4, Garolite, fiber reinforced plastic, wood-plastic composite, or other similar material.

Still referring to FIGS. 12-12G, the stabilizer 1206 may be fixedly and removably attached to the aft section of the fuselage 1202. In this embodiment the stabilizer 1206 may be one piece, but in other embodiments the stabilizer 1206 may be two pieces. Furthermore, the stabilizer 1206 may have a tapered-airfoil shape and may include a notch for accommodating the swimmer's feet. Similar to previously described embodiments, the stabilizer 1206 may be manufactured from materials including but not limited to plastic G10/FR4, Garolite, fiber reinforced plastic, wood-plastic composite, or other similar material.

Still referring to FIGS. 12-12G, also mounted to the aft section of the fuselage 1202 may be an attachment mechanism 1208. In one embodiment the mechanism may include a pair of cuffs 1210, locking mechanisms 1212, and a pair of mounting brackets 1214. The mounting brackets 1214 may be attached to the aft section of the fuselage 1202 and support the locking mechanism 1212. In this embodiment the locking mechanism 1212 may be similar to mechanisms previously described herein and illustrated in FIGS. 4-4I. Some embodiments of the attachment mechanisms may not include a locking mechanism 1212 as described herein and illustrated in FIGS. 4J-S, but may include any locking mechanism suitable for the purpose.

Still referring to FIGS. 12-12G, these figures also illustrate a fin attachment 1209 for securing a pair of swimming fins 1218 to the device 1200. In operation, the fin attachment 1209 may be raised to a vertical position, as shown in FIG. 12E. With the mechanism in the vertical position, the fins 1218 may be attached to the fin attachment 1209 by connecting one end of a cable (not shown) to the fin attachment mechanism 1209, then wrapping the fins with the cable, and securing the other end of the cable to an attachment point 1211. In other embodiments the fins 1218 may be secured to the fin attachment mechanism 1209 using for example, but not limited to: rope, bungee cords, or webbing. The swimming fins 1218 may be attached to the device 1200 while the swimmer is operating the device. When the fin attachment 1209 is not in use, the attachment may be folded towards the forward end of the device 1200 as shown in FIGS. 12F-G.

Still referring to FIGS. 12-12G, this embodiment of the swimming propulsion device 1200 may include a control mechanism 1216. The control mechanism 1216 illustrates one possible adjustable control mechanism, but in other embodiments the control mechanism 1216 may be any of the previously described mechanisms for optimizing the angle of attack of the propulsor 1204 to maximize propulsion through the water as the propulsors 1204 pivot against the pressure of the resisting water.

EXAMPLES

The swimming propulsion device may be used to decrease: the amount of energy; amount of oxygen; and the average heart-rate while swimming a given velocity a swimmer expends while using the device as compared with the use of swimming fins alone as shown in human testing. A number of figures are shown herein representing data from human use tests performed. The swimming propulsion device was performance tested in the Moving Flow Pool (MFP) against standard swim fins which represents the baseline for comparison. Each test subject was asked to swim against a fixed water velocity using first, standard swim fins, and next, the swimming propulsion device. The water velocity varied from 0.6 to 1.5 knots. During each test several metabolic parameters were measured: oxygen consumption, heart rate and blood lactate level. Oxygen consumption and heart rate were measured continuously while blood lactate level could only be measure at the completion of the test.

Test duration was typically 15 minutes in length. Typically heart rate and oxygen consumption reached steady state during the first 5 minutes of the test. Once steady state was achieved data was recorded and averaged for the next 10 minutes. Only steady state values were used in the reported data.

Some test subjects were unable to complete the higher velocity standard swim fin tests. In addition some test subjects had elevated blood lactate levels (in excess of 4 mmol/liter) at the completion of the test. In either case the efforts were noted as unsustainable.

Figure 13:
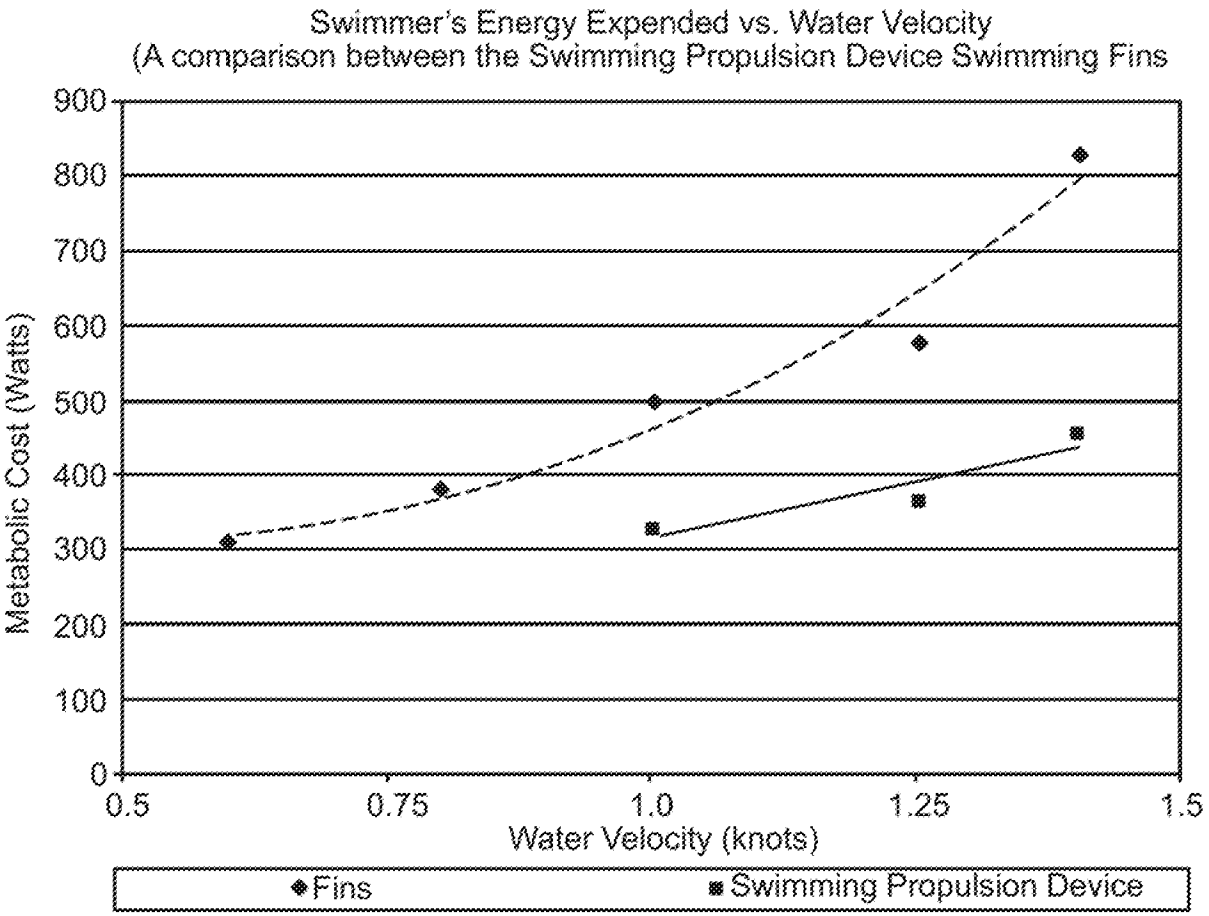
FIG. 13 is a chart illustrating the metabolic cost of using the swimming propulsion device versus swimming fins at various water velocities.

Referring now to FIG. 13, this figure illustrates the amount of energy a swimmer used while swimming at various water velocities. Metabolic cost, in Watts, was calculated from the amount of oxygen consumed. Power may be calculated because the oxygen rate is known (i.e., is measured) and the fuel source is estimated (i.e., ratio of carbohydrates, protein and fat). From inspection, FIG. 13 shows as the velocity of the water increases, a swimmer using the swimming propulsion device expends significantly less energy than a swimmer using fins. Thus, from this date, the swimming propulsion device may allow for a swimmer to swim further distances with less energy as compared with a swimmer using swimming fins.

Figure 14:
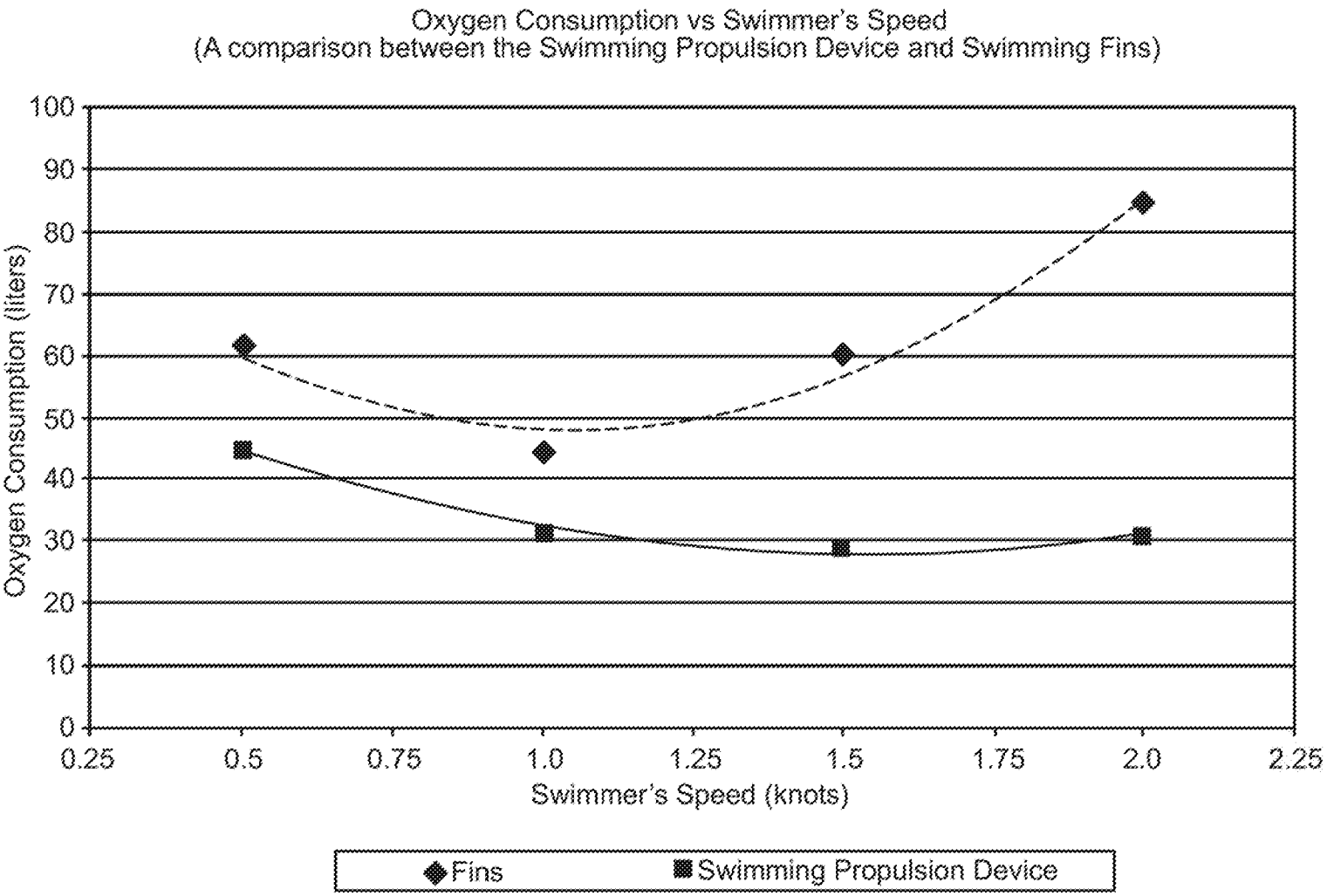
FIG. 14 is a chart illustrating the amount of oxygen consumed by a swimming using the swimming propulsion device versus swimming fins.

Referring now to FIG. 14, this figure illustrates the amount of oxygen consumed by a swimmer at various swimming speeds using fins and the swimming propulsion device. The chart shows that a swimmer using the propulsion device may consume less oxygen than a swimmer using swimming fins for all swimming speeds. The difference in the amount of oxygen consumed by a swimmer using the propulsion device versus a person using swimming fins becomes significant as the swimmer's speed increases. The lower amount of oxygen consumed by the swimmer using the propulsion device may allow the swimmer to swim for longer durations than someone using swimming fins.

Figure 15:
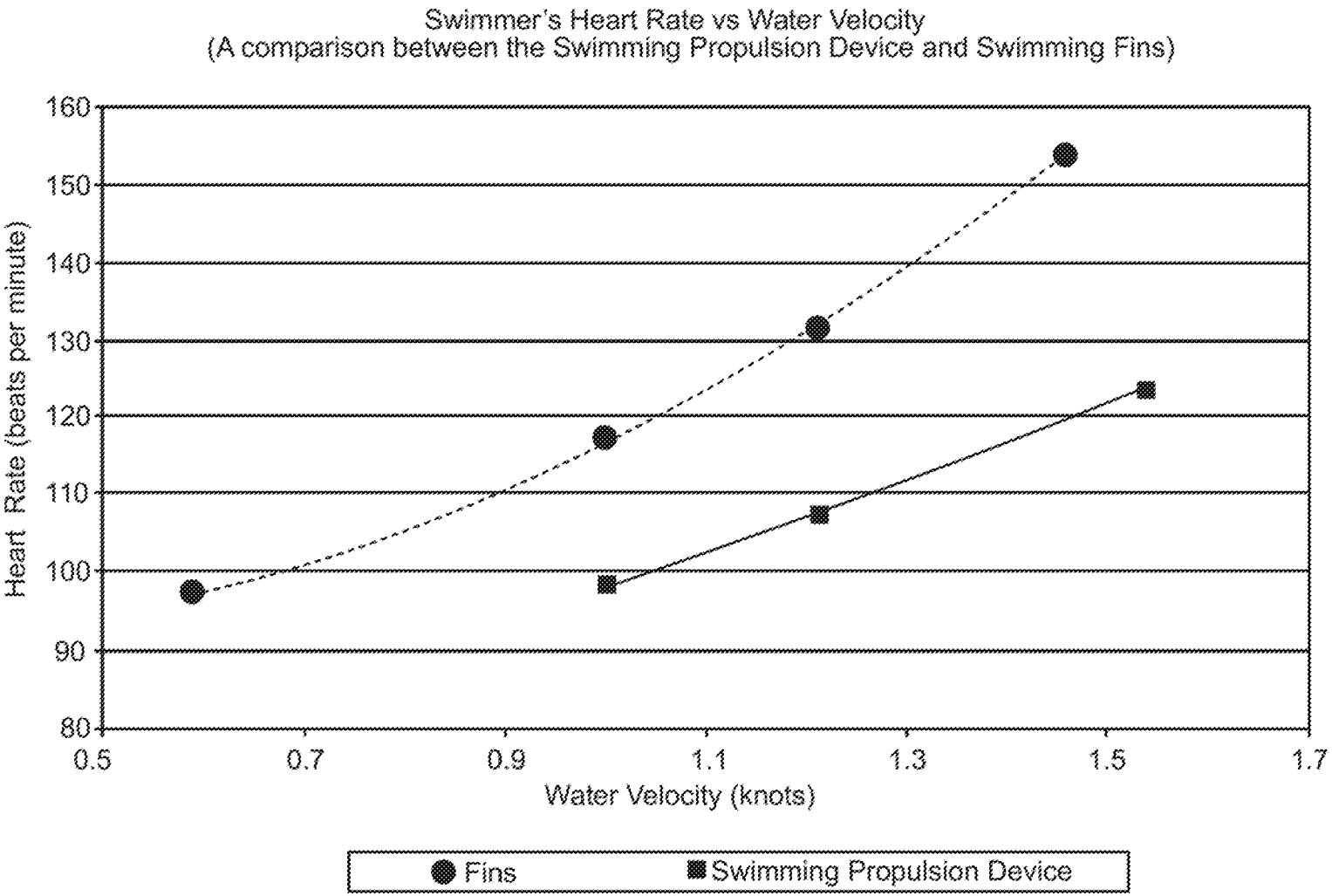
FIG. 15 is a chart illustrating a swimmer's heart rate while using the swimming propulsion device versus swimming fins at various water velocities.

Referring now to FIG. 15, this figure illustrates a swimmer's heart rate while swimming using the propulsion device and swimming fins at various velocities. The chart shows that a person using swimming fins has a greater heart rate than one using the propulsion device when swimming in water having greater velocities. The higher the water velocity the more significant is the difference between the heart rate for a swimmer using fins versus a person using the swimming propulsion device. The greater the swimmer's heart rate the more stress the swimmer is experiencing. Using the swimming propulsion device may reduce the swimmer's heart rate and the stress experienced by the swimmer. With the swimmer experiencing less stress may swim for longer periods of time and/or further distances.

The various embodiments of the swimming propulsion device described have been tested for efficiency. The tests were conducted using a mechanical test fixture (dyno) constructed to oscillate the device's propulsors through the water of the MFP. The test fixture allowed for the determination of the propulsive power generated by the propulsors. A pair of propulsors was attached to the end of a pivoting arm which represented the fuselage of the OFD. An electric motor was used to oscillate the arm and propulsor assembly. Input power to the electric motor could then be measured. In addition a load cell was incorporated into the test fixture to allow for the measurement of the propulsive force of the foils. The water speed was fixed at various velocities from 0.5 to 1.5 knots. Since the propulsive force and water speed were known propulsive power was able to be calculated. Also, since the input power to the electric motor was know, this allowed for the calculation of propulsive efficiency.

Figure 16:
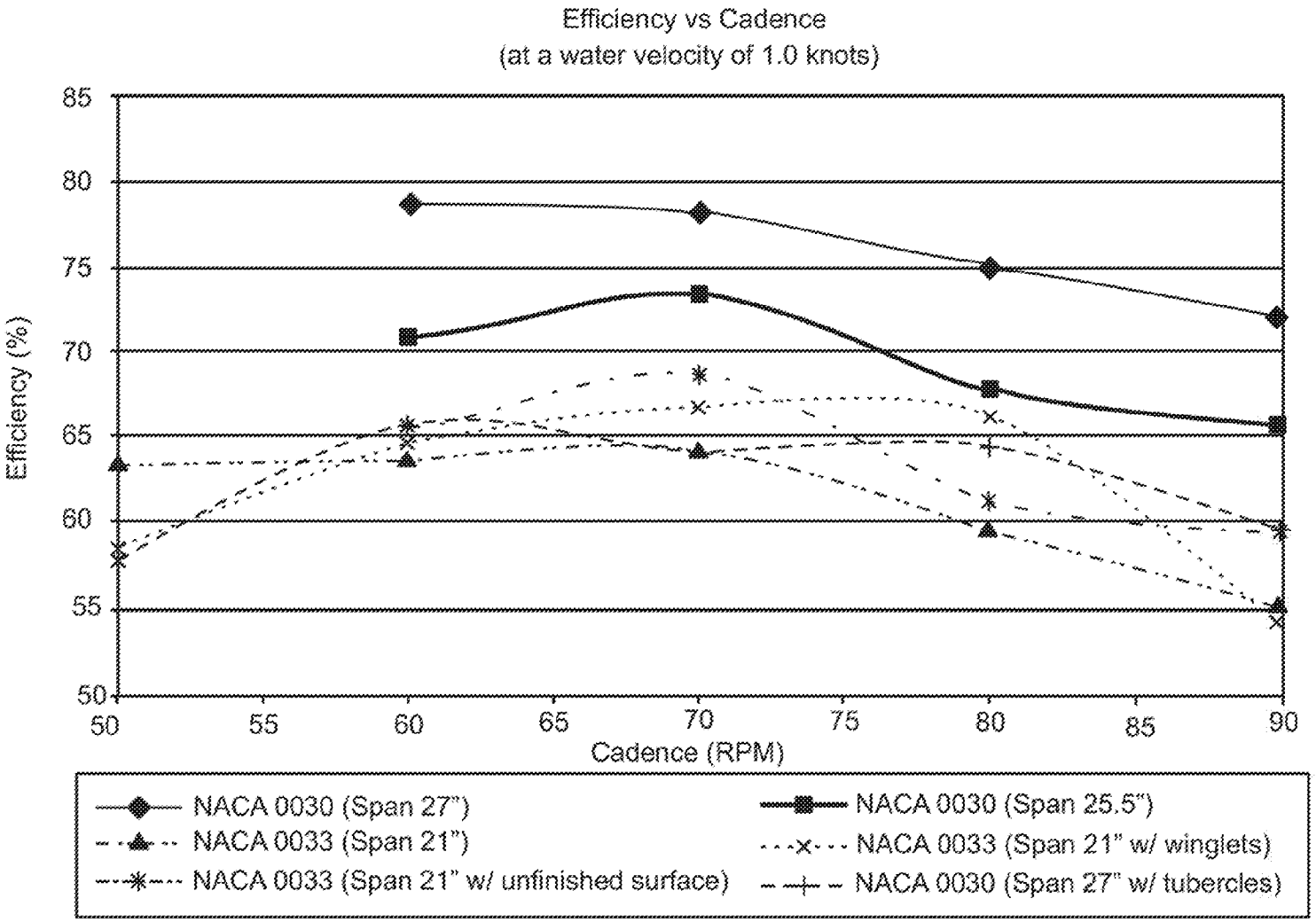
FIG. 16 is a chart illustrating the efficiency of various embodiments of the swimming propulsion device at various cadence rates for a water velocity of 1.0 knots.

Referring now to FIG. 16, this figure illustrates the efficiency of various designs of the swimming propulsion device for different rates of operating strokes, called cadences, for a water velocity of 1.0 knots. The figure shows that a swimming propulsion device with a propulsor design having a National Advisory Committee for Aeronautics (NACA) designation of 0030 and a span of 27 inches provides the greatest amount of efficiency at various cadence rates. Other similar designs having tubercles on the leading edge of the propulsor or a smaller propulsor span were not as efficient. Similarly, propulsor designs having a NACA designation of 0033 and a span of 21 inches were also less efficient than the exemplary embodiment.

Figure 17:
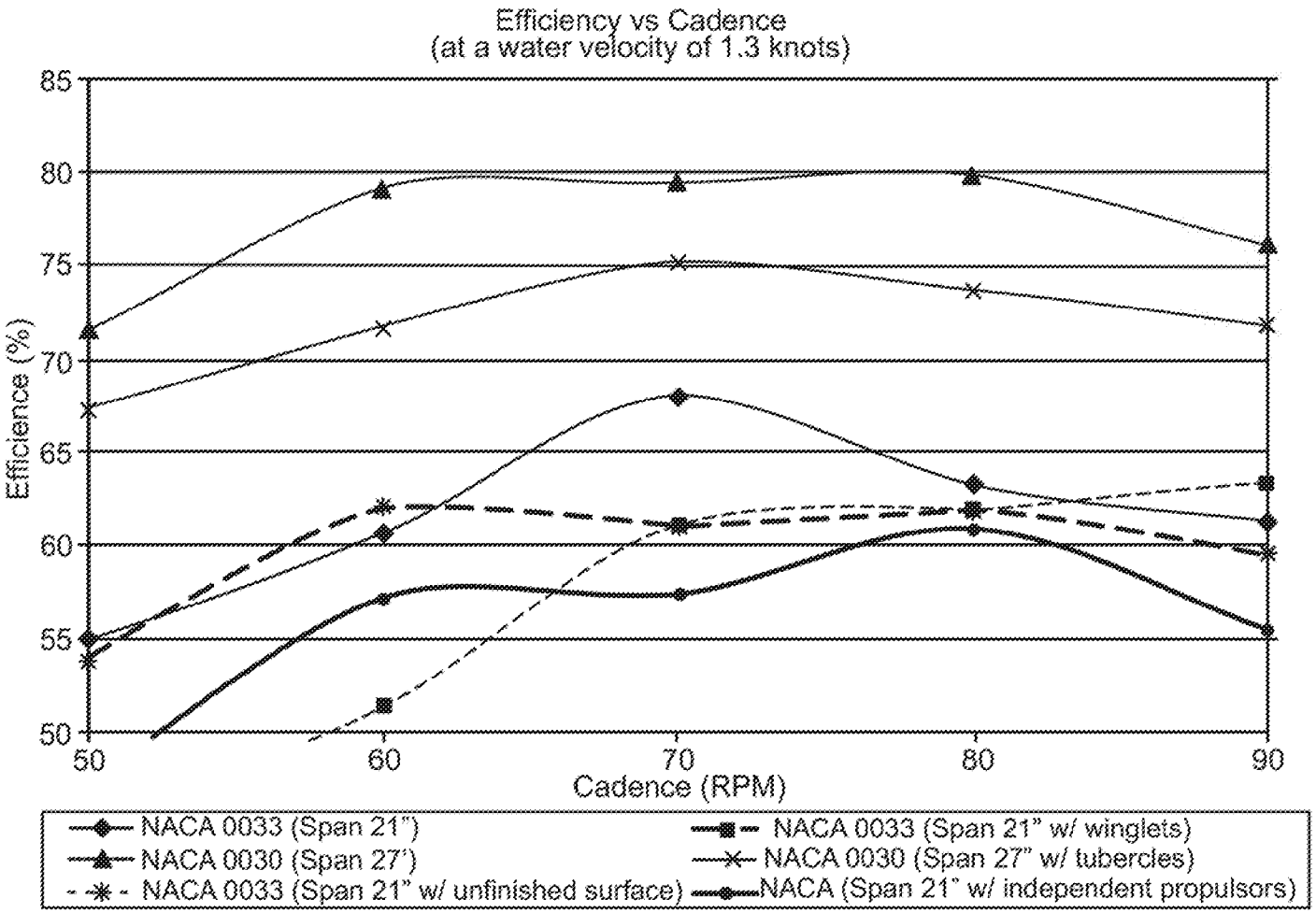
FIG. 17 is a chart illustrating the efficiency of various embodiments of the swimming propulsion device at various cadence rates for a water velocity of 1.3 knots.

Referring now to FIG. 17, this figure illustrates the efficiency of various designs of the swimming propulsion device for different cadence rates for a water velocity of 1.3 knots. Similar to the previous figure, the exemplary embodiment having a propulsor with a NACA profile designation of 0030 and a span of 27 inches had the greatest efficiency at all cadence rates. Moreover, the addition of tubercles to the leading edge of the propulsor did not increase the efficiency of the propulsor design. Other propulsor designs having a NACA designation of 0033 had varying levels of efficiency, but all of these designs had an efficiency that was significantly lower than the exemplary embodiment.

Figure 18:
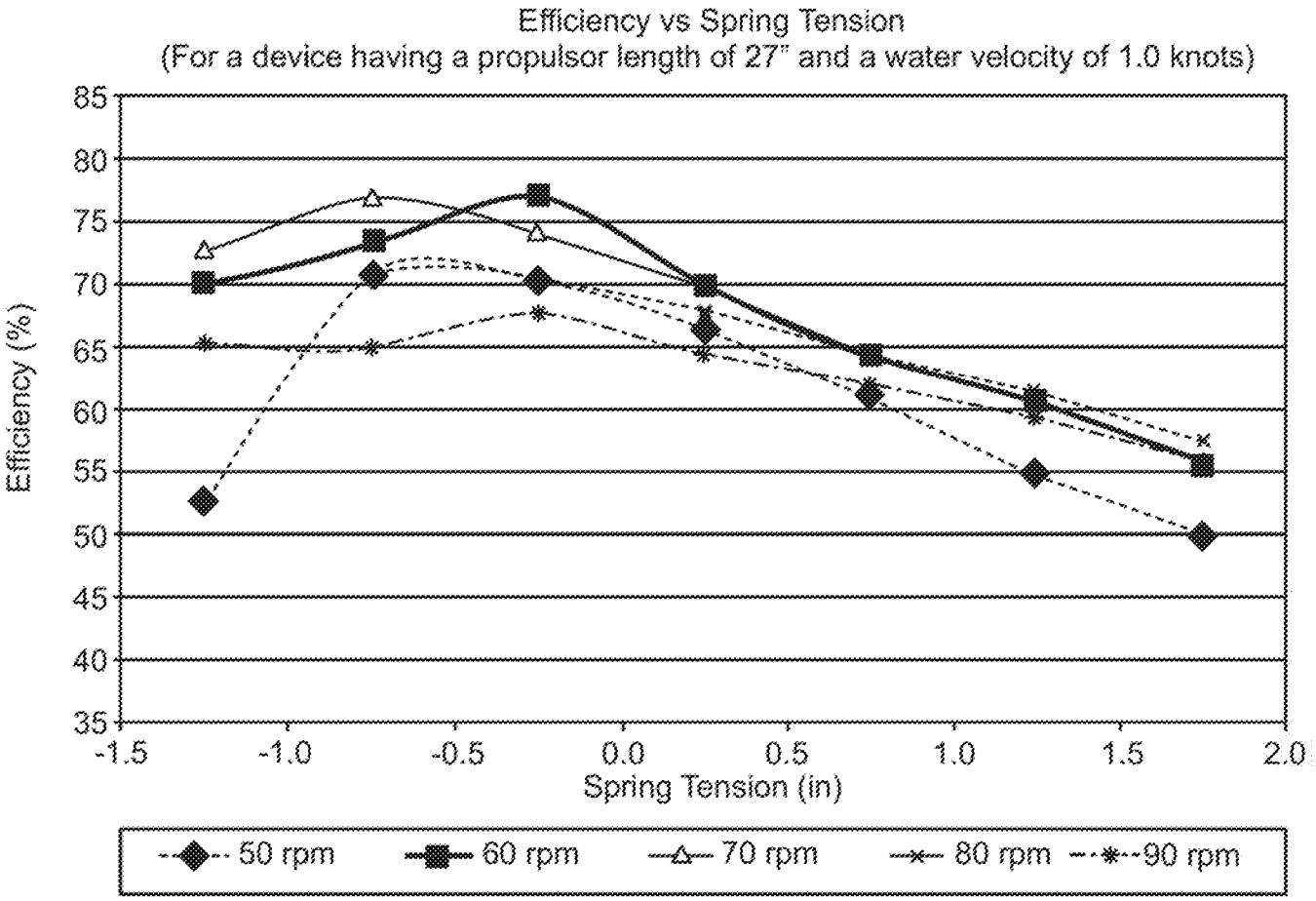
FIG. 18 is a chart illustrating the efficiency of the swimming propulsion device relating to the spring tension of the control mechanism at various cadence rates for a water velocity of 1.0 knots.
Figure 19:
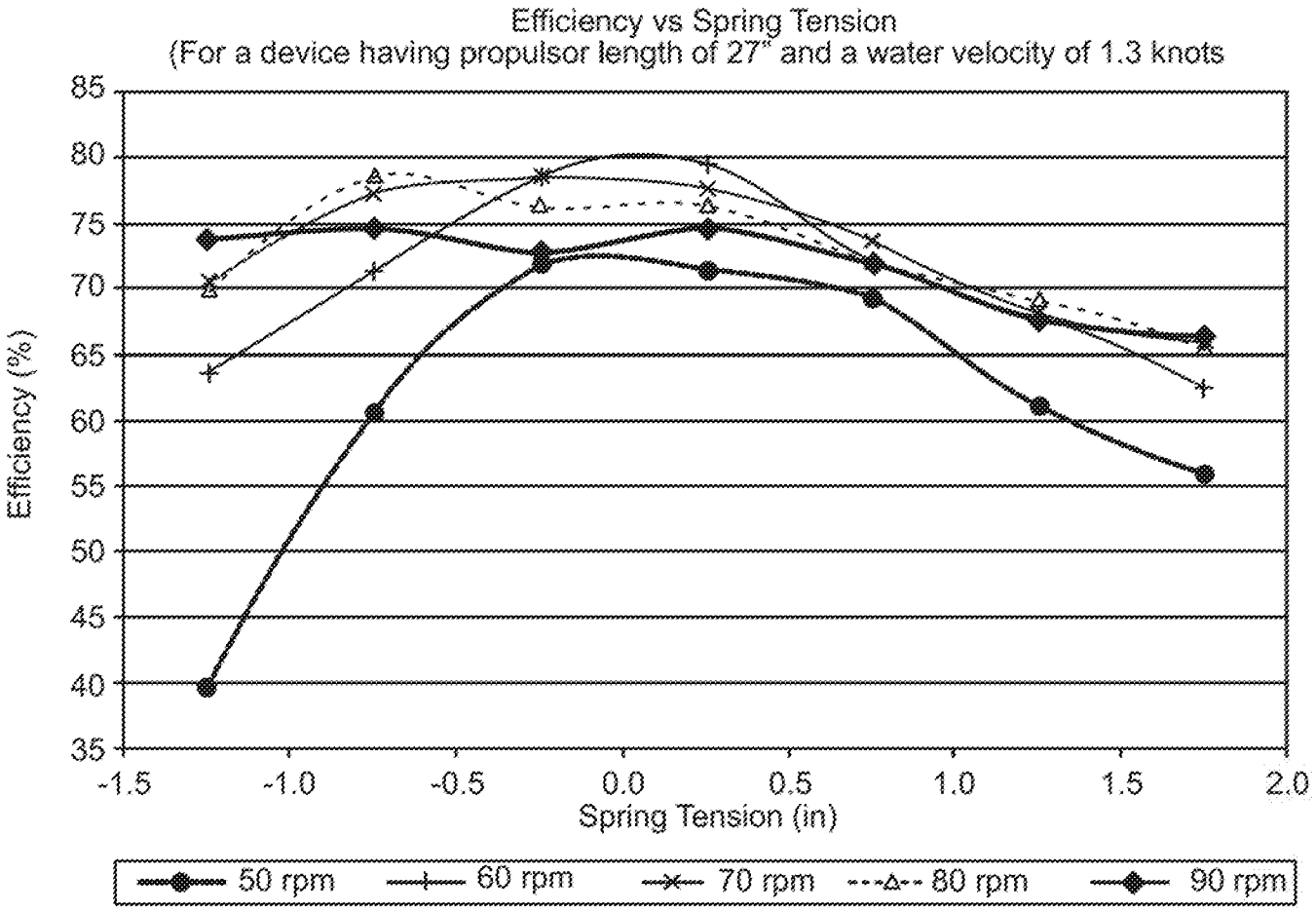
FIG. 19 is a chart illustrating the efficiency of the swimming propulsion device relating to the spring tension of the control mechanism at various cadence rates for a water velocity of 1.3 knots.

Referring now to FIGS. 18-19, these figures depict the efficiency of the exemplary embodiment of the swimming propulsion device versus the amount of spring tension applied to the propulsors for various cadence rates at a water velocity of 1.0 and 1.3 knots. The negative spring tension numbers indicate that the spring has no pre-load on the spring to produce any displacement. Conversely, the positive numbers identify a spring displacement indicating an initial pre-load on the spring. Referring specifically to FIG. 18, the greatest efficiency occurred with a spring displacement of approximately zero to −0.5 inches for a water velocity of 1.0 knots. This spring displacement indicates that the device operates efficiently when the spring is at its natural length. Referring now to FIG. 19, this figure depicts the efficiency of the exemplary embodiment of the swimming propulsion device versus the amount of spring tension applied to the propulsors for various cadence rates at a water velocity of 1.3 knots. Similar to the previous figure, the greatest efficiency occurs with a spring displacement of approximately zero to −0.5 inches.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention.

What is claimed is:

1. A swimming propulsion device comprising:

a fuselage; and at least one propulsor connected to the fuselage, wherein the at least one propulsor comprising at least two portions connected one to another at a propulsor connection point adjacent to the fuselage and wherein the two portions of the at least one propulsor fold towards one another about the connection point.

2. The device of claim 1, further comprising:

at least one stabilizer connected to the fuselage; and a swimmer connection mechanism removably attached to the fuselage by a locking mechanism whereby the swimmer connection mechanism connects a swimmer to the device.

3. The device of claim 2, wherein the locking mechanism further comprising:

a first member; and a second member, wherein the first member and second member removably mate by a ball and pin mechanism.

4. The device of claim 2, wherein the swimmer connection mechanism further comprising:

a first member;

a second member; and a fastening mechanism comprising a buckle and strap, wherein the first member and second member are attached to one another by the fastening mechanism and wherein the first member and second member are ergonomic to a swimmer's bottom leg.

5. The device of claim 4, further comprising wherein the first member and the second member include a hard layer and a foam layer.

6. The device of claim 4, wherein the second member further comprising a cleat for attachment to a locking mechanism member.

7. The device of claim 1, wherein the fuselage further comprising:

a wedge shaped forward section; and a front edge, a top edge and bottom edge wherein the front edge, the top edge, and the bottom edge are tapered and wherein the forward section is positioned on a lower plane than the aft section.

8. The device of claim 1, wherein the fuselage further comprising:

a forward member; and an aft member, wherein the forward member and aft member are slidably connected whereby the fuselage is adjustable in length.

9. The device of claim 1, wherein each propulsor comprising:

a first propulsor member; and a second propulsor member, wherein the first propulsor wing member is releasably and foldably attached to the second propulsor member whereby the first propulsor wing member folds back when released from the second propulsor member.

10. The device of claim 9, wherein the second propulsor member is attached to the fuselage.

11. The device of claim 1, further comprising a fin attachment mechanism.

12. The device of claim 2, wherein the swimmer connection mechanism further comprising at least one housing for receiving a swimmer's feet.

13. The device of claim 2, further comprising wherein the at least one stabilizer comprising two portions connected one to another at a stabilizer connection point adjacent to the fuselage and wherein the two portions of the at least one stabilizer fold towards one another about the stabilizer connection point.

14. A swimming propulsion device comprising:

a swimmer connection mechanism removably attached to a fuselage by a locking mechanism, the swimmer connection mechanism further comprising:

a first member;

a second member; and a fastening mechanism comprising a buckle and strap.

15. The swimming device of claim 14, further comprising:

at least one propulsor connected to the fuselage, wherein the first member and second member are attached to one another by the fastening mechanism and wherein the first member and second member are ergonomic to a swimmer's bottom leg, and wherein the at least one propulsor comprising at least two portions connected one to another at a connection point adjacent to the fuselage and wherein the two portions of the at least one propulsor fold towards one another about the connection point.

16. The swimming propulsion device of claim 15, further comprising at least one stabilizer affixed to an aft section of the fuselage.

17. The swimming propulsion device of claim 16, further comprising a control mechanism attached to the fuselage and the propulsor.

18. The swimming propulsion device of claim 16, further comprising a fin attachment mechanism.

19. The swimming propulsion device of claim 16, wherein the second member further comprising a cleat for attachment to a locking mechanism member.

20. The swimming propulsion device of claim 17, wherein the at least one stabilizer comprising two portions connected one to another at a stabilizer connection point adjacent to the fuselage and wherein the two portions of the at least one stabilizer fold towards one another about the stabilizer connection point.

* * * * *